US008104188B1

(12) United States Patent
Aguilar

(10) Patent No.: US 8,104,188 B1
(45) Date of Patent: Jan. 31, 2012

(54) SUSPENDED-CEILING GRID CONTROL LINES AND GRID COMPONENTS HOLDERS

(76) Inventor: Jose G. Aguilar, Elgin, IL (US)

( * ) Notice: Subject to any disclaimer, the term of this patent is extended or adjusted under 35 U.S.C. 154(b) by 272 days.

(21) Appl. No.: 12/387,712

(22) Filed: May 6, 2009

Related U.S. Application Data

(60) Provisional application No. 61/192,058, filed on Sep. 13, 2008.

(51) Int. Cl.
*G01C 15/10* (2006.01)

(52) U.S. Cl. ..... 33/413; 33/407; 33/410; 33/1 LE; 52/127.1

(58) Field of Classification Search ..... 33/1 LE, 33/404, 407–411, 413, 414; 248/322, 328; 52/127.1, 127.2, 291
See application file for complete search history.

(56) References Cited

U.S. PATENT DOCUMENTS

| | | | | |
|---|---|---|---|---|
| 1,004,194 | A * | 9/1911 | Platt | 33/406 |
| 2,258,574 | A * | 10/1941 | Leary | 52/362 |
| 2,991,557 | A * | 7/1961 | Bongiovanni | 33/407 |
| 3,626,434 | A * | 12/1971 | Miller | 33/408 |
| 4,137,636 | A * | 2/1979 | Dietrich | 33/404 |
| 4,715,161 | A * | 12/1987 | Carraro et al. | 52/714 |
| 5,046,294 | A * | 9/1991 | Platt | 52/506.06 |
| 5,519,976 | A | 5/1996 | Gee | |
| 5,711,081 | A * | 1/1998 | Zaccaria | 33/409 |
| 7,207,144 | B2 | 4/2007 | Shepard | |
| 7,614,195 | B2 * | 11/2009 | Platt et al. | 52/506.06 |
| 7,624,580 | B2 * | 12/2009 | Fukutani | 60/785 |
| 7,673,393 | B1 * | 3/2010 | Hudson | 33/409 |

FOREIGN PATENT DOCUMENTS

| | | |
|---|---|---|
| CA | 2132759 | 3/1996 |

* cited by examiner

*Primary Examiner* — Amy Cohen Johnson

(57) ABSTRACT

Devices for aiding installation of control lines in suspended ceiling systems; each comprising a flat base portion, a squared side having a paralleled horizontal groove formed therein to receive a portion of wall angle molding used with grids at 90° angles in relation to walls, an angled side having a paralleled horizontal groove formed therein to receive a portion of wall angle molding used with grids at 45° angles in relation to walls, threaded holes formed through top portion, first and second means for temporarily attaching devices onto wall angle moldings, means for restricting movement of main tees and cross tees which together allow a control line be wrapped around horizontal grooves, pulled taut, and wrapped around first or second means for temporarily attaching said devices onto wall angle moldings to lock said control line taut.

24 Claims, 80 Drawing Sheets

SUSPENDED-CEILING GRID CONTROL LINES AND GRID COMPONENTS HOLDERS

This application claims the benefit of provisional patent application Ser. No. 61/192,058, filed on Sep. 13, 2008 by the present inventor.

FEDERALLY SPONSORED RESEARCH

Not Applicable

SEQUENCE LISTING OR PROGRAM

Not Applicable

BACKGROUND

1. Field

This application relates to hand tools, specifically to improved wall angle molding attachable-detachable devices, which are used to set or install control lines, reference strings or guide strings for suspended-ceiling grids, and to temporarily restrict the movement of grid components such as main tees and cross tees.

2. Prior Art

Acoustical ceiling, Suspended ceiling, or Dropped ceiling systems are well known and are the most common ceiling systems used in stores, hospitals, libraries, office complexes and residential basement improvements or renovations. A suspended ceiling grid system comprises wall angle moldings 23.81 mm. by 23.81 mm. and 14.29 mm. by 23.81 mm. which are fastened to walls at any prescribed height, main grid members bottom face 23.81 mm. or 14.29 mm. (main tees or main runners) running in one direction of the ceiling with cross members bottom face 23.81 mm. or 14.29 mm. (cross tees) connected to adjacent main grid members to form the grid pattern. The main-tees are suspended by hanger wires looped through factory provided holes together with the wall angle molding which is secured to the wall, which together support the cross-tees and all other finish components.

The most common grid patterns are ninety degree angle in relation to the walls or forty-five degree angle in relation to the walls.

It is not common for a room to be perfectly square. So from any corner of the room, two control lines, guide lines or reference strings, are pulled taut along both walls at the distance calculated for the border panels. Originally, the strings are being positioned to the bottom of the wall angle molding by using leveling clips such those in U.S. Pat. No. 5,519,976 to Gee, 1996 May 28, and by also using grid squaring devices such those in U.S. Pat. No. 7,207,144 to Shepard, 2007 Apr. 24, grid leveling clamps, pop-rivet pins, nails, or a small perforated piece of wall angle molding, and aligned so they intersect at a ninety degree angle. This insures that the grid pattern is square. One control line is the guide for the first row of main tees and the other control line for the first row of cross tees. But these tools or methods to set or install control lines have had and still have significant problems.

Leveling Clips from U.S. Pat. No. 5,519,976 FIGS. 1-3:

Although these leveling clips 1 are made from a thin material it is still hard to insert them between the wall (not shown) and wall angle molding 11, because the space between the wall and wall angle molding is usually too tight, also these leveling clips can damage the finished painted walls as well as the bottom of the wall angle molding when they have to be slid to a different place, furthermore, the leveling lines 15 have to be tied and untied and then tied again through aperture 9 when the grid framer he or she encounters a longer or shorter span between the walls, these leveling clips are also not design to hold guide lines and control the straightness of the main tees and cross tees on grids framed at forty-five degree angles in relation to the walls, they have to also be pried down and out from between the wall and the wall angle molding, the grid framer, she or he also needs two different sizes of these leveling clips for the two sizes of wall angle molding which are 23.81 mm. by 23.81 mm. and 14.29 mm. by 23.81 mm.

Devices from U.S. Pat. No. 7,207,144 FIG. 4:

In order for a grid framer to frictionally attach these devices 10 onto the main tees and control the straightness of the main tees and cross tees with guide lines He or She has to frame most of the grid, guide lines must be tied and untied and then tied again into eyelet 30 of these devices every time grid framers reposition these devices to a different place; Grid framers need to have different sizes of these devices in order to be able to work with the two width sizes of the bottom face of main tees and cross tees which are 23.81 mm. and 14.29 mm.

Grid Leveling Clamps FIG. 5:

These leveling clamps 1A, when in use, do not provide enough anchoring force onto the wall angle molding (not shown) by the clamping actuator 3 and the rubber pads 2, they come off the wall angle molding when a leveling line 15 must be pulled taut, also their structure provides no accuracy reference when setting guide lines to control the straightness of the main tees and cross tees and they are also not design to control the straightness of main tees and cross tees on grids framed at forty-five degree angles in relation to the walls.

Pop-Rivet Pins or Nails FIG. 6 and FIG. 7:

By using pop-rivets 4 or nails 5 the grid framer has to first tie the control line 15 to the pop-rivet or nail, then insert the pop-rivet or nail between the wall (not shown) and the wall angle molding (not shown) underneath the mark where the main runner or cross tee is laid out to go, next, the framer, He or She has to go to the opposite mark, calculate how much line will be needed, cut the line, tie the line to the pop-rivet or nail and then pull and insert the pop-rivet or nail between the wall and the wall angle molding underneath the mark where the main runner or cross tee is laid out to go. This method is both time consuming and impractical for the wall could be damaged by the pop rivet or nail and it is not easy adjusting the control lines.

Small Pieces of Wall Angle Molding with a Punched Out Hole in the Middle and the Folded Extremities Cut. FIGS. 8 and 9:

This other method or tool consists of cutting small pieces of wall angle molding 1, about one inch long, punching out a hole 9 in the middle of each piece, then cutting the extremities that are folded 1A and 1B; Next, the grid framer has to tie the control line 15 to the piece of wall angle molding in the previously punched out hole, then position the small piece of wall angle molding between the wall (not shown) and the wall angle molding (not shown) underneath the mark where the main runner or cross tee is to go. The grid framer, once He or She has accomplished this step, has to go to the opposite mark, calculate how much line She or He will need, cut the line, tie the line to the small piece of wall angle molding, and then pull on the line and insert the piece of wall angle molding between the wall and wall angle molding underneath the mark where the main runner or the cross tee is laid out to go. This other method or tool also lacks a practical system for installing and adjusting the control lines because it takes time to make all the small pieces, and it is also not an easy task adjusting the control lines and the walls can be easily damaged.

There thus remains a need to improve the method and device for installing control lines, guide lines or reference strings for controlling the straightness and squareness of main tees and cross tees in suspended ceiling systems and for temporarily holding main tees and cross tees onto wall angle moldings.

SUMMARY

I have conceived of and designed certain new and useful control line holders which are geometrically designed to work with and use the physical structure of wall angle moldings, main tees and cross tees, that also can temporarily restrict the movement of main tees and cross tees onto wall angle moldings, they facilitate and expedite the setting and the adjustment if it is needed of the control lines to control the straightness and squareness of the main tees and cross tees in suspended-ceiling grids. These control line holders can easily, speedily and accurately be attached to, and detached from a wall angle molding without damaging the wall or the wall angle molding. They enable the grid framer to work with the two different sizes of wall angle moldings which are 23.81 mm. by 23.81 mm. and 14.29 mm. by 23.81 mm. and I have also designed these tools so that they can be used with grids at forty-five degree angles as well as grids framed at ninety degree angles in relation to the walls.

Another feature of my tools is that they allow the grid framer to pull the control lines as taut as needed. My tools also comprise such other advantages and capabilities as will later more fully appear, and which are inherently possessed by my tools.

DETAILED DESCRIPTION

FIGS. 10 Through 36—First Embodiment

Figure 1:
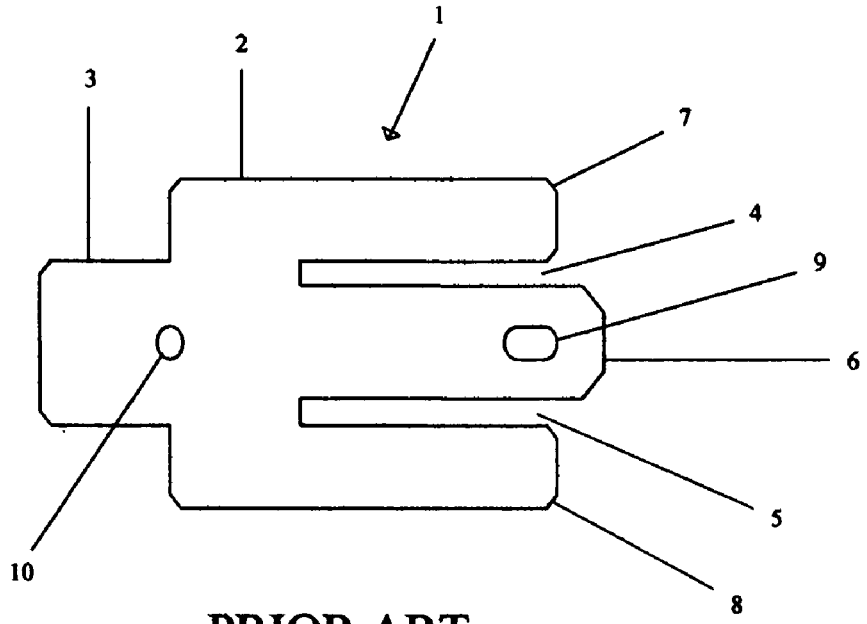
PRIOR ART FIG. 1
FIG. 1 Prior Art
Figure 2:
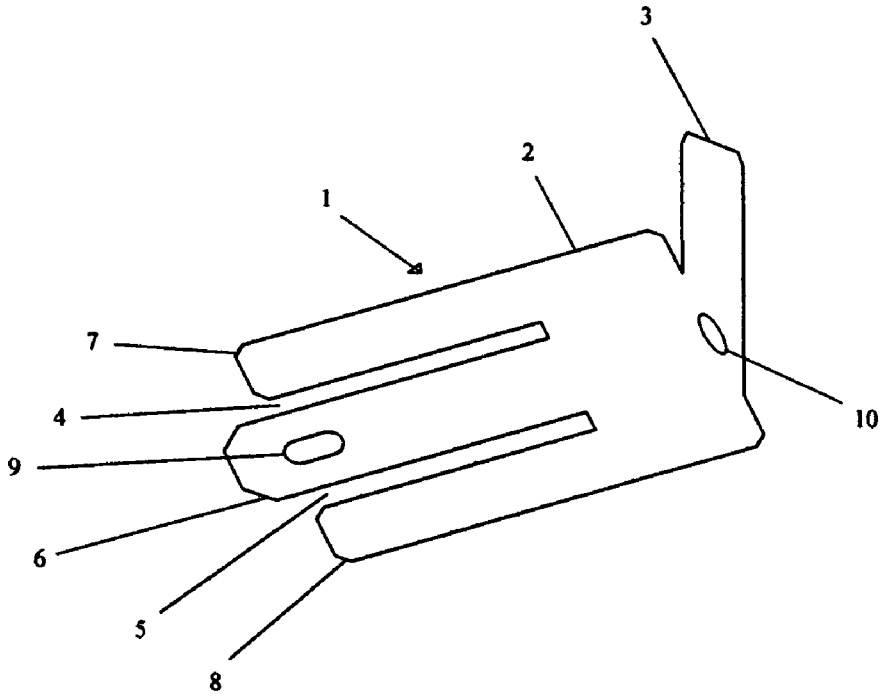
PRIOR ART FIG. 2
FIG. 2 Prior Art
Figure 3:
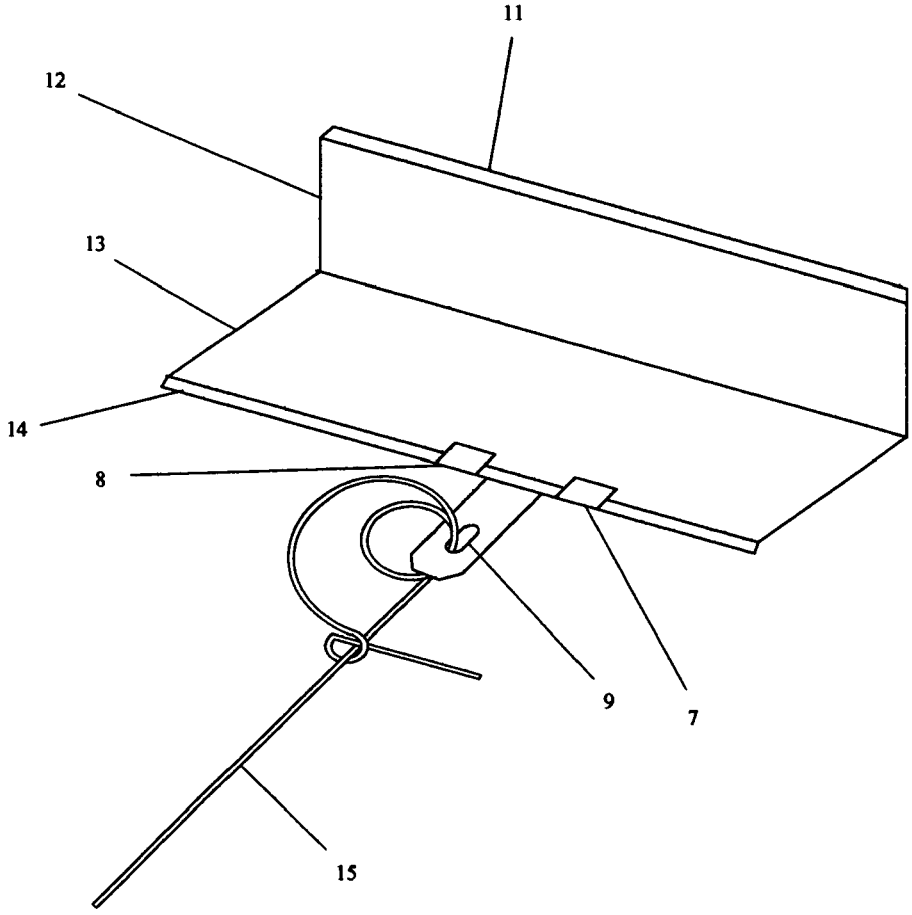
PRIOR ART FIG. 3
FIG. 3 Prior Art
Figure 4:
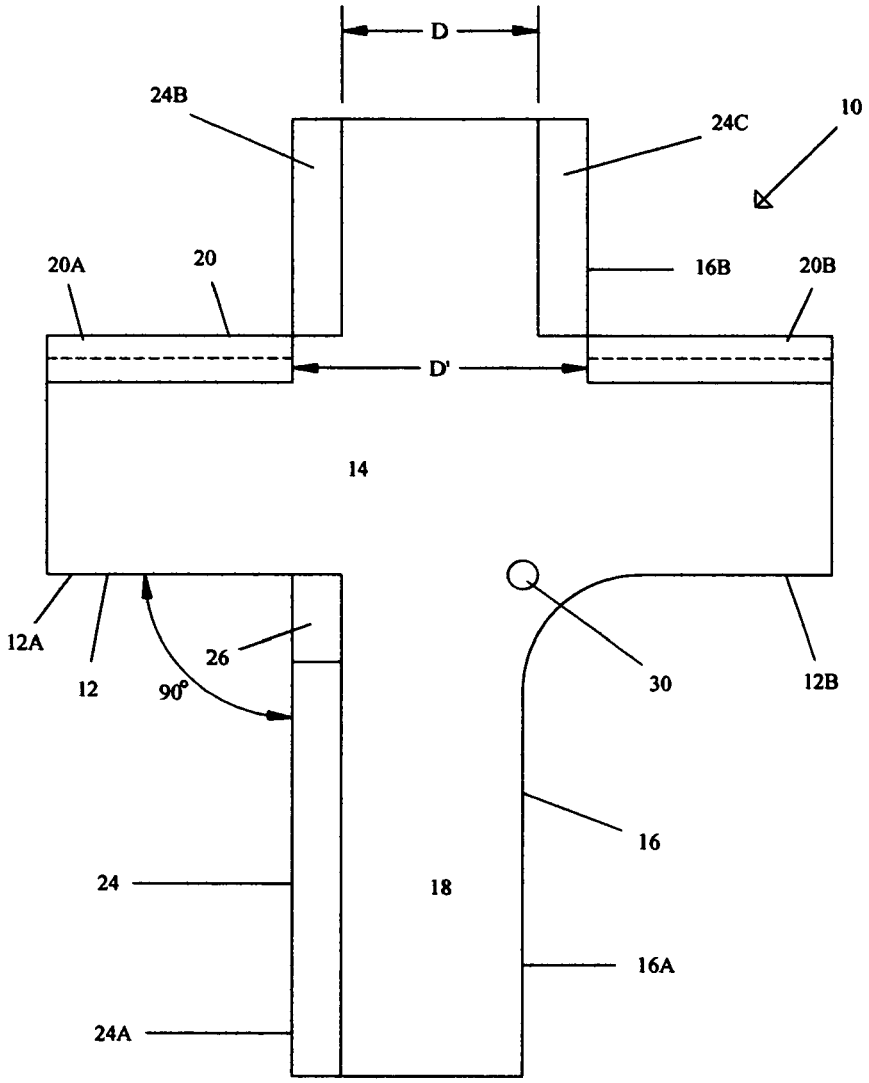
PRIOR ART FIG. 4
FIG. 4 Prior Art
Figure 5:
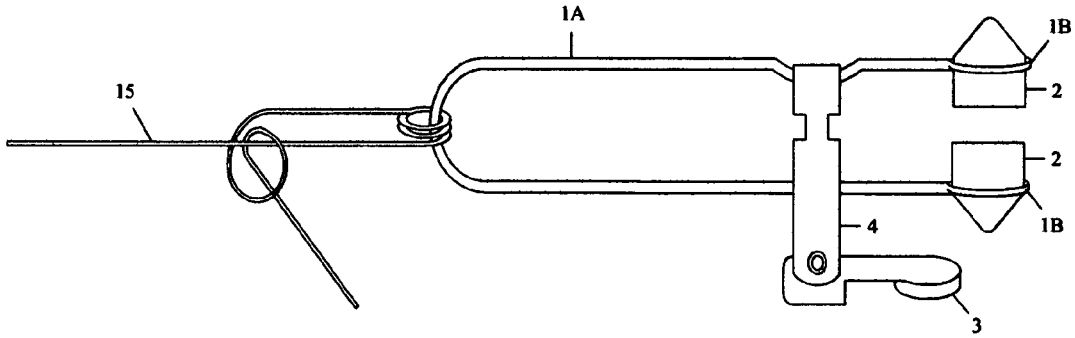
PRIOR ART FIG. 5
FIG. 5 Prior Art
Figure 6:
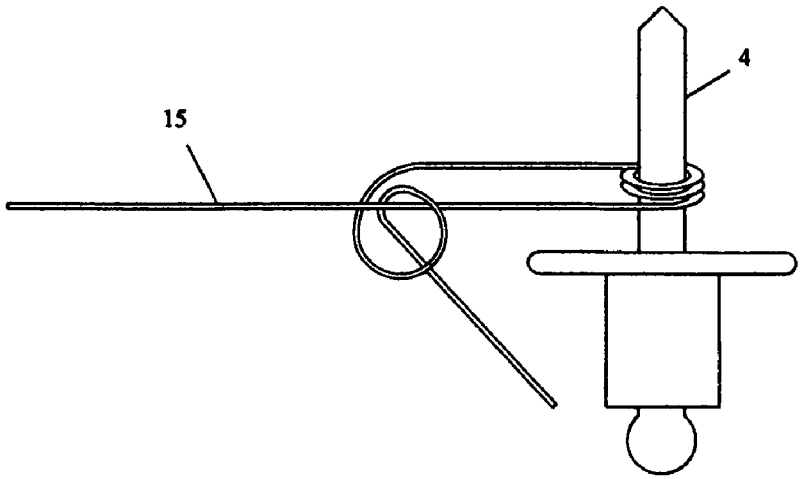
PRIOR ART FIG. 6
FIG. 6 Prior Art
Figure 7:
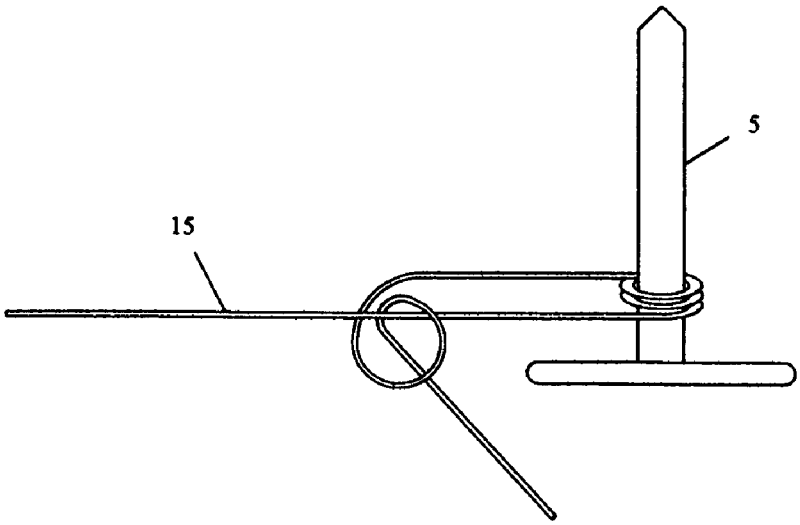
PRIOR ART FIG. 7
FIG. 7 Prior Art
Figure 8:
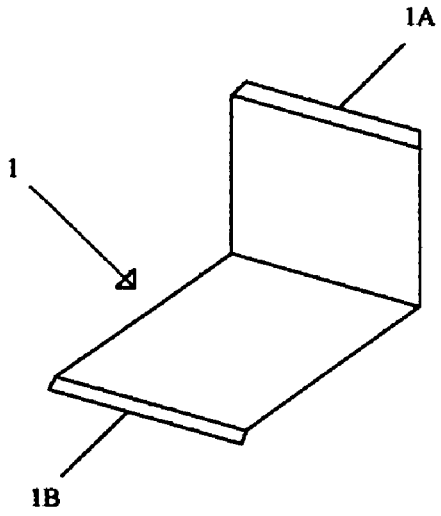
PRIOR ART FIG. 8
FIG. 8 Prior Art
Figure 9:
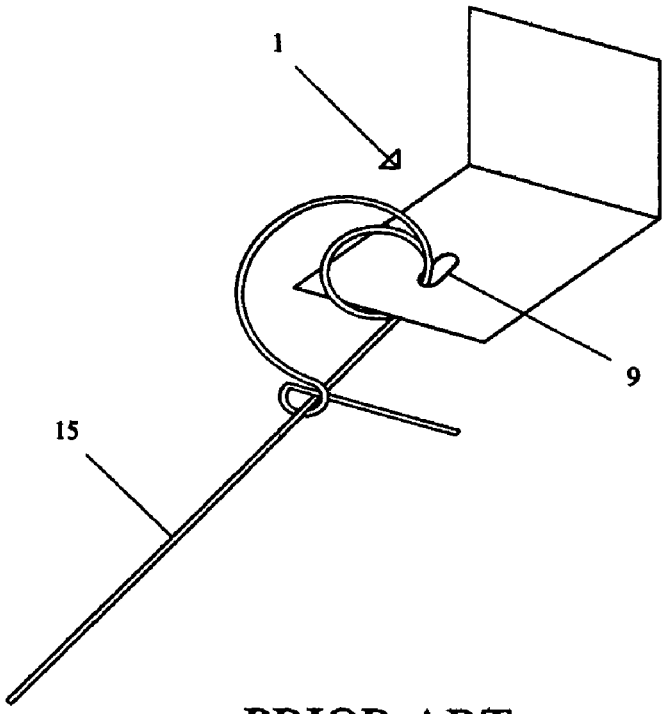
PRIOR ART FIG. 9
FIG. 9 Prior Art
Figure 10:
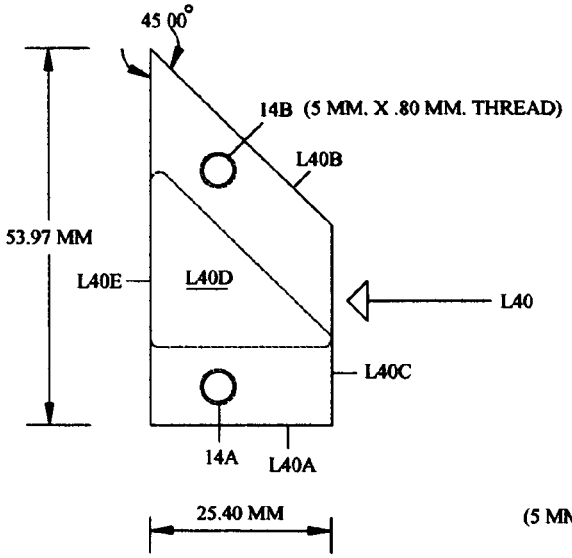
FIG. 10 is a top orthogonal view of a first embodiment L40 of my tools.
Figure 11:
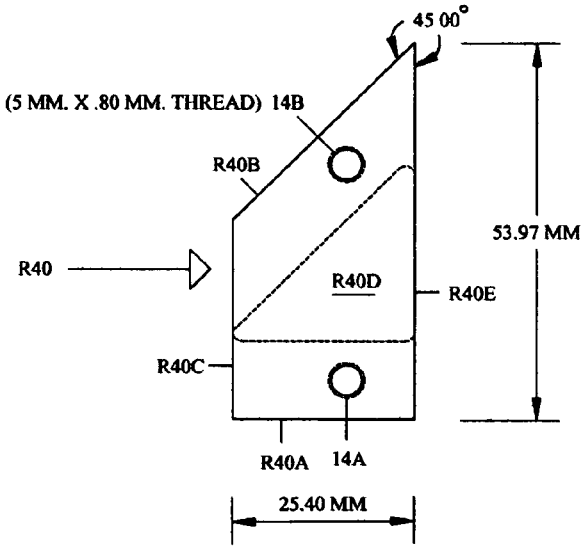
FIG. 11 is a top mirrored orthogonal view of FIG. 10 that complements the first embodiment of my tools designated as R40.

One embodiment of the control line holders is illustrated in FIG. 10 (top orthogonal view) designated as L40 and FIG. 11 (mirrored top orthogonal view of FIG. 10) designated as R40 that complements this first embodiment.

FIG. 10 control line holder L40 comprises a squared side L40A, a groove 16 formed within the squared side L40A (reference number and dimension not shown in this view), an angled side L40B, an angled groove 17 formed within angled side L40B (reference number and dimension not shown in this view), a group of three rounded inside corners 15A, 15B, and 15C formed by grooves 16 and 17 (reference numbers and dimensions not shown in this view), a right side L40C, a top L40D, an aligning side L40E, a bottom side L40F (not seen in this view), and two threaded holes 14A and 14B formed through top L40D to grooves 16 and 17, the squared side L40A can have a width dimension of 25.40 mm. and the aligning side L40E can have a longitudinal dimension of 53.97 mm., the aligning side L40E and the angled side L40B can form a forty-five degree angle and the threaded holes 14A and 14B can be threaded to receive a 5 mm. by 0.80 mm. pitch threaded thumb screw 11A.

FIG. 11 control line holder R40 comprises a squared side R40A, a groove 16 formed within the squared side R40A (reference number and dimension not shown in this view), an angled side R40B, an angled groove 17 formed within angled side R40B (reference number and dimension not shown in this view), a group of three rounded inside corners 15A, 15B, and 15C formed by grooves 16 and 17 (reference numbers and dimensions not shown in this view), a left side R40C, a top R40D, an aligning side R40E, a bottom side R40F (not seen in this view), and two threaded holes 14A and 14B formed through top R40D to grooves 16 and 17, the squared side R40A can have a width dimension of 25.40 mm., the aligning side R40E can have a longitudinal dimension of 53.97 mm., the aligning side R40E and the angled side R40B can form a forty-five degree angle and the threaded holes 14A and 14B can be threaded to receive the 5 mm. by 0.80 mm. pitch threaded thumb screw 11A.

Figure 12:
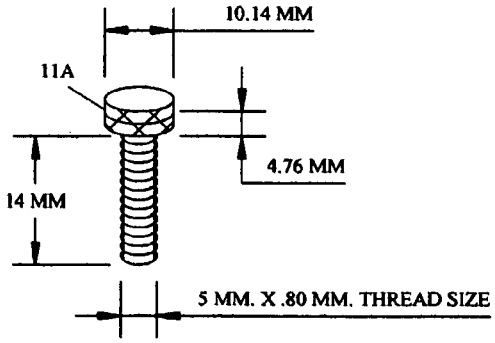
FIG. 12 is a perspective view of a thumb screw 11A seen slightly from the top.

FIG. 12 shows a perspective view of the thumb screw 11A seen slightly from the top which can be manufactured with the following dimensions: shank length at 14 mm., head diameter at 10.14 mm., head width at 4.76 mm., and the shank threaded at 5 mm. by 0.80 mm. pitch tread size.

Figure 13:
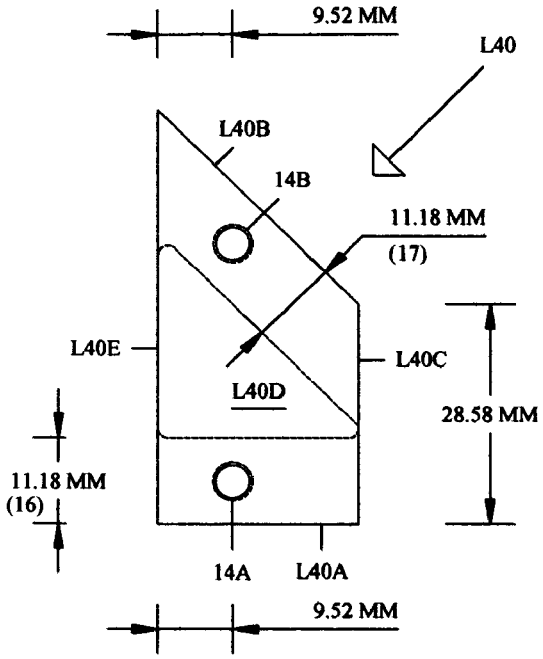
FIG. 13 is a top orthogonal view of embodiment L40 of my tools.

FIG. 13 shows another top orthogonal view of the first embodiment L40 with more dimensions assigned to the parts, the groove 16 formed within the squared side L40A can have a depth of 11.18 mm., the groove 17 formed within the angled side L40B can have a depth of 11.18 mm. the right side L40C can have a longitudinal dimension of 28.58 mm., and the center for the threaded holes is taken from the aligning side L40E and can be 9.52 mm.

Figure 14:
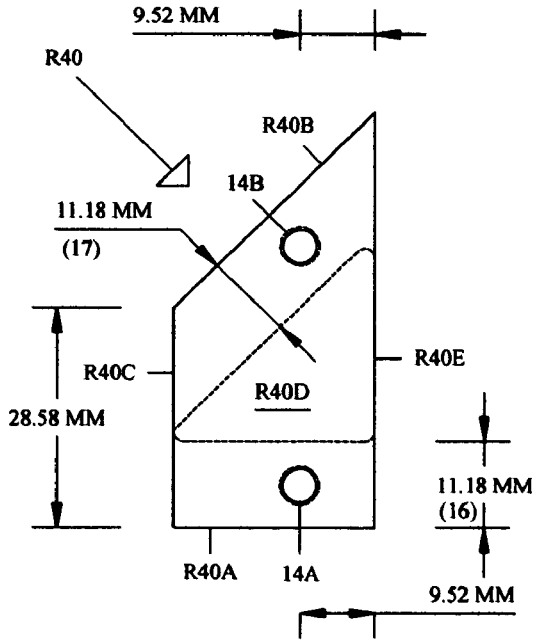
FIG. 14 is a top mirrored orthogonal view of FIG. 13 that complements the first embodiment of my tools designated as R40.

FIG. 14 shows another mirrored top orthogonal view of FIG. 13 designated as R40 that complements this first embodiment with more dimensions assigned to the parts, the groove 16 formed within the squared side R40A can have a depth of 11.18 mm., the groove 17 formed within the angled side R40B can have a depth of 11.18 mm., the left side R40C can have a longitudinal dimension of 28.58 mm., and the center for the threaded holes is taken from the aligning side R40E and can be 9.52 mm.

Figure 15:
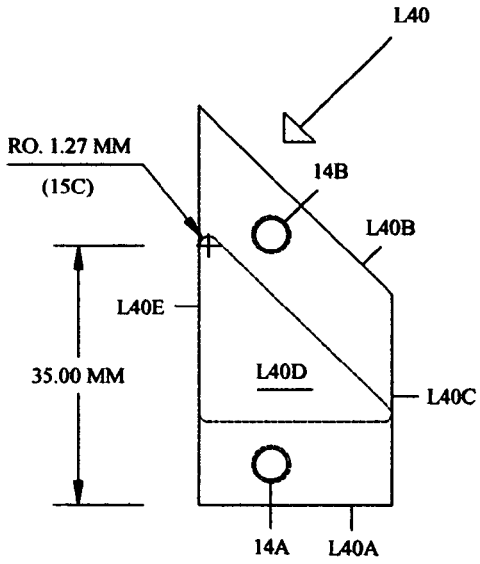
FIG. 15 is a top orthogonal view of embodiment L40 of my tools.

FIG. 15 shows another top orthogonal view of the first embodiment L40 with more dimensions assigned to the parts, the rounded corner 15C formed by groove 17 can have a radius of 1.27 mm., and the longitudinal dimension center for the rounded corner 15C can be 35.00 mm., and it is taken from the squared side L40A.

Figure 16:
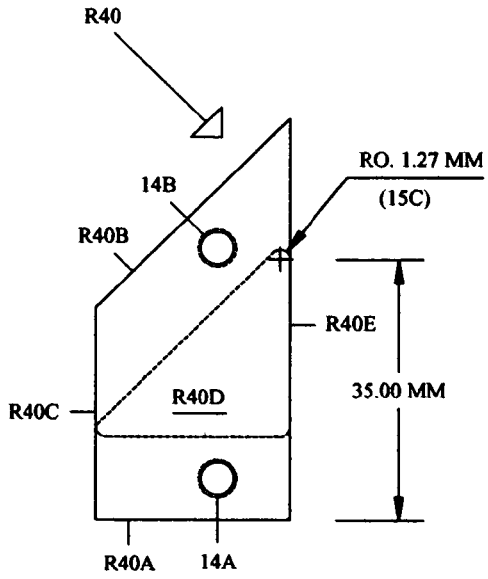
FIG. 16 is a top mirrored orthogonal view of FIG. 15 that complements the first embodiment of my tools designated as R40.

FIG. 16 shows another mirrored top orthogonal view of FIG. 15 designated as R40 that complements this first embodiment with more dimensions assigned to the parts, the rounded corner 15C formed by groove 17 can have a radius of 1.27 mm., and the longitudinal dimension center for the rounded corner 15C can be 35.00 mm., and it is taken from the squared side R40A.

Figure 17:
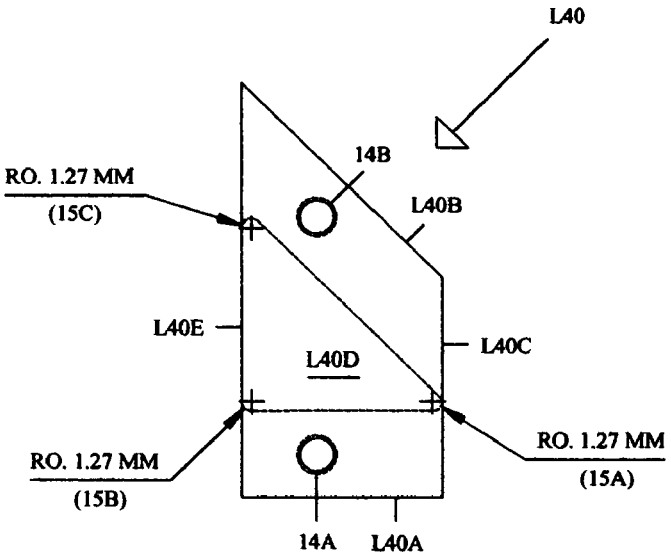
FIG. 17 is a top orthogonal view of embodiment L40 of my tools.

FIG. 17 shows another top orthogonal view of the first embodiment L40 with more dimensions assigned to the parts, the rounded corners 15A, 15B, and 15C formed by grooves 16 and 17 can all have a radius of 1.27 mm.

Figure 18:
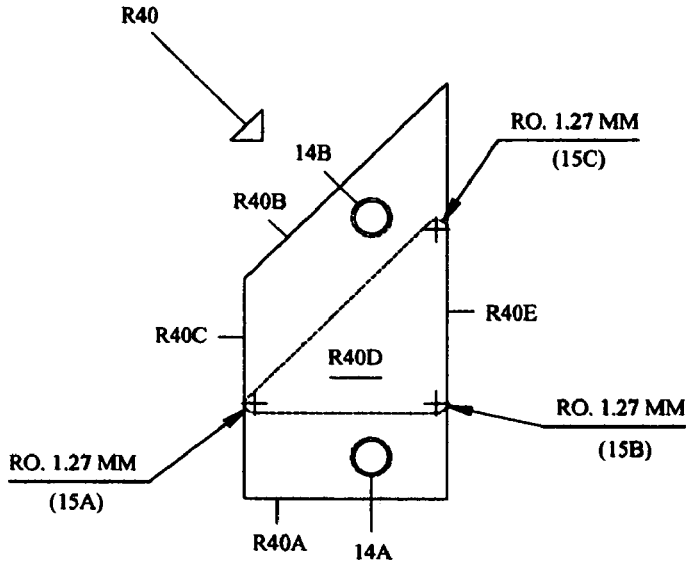
FIG. 18 is a top mirrored orthogonal view of FIG. 17 that complements the first embodiment of my tools designated as R40.

FIG. 18 shows another mirrored top orthogonal view of FIG. 17 designated as R40 that complements this first embodiment with more dimensions assigned to the parts, the rounded corners 15A, 15B, and 15C formed by grooves 16 and 17 can all have a radius of 1.27 mm.

Figure 19:
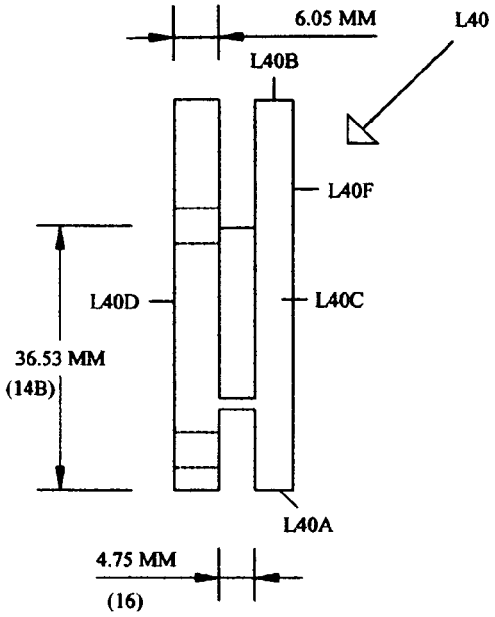
FIG. 19 is an orthogonal side view of embodiment L40 seen from the right.

FIG. 19 shows a side orthogonal view of the first embodiment L40 seen from the right with more dimensions assigned to the parts, the groove 16 formed within the squared side L40A can have a height of 4.75 mm., the groove 17 formed within the angled side L40B can have a height of 4.75 mm. (reference number not shown in this view), the height of the top L40D can be 6.05 mm., and the longitudinal dimension center for the threaded hole 14B can be 36.53 mm., and it is taken from the squared side L40A.

Figure 20:
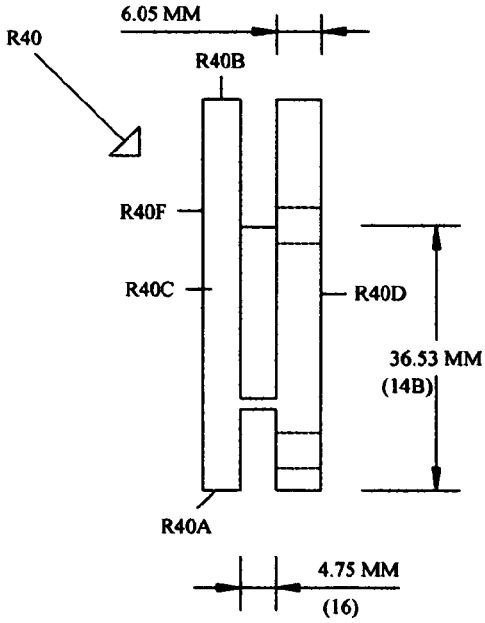
FIG. 20 is an orthogonal side view of embodiment R40 seen from the left.

FIG. 20 shows a mirrored side orthogonal view of FIG. 19 designated as R40 seen from the left that complements this first embodiment with more dimensions assigned to the parts, the groove 16 formed within the squared side R40A can have a height of 4.75 mm., the groove 17 formed within the angled side R40B can have a height of 4.75 mm. (reference number not shown in this view), the height of the top R40D can be 6.05 mm., and the longitudinal dimension center for the threaded hole 14B can be 36.53 mm., and it is taken from the squared side R40A.

Figure 21:
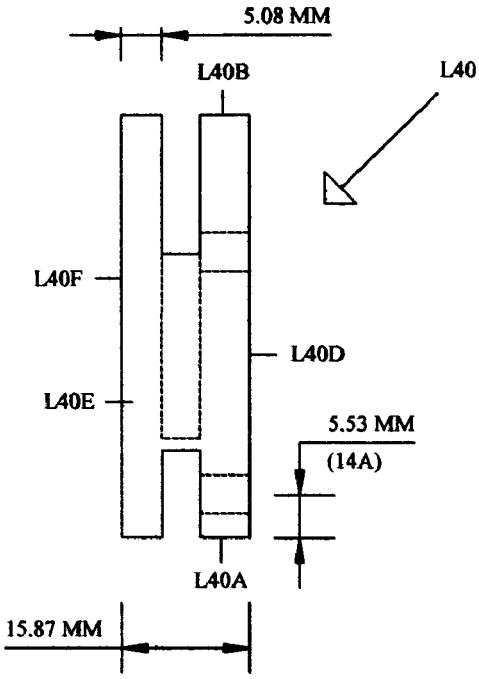
FIG. 21 is an orthogonal side view of embodiment L40 seen from the left.

FIG. 21 shows a side orthogonal view of the first embodiment L40 seen from the left with more dimensions assigned to the parts, the height of embodiment L40 can be 15.87 mm., the height of the bottom L40F can be 5.08 mm., and the longitudinal dimension center for the threaded hole 14A can be 5.53 mm., and it is taken from the squared side L40A.

Figure 22:
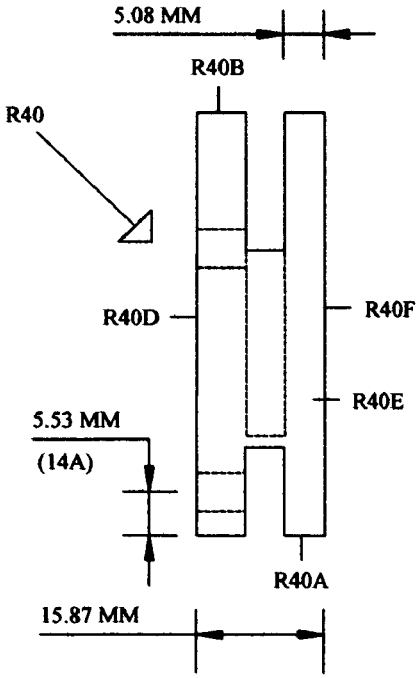
FIG. 22 is an orthogonal side view of embodiment R40 seen from the right.

FIG. 22 shows a mirrored side orthogonal view of FIG. 21 designated as R40 seen from the right that complements this first embodiment with more dimensions assigned to the parts, the height of embodiment R40 can be 15.87 mm., the height of the bottom R40F can be 5.08 mm., and the longitudinal dimension center for the threaded hole 14A can be 5.53 mm. and it is taken from the squared side R40A.

Figure 23:
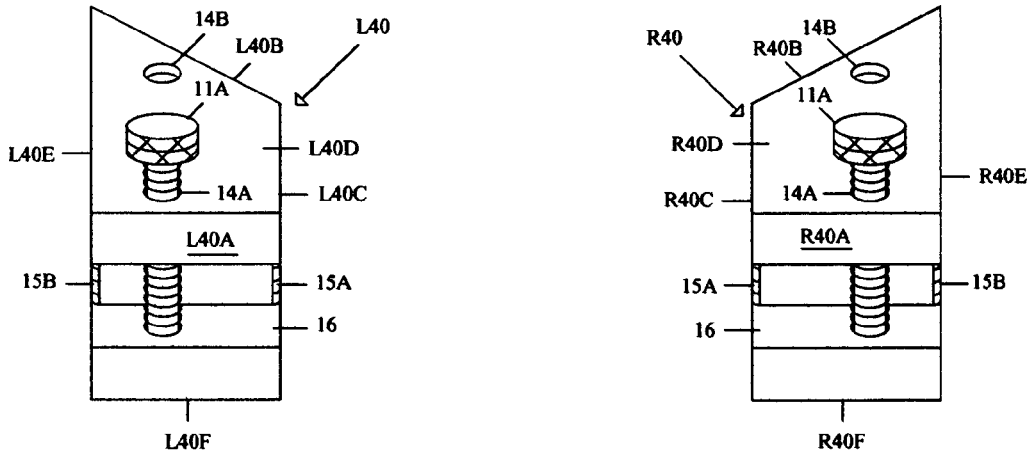
FIG. 23 is a perspective view of embodiment L40 and R40 with one screw each seen slightly from the top for use with grids at ninety degree angles in relation to the walls.

FIG. 23 is a perspective view of embodiment L40 and R40 with one thumb screw 11A each seen slightly from the top for use with grids at ninety degree angles in relation to the walls, control line holder L40 comprises a squared side L40A, a groove 16 formed within the squared side L40A, an angled side L40B, an angled groove 17 (not seen) formed within angled side L40B, a group of three rounded inside corners 15A, 15B, and 15C formed by grooves 16 and 17 (rounded corner 15C not seen), a right side L40C, a top L40D, an aligning side L40E, a bottom side L40F (not seen), and two threaded holes 14A and 14B formed through top L40D to grooves 16 and 17, and the thumb screw 11A screwed into threaded hole 14A, control line holder R40 comprises a squared side R40A, a groove 16 formed within the squared side R40A, an angled side R40B, an angled groove 17 formed within angled side R40B (not seen), a group of three rounded inside corners 15A, 15B, and 15C formed by grooves 16 and 17 (rounded corner 15C not seen), a left side R40C, a top R40D, an aligning side R40E, a bottom side R40F (not seen), two threaded holes 14A and 14B formed through top R40D to grooves 16 and 17, and the thumb screw 11A screwed into threaded hole 14A.

Figure 24:
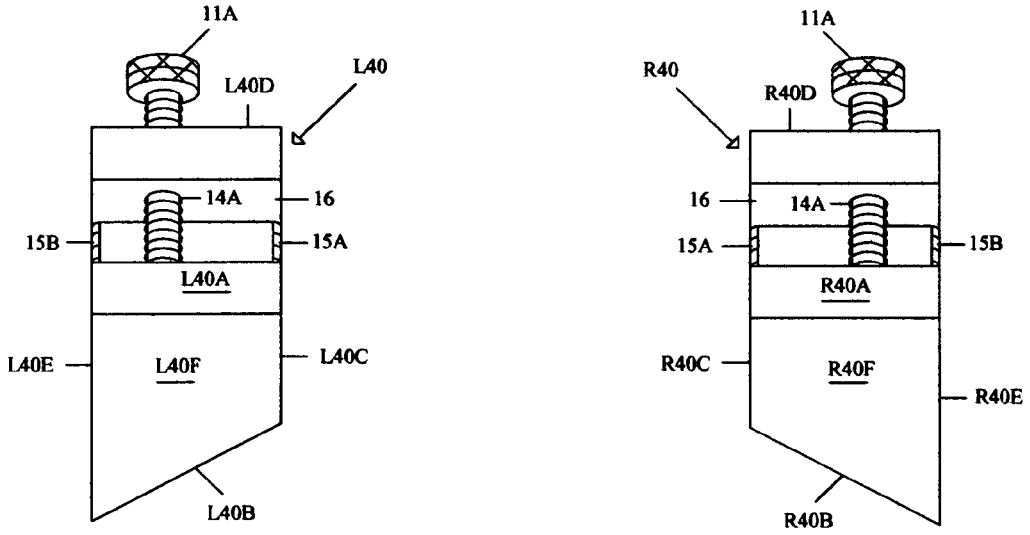
FIG. 24 is a perspective view of embodiment L40 and R40 with one screw each seen slightly from the bottom for use with grids at ninety degree angles in relation to the walls.

FIG. 24 is a perspective view of control line holders embodiment L40 and R40 with one thumb screw 11A each seen slightly from the bottom for use with grids at ninety degree angles in relation to the walls, control line holder L40 comprises a squared side L40A, a groove 16 formed within the squared side L40A, an angled side L40B, an angled groove 17 (not seen) formed within angled side L40B, a group of three rounded inside corners 15A, 15B and 15C formed by grooves 16 and 17 (rounded corner 15C not seen), a right side L40C, a top L40D, an aligning side L40E, a bottom side L40F, and two threaded holes 14A and 14B formed through top L40D to grooves 16 and 17, and the thumb screw 11A screwed into threaded hole 14A, control line holder R40 comprises a squared side R40A, a groove 16 formed within the squared side R40A, an angled side R40B, an angled groove 17 formed within angled side R40B (not seen), a group of three rounded inside corners 15A, 15B and 15C formed by grooves 16 and 17 (rounded corner 15C not seen), a left side R40C, a top R40D, an aligning side R40E, a bottom side R40F, two threaded holes 14A and 14B formed through top R40D to grooves 16 and 17, and the thumb screw 11A screwed into threaded hole 14A.

Figure 25:
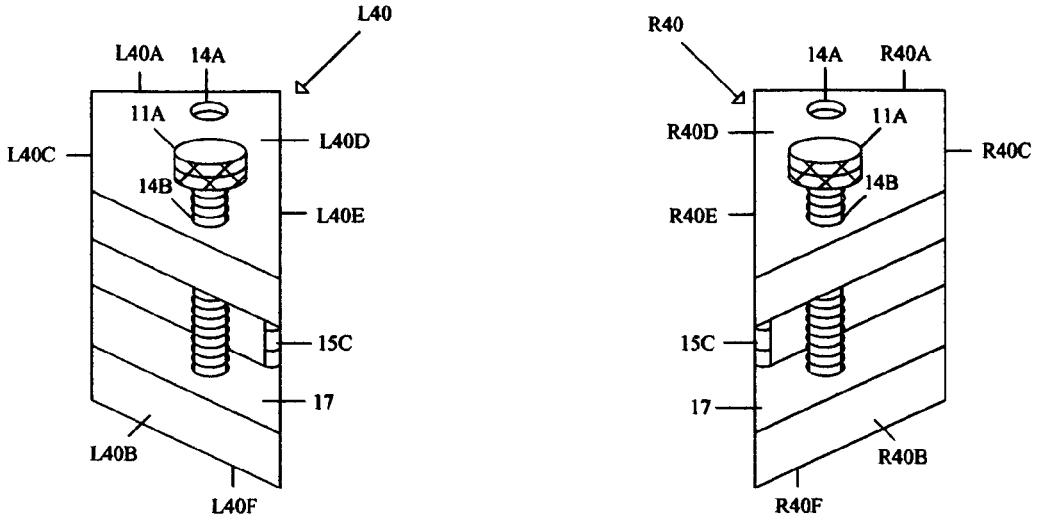
FIG. 25 is a perspective view of embodiment L40 and R40 with one screw each seen slightly from the top for use with grids at forty-five degree angles in relation to the walls.

FIG. 25 is a perspective view of control line holders embodiment L40 and R40 with one thumb screw 11A each seen slightly from the top for use with grids at forty-five degree angles in relation to the walls, control line holder L40 comprises a squared side L40A (not fully seen), a groove 16 formed within the squared side L40A (not seen), an angled side L40B, an angled groove 17 formed within angled side L40B, a group of three rounded inside corners 15A (not seen), 15B (not seen) and 15C formed by grooves 16 and 17, a right side L40C, a top L40D, an aligning side L40E, a bottom side L40F (not seen), and two threaded holes 14A and 14B formed through top L40D to grooves 16 and 17, and the thumb screw 11A screwed into threaded hole 14B, control line holder R40 comprises a squared side R40A (not fully seen), a groove 16 formed within the squared side R40A (not seen), an angled side R40B, an angled groove 17 formed within angled side R40B, a group of three rounded inside corners 15A (not seen), 15B (not seen) and 15C formed by grooves 16 and 17, a left side R40C, a top R40D, an aligning side R40E, a bottom side R40F (not seen), two threaded holes 14A and 14B formed through top R40D to grooves 16 and 17, and the thumb screw 11A screwed into threaded hole 14B.

Figure 26:
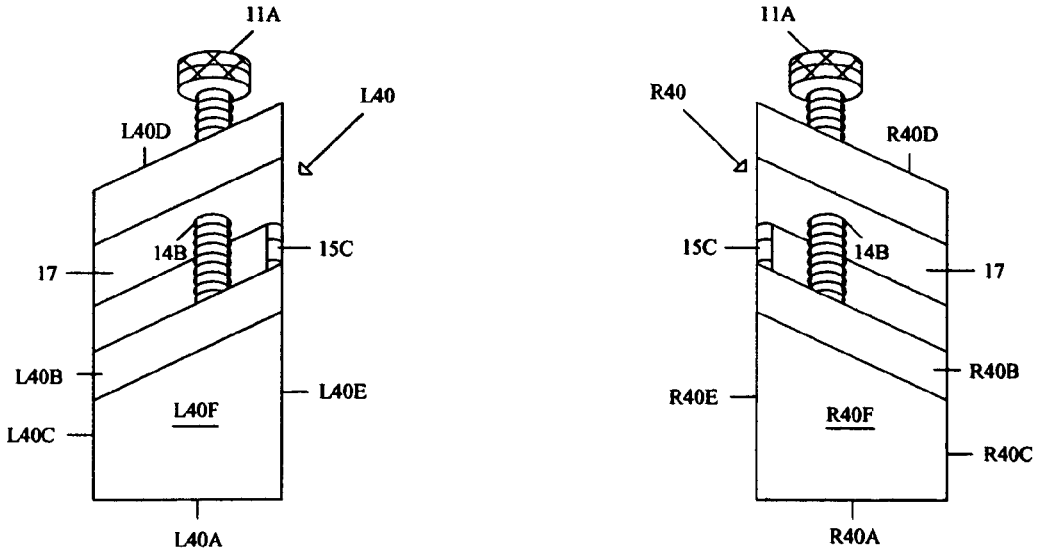
FIG. 26 is a perspective view of embodiment L40 and R40 with one screw each seen slightly from the bottom for use with grids at forty-five degree angles in relation to the walls.

FIG. 26 is a perspective view of control line holders embodiment L40 and R40 with one thumb screw 11A each seen slightly from the bottom for use with grids at forty-five degree angles in relation to the walls, control line holder L40 comprises a squared side L40A (not fully seen), a groove 16 formed within the squared side L40A (not seen), an angled side L40B, an angled groove 17 formed within angled side L40B, a group of three rounded inside corners 15A (not seen), 15B (not seen) and 15C formed by grooves 16 and 17, a right side L40C, a top L40D, an aligning side L40E, a bottom side L40F, and two threaded holes 14A (not seen) and 14B formed through top L40D to grooves 16 and 17, and the thumb screw 11A screwed into threaded hole 14B, control line holder R40 comprises a squared side R40A (not fully seen), a groove 16 formed within the squared side R40A (not seen), an angled side R40B, an angled groove 17 formed within angled side R40B, a group of three rounded inside corners 15A (not seen), 15B (not seen) and 15C formed by grooves 16 and 17, a left side R40C, a top R40D, an aligning side R40E, a bottom side R40F, two threaded holes 14A (not seen) and 14B formed through top R40D to grooves 16 and 17, and the thumb screw 11A screwed into threaded hole 14B.

Figure 27:
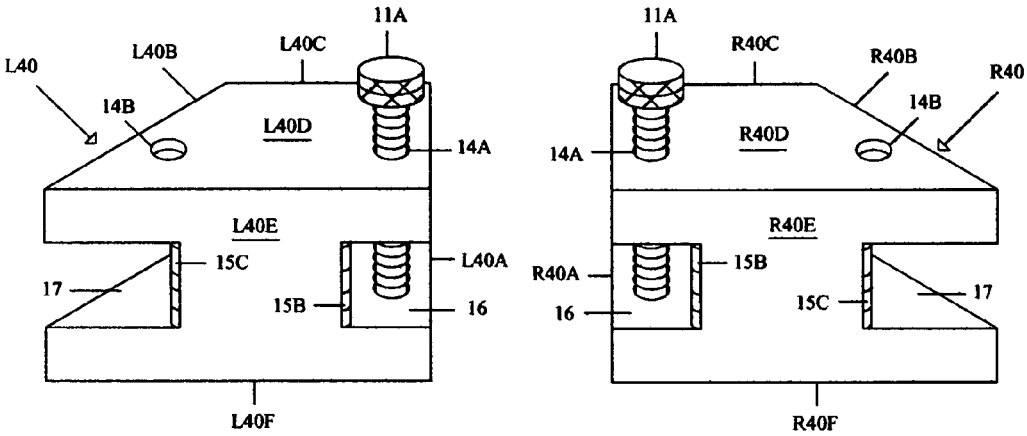
FIG. 27 is a perspective side view of embodiment L40 and R40 with one screw each seen slightly from the top.

FIG. 27 is a perspective side view of aligning sides L40E, R40E of control line holders embodiment L40 and R40 with one thumb screw 11A each seen slightly from the top for use with grids at ninety degree angles in relation to the walls, control line holder L40 comprises a squared side L40A, a groove 16 formed within the squared side L40A, an angled side L40B, an angled groove 17 formed within angled side L40B, a group of three rounded inside corners 15A (not seen), 15B, and 15C formed by grooves 16 and 17, a right side L40C, a top L40D, an aligning side L40E, a bottom side L40F (not seen), and two threaded holes 14A and 14B formed through top L40D to grooves 16 and 17, and the thumb screw 11A screwed into threaded hole 14A, control line holder R40 comprises a squared side R40A, a groove 16 formed within the squared side R40A, an angled side R40B, an angled groove 17 formed within angled side R40B, a group of three rounded inside corners 15A (not seen), 15B, and 15C formed by grooves 16 and 17, a left side R40C, a top R40D, an aligning side R40E, a bottom side R40F (not seen), two threaded holes 14A and 14B formed through top R40D to grooves 16 and 17, and the thumb screw 11A screwed into threaded hole 14A.

Figure 28:
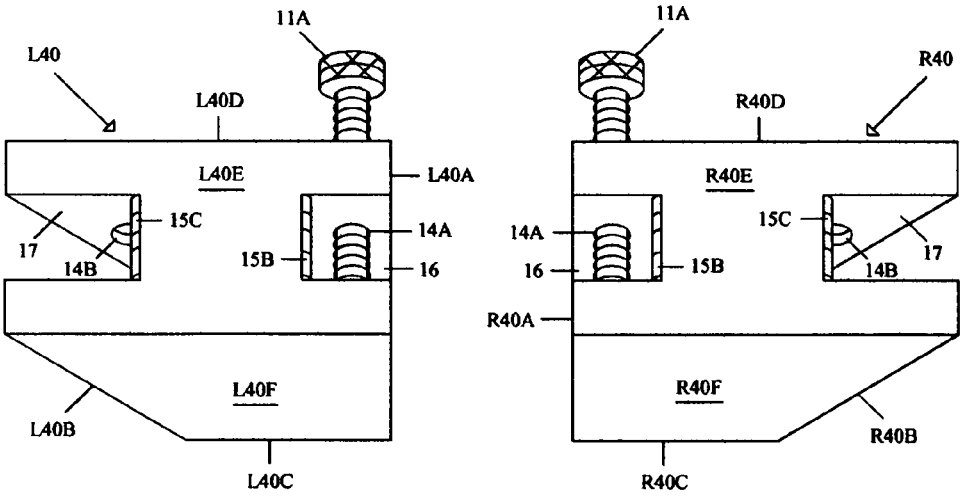
FIG. 28 is a perspective side view of embodiment L40 and R40 with one screw each seen slightly from the bottom.

FIG. 28 is a perspective side view of aligning sides L40E, R40E of control line holders embodiment L40 and R40 with one thumb screw 11A each seen slightly from the bottom for use with grids at ninety degree angles in relation to the walls, control line holder L40 comprises a squared side L40A, a groove 16 formed within the squared side L40A, an angled side L40B, an angled groove 17 formed within angled side L40B, a group of three rounded inside corners 15A (not seen), 15B, and 15C formed by grooves 16 and 17, a right side L40C, a top L40D, an aligning side L40E, a bottom side L40F, and two threaded holes 14A and 14B formed through top L40D to grooves 16 and 17, and the thumb screw 11A screwed into threaded hole 14A, control line holder R40 comprises a squared side R40A, a groove 16 formed within the squared side R40A, an angled side R40B, an angled groove 17 formed within angled side R40B, a group of three rounded inside corners 15A (not seen), 15B, and 15C formed by grooves 16 and 17, a left side R40C, a top R40D, an aligning side R40E, a bottom side R40F, two threaded holes 14A and 14B formed through top R40D to grooves 16 and 17, and the thumb screw 11A screwed into threaded hole 14A.

Figure 29:
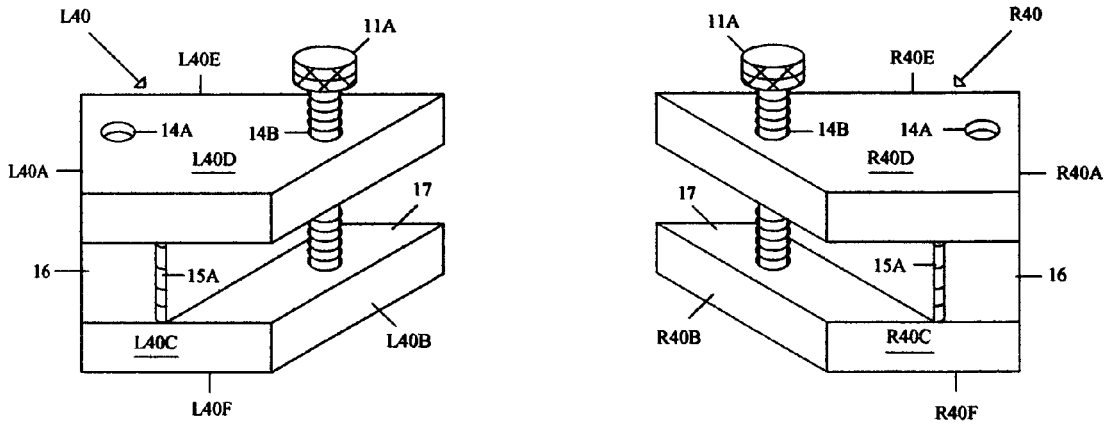
FIG. 29 is a perspective side view of embodiment L40 and R40 with one screw each seen slightly from the top.

FIG. 29 is a perspective left side L40C and right side R40C view of control line holders embodiment L40 and R40 with one thumb screw 11A each seen slightly from the top for use with grids at forty-five degree angles in relation to the walls, control line holder L40 comprises a squared side L40A, a groove 16 formed within the squared side L40A, an angled side L40B, an angled groove 17 formed within angled side L40B, a group of three rounded inside corners 15A, 15B (not seen), and 15C (not seen) formed by grooves 16 and 17, a right side L40C, a top L40D, an aligning side L40E, a bottom side L40F (not seen), and two threaded holes 14A and 14B formed through top L40D to grooves 16 and 17, and the thumb screw 11A screwed into threaded hole 14B, control line holder R40 comprises a squared side R40A, a groove 16 formed within the squared side R40A, an angled side R40B, an angled groove 17 formed within angled side R40B, a group of three rounded inside corners 15A, 15B (not seen), and 15C (not seen) formed by grooves 16 and 17, a left side R40C, a top R40D, an aligning side R40E, a bottom side R40F (not seen), two threaded holes 14A and 14B formed through top R40D to grooves 16 and 17, and the thumb screw 11A screwed into threaded hole 14B.

Figure 30:
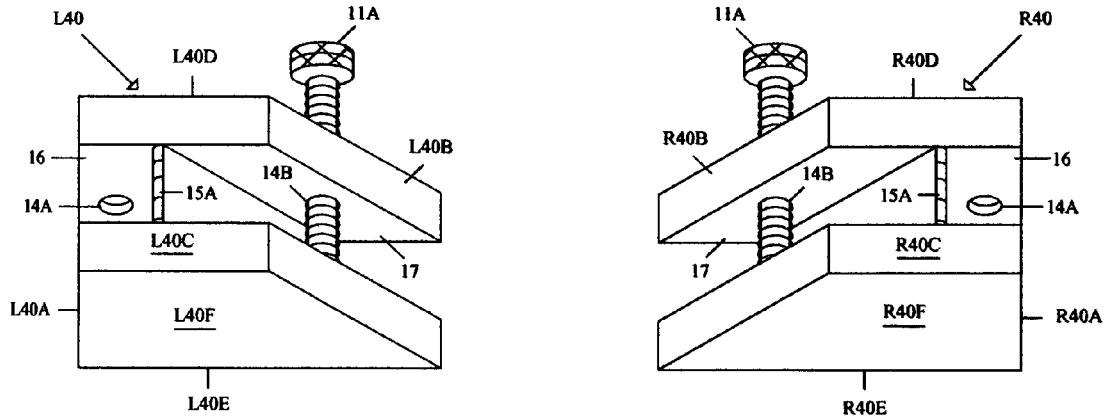
FIG. 30 is a perspective side view of embodiment L40 and R40 with one screw each seen slightly from the bottom.

FIG. 30 is a perspective left side L40C and right side R40C view of control line holders embodiment L40 and R40 with one thumb screw 11A each seen slightly from the bottom for use with grids at forty-five degree angles in relation to the walls, control line holder L40 comprises a squared side L40A, a groove 16 formed within the squared side L40A, an angled side L40B, an angled groove 17 formed within angled side L40B, a group of three rounded inside corners 15A, 15B (not seen), and 15C (not seen) formed by grooves 16 and 17, a right side L40C, a top L40D, an aligning side L40E, a bottom side L40F, and two threaded holes 14A and 14B formed through top L40D to grooves 16 and 17, and the thumb screw 11A screwed into threaded hole 14B, control line holder R40 comprises a squared side R40A, a groove 16 formed within the squared side R40A, an angled side R40B, an angled groove 17 formed within angled side R40B, a group of three rounded inside corners 15A, 15B (not seen), and 15C (not seen) formed by grooves 16 and 17, a left side R40C, a top R40D, an aligning side R40E, a bottom side R40F, two threaded holes 14A and 14B formed through top R40D to grooves 16 and 17, and the thumb screw 11A crewed into threaded hole 14B.

Figure 31:
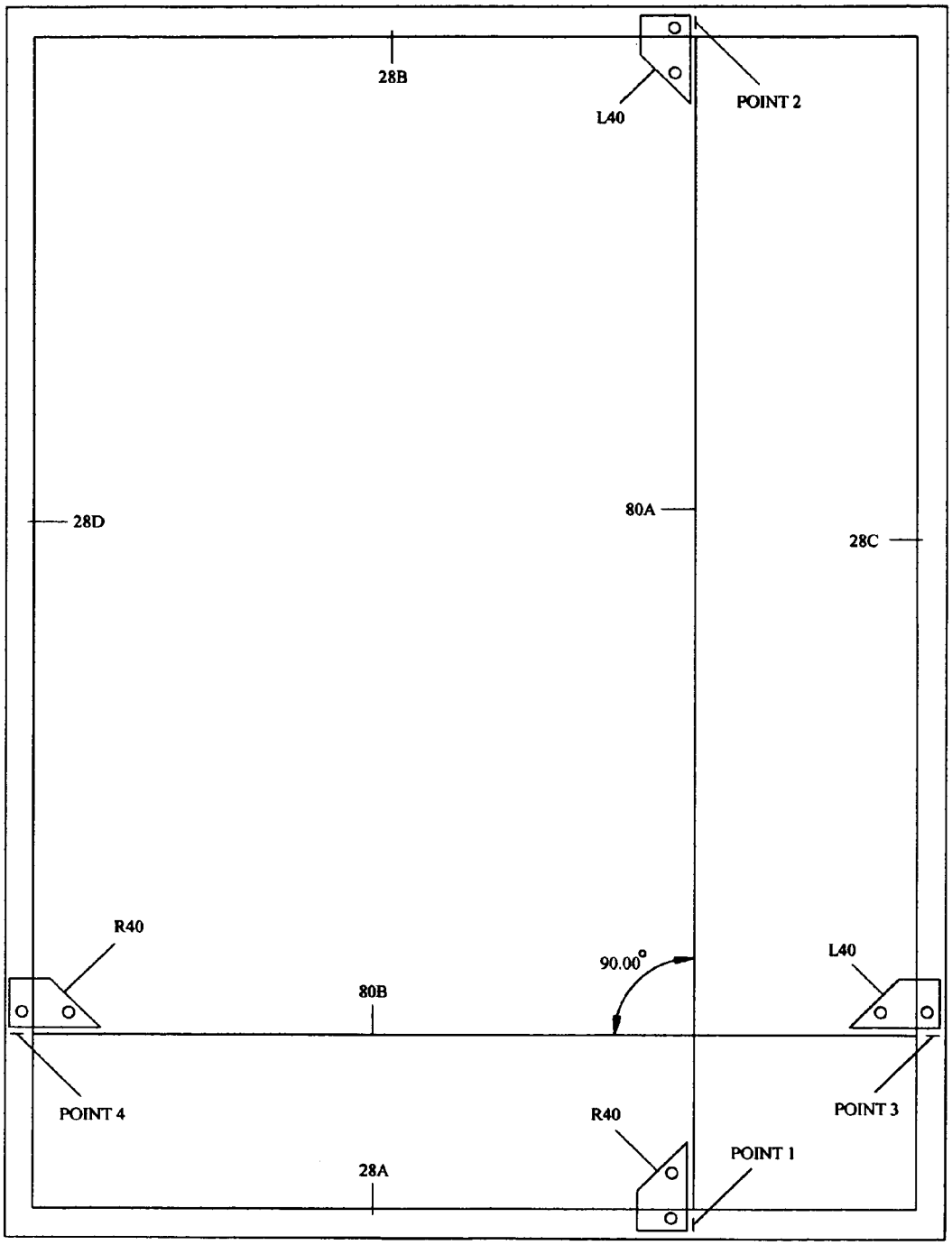
FIG. 31 is a perspective top view of embodiment R40, L40, additional L40, and additional R40 in use for grids at ninety degree angles in relation to the walls.

FIG. 31 is a perspective top view of control line holders embodiment R40, L40, additional L40, and additional R40 in use for grids at ninety degree angles in relation to the walls and comprises control line holder R40 attached to the right and next to a main tee 82A (not shown in this view) laid out mark or point one inscribed onto wall angle molding 28A, control line 80A pulled and held taut by control line holder L40 attached to the left and next to a main tee 82A (not shown in this view) laid out mark or point two inscribed onto wall angle molding 28B, additional control line holder L40 attached to the left and next to a cross tee 82B (not shown in this view) laid out mark or point three inscribed onto wall angle molding 28C, control line 80B pulled and held taut by additional control line holder R40 attached to the right and next to a cross tee 82B (not shown in this view) laid out mark or point four inscribed onto wall angle molding 28D.

Figure 32:
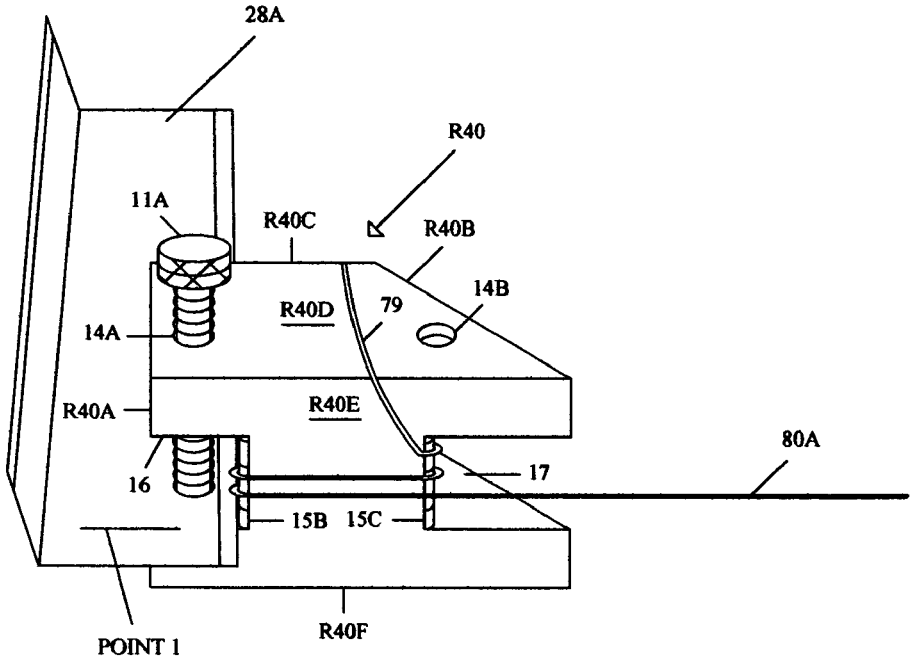
FIG. 32 is a perspective side view of embodiment R40 in use with grids at ninety degree angles in relation to the walls seen slightly from the top.

FIG. 32 is a perspective side view of control line holder embodiment R40 in use with grids at ninety degree angles in relation to the walls seen slightly from the top and comprises a squared side R40A, a groove 16 formed within the squared side R40A, an angled side R40B, a groove 17 formed within the angled side R40B, a group of three rounded corners 15A (not seen in this view), 15B, and 15C formed by grooves 16 and 17, a left side R40C, a top R40D, an aligning side R40E aligned to the right and next to a main tee 82A (not shown in this view) laid out mark or point one which is inscribed onto wall angle molding 28A, a bottom side R40F (not seen), two threaded holes 14A and 14B formed through top R40D to grooves 16 and 17, a thumb screw 11A screwed into threaded hole 14A that is applying a clamping force onto a piece of wall angle molding 28A against the bottom of groove 16, a loop 79 about 31.75 mm. in diameter tied from a roll of control line 80A which is hooked from groove 17 and the top R40D, control line 80A which is wrapped around counter clock wise left side R40C (not fully seen in this view), rounded corner 15A (not seen in this view), groove 16, rounded corner 15B, aligning side R40E, rounded corner 15C, groove 17, rounded corner 15A (not seen in this view), groove 16, rounded corner 15B, and ending running along aligning side R40E.

Figure 33:
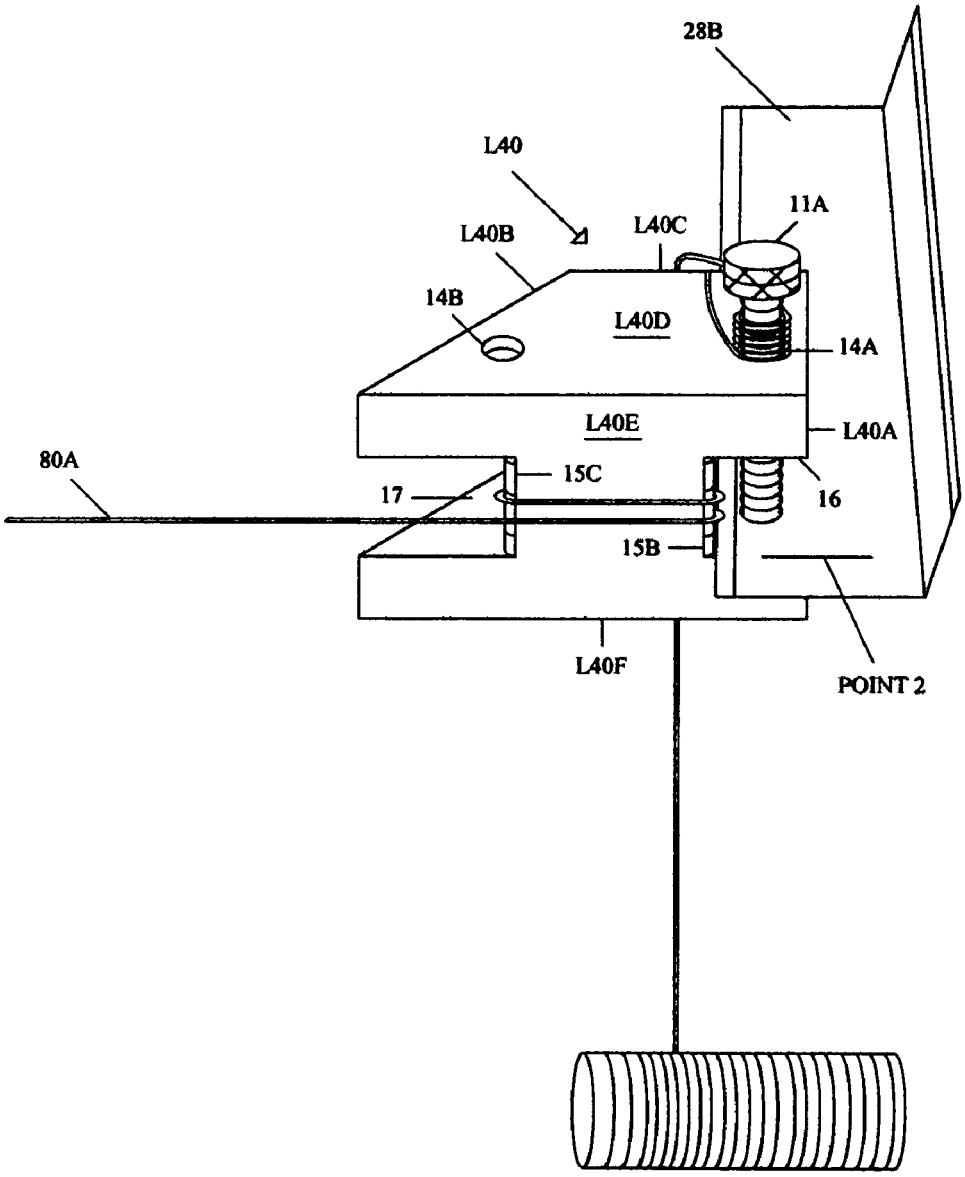
FIG. 33 is a perspective side view of embodiment L40 in use with grids at ninety degree angles in relation to the walls seen slightly from the top.

FIG. 33 is a perspective side view of control line holder embodiment L40 in use with grids at ninety degree angles in relation to the walls seen slightly from the top and comprises a squared side L40A, a groove 16 formed within the squared side L40A, an angled side L40B, a groove 17 formed within the angled side L40B, a group of three rounded corners 15A (not seen in this view), 15B, and 15C formed by grooves 16 and 17, a right side L40C (not fully seen in this view), a top L40D, an aligning side L40E aligned to the left and next to a main tee 82A (not shown in this view) laid out mark or point two which is inscribed onto wall angle molding 28B, a bottom side L40F (not seen), two threaded holes 14A and 14B formed through top L40D to grooves 16 and 17, a thumb screw 11A screwed into threaded hole 14A that is applying a clamping force onto a piece of wall angle molding 28B against the bottom of groove 16, control line 80A which is wrapped around counter clock wise aligning side L40E, rounded corner 15B, groove 16 formed within the squared side L40A, rounded corner 15A (not seen in this view), right side L40C (not fully seen in this view), groove 17 formed within the angled side L40B, rounded corner 15C, aligning side L40E, rounded corner 15B, groove 16 formed within the squared side L40A, right side L40C (not fully seen in this view), pulled taut and wrapped around counter clock wise five times the remainder top section of the thumb screw 11A, returned and let hung next to right side L40C (not fully seen in this view).

Figure 34:
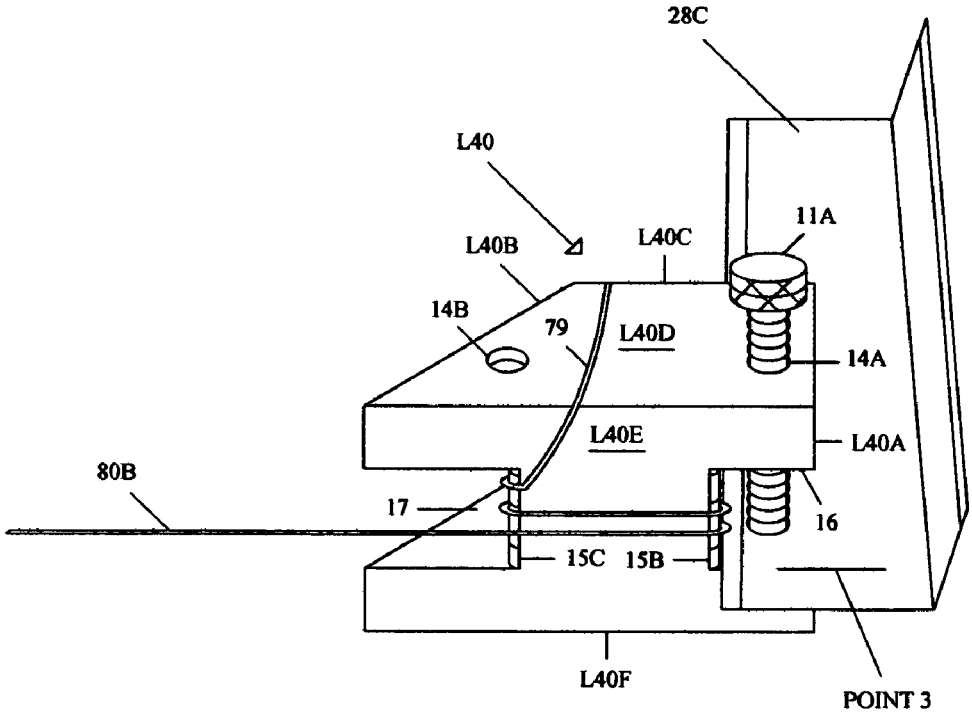
FIG. 34 is a perspective side view of additional embodiment L40 in use with grids at ninety degree angles in relation to the walls seen slightly from the top.

FIG. 34 is a perspective side view of additional embodiment L40 in use with grids at ninety degree angles in relation to the walls seen slightly from the top and comprises a squared side L40A, a groove 16 formed within the squared side L40A, an angled side L40B, a groove 17 formed within the angled side L40B, a group of three rounded corners 15A (not seen in this view), 15B, and 15C formed by grooves 16 and 17, a right side L40C (not fully seen in this view), a top L40D, an aligning side L40E aligned to the left and next to a cross tee 82B (not shown in this view) laid out mark or point three which is inscribed onto wall angle molding 28C, a bottom side L40F (not seen), two threaded holes 14A and 14B formed through top L40D to grooves 16 and 17, a thumb screw 11A screwed into threaded hole 14A that is applying a clamping force onto a piece of wall angle molding 28C against the bottom of groove 16, a loop 79 about 31.75 mm. in diameter tied from control line 80B which is hooked from groove 17 and the top L40D, control line 80B which is wrapped around clock wise right side L40C (not fully seen in this view), rounded corner 15A (not seen in this view), groove 16 formed within the squared side L40A, rounded corner 15B, aligning side L40E, rounded corner 15C, groove 17 formed within the angled side L40B, right side L40C (not fully seen in this view), rounded corner 15A (not seen in this view), groove 16 formed within the squared side L40A, rounded corner 15B, and ending running along aligning side L40E.

Figure 35:
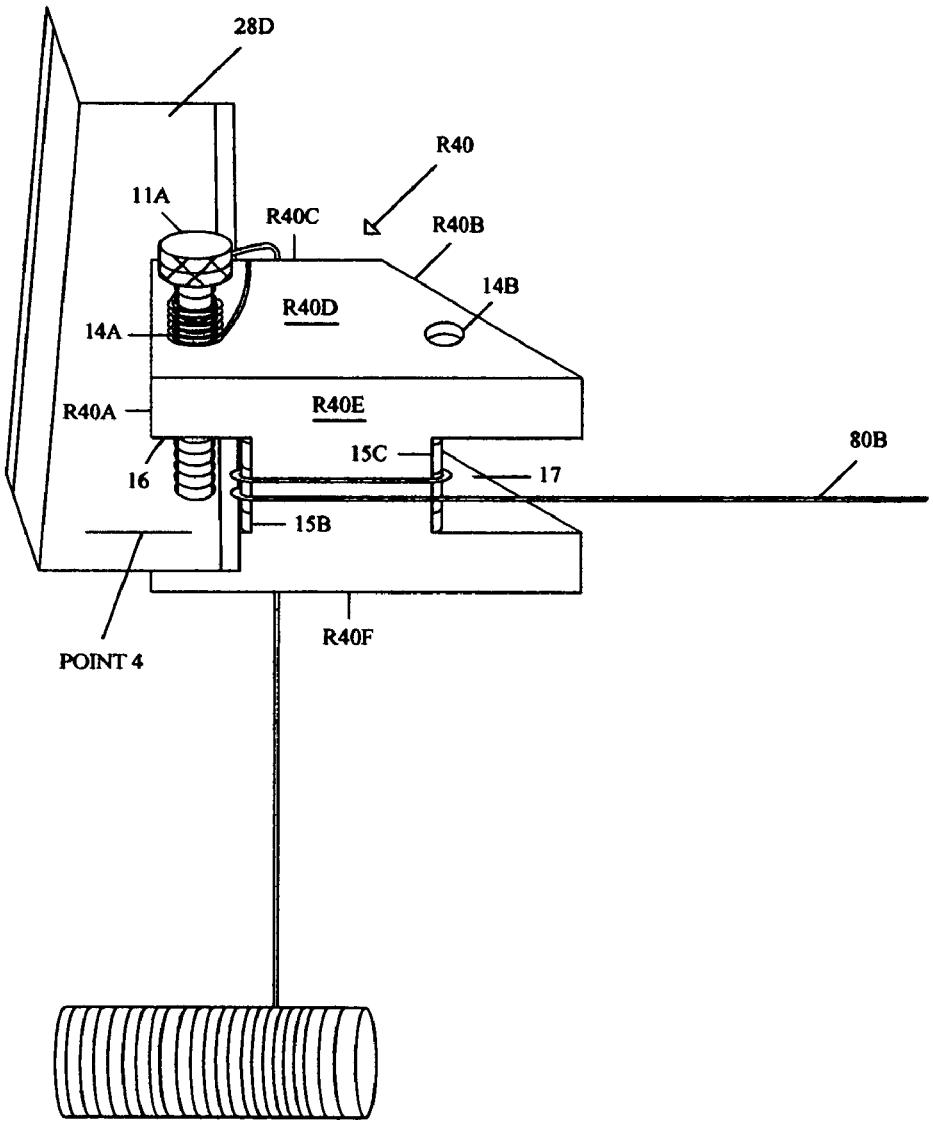
FIG. 35 is a perspective side view of additional embodiment R40 in use with grids at ninety degree angles in relation to the walls seen slightly from the top.

FIG. 35 is a perspective side view of additional embodiment R40 in use with grids at ninety degree angles in relation to the walls seen slightly from the top and comprises a squared side R40A, a groove 16 formed within the squared side R40A, an angled side R40B, a groove 17 formed within the angled side R40B, a group of three rounded corners 15A (not seen in this view), 15B, and 15C formed by grooves 16 and 17, a left side R40C (not fully seen in this view), a top R40D, an aligning side R40E aligned to the right and next to a cross tee 82B (not shown in this view) laid out mark or point four which is inscribed onto wall angle molding 28D, a bottom side L40F (not seen), two threaded holes 14A and 14B formed through top R40D to grooves 16 and 17, a thumb screw 11A screwed into threaded hole 14A that is applying a clamping force onto a piece of wall angle molding 28D against the bottom of groove 16, control line 80B which is wrapped around clock wise aligning side R40E, rounded corner 15B, groove 16 formed within the squared side R40A, rounded corner 15A (not seen in this view), left side R40C (not fully seen in this view), groove 17 formed within the angled side R40B, rounded corner 15C, aligning side R40E, rounded corner 15B, groove 16 formed within the squared side R40A, left side R40C (not fully seen in this view), pulled taut and wrapped around counter clock wise five times the remainder top section of the thumb screw 11A, returned and let hung next to left side R40C (not fully seen in this view).

Figure 36:
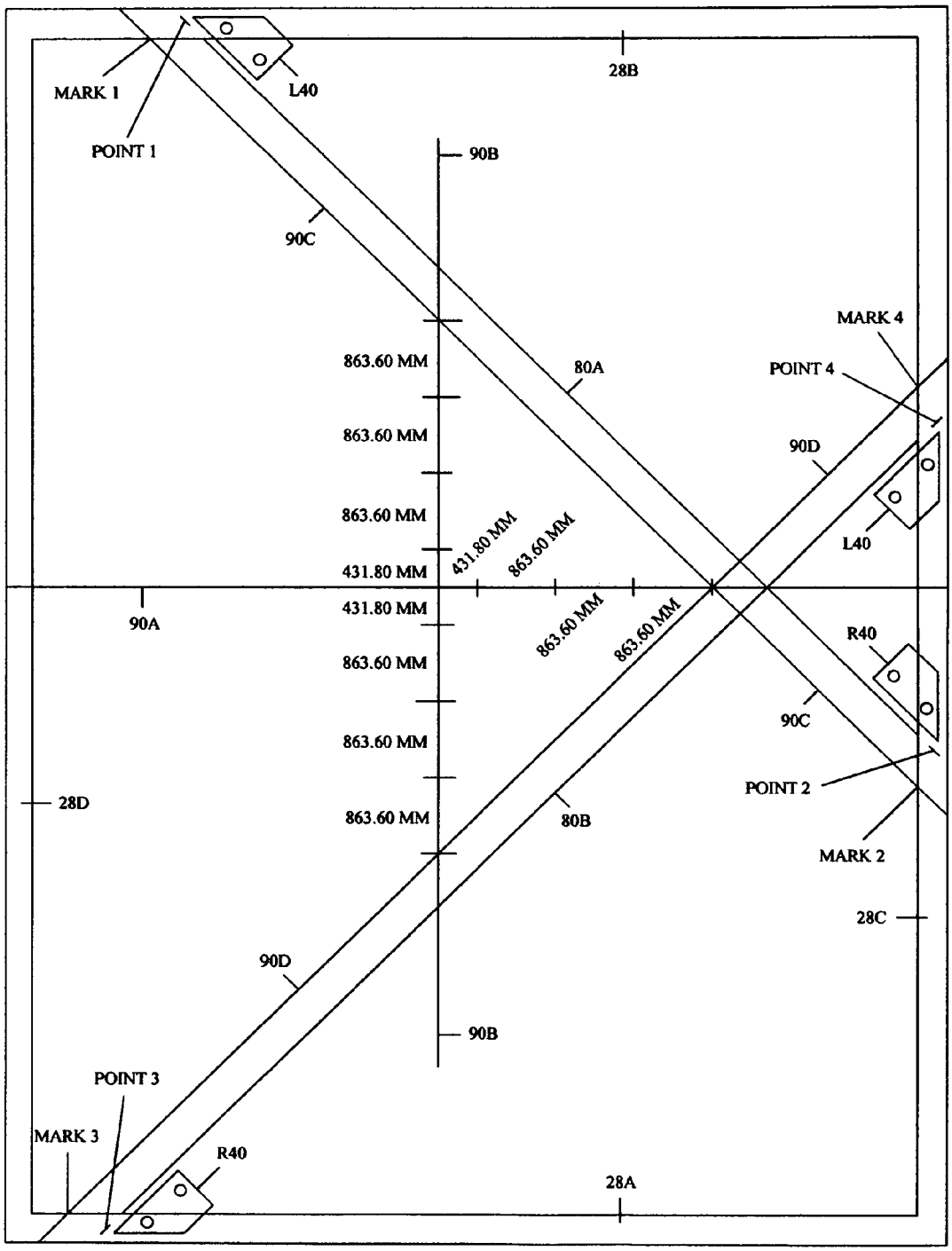
FIG. 36 is a perspective top view of embodiment L40, R40, additional R40 and additional L40 in use with grids at forty-five degree angles in relation to the walls.

FIG. 36 is a perspective top view of control line holders embodiment L40, R40, additional L40 and additional R40 in use for grids at forty-five degree angles in relation to the walls (not shown) and comprises a chalk line 90A snapped on the floor in the middle of the room, a chalk line 90B snapped on the floor in the center of and perpendicular to chalk line 90A, graduations marked in one direction on chalk line 90A starting from where chalk line 90A and chalk line 90B intersect are 431.80 mm. followed by three times graduations of 863.60 mm., graduations marked in opposite directions on chalk line 90B starting from where chalk line 90B and 90A intersect are 431.80 mm. followed by three times graduations of 863.60 mm., chalk line 90C snapped on the floor and joining the last marked graduation of 863.60 mm. on chalk line 90A and one last marked graduation of 863.60 mm. on chalk line 90B and extending to wall angle moldings 28B and 28C thus creating mark 1 transferred from the floor onto wall angle molding 28B and mark 2 transferred from the floor onto wall angle molding 28C, chalk line 90D snapped on the floor and joining the last marked graduation of 863.60 mm. on chalk line 90A and one opposite last marked graduation of 863.60 mm. on chalk line 90B and extending to wall angle moldings 28A and 28C thus creating mark 3 transferred from the floor onto wall angle molding 28A and mark 4 transferred from the floor onto wall angle molding 28C, control line holder L40 attached to the right and next to a main tee 82A (not shown in this view) laid out mark or point one inscribed onto wall angle molding 28B, control line 80A pulled and held taut by control line holder R40 attached to the left and next to a main tee 82A (not shown in this view) laid out mark or point two inscribed onto wall angle molding 28C, additional control line holder R40 attached to the left and next to a cross tee 82B (not shown in this view) laid out mark or point three inscribed onto wall angle molding 28A, control line 80B pulled and held taut by additional control line holder L40 attached to the right and next to a cross tee 82B (not shown in this view) laid out mark or point four inscribed onto wall angle molding 28C.

Figure 37:
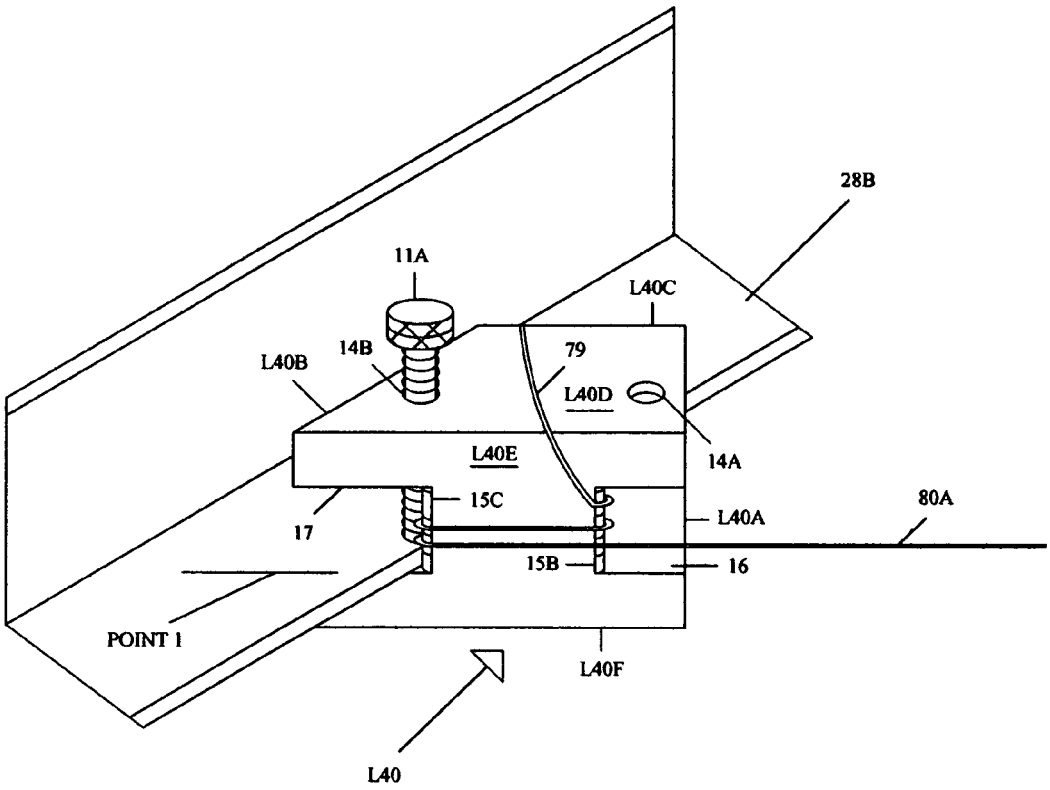
FIG. 37 is a perspective side view of embodiment L40 in use with grids at forty-five degree angles in relation to the walls seen slightly from the top.

FIG. 37 is a perspective side view of control line holder embodiment L40 in use with grids at forty-five degree angles in relation to the walls seen slightly from the top and comprises a squared side L40A, a groove 16 formed within the squared side L40A, an angled side L40B, a groove 17 formed within the angled side L40B, a group of three rounded corners 15A (not seen in this view), 15B, and 15C formed by grooves 16 and 17, a right side L40C, a top L40D, an aligning side L40E aligned to the right and next to a main tee 82A (not shown in this view) laid out mark or point one which is inscribed onto wall angle molding 28B, a bottom side L40F (not fully seen in this view), two threaded holes 14A and 14B formed through top L40D to grooves 16 and 17, a thumb screw 11A screwed into threaded hole 14B that is applying a clamping force onto a piece of wall angle molding 28B against the bottom of groove 17, a loop 79 about 31.75 mm. in diameter tied from control line 80A which is hooked from groove 16 and the top L40D, control line 80A which is wrapped around counter clock wise right side L40C (not fully seen in this view), rounded corner 15A (not seen in this view), groove 17, rounded corner 15C, aligning side L40E, rounded corner 15B, groove 16, rounded corner 15A (not seen in this view), groove 17, rounded corner 15C, and ending running along aligning side L40E.

Figure 38:
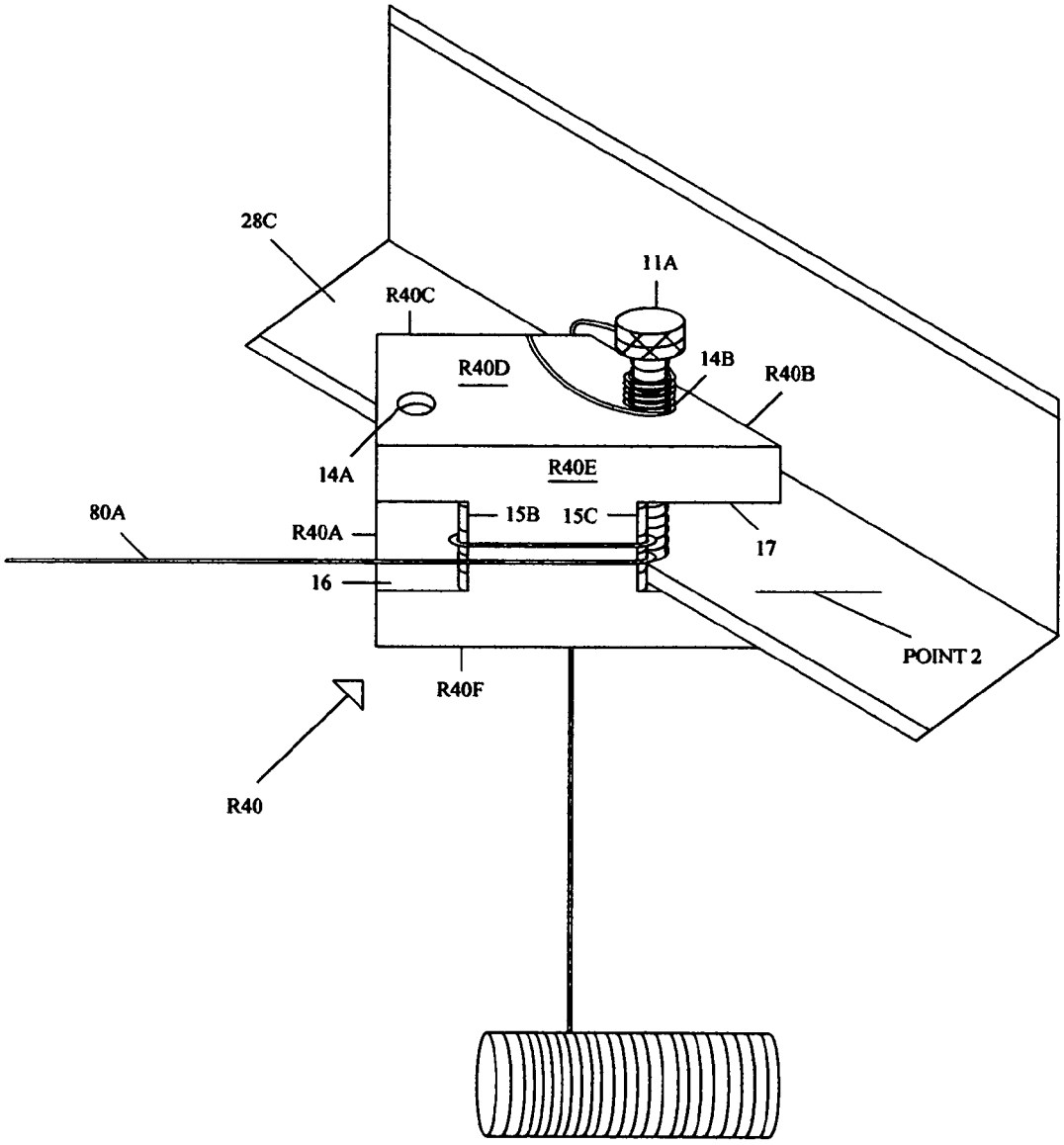
FIG. 38 is a perspective side view of embodiment R40 in use with grids at forty-five degree angles in relation to the walls seen slightly from the top.

FIG. 38 is a perspective side view of embodiment R40 in use with grids at forty-five degree angles in relation to the walls seen slightly from the top and comprises a squared side R40A, a groove 16 formed within the squared side R40A, an angled side R40B, a groove 17 formed within the angled side R40B, a group of three rounded corners 15A (not seen in this view), 15B, and 15C formed by grooves 16 and 17, a left side R40C (not fully seen in this view), a top R40D, an aligning side R40E aligned to the left and next to a main tee 82A (not shown in this view) laid out mark or point two which is inscribed onto a piece of wall angle molding 28C, a bottom side R40F (not fully seen in this view), two threaded holes 14A and 14B formed through top R40D to grooves 16 and 17, a thumb screw 11A screwed into threaded hole 14B that is applying a clamping force onto a piece of wall angle molding 28C against the bottom of groove 17, control line 80A which is wrapped around counter clock wise aligning side R40E, rounded corner 15C, groove 17 formed within the angled side R40B, rounded corner 15A (not seen in this view), left side R40C (not fully seen in this view), groove 16 formed within the squared side R40A, rounded corner 15B, aligning side R40E, rounded corner 15C, groove 17 formed within the angled side R40B, left side R40C (not fully seen in this view), pulled taut and wrapped around counter clock wise five times the remainder top section of the thumb screw 11A, returned and let hung next to left side R40C (not fully seen in this view).

Figure 39:
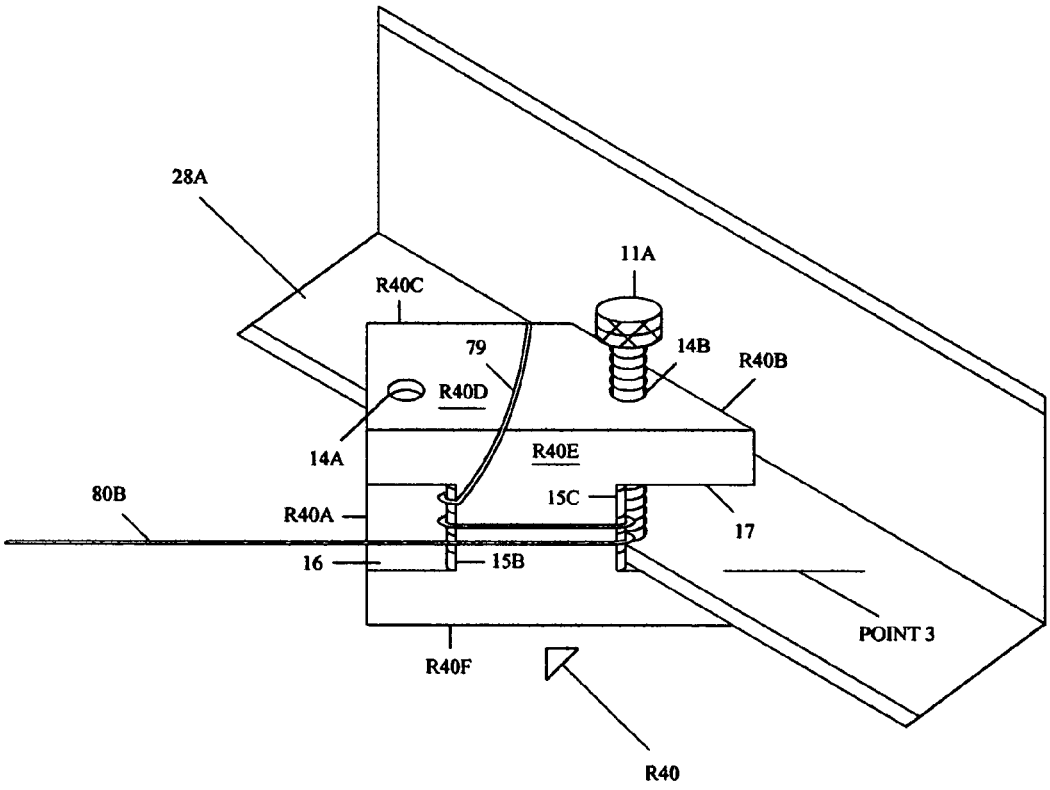
FIG. 39 is a perspective side view of additional embodiment R40 in use with grids at forty-five degree angles in relation to the walls seen slightly from the top.

FIG. 39 is a perspective side view of additional embodiment R40 in use with grids at forty-five degree angles in relation to the walls seen slightly from the top and comprises a squared side R40A, a groove 16 formed within the squared side R40A, an angled side R4013, a groove 17 formed within the angled side R40B, a group of three rounded corners 15A (not seen in this view), 15B, and 15C formed by grooves 16 and 17, a left side R40C (not fully seen in this view), a top R40D, an aligning side R40E aligned to the left and next to a cross tee 82B (not shown in this view) laid out mark or point three which is inscribed onto a piece of wall angle molding 28A, a bottom side R40F (not seen), two threaded holes 14A and 14B formed through top R40D to grooves 16 and 17, a thumb screw 11A screwed into threaded hole 14B that is applying a clamping force onto a piece of wall angle molding 28A against the bottom of groove 17, a loop 79 about 31.75 mm. in diameter tied from control line 80B which is hooked from groove 16 and the top R40D, control line 80B which is wrapped around clock wise left side R40C (not fully seen in this view), rounded corner 15A (not seen in this view), groove 17 formed within the angled side R40B, rounded corner 15C, aligning side R40E, rounded corner 15B, groove 16 formed within the squared side R40A, rounded corner 15A (not seen in this view), left side R40C (not fully seen in this view), groove 17 formed within the angled side R40B, rounded corner 15C, and ending running along aligning side R40E.

Figure 40:
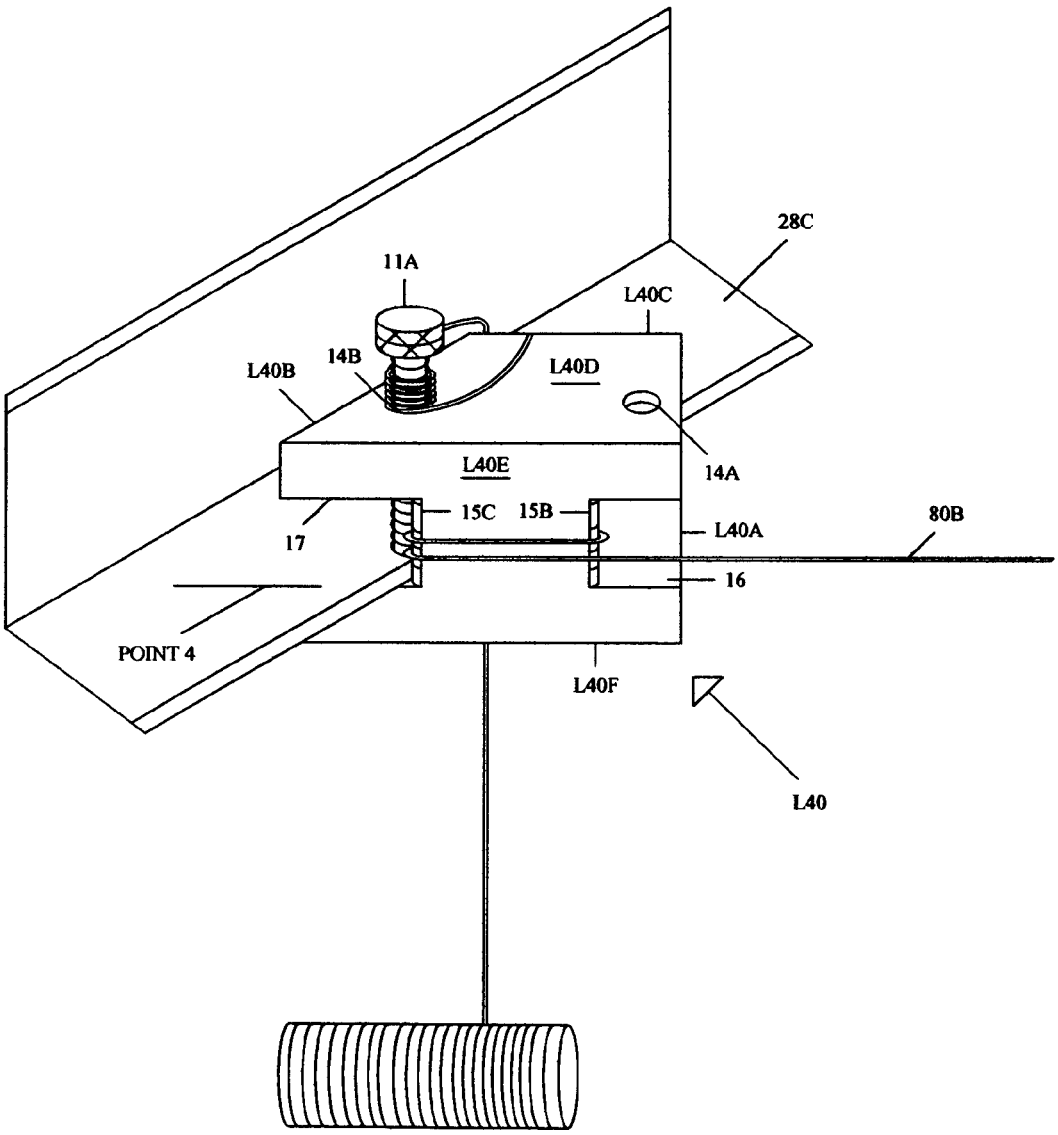
FIG. 40 is a perspective side view of additional embodiment L40 in use with grids at forty-five degree angles in relation to the walls seen slightly from the top.

FIG. 40 is a perspective side view of additional embodiment L40 in use with grids at forty-five degree angles in relation to the walls seen slightly from the top and comprises a squared side L40A, a groove 16 formed within the squared side L40A, an angled side L40B, a groove 17 formed within the angled side L40B, a group of three rounded corners 15A (not seen in this view), 15B, and 15C formed by grooves 16 and 17, a right side L40C (not fully seen in this view), a top L40D, an aligning side L40E aligned to the right and next to a cross tee 82B (not shown in this view) laid out mark or point four which is inscribed onto a piece of wall angle molding 28C, a bottom side L40F (not fully seen in this view), two threaded holes 14A and 14B formed through top L40D to grooves 16 and 17, a thumb screw 11A screwed into threaded hole 14B that is applying a clamping force onto a piece of wall angle molding 28C against the bottom of groove 17, control line 80B which is wrapped around clock wise aligning side L40E, rounded corner 15C, groove 17 formed within the angled side L40B, rounded corner 15A (not seen in this view), right side L40C (not fully seen in this view), groove 16 formed within the squared side L40A, rounded corner 15B, aligning side L40E, rounded corner 15C, groove 17 formed within the angled side L40B, right side L40C (not fully seen in this view) pulled taut and wrapped around counter clock wise five times the remainder top section of the thumb screw 11A, returned and let hung next to right side L40C (not fully seen in this view).

Referring to FIGS. 10 through 22 and by using the dimensions contained therein a person skilled in the art can use flat stock 6061 extruded aluminum and round stock 303 stainless steel material to manufacture with milling machines control line holders L40, R40, and thumb screw 11A, then, the control line holders L40 and R40 can be heat treated to a T6 condition, bright dipped and dye anodized with a nickel acetate seal.

There are different machines or methods for manufacturing said control line holders and said thumb screw, four of which are:

1. CNC (Computerized Numerical Controls) milling machines.
2. Manual milling machines.
3. CNC (Computerized Numerical Controls) plastic injection machines.

4. Casting.

Using a CNC milling machine has many advantages over the manual milling machine because an experienced CNC milling machine machinist can program said machine to perform many consecutive operations without having to change the setup and she or he can also program the machine to use a variety of milling tools such as: key seat cut milling tools, rough milling end mills, finish or fine texture milling end mills, corner rounding end mills for breaking sharp corners, insert-supplied end mills, rough milling inserts, finish or fine texture milling inserts, solid threading tools, threading-insert supplied turning tools, drill bits, dies, and roll form-plug style taps. To achieve the successful manufacture of said control line holder tools L40, R40 and the thumb screw 11A any or all of the milling tools that I have mentioned may be used.

Referring to FIGS. 10 through 22 and by using the dimensions contained therein a person skilled in the art can make molds to be used with CNC plastic injection machines or to do castings of control line holders L40, R40 and thumb screw 11A.

To enable those skilled in the art to fully understand and practice my new and improved method of installing or setting the control lines, I will proceed to give an example as to how a suspended grid framer can use the control line holders R40, L40, additional L40, and additional R40 to frame a 609.6 mm.×1219.2 mm. or 2'×4' 90 degree angle suspended grid:

1. Referring to FIGS. 31 through 35 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed height and label them as such.
3. Layout location of control lines 80A and 80B on wall angle moldings 28A, 28B, 28C, and 28D making sure all the marks are above the finished ceiling so no one will be able to see them.
4. The location of the control line 80A that runs parallel to the main tee is determined by adding the border dimension plus ½ the thickness of the main tee.
5. Make sure the thumb screws 11A are threaded into holes 14A but not into squared grooves 16.
6. See FIG. 32, control line for main tee 82A (not shown): Grab a roll of control line 80A and tie a loop 79 about 31.75 mm. in diameter at the end, with the other hand take control line holder R40 with the thumb screw 11A facing up, next, hook the loop 79 from groove 17 and the top R40D wrap control line 80A around counter clock wise left side R40C (not fully seen), rounded corner 15A (not seen), groove 16, rounded corner 15B, aligning side R40E, rounded corner 15C, groove 17, rounded corner 15A (not seen), groove 16, rounded corner 15B, and ending running along aligning side R40E.
7. See FIG. 32, go to main tee 82A (not shown) laid out mark or point 1 and as you face this laid out mark attach control line holder R40 to your right of this laid out mark or point 1 by first inserting the wall angle molding 28A into the groove 16 formed within the squared side R40A, aligning side R40E to your right of point 1, followed by firmly tightening the thumb screw 11A.
8. See FIG. 33, roll out control line 80A and go to the other laid out mark or point 2 for the main tee 82A (not shown) inscribed onto wall angle molding 28B, take control line holder L40, wrap the control line 80A around counter clock wise aligning side L40E, rounded corner 15B, groove 16 formed within the squared side L40A, rounded corner 15A (not seen), right side L40C (not fully seen in this view), groove 17 formed within the angled side L40B, rounded corner 15C, aligning side L40E, rounded corner 15B, groove 16 formed within the squared side L40A, right side L40C (not fully seen in this view).
9. See FIG. 33, as you face the laid out mark or point 2 for the main tee 82A (not shown), attach control line holder L40 to your left of this laid out mark or point 2 by first inserting the wall angle molding 28B into the groove 16 formed within the squared side L40A, aligning side L40E to your left of point 2, followed by firmly tightening the thumb screw 11A.
10. See FIG. 33, the control line 80A must not be trapped against the groove 16 by the wall angle molding 28B.
11. See FIG. 33, next, with your right hand grab the control line 80A coming from holder R40 and pull on it while at the same time with your left hand you pull at the previously wrapped control line 80A on the holder L40, do this until you are satisfied with the tautness of the control line, finally, with the line that is on your left hand wrap it around counter clock wise five times the remainder top section of the thumb screw 11A, return the line and let it hang next to right side L40C (not fully seen), by using the control line's 80A pulling force and wrapping the control line 80A counter clock wise the remainder top section of the thumb screw 11A locks the control line 80A and prevents it from becoming loose.
12. To adjust this control line 80A, first, the line must be unwrapped from the screw 11A to relieve the pulling pressure from the taut control line, second, unscrew the thumb screw 11A four turns, then move the control line holder L40 to either side and firmly tighten the screw back, repeat step 11 over again.
13. The location of the control line 80B that runs perpendicular to the main tee is determined by adding the border dimension plus ½ the thickness of the cross tee.
14. See FIG. 34, control line for cross tee 82B (not shown): Grab a roll of control line 80B and tie a loop 79 about 31.75 mm. in diameter at the end, with the other hand take additional control line holder L40 with the thumb screw 11A facing up, next, hook the loop 79 from groove 17 and the top L40D, wrap control line 80B around clock wise right side L40C (not fully seen), rounded corner 15A (not seen), groove 16, rounded corner 15B, aligning side L40E, rounded corner 15C, groove 17, right side L40C (not fully seen), rounded corner 15A (not seen), groove 16, rounded corner 15B, and ending running along aligning side L40E.
15. See FIG. 34, go to cross tee 82B (not shown) laid out mark or point 3 and as you face this laid out mark attach additional control line holder L40 to your left of this laid out mark or point 3 by first inserting the wall angle molding 28C into the groove 16 formed within the squared side L40A, aligning side L40E to your left of point 3, followed by firmly tightening the thumb screw 11A.
16. See FIG. 35, roll out control line 80B and go to the other laid out mark or point 4 for the cross tee 82B (not shown) inscribed onto wall angle molding 28D, take additional control line holder R40, wrap the control line 80B around clock wise aligning side R40E, rounded corner 15B, groove 16 formed within the squared side R40A, rounded corner 15A (not seen), left side R40C (not fully seen in this view), groove 17 formed within the angled side R40B, rounded corner 15C, aligning side R40E, rounded corner 15B, groove 16 formed within the squared side R40A, left side R40C (not fully seen in this view).
17. See FIG. 35, as you face the laid out mark or point 4 for the cross tee 82B (not shown), attach control line holder R40 to your right of this laid out mark or point 4 by first inserting the wall angle molding 28D into the groove 16 formed within the squared side R40A, aligning side R40E to your right of point 4, followed by firmly tightening the thumb screw 11A.

18. See FIG. 35, the control line 80B must not be trapped against the groove 16 by the wall angle molding 28D.
19. See FIG. 35, next, with your left hand grab the control line 80B coming from additional holder L40 and pull on it while at the same time with your right hand you pull at the previously wrapped control line 80B on the additional holder R40, do this until you are satisfied with the tautness of the control line, finally, with the line that is on your right hand wrap it around counter clock wise five times the remainder top section of the thumb screw 11A, return the line and let it hang next to left side R40C (not fully seen), by using the control line's 80B pulling force and wrapping the control line 80B counter clock wise the remainder top section of the thumb screw 11A locks the control line 80B and prevents it from becoming loose.
20. To adjust this control line 80B unwrap the line from the screw 11A to relieve the pulling pressure from the taut control line 80B, unscrew the thumb screw 11A four turns then move the additional control line holder R40 to either side and firmly tighten the screw back, repeat step 19 over again.
21. You have successfully installed, or set the control lines for a 90 degree angle grid.

Using control line holders L40, R40, additional R40, and additional L40 for 609.6 mm.×609.6 mm. or 2'×2' suspended-ceiling grids at 45 degree angles:

1. Referring to FIGS. 36 through 40 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed ceiling's height and label them as such.
3. On the floor of the room establish and snap a chalk line 90A in the middle, at the center of this line 90A establish and snap a perpendicular chalk line 90B making sure it is a perfect 90 degree angle.
4. From this center point where chalk line 90A and chalk line 90B intersect mark graduations of 431.8 mm. in three directions, then, from the marked graduations of 431.8 mm. measure and mark graduations of 863.6 mm. three times.
5. Snap a third chalk line 90C on the floor joining the last marked graduation of 863.60 mm. on chalk line 90A and one last marked graduation of 863.60 mm. on chalk line 90B extending to wall angle moldings 28B and 28C.
6. Snap a fourth chalk line 90D on the floor joining the last marked graduation of 863.60 mm. on chalk line 90A and one opposite last marked graduation of 863.60 mm. on chalk line 90B extending to wall angle moldings 28A and 28C.
7. You have created 4 new marks, mark 1, mark 2, mark 3, and mark 4, transfer these 4 marks from the floor up to the wall angle moldings 28B, 28C, 28A, and 28C.
8. Layout location of control lines 80A and 80B on wall moldings 28B, 28C, 28A, and 28C making sure all the marks are above the finished ceiling so no one will be able to see them.
9. The location of the control line 80A that runs parallel to the main tee 82A (not shown) is determined by inscribing ½ the thickness of the main tee parallel and to the right of mark 1 transferred from the floor onto wall angle molding 28B thus creating point 1, and parallel and to the left of mark 2 transferred from the floor onto wall angle molding 28C thus creating point 2.
10. The location of the control line 80B that runs parallel to the cross tee 82B (not shown) is determined by inscribing ½ the thickness of the cross tee parallel and to the left of mark 3 transferred from the floor onto wall angle molding 28A thus creating point 3, and parallel and to the right of mark 4 transferred from the floor onto wall angle molding 28C thus creating point 4.
11. Make sure the thumb screws 11A are threaded into holes 14B but not into angled groove 17.
12. See FIG. 37, take a roll of control line 80A and tie a loop 79 at the end, about 31.75 mm. in diameter, take control line holder L40 and hook the loop 79 from groove 16 and the top L40D, wrap control line 80A around counter clock wise right side L40C (not fully seen in this view), rounded corner 15A (not seen in this view), groove 17, rounded corner 15C, aligning side L40E, rounded corner 15B, groove 16, rounded corner 15A (not seen in this view), groove 17, rounded corner 15C, and ending running along aligning side L40E.
13. See FIG. 37, go to point 1 inscribed onto wall angle molding 28B and as you face this main tee 82A (not shown) laid out mark or point 1 attach control line holder L40 to your right of this point 1 by first inserting the wall angle molding 28B into groove 17 formed within angled side L40B, aligning side L40E to your right of point 1, followed by firmly tightening the thumb screw 11A.
14. See FIG. 38, roll out control line 80A and go to point 2, take control line holder R40, wrap the control line 80A around counter clock wise aligning side R40E, rounded corner 15C, groove 17 formed within the angled side R40B, rounded corner 15A (not seen), left side R40C (not fully seen in this view), groove 16 formed within the squared side R40A, rounded corner 15B, aligning side R40E, rounded corner 15C, groove 17 formed within the angled side R40B, left side R40C (not fully seen in this view).
15. See FIG. 38, as you face this main tee 82A (not shown) laid out mark or point 2 attach control line holder R40 to your left of this point 2 by first inserting the wall angle molding 28C into groove 17, aligning side R40E to your left of point 2, followed by firmly tightening the thumb screw 11A.
16. See FIG. 38, the control line must not be trapped against the groove 17 by the wall angle molding 28C.
17. See FIG. 38, next, with your right hand grab the control line 80A coming from holder L40 and pull on it while at the same time with your left hand you pull at the previously wrapped control line on holder R40, do this until you are satisfied with the tautness of the line, finally with the line that is on your left hand wrap it around counter clock wise five times the remainder top section of the thumb screw 11A, return the line and let it hang next to left side R40C (not fully seen), by using the control line's 80A pulling force and wrapping the control line 80A counter clock wise the remainder top section of the thumb screw 11A locks the control line 80A and prevents it from becoming loose.
18. See FIG. 39, control line for cross tee 82B (not shown), Grab a roll of control line 80B and tie a loop 79 about 31.75 mm. in diameter at the end, with the other hand take additional control line holder R40 with the thumb screw 11A facing up, next, hook the loop 79 from groove 16 and the top R40D, wrap control line 80B around clock wise left side R40C (not fully seen), rounded corner 15A (not seen), groove 17, rounded corner 15C, aligning side R40E, rounded corner 15B, groove 16, rounded corner 15A (not seen), left side R40C (not fully seen), groove 17, rounded corner 15C, and ending running along aligning side R40E.

19. See FIG. 39, take additional holder R40 and go to point 3, and as you face point 3, attach control line holder R40 to your left of this point 3 by first inserting the wall angle molding 28A into groove 17, aligning side R40E to your left of point 3, followed by firmly tightening the thumb screw 11A.
20. See FIG. 40, roll out control line 80B and go to point 4, take additional control line holder L40 and wrap control line 80B clock wise aligning side L40E, rounded corner 15C, groove 17 formed within the angled side L40B, rounded corner 15A (not seen), right side L40C (not fully seen in this view), groove 16 formed within the squared side L40A, rounded corner 15B, aligning side L40E, rounded corner 15C, groove 17 formed within the angled side L40B, right side L40C (not fully seen in this view).
21. See FIG. 40, as you face this cross tee 828 (not shown) laid out mark or point 4 attach control line holder L40 to your right of this point 4 by first inserting the wall angle molding 28C into the groove 17, aligning side L40E to your right of point 4, followed by firmly tightening the thumb screw 11A.
22. See FIG. 40, the control line 80B must not be trapped against the groove 17 by the wall angle molding 28C.
23. See FIG. 40, next, with your left hand grab the control line 80B coming from holder R40 and pull on it while at the same time with your right hand you pull at the previously wrapped control line on holder L40, do this until you are satisfied with the tautness of the line, finally, with the line that is on your right hand wrap it around counter clock wise five times the remainder top section of the thumb screw 11A, return the line and let it hang next to right side L40C (not fully seen), by using the control line's 80B pulling force and wrapping the control line 80B counter clock wise the remainder top section of the thumb screw 11A locks the control line 80B and prevents it from becoming loose.
24. You have set, or installed the control lines for a 45 degree angle grid.

DETAILED DESCRIPTION

FIGS. 41 Through 58—Second Embodiment

Figure 41:
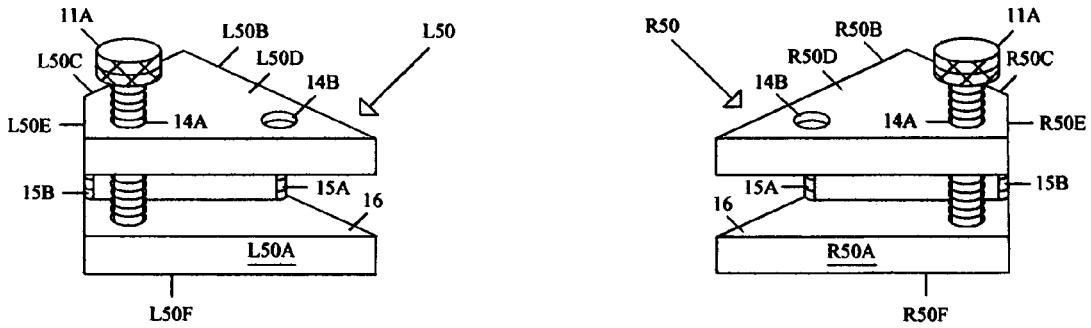
FIG. 41 is a perspective view of a second embodiment L50 and R50 with one screw each seen slightly from the top for use with grids at ninety degree angles in relation to the walls.

FIG. 41 is a perspective view of a second embodiment L50 and R50 with one screw 11A each seen slightly from the top for use with grids at ninety degree angles in relation to the walls, control line holder L50 comprises a squared side L50A, a groove 16 formed within the squared side L50A, a 45 degree angle grid aligning side L50B, a group of three rounded corners 15A, 15B formed by groove 16 and 15C (rounded corner 15C not seen), a side L50C, a top L50D, a 90 degree angle grid aligning side L50E, a bottom side L50F (not seen), and two threaded holes 14A and 14B formed through top L50D to groove 16, and the thumb screw 11A screwed into threaded hole 14A, control line holder R50 comprises a squared side R50A, a groove 16 formed within the squared side R50A, a 45 degree angle grid aligning side R50B, a group of three rounded corners 15A, 15B formed by groove 16 and 15C (rounded corner 15C not seen), a side R50C, a top R50D, a 90 degree angle grid aligning side R50E, a bottom side R50F (not seen), two threaded holes 14A and 14B formed through top R50D to groove 16, and the thumb screw 11A screwed into threaded hole 14A.

Figure 42:
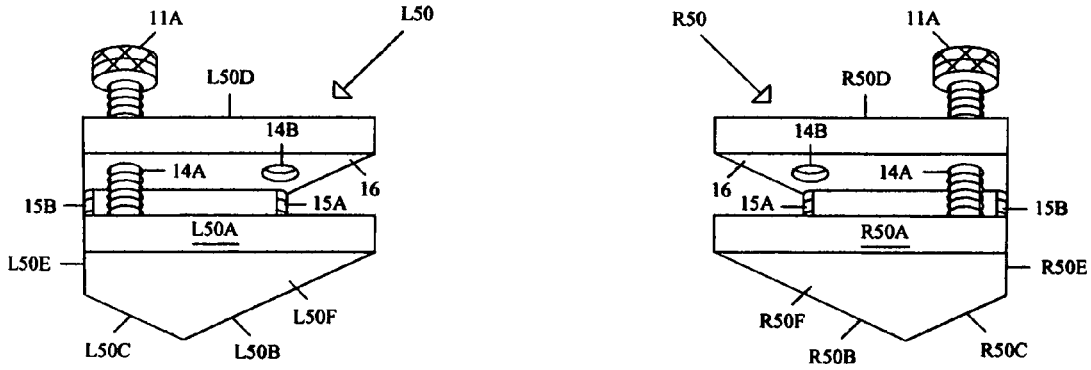
FIG. 42 is a perspective view of the second embodiment L50 and R50 with one screw each seen slightly from the bottom for use with grids at ninety degree angles in relation to the walls.

FIG. 42 is a perspective view of the second embodiment L50 and R50 with one screw each seen slightly from the bottom for use with grids at ninety degree angles in relation to the walls, control line holder L50 comprises a squared side L50A, a groove 16 formed within the squared side L50A, a 45 degree angle grid aligning side L50B, a group of three rounded corners 15A, 15B formed by groove 16 and 15C (rounded corner 15C not seen), a side L50C, a top L50D (not fully seen), a 90 degree angle grid aligning side L50E, a bottom side L50F, and two threaded holes 14A and 14B formed through top L50D to groove 16, and the thumb screw 11A screwed into threaded hole 14A, control line holder R50 comprises a squared side R50A, a groove 16 formed within the squared side R50A, a 45 degree angle grid aligning side R50B, a group of three rounded corners 15A, 15B formed by groove 16 and 15C (rounded corner 15C not seen), a side R50C, a top R50D (not fully seen), a 90 degree angle grid aligning side R50E, a bottom side R50F, two threaded holes 14A and 14B formed through top R50D to groove 16, and the thumb screw 11A screwed into threaded hole 14A.

Figure 43:
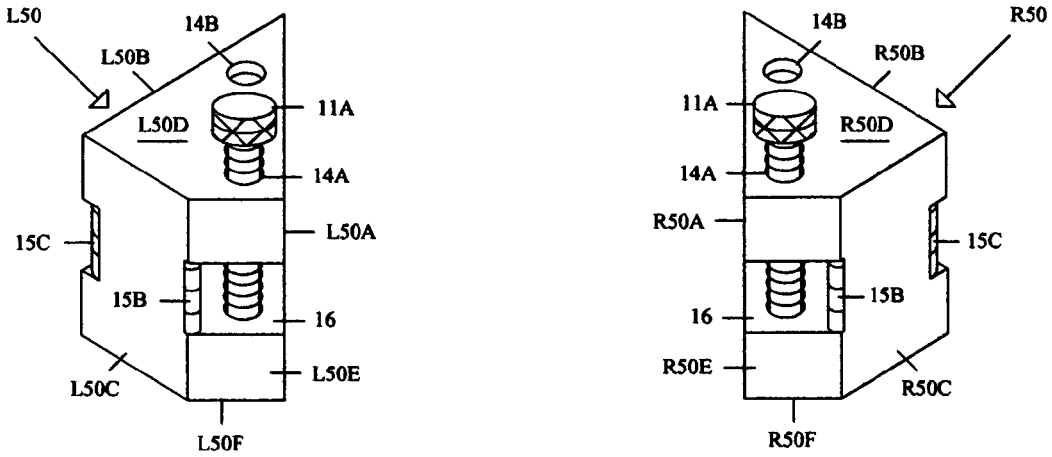
FIG. 43 is a perspective side view of the second embodiment L50 and R50 with one screw each seen slightly from the top for use with grids at ninety degree angles in relation to the walls.

FIG. 43 is a perspective side view of the second embodiment L50 and R50 with one screw each seen slightly from the top for use with grids at ninety degree angles in relation to the walls, control line holder L50 comprises a squared side L50A, a groove 16 formed within the squared side L50A, a 45 degree angle grid aligning side L50B, a group of three rounded corners 15A (rounded corner 15A not seen), 15B formed by groove 16 and 15C, a side L50C, a top L50D, a 90 degree angle grid aligning side L50E, a bottom side L50F (not seen), and two threaded holes 14A and 14B formed through top L50D to groove 16, and the thumb screw 11A screwed into threaded hole 14A, control line holder R50 comprises a squared side R50A, a groove 16 formed within the squared side R50A, a 45 degree angle grid aligning side R50B, a group of three rounded corners 15A (rounded corner 15A not seen), 15B formed by groove 16 and 15C, a side R50C, a top R50D, a 90 degree angle grid aligning side R50E, a bottom side R50F (not seen), two threaded holes 14A and 14B formed through top R50D to groove 16, and the thumb screw 11A screwed into threaded hole 14A.

Figure 44:
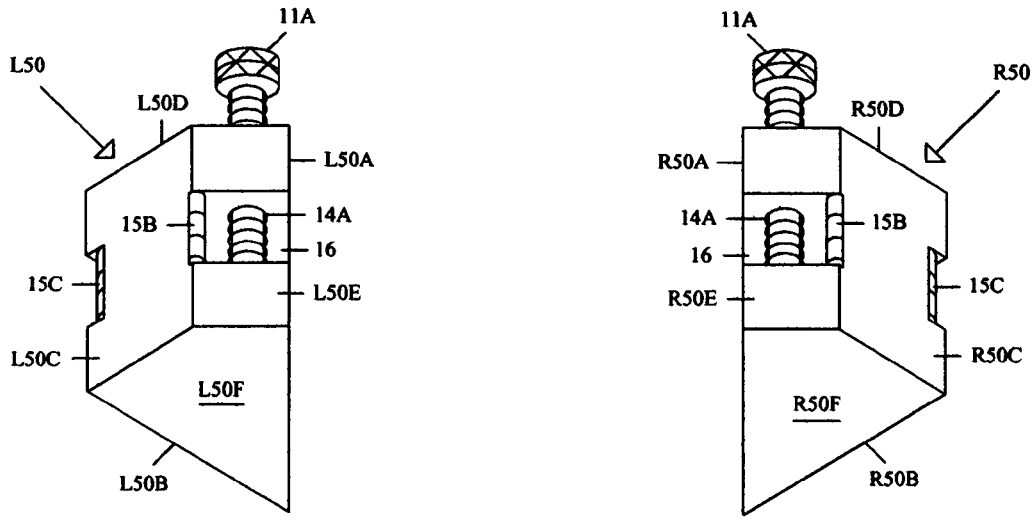
FIG. 44 is a perspective side view of the second embodiment L50 and R50 with one screw each seen slightly from the bottom for use with grids at ninety degree angles in relation to the walls.

FIG. 44 is a perspective side view of the second embodiment L50 and R50 with one screw each seen slightly from the bottom for use with grids at ninety degree angles in relation to the walls, control line holder L50 comprises a squared side L50A, a groove 16 formed within the squared side L50A, a 45 degree angle grid aligning side L50B, a group of three rounded corners 15A (rounded corner 15A not seen), 15B formed by groove 16 and 15C, a side L50C, a top L50D (not fully seen), a 90 degree angle grid aligning side L50E, a bottom side L50F, and two threaded holes 14A and 14B (not seen) formed through top L50D to groove 16, and the thumb screw 11A screwed into threaded hole 14A, control line holder R50 comprises a squared side R50A, a groove 16 formed within the squared side R50A, a 45 degree angle grid aligning side R50B, a group of three rounded corners 15A (rounded corner 15A not seen), 15B formed by groove 16 and 15C, a side R50C, a top R50D (not fully seen), a 90 degree angle grid aligning side R50E, a bottom side R50F, two threaded holes 14A and 14B (not seen) formed through top R50D to groove 16, and the thumb screw 11A screwed into threaded hole 14A.

Figure 45:
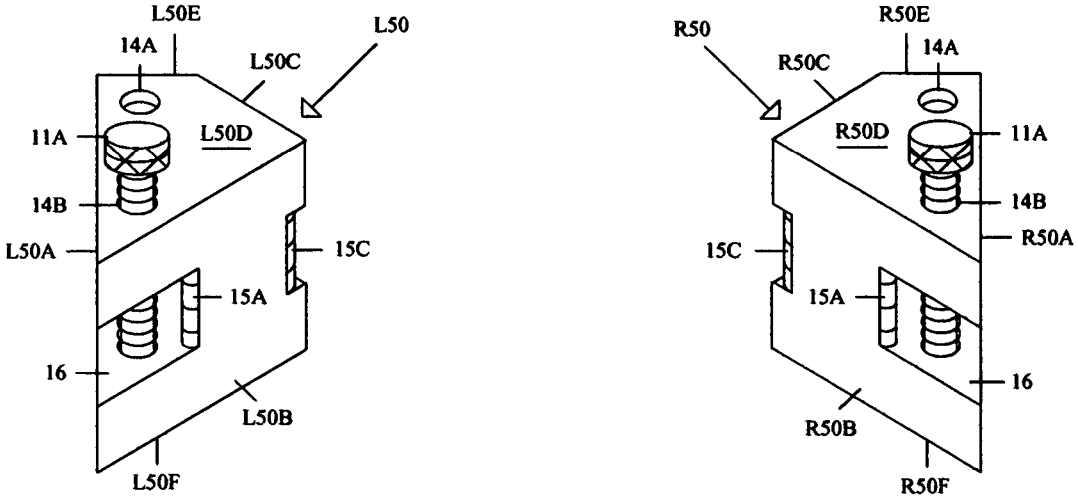
FIG. 45 is a perspective side view of the second embodiment L50 and R50 with one screw each seen slightly from the top for use with grids at forty-five degree angles in relation to the walls.

FIG. 45 is a perspective side view of the second embodiment L50 and R50 with one screw each seen slightly from the top for use with grids at forty-five degree angles in relation to the walls, control line holder L50 comprises a squared side L50A, a groove 16 formed within the squared side L50A, a 45 degree angle grid aligning side L50B, a group of three rounded corners 15A, 15B (not seen), formed by groove 16 and 15C, a top L50D, a 90 degree angle grid aligning side L50E, a bottom side L50F (not seen), and two threaded holes 14A and 14B formed through top L50D to groove 16, and the thumb screw 11A screwed into threaded hole 14B, control line holder R50 comprises a squared side R50A, a groove 16 formed within the squared side R50A, a 45 degree angle grid aligning side R50B, a group of three rounded corners 15A, 15B (not seen) formed by groove 16 and 15C, a side R50C, a top R500, a 90 degree angle grid aligning side R50E, a bottom side R50F (not seen), two threaded holes 14A and 14B formed though top R50D to groove 16, and the thumb screw 11A screwed into threaded hole 14B.

Figure 46:
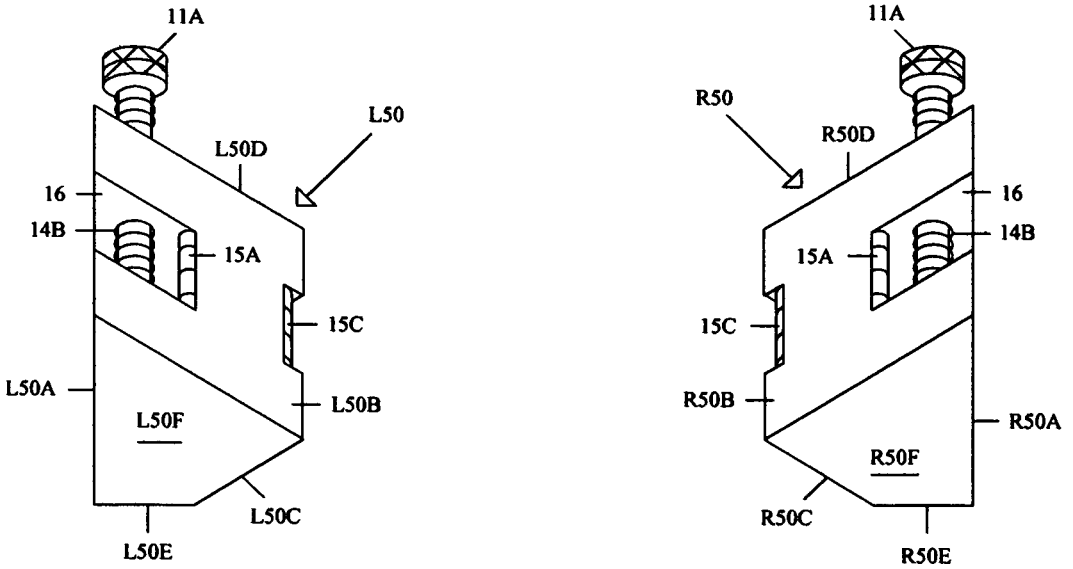
FIG. 46 is a perspective side view of the second embodiment L50 and R50 with one screw each seen slightly from the bottom for use with grids at forty-five degree angles in relation to the walls.

FIG. 46 is a perspective side view of the second embodiment L50 and R50 with one screw each seen slightly from the bottom for use with grids at forty-five degree angles in relation to the walls, control line holder L50 comprises a squared side L50A, a groove 16 formed within the squared side L50A, a 45 degree angle grid aligning side L50B, a group of three rounded corners 15A, 15B (not seen), formed by groove 16 and 15C, a top L50D (not fully seen), a 90 degree angle grid aligning side L50E, a bottom side L50F, and two threaded holes 14A (not seen) and 14B formed through top L50D to groove 16, and the thumb screw 11A screwed into threaded hole 14B, control line holder R50 comprises a squared side R50A, a groove 16 formed within the squared side R50A, a 45 degree angle grid aligning side R50B, a group of three rounded corners 15A, 15B (not seen) formed by groove 16 and 15C, a side R50C, a top R50D (not fully seen), a 90 degree angle grid aligning side R50E, a bottom side R50F, two threaded holes 14A (not seen) and 14B formed through top R50D to groove 16, and the thumb screw 11A screwed into threaded hole 14B.

Figure 47:
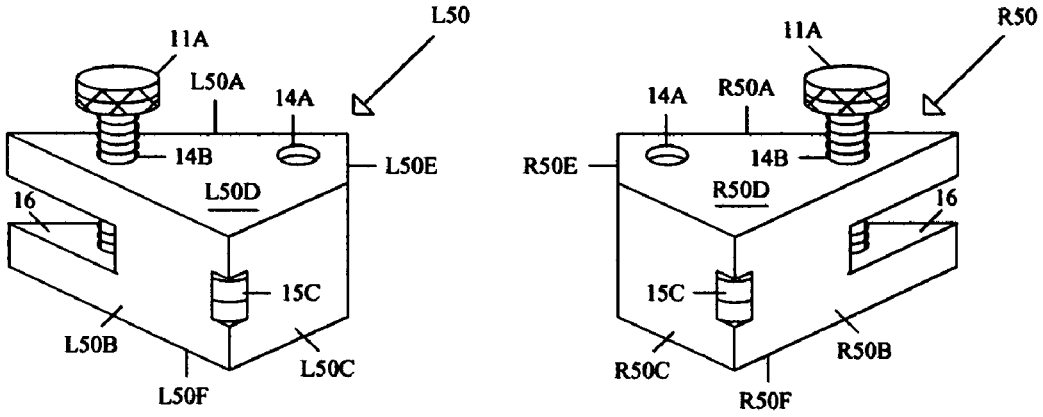
FIG. 47 is a perspective side view of the second embodiment L50 and R50 with one screw each seen slightly from the top for use with grids at forty-five degree angles in relation to the walls.

FIG. 47 is a perspective side view of the second embodiment L50 and R50 with one screw each seen slightly from the top for use with grids at forty-five degree angles in relation to the walls, control line holder L50 comprises a squared side L50A (not fully seen), a groove 16 (not fully seen) formed within the squared side L50A, a 45 degree angle grid aligning side L50B, a group of three rounded corners 15A (not seen), 15B (not seen) formed by groove 16 and 15C, a top L50D, a 90 degree angle grid aligning side L50E, a bottom side L50F (not seen), and two threaded holes 14A and 14B formed through top L50D to groove 16, and the thumb screw 11A screwed into threaded hole 14B, control line holder R50 comprises a squared side R50A (not fully seen), a groove 16 (not fully seen) formed within the squared side R50A, a 45 degree angle grid aligning side R50B, a group of three rounded corners 15A (not seen), 15B (not seen) formed by groove 16 and 15C, a side R50C, a top R50D, a 90 degree angle grid aligning side R50E, a bottom side R50F (not seen), two threaded holes 14A and 14B formed through top R50D to groove 16, and the thumb screw 11A screwed into threaded hole 14B.

Figure 48:
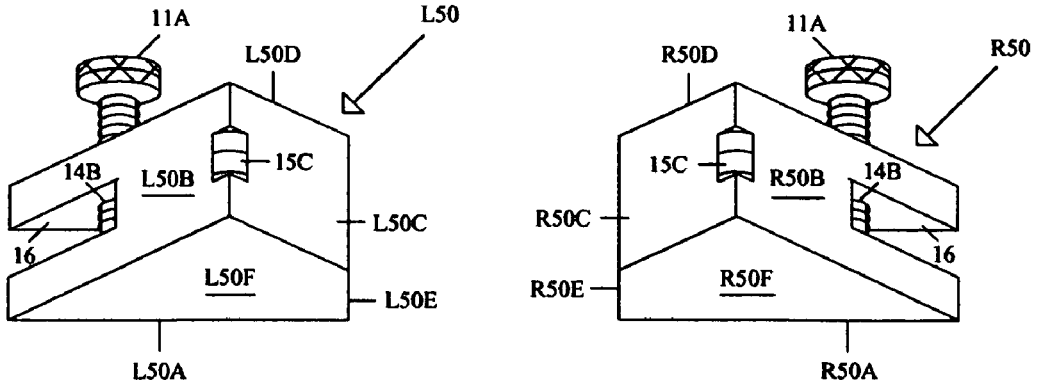
FIG. 48 is a perspective side view of the second embodiment L50 and R50 with one screw each seen slightly from the bottom for use with grids at forty-five degree angles in relation to the walls.

FIG. 48 is a perspective side view of the second embodiment L50 and R50 with one screw each seen slightly from the bottom for use with grids at forty-five degree angles in relation to the walls, control line holder L50 comprises a squared side L50A (not fully seen), a groove 16 (not fully seen) formed within the squared side L50A, a 45 degree angle grid aligning side L50B, a group of three rounded corners 15A (not seen), 15B (not seen) formed by groove 16 and 15C, a top L50D (not fully seen), a 90 degree angle grid aligning side L50E, a bottom side L50F, and two threaded holes 14A (not seen) and 14B formed through top L50D to groove 16, and the thumb screw 11A screwed into threaded hole 14B, control line holder R50 comprises a squared side R50A (not fully seen), a groove 16 (not fully seen) formed within the squared side R50A, a 45 degree angle grid aligning side R50B, a group of three rounded corners 15A (not seen), 15B (not seen) formed by groove 16 and 15C, a side R50C, a top R50D (not fully seen), a 90 degree angle grid aligning side R50E, a bottom side R50F, two threaded holes 14A (not seen) and 14B formed through top R50D to groove 16, and the thumb screw 11A screwed into threaded hole 14B.

Figure 49:
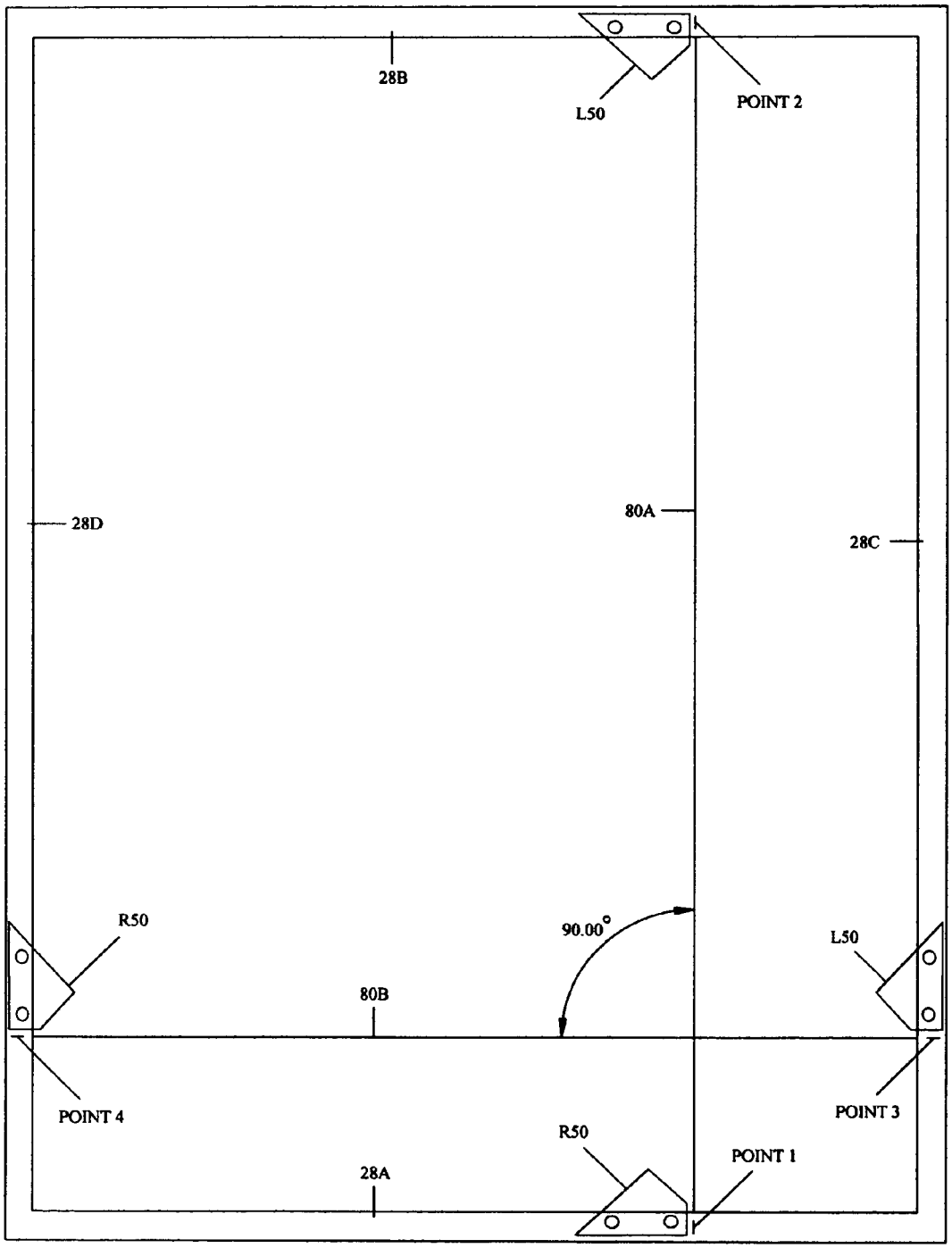
FIG. 49 is a perspective top view of embodiment R50, L50, additional L50, and additional R50 in use for grids at ninety degree angles in relation to the walls.

FIG. 49 is a perspective top view of embodiment R50, L50, additional L50, and additional R50 in use for grids at ninety degree angles in relation to the walls and comprises control line holder R50 attached to the right and next to a main tee 82A (not shown in this view) laid out mark or point one inscribed onto wall angle molding 28A, control line 80A pulled and held taut by control line holder L50 attached to the left and next to a main tee 82A (not shown in this view) laid out mark or point two inscribed onto wall angle molding 28B, additional control line holder L50 attached to the left and next to a cross tee 82B (not shown in this view) laid out mark or point three inscribed onto wall angle molding 28C, control line 80B pulled and held taut by additional control line holder R50 attached to the right and next to a cross tee 82B (not shown in this view) laid out mark or point four inscribed onto wall angle molding 28D.

Figure 50:
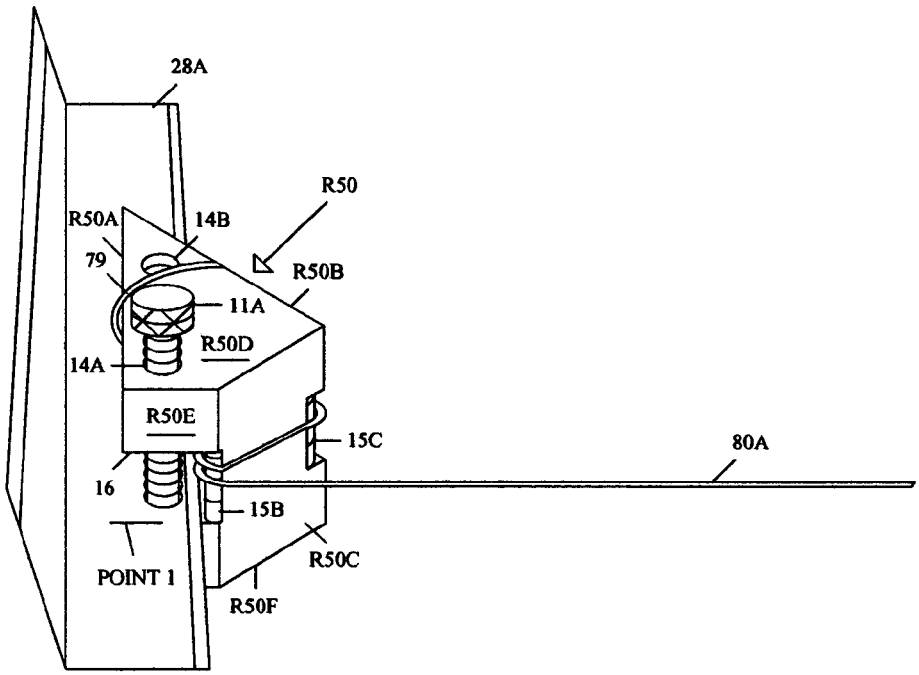
FIG. 50 is a perspective side view of embodiment R50 in use with grids at ninety degree angles in relation to the walls seen slightly from the top.

FIG. 50 is a perspective side view of embodiment R50 in use with grids at ninety degree angles in relation to the walls seen slightly from the top and comprises a squared side R50A, a groove 16 formed within the squared side R50A, a 45 degree angle grid aligning side R50B, a group of three rounded corners 15A (not seen), 15B formed by groove 16 and 15C, a side R50C, a top R50D, a 90 degree angle grid aligning side R50E aligned to the right of point 1 which is inscribed onto wall angle molding 28A, a bottom side R50F (not seen), two threaded holes 14A and 14B formed through top R50D to groove 16, a thumb screw 11A screwed into threaded hole 14A that is applying a clamping force onto a piece of wall angle molding 28A against the bottom of groove 16, a loop 79 about 31.75 mm. in diameter tied from a roll of control line 80A which is hooked from groove 16 and the top R50D, control line 80A which is wrapped around counter clock wise groove 16, rounded corner 15B, side R50C, rounded corner 15C, 45 degree angle grid aligning side R50B, rounded corner 15A (not seen in this view), groove 16, rounded corner 15B and directed towards point 2.

Figure 51:
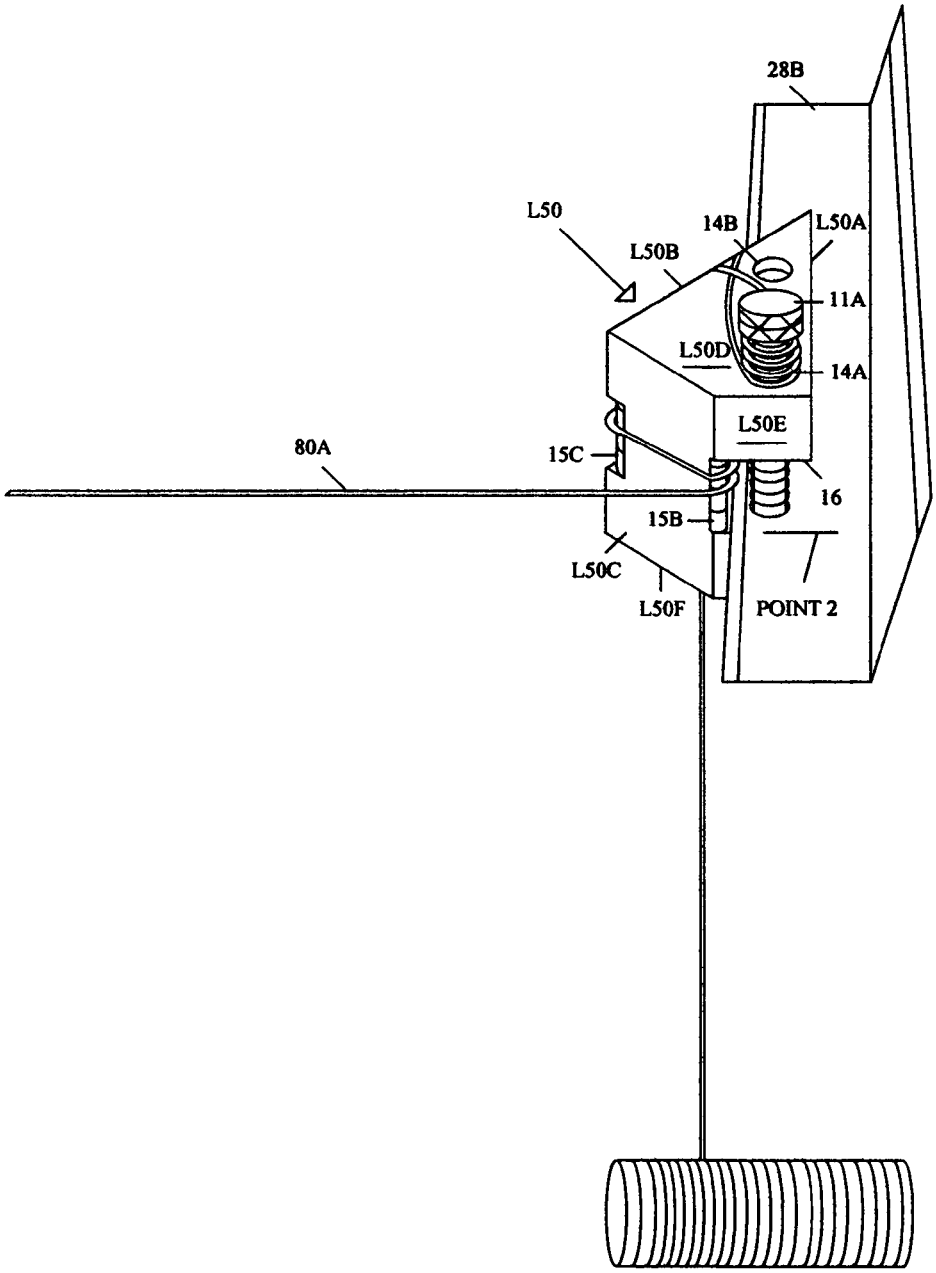
FIG. 51 is a perspective side view of embodiment L50 in use with grids at ninety degree angles in relation to the walls seen slightly from the top.

FIG. 51 is a perspective side view of embodiment L50 in use with grids at ninety degree angles in relation to the walls seen slightly from the top and comprises a squared side L50A, a groove 16 formed within the squared side L50A, a 45 degree angle grid aligning side L50B, a group of three rounded corners 15A (not seen), 15B formed by groove 16 and 15C, a side L50C, a top L50D, a 90 degree angle grid aligning side L50E aligned to the left of point 2 which is inscribed onto wall angle molding 28B, a bottom side L50F (not seen), two threaded holes 14A and 14B formed through top L50D to groove 16, a thumb screw 11A screwed into threaded hole 14A that is applying a clamping force onto a piece of wall angle molding 28B against the bottom of groove 16, control line 80A which is wrapped around counter clock wise rounded corner 15B, groove 16 formed within the squared side L50A, rounded corner 15A (not seen in this view), 45 degree angle grid aligning side L50B, rounded corner 15C, side L50C, rounded corner 15B, groove 16 formed within the squared side L50A, 45 degree angle grid aligning side L50B, pulled taut and wrapped around counter clock wise three times the remainder top section of the thumb screw 11A, returned and let hung next to 45 degree angle grid aligning side L50B.

Figure 52:
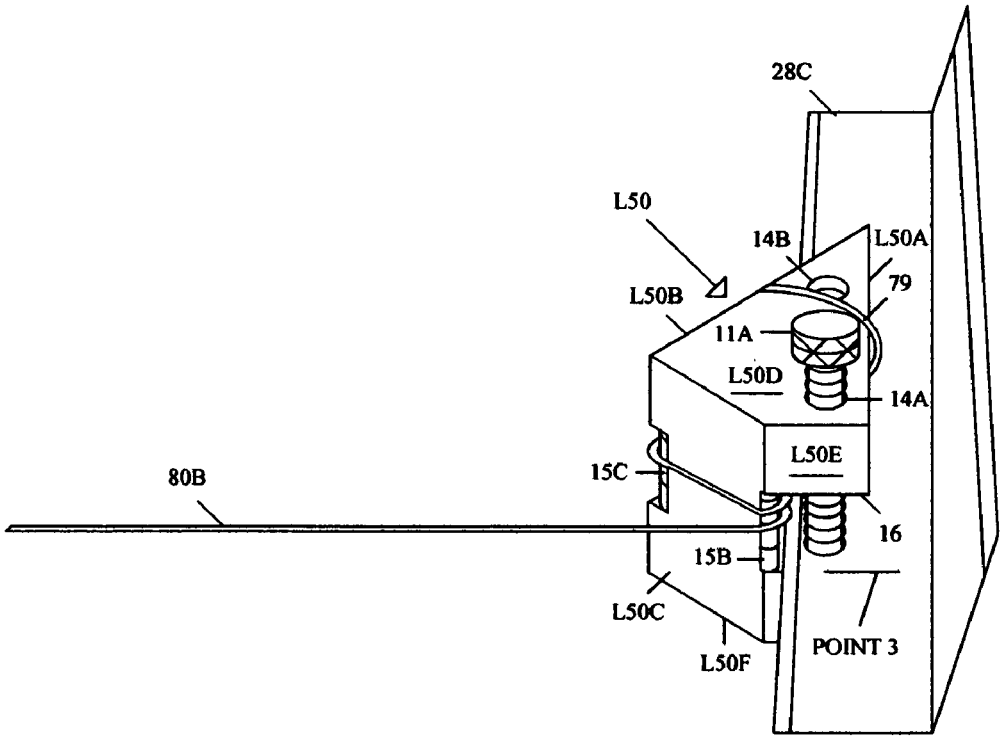
FIG. 52 is a perspective side view of additional embodiment L50 in use with grids at ninety degree angles in relation to the walls seen slightly from the top.

FIG. 52 is a perspective side view of additional embodiment L50 in use with grids at ninety degree angles in relation to the walls seen slightly from the top and comprises a squared side L50A, a groove 16 formed within the squared side L50A, a 45 degree angle grid aligning side L50B, a group of three rounded corners 15A (not seen), 15B formed by groove 16 and 15C, a side L50C, a top L50D, a 90 degree angle grid aligning side L50E aligned to the left of point 3 which is inscribed onto wall angle molding 28C, a bottom side L50F (not seen), two threaded holes 14A and 14B formed through top L50D to groove 16, a thumb screw 11A screwed into threaded hole 14A that is applying a clamping force onto a piece of wall angle molding 28C against the bottom of groove 16, a loop 79 about 31.75 mm. in diameter tied from a roll of control line 80B which is hooked from groove 16 and the top L50D, control line 80B which is wrapped around clock wise groove 16, rounded corner 15B, side L50C, rounded corner 15C, 45 degree angle grid aligning side R50B, rounded corner 15A (not seen in this view), groove 16, rounded corner 15B and directed towards point 4.

Figure 53:
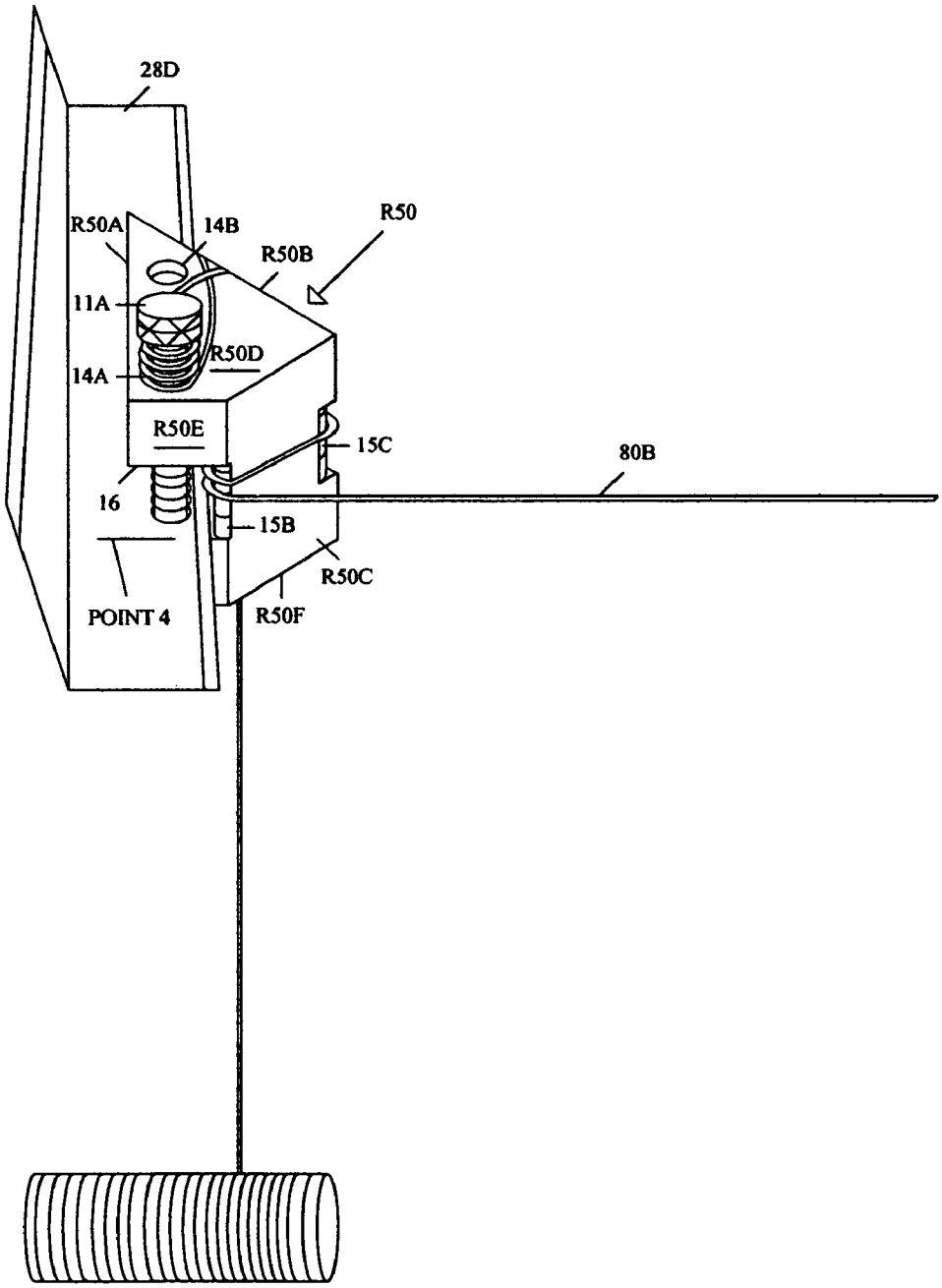
FIG. 53 is a perspective side view of additional embodiment R50 in use with grids at ninety degree angles in relation to the walls seen slightly from the top.

FIG. 53 is a perspective side view of additional embodiment R50 in use with grids at ninety degree angles in relation to the walls seen slightly from the top and comprises a squared side R50A, a groove 16 formed within the squared side R50A, a 45 degree angle grid aligning side R50B, a group of three rounded corners 15A (not seen), 15B formed by groove 16 and 15C, a side R50C, a top R50D, a 90 degree angle grid aligning side R50E aligned to the right of point 4 which is inscribed onto wall angle molding 28D, a bottom side R50F (not seen), two threaded holes 14A and 14B formed through top R50D to groove 16, a thumb screw 11A screwed into threaded hole 14A that is applying a clamping force onto a piece of wall angle molding 28D against the bottom of groove 16, control line 80B which is wrapped around clock wise rounded corner 15B, groove 16 formed within the squared side R50A, rounded corner 15A (not seen in this view), 45 degree angle grid aligning side R50B, rounded corner 15C, side R50C, rounded corner 15B, groove 16 formed within the squared side R50A, 45 degree angle grid aligning side R50B, pulled taut and wrapped around counter clock wise three times the remainder top section of the thumb screw 11A, returned and let hung next to 45 degree angle grid aligning side L50B.

Figure 54:
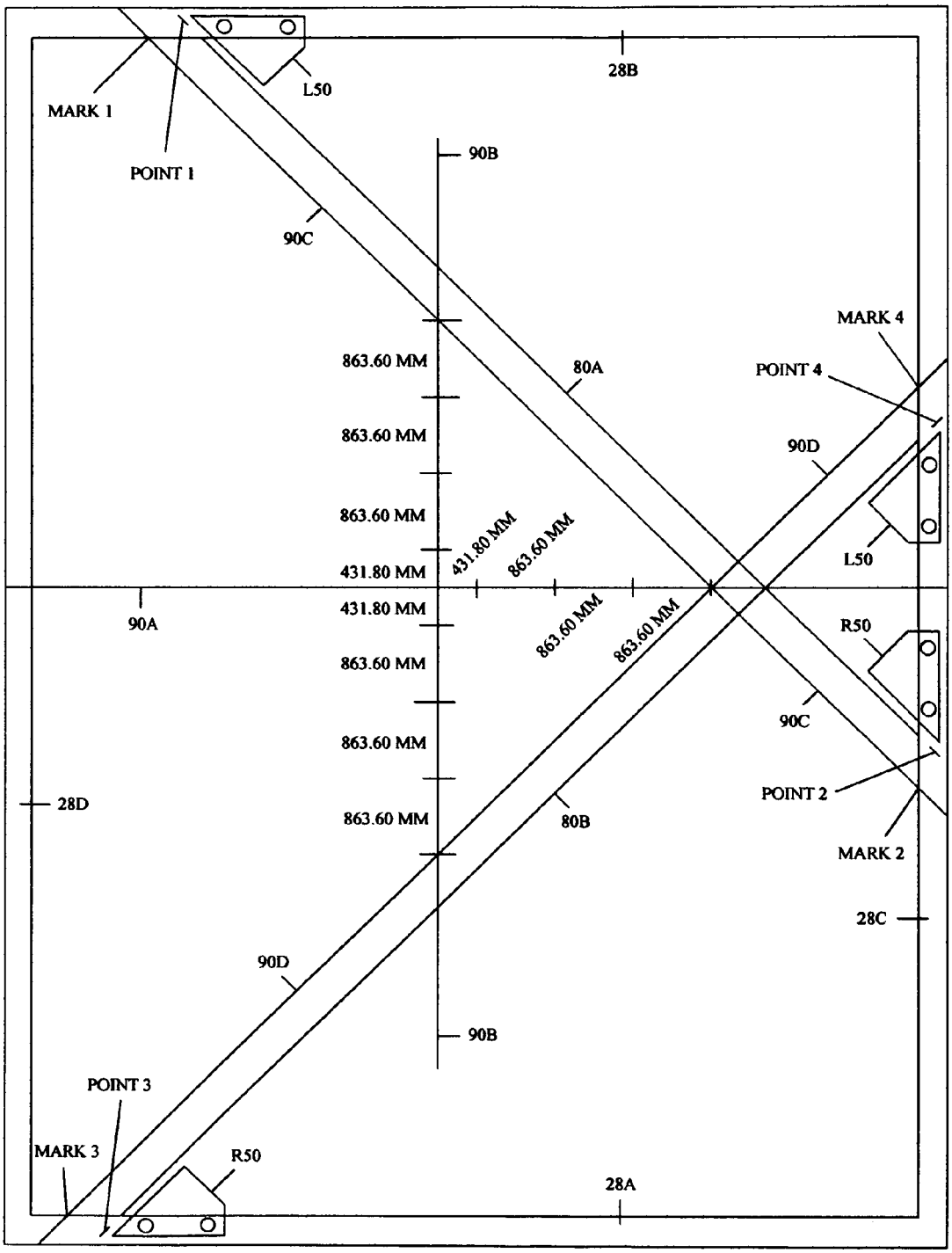
FIG. 54 is a perspective top view of embodiment L50, R50, additional R50 and additional L50 in use with grids at forty-five degree angles in relation to the walls.

FIG. 54 is a perspective top view of embodiment L50, R50, additional R50 and additional L50 in use with grids at forty-five degree angles in relation to the walls (not shown) and comprises a chalk line 90A snapped on the floor in the middle of the room, a chalk line 90B snapped on the floor in the center of and perpendicular to chalk line 90A, graduations marked in one direction on chalk line 90A starting from where chalk line 90A and chalk line 90B intersect are 431.80 mm. followed by three times graduations of 863.60 mm., graduations marked in opposite directions on chalk line 90B starting from where chalk line 90B and 90A intersect are 431.80 mm. followed by three times graduations of 863.60 mm., chalk line 90C snapped on the floor and joining the last marked graduation of 863.60 mm. on chalk line 90A and one last marked graduation of 863.60 mm. on chalk line 90B and extending to wall angle moldings 28B and 28C thus creating mark 1 transferred from the floor onto wall angle molding 28B and mark 2 transferred from the floor onto wall angle molding 28C, chalk line 90D snapped on the floor and joining the last marked graduation of 863.60 mm. on chalk line 90A and one opposite last marked graduation of 863.60 mm. on chalk line 90B and extending to wall angle moldings 28A and 28C thus creating mark 3 transferred from the floor onto wall angle molding 28A and mark 4 transferred from the floor onto wall angle molding 28C, control line holder L50 attached to the right and next to a main tee 82A (not shown in this view) laid out mark or point one inscribed onto wall angle molding 28B, control line 80A pulled and held taut by control line holder R50 attached to the left and next to a main tee 82A (not shown in this view) laid out mark or point two inscribed onto wall angle molding 28C, additional control line holder R50 attached to the left and next to a cross tee 82B (not shown in this view) laid out mark or point three inscribed onto wall angle molding 28A, control line 80B pulled and held taut by control line holder L50 attached to the right and next to a cross tee 82B (not shown in this view) laid out mark or point four inscribed onto wall angle molding 28C.

Figure 55:
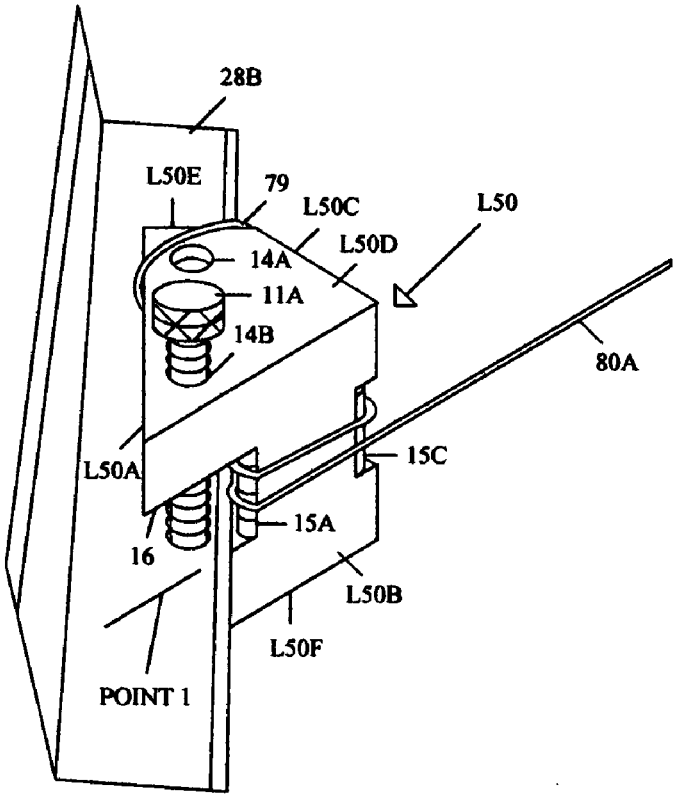
FIG. 55 is a perspective side view of the second embodiment L50 in use with one screw seen slightly from the top for use with grids at forty-five degree angles in relation to the walls.

FIG. 55 is a perspective side view of the second embodiment L50 in use with one screw 11A seen slightly from the top for use with grids at forty-five degree angles in relation to the walls and comprises a squared side L50A, a groove 16 formed within the squared side L50A, a 45 degree angle grid aligning side L50B aligned to the right of point 1 which is inscribed onto wall angle molding 28B, a group of three rounded corners 15A, 15B (not seen) formed by groove 16 and 15C, a side L50C, a top L50D, a 90 degree angle grid aligning side L50E, a bottom side L50F (not fully seen in this view), two threaded holes 14A and 14B formed through top L50D to groove 16, the thumb screw 11A screwed into threaded hole 14B that is applying a clamping force onto a piece of wall angle molding 28B against the bottom of groove 16, a loop 79 about 31.75 mm. in diameter tied from control line 80A which is hooked from groove 16 and the top L50D, control line 80A which is wrapped around counter clock wise groove 16, rounded corner 15A, 45 degree angle grid aligning side L50B, rounded corner 15C, side L50C, rounded corner 15B (not seen), groove 16, rounded corner 15A and ending running along the 45 degree angle grid aligning side L50B and directed towards point 2.

Figure 56:
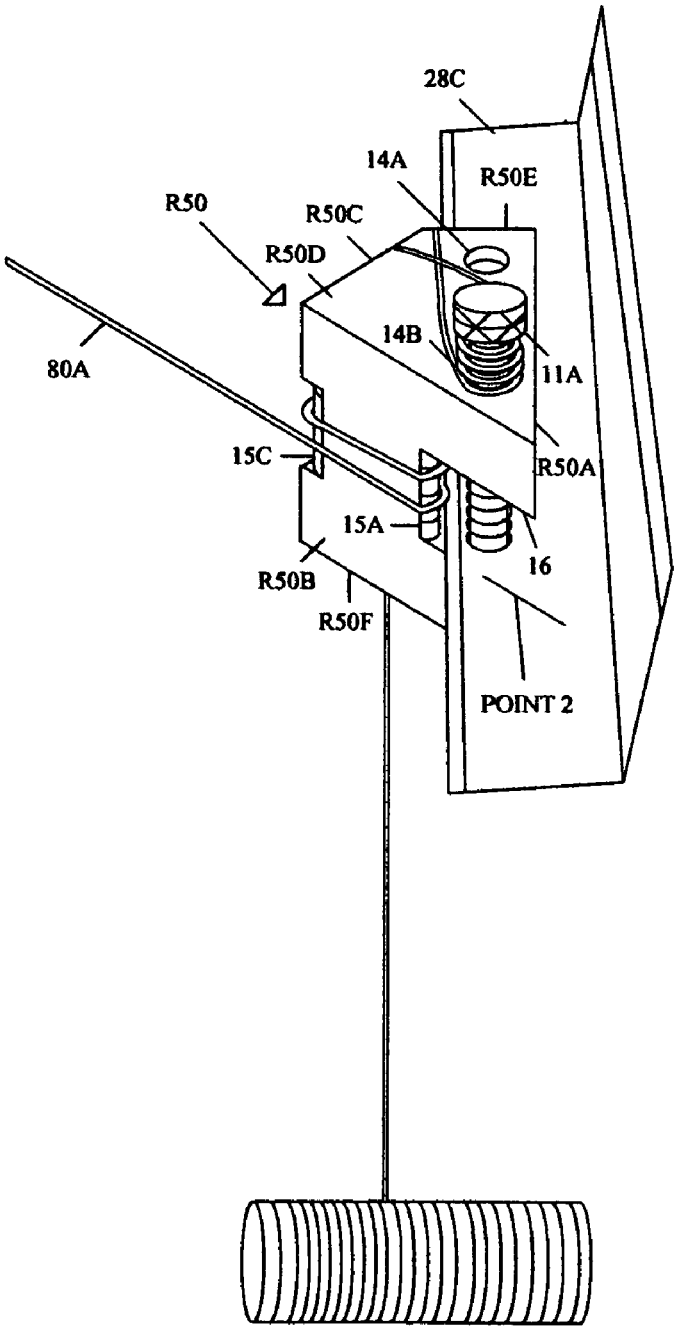
FIG. 56 is a perspective side view of the second embodiment R50 in use with one screw seen slightly from the top for use with grids at forty-five degree angles in relation to the walls.

FIG. 56 is a perspective side view of the second embodiment R50 in use with one screw 11A seen slightly from the top for use with grids at forty-five degree angles in relation to the walls and comprises a squared side R50A, a groove 16 formed within the squared side R50A, a 45 degree angle grid aligning side R50B aligned to the left of point 2 which is inscribed onto wall angle molding 28C, a group of three rounded corners 15A, 15B (not seen) formed by groove 16 and 15C, a side R50C, a top R50D, a 90 degree angle grid aligning side R50E, a bottom side R50F (not seen), two threaded holes 14A and 14B formed through top R50D to groove 16, the thumb screw 11A screwed into threaded hole 14B that is applying a clamping force onto a piece of wall angle molding 28C against the bottom of groove 16, line 80A which is wrapped around counter clock wise 45 degree angle grid aligning side R50B, rounded corner 15A, groove 16 formed within the squared side R50A, rounded corner 15B (not seen), side R50C (not fully seen), rounded corner 15C, 45 degree angle grid aligning side R50B, groove 16 formed within the squared side R50A, 90 degree angle grid aligning side R50E, pulled taut and wrapped around counter clock wise three times the remainder top section of the thumb screw 11A, returned and let hung next to side R50C (not fully seen).

Figure 57:
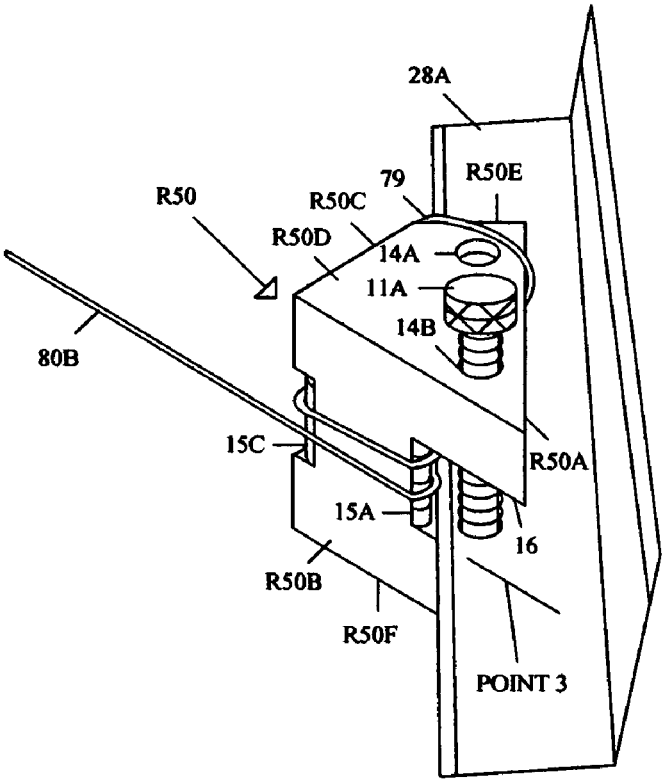
FIG. 57 is a perspective side view of additional embodiment R50 in use with one screw seen slightly from the top for use with grids at forty-five degree angles in relation to the walls.

FIG. 57 is a perspective side view of additional embodiment R50 in use with one screw 11A seen slightly from the top for use with grids at forty-five degree angles in relation to the walls and comprises a squared side R50A, a groove 16 formed within the squared side R50A, a 45 degree angle grid aligning side R50B aligned to the left of point 3 which is inscribed onto wall angle molding 28A, a group of three rounded corners 15A, 15B (not seen) formed by groove 16 and 15C, a side R50C (not fully seen), a top R50D, a 90 degree angle grid aligning side R50E (not fully seen), a bottom side R50F (not seen), two threaded holes 14A and 14B formed through top R50D to groove 16, the thumb screw 11A screwed into threaded hole 14B that is applying a clamping force onto a piece of wall angle molding 28A against the bottom of groove 16, a loop 79 about 31.75 mm. in diameter tied from a roll of control line 80B which is hooked from groove 16 and the top R500, control line 80B which is wrapped around clock wise groove 16, rounded corner 15A, 45 degree angle grid aligning side R50B, rounded corner 15C, side R50C (not fully seen), rounded corner 15B (not seen), groove 16, rounded corner 15A and ending running along the 45 degree angle grid aligning side R50B and directed towards point 4.

Figure 58:
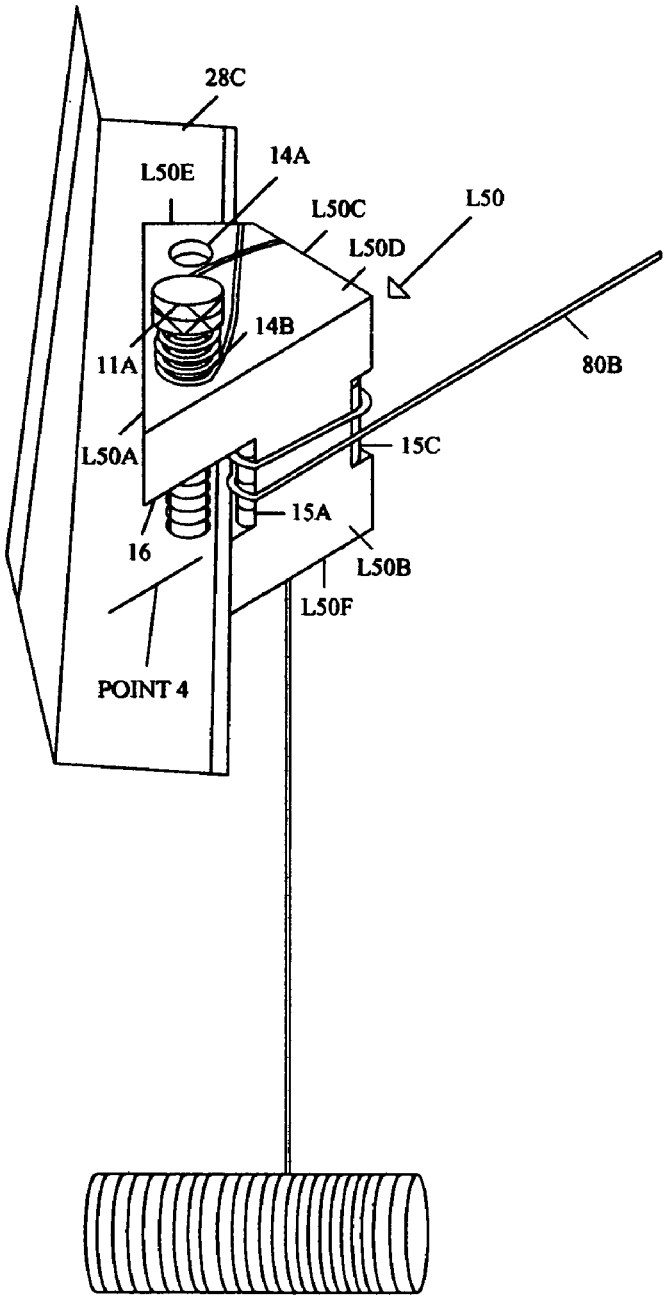
FIG. 58 is a perspective side view of additional embodiment L50 in use with one screw seen slightly from the top for use with grids at forty-five degree angles in relation to the walls.

FIG. 58 is a perspective side view of additional embodiment L50 in use with one screw 11A seen slightly from the top for use with grids at forty-five degree angles in relation to the walls and comprises a squared side L50A, a groove 16 formed within the squared side L50A, a 45 degree angle grid aligning side L50B aligned to the right of point 4 which is inscribed onto wall angle molding 28C, a group of three rounded corners 15A, 15B (not seen) formed by groove 16 and 15C, a side L50C (not fully seen), a top L50D, a 90 degree angle grid aligning side L50E (not fully seen), a bottom side L50F (not seen), two threaded holes 14A and 14B formed through top L50D to groove 16, the thumb screw 11A screwed into threaded hole 14B that is applying a clamping force onto a piece of wall angle molding 28C against the bottom of groove 16, control line 80B which is wrapped around clock wise 45 degree angle grid aligning side L50B, rounded corner 15A, groove 16 formed within the squared side L50A, rounded corner 15B (not seen in this view), side L50C (not fully seen), rounded corner 15C, 45 degree angle grid aligning side L50B, rounded corner 15A, groove 16 formed within the squared side L50A, 90 degree angle grid aligning side L50E, pulled taut and wrapped around counter clock wise three times the remainder top section of the thumb screw 11A, returned and let hung next to side L50C.

To enable those skilled in the art to fully understand and practice my new and improved method of installing or setting the control lines, I will proceed to give an example as to how a suspended grid framer can use the control line holders R50, L50, additional L50, and additional R50 to frame a 609.6 mm.×1219.2 mm. or 2'×4' 90 degree angle suspended grid:

1. Referring to FIGS. 49 through 53 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed height and label them as such.
3. Layout location of control lines 80A and 80B on wall angle moldings 28A, 28B, 28C, and 28D making sure all the marks are above the finished ceiling so no one will be able to see them.
4. The location of the control line 80A that runs parallel to the main tee is determined by adding the border dimension plus ½ the thickness of the main tee.
5. Make sure the thumb screws 11A are threaded into holes 14A but not into squared groove 16.
6. See FIG. 50, control line for main tee 82A (not shown): Grab a roll of control line 80A and tie a loop 79 about 31.75 mm. in diameter at the end, with the other hand take control line holder R50 with the thumb screw 11A facing up, next, hook the loop 79 from groove 16 and the top R50D wrap control line 80A around counter clock wise groove 16, rounded corner 15B, side R50C, rounded corner 15C, 45 degree angle grid aligning side R50B, rounded corner 15A (not seen in this view), groove 16, and rounded corner 15B.
7. See FIG. 50, go to main tee 82A (not shown) laid out mark or point 1 and as you face this laid out mark or point 1 attach control line holder R50 to your right of this laid out mark or point 1 by first inserting the wall angle molding 28A into the groove 16 formed within the squared side R50A, aligning 90 degree angle grid aligning side R50E to your right of point 1, followed by firmly tightening the thumb screw 11A.
8. See FIG. 51, roll out control line 80A and go to the other laid out mark or point 2 for the main tee 82A (not shown) inscribed onto wall angle molding 28B, take control line holder L50, wrap the control line 80A around counter clock wise rounded corner 15B, groove 16 formed within the squared side L50A, rounded corner 15A (not seen in this view), 45 degree angle grid aligning side L50B, rounded corner 15C, side L50C, rounded corner 15B, groove 16 formed within the squared side L50A, 45 degree angle grid aligning side L50B.
9. See FIG. 51, as you face the laid out mark or point 2 for the main tee 82A (not shown), attach control line holder L50 to your left of this laid out mark or point 2 by first inserting the wall angle molding 28B into the groove 16 formed within the squared side L50A, aligning 90 degree angle grid aligning side L50E to your left of point 2, followed by firmly tightening the thumb screw 11A.
10. See FIG. 51, the control line 80A must not be trapped against the groove 16 by the wall angle molding 28B.
11. See FIG. 51, next, with your right hand grab the control line 80A coming from holder R50 and pull on it while at the same time with your left hand you pull at the previously wrapped control line 80A on the holder L50, do this until you are satisfied with the tautness of the line, finally with the line that is on your left hand wrap it around counter clock wise three times the remainder top section of the thumb screw 11A, return the line and let it hang next to aligning side L50B, by using the control line's 80A pulling force and wrapping the control line 80A counter clock wise the remainder top section of the thumb screw 11A locks the control line 80A and prevents it from becoming loose.
12. To adjust this control line 80A, first the line must be unwrapped from the screw 11A to relieve the pulling pressure from the taut control line, second, unscrew the thumb screw 11A four turns, then move the control line holder L50 to either side and firmly tighten the screw back, repeat step 11 over again.
13. The location of the control line 80B that runs perpendicular to the main tee is determined by adding the border dimension plus ½ the thickness of the cross tee.
14. See FIG. 52, control line for cross tee 82B (not shown): Grab a roll of control line 80B and tie a loop 79 about 31.75 mm. in diameter at the end, with the other hand take additional control line holder L50 with the thumb screw 11A facing up, next, hook the loop 79 from groove 16 and the top L50D, wrap control line 80B around clock wise groove 16, rounded corner 15B, side L50C, rounded corner 15C, 45 degree angle grid aligning side R50B, rounded corner 15A (not seen), groove 16, rounded corner 15B.
15. See FIG. 52, go to cross tee 82B (not shown) laid out mark or point 3 and as you face this laid out mark attach additional control line holder L50 to your left of this laid out mark or point 3 by first inserting the wall angle molding 28C into the groove 16 formed within the squared side L50A, aligning 90 degree angle grid aligning side L50E to your left of point 3, followed by firmly tightening the thumb screw 11A.

16. See FIG. 53, roll out control line 80B and go to the other laid out mark or point 4 for the cross tee 82B (not shown) inscribed onto wall angle molding 28D, take additional control line holder R50, wrap the control line 80B around clock wise rounded corner 15B, groove 16 formed within the squared side R50A, rounded corner 15A (not seen in this view), 45 degree angle grid aligning side R50B, rounded corner 15C, side R50C, rounded corner 15B, groove 16 formed within the squared side R50A, 45 degree angle grid aligning side R50B.
17. See FIG. 53, as you face the laid out mark or point 4 for the cross tee 82B (not shown), attach control line holder R50 to your right of this laid out mark or point 4 by first inserting the wall angle molding 28D into the groove 16 formed within the squared side R50A, aligning 90 degree angle grid aligning side R50E to your right of point 4, followed by firmly tightening the thumb screw 11A.
18. See FIG. 53, the control line 80B must not be trapped against the groove 16 by the wall angle molding 28D.
19. See FIG. 53, next, with your left hand grab the control line 80B coming from additional holder L50 and pull on it while at the same time with your right hand you pull at the previously wrapped control line 80B on the additional holder R50, do this until you are satisfied with the tautness of the line, finally, with the line that is on your right hand wrap it around counter clock wise three times the remainder top section of the thumb screw 11A, return the line and let it hang next to the 45 degree angle grid aligning side R50B, by using the control line's 80B pulling force and wrapping the control line 80B counter clock wise the remainder top section of the thumb screw 11A locks the control line 80B and prevents it from becoming loose.
20. To adjust this control line 80B unwrap the line from the screw 11A to relieve the pulling pressure from the taut control line 80B, unscrew the thumb screw 11A four turns then move the additional control line holder R50 to either side and firmly tighten the screw back, repeat step 19 over again.
21. You have successfully installed, or set the control lines for a 90 degree angle grid.

Using control line holders L50, R50, additional R50, and additional L50 for 609.6 mm.×609.6 mm. or 2'×2' suspended-ceiling grids at 45 degree angle:

1. Referring to FIGS. 54 through 58 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed ceiling's height and label them as such.
3. On the floor of the room establish and snap a chalk line 90A in the middle of the room, at the center of this line 90A establish and snap a perpendicular chalk line 90B making sure it is a perfect 90 degree angle.
4. From this center point where chalk lines 90A and chalk line 90B intersect mark graduations of 431.8 mm. in three directions, then, from the marked graduations of 431.8 mm. measure and mark graduations of 863.6 mm. three times.
5. Snap a third chalk line 90C on the floor joining the last marked graduation of 863.60 mm. on chalk line 90A and one last marked graduation of 863.60 mm. on chalk line 90B extending to wall angle moldings 28B and 28C.
6. Snap a fourth chalk line 90D on the floor joining the last marked graduation of 863.60 mm. on chalk line 90A and one opposite last marked graduation of 863.60 mm. on chalk line 90B extending to wall angle moldings 28A and 28C.
7. You have created 4 new marks, mark 1, mark 2, mark 3, and mark 4, transfer these 4 marks from the floor up to the wall moldings 28B, 28C, 28A, and 28C.
8. Layout location of control lines 80A and 80B on wall moldings 28B, 28C, 28A, and 28C making sure all the marks are above the finished ceiling so no one will be able to see them.
9. The location of the control line 80A that runs parallel to the main tee 82A (not shown) is determined by inscribing ½ the thickness of the main tee parallel and to the right of mark 1 transferred from the floor onto wall angle molding 28B thus creating point 1, and parallel and to the left of mark 2 transferred from the floor onto wall angle molding 28C thus creating point 2.
10. The location of the control line 80B that runs parallel to the cross tee 82B (not shown) is determined by inscribing ½ the thickness of the cross tee parallel and to the left of mark 3 transferred from the floor onto wall angle molding 28A thus creating point 3, and parallel and to the right of mark 4 transferred from the floor onto wall angle molding 28C thus creating point 4.
11. Make sure the thumb screws 11A are threaded into holes 14B but not into groove 16.
12. See FIG. 55, take a roll of control line 80A and tie a loop 79 at the end, about 31.75 mm. in diameter, take control line holder L50 and hook the loop 79 from groove 16 and the top L50D, wrap control line 80A around counter clock wise groove 16, rounded corner 15A, 45 degree angle grid aligning side L50B, rounded corner 15C, side L50C, rounded corner 15B (not seen), groove 16, rounded corner 15A and ending running along the 45 degree angle grid aligning side L50B.
13. See FIG. 55, go to point 1 inscribed onto wall angle molding 28B and as you face this main tee 82A (not shown) point 1 attach control line holder L50 to your right of this point 1 by first inserting the wall angle molding 28B into groove 16 formed within squared side L50A, aligning 45 degree angle grid aligning side L50B to your right of point 1, followed by firmly tightening the thumb screw 11A.
14. See FIG. 56, roll out control line 80A and go to point 2, take control line holder R50, wrap the control line 80A around counter clock wise 45 degree angle grid aligning side R50B, rounded corner 15A, groove 16 formed within the squared side R50A, rounded corner 15B (not seen), side R50C (not fully seen), rounded corner 15C, 45 degree angle grid aligning side R50B, groove 16 formed within the squared side R50A, 90 degree angle grid aligning side R50E.
15. See FIG. 56, as you face this main tee 82A (not shown) point 2 attach control line holder R50 to your left of this point 2 by first inserting the wall angle molding 28C into groove 16, aligning 45 degree angle grid aligning side R50B to your left of point 2, followed by firmly tightening the thumb screw 11A.
16. See FIG. 56, the control line must not be trapped against the groove 16 by the wall angle molding 28C.
17. See FIG. 56, next, with your right hand grab the control line 80A coming from holder L50 and pull on it while at the same time with your left hand you pull at the previously wrapped line on holder R50, do this until you are satisfied with the tautness of the line, finally with the line that is on your left hand wrap it around counter clock wise three times the remainder top section of the thumb screw 11A, return the line and let it hang next to side R50C, by using the control line's 80A pulling force and wrapping the control line 80A counter clock wise the remainder top section of the thumb screw 11A locks the control line 80A and prevents it from becoming loose.

18. See FIG. 57, control line for cross tee 82B (not shown), grab a roll of control line 80B and tie a loop 79 about 31.75 mm. in diameter at the end, with the other hand take additional control line holder R50 with the thumb screw 11A facing up, next, hook the loop 79 from groove 16 and the top R50D, wrap control line 80B around clock wise groove 16, rounded corner 15A, 45 degree angle grid aligning side R50B, rounded corner 15C, side R50C (not fully seen), rounded corner 158 (not seen), groove 16, rounded corner 15A and ending running along the 45 degree angle grid aligning side R50B.
19. See FIG. 57, take additional holder R50 and go to point 3, and as you face point 3, attach control line holder R50 to your left of this point 3 by first inserting the wall angle molding 28A into groove 16, aligning 45 degree angle grid aligning side R50B to your left of point 3, followed by firmly tightening the thumb screw 11A.
20. See FIG. 58, roll out control line 80B and go to point 4, take control line holder L50 and wrap control line 80B clock wise 45 degree angle grid aligning side L50B, rounded corner 15A, groove 16 formed within the squared side L50A, rounded corner 15B (not seen in this view), side L50C (not fully seen), rounded corner 15C, 45 degree angle grid aligning side L50B, rounded corner 15A, groove 16 formed within the squared side L50A, 90 degree angle grid aligning side L50E.
21. See FIG. 58, as you face this cross tee 82B (not shown) point 4 attach control line holder L50 to your right of this point 4 by first inserting the wall angle molding 28C into the groove 16, aligning 45 degree angle grid aligning side L50B to your right of point 4, followed by firmly tightening the thumb screw 11A.
22. See FIG. 58, the control line 80B must not be trapped against the groove 16 by the wall angle molding 28C.
23. See FIG. 58, next, with your left hand grab the control line 80B coming from holder R50 and pull on it while at the same time with your right hand you pull at the previously wrapped line on holder L50, do this until you are satisfied with the tautness of the line, finally, with the line that is on your right hand wrap it around counter clock wise three times the remainder top section of the thumb screw 11A, return the line and let it hang next to side L50C, by using the control line's 80B pulling force and wrapping the control line 80B counter clock wise the remainder top section of the thumb screw 11A locks the control line 80B and prevents it from becoming loose.
24. You have set, or installed the control lines for a 45 degree angle grid.

DETAILED DESCRIPTION

FIGS. 59 Through 76—Third Embodiment

Figure 59:
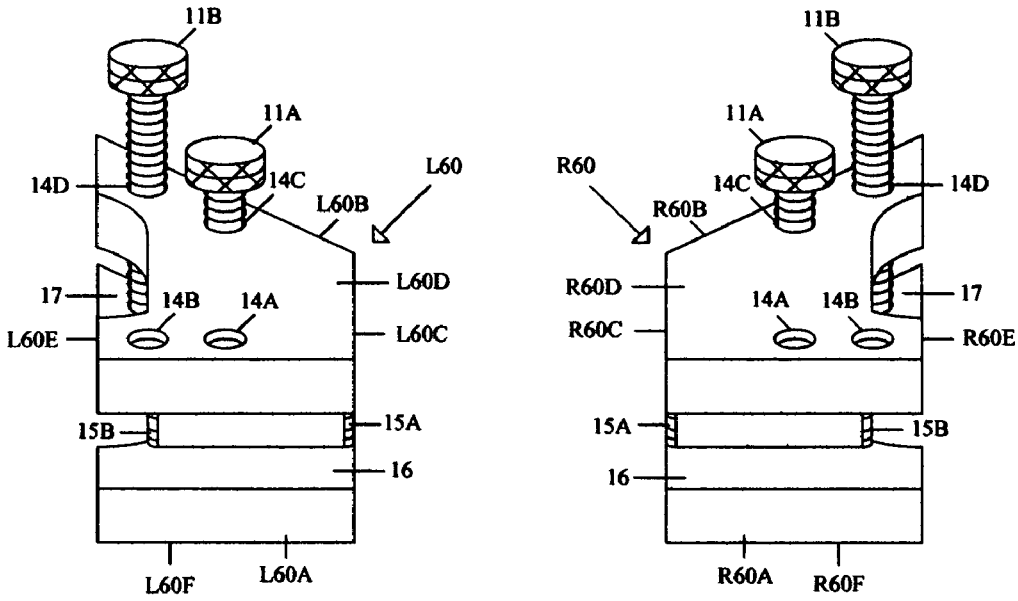
FIG. 59 is a perspective view of a third embodiment L60 and R60 with two screws each seen slightly from the top for use with grids at forty-five degree angles in relation to the walls.

FIG. 59 is a perspective view of a third embodiment L60 and R60 with two thumb screws 11A and 11B each seen slightly from the top for use with grids at forty-five degree angles in relation to the walls, control line holder L60 comprises a squared side L60A, a groove 16 formed within the squared side L60A, an angled side L60B, an angled groove 17 (not fully seen) formed within angled side L60B, a group of three rounded inside corners 15A, 15B, and 15C formed by grooves 16 and 17 (rounded corner 15C is not seen), a right side L60C, a top L60D, an aligning side L60E, a bottom side L60F (not seen), and four threaded holes 14A, 14B, 14C, and 14D formed through top L60D to grooves 16 and 17, the thumb screws 11A and 11B are screwed into threaded holes 14C and 14D, control line holder R60 comprises a squared side R60A, a groove 16 formed within the squared side R60A, an angled side R60B, an angled groove 17 formed within angled side R60B (not fully seen), a group of three rounded inside corners 15A, 15B, and 15C formed by grooves 16 and 17 (rounded corner 15C not seen), a left side R60C, a top R60D, an aligning side R60E, a bottom side R60F (not seen), four threaded holes 14A, 14B, 14C, and 14D formed through top R60D to grooves 16 and 17, the thumb screws 11A and 11B are screwed into threaded holes 14C and 14D.

Figure 60:
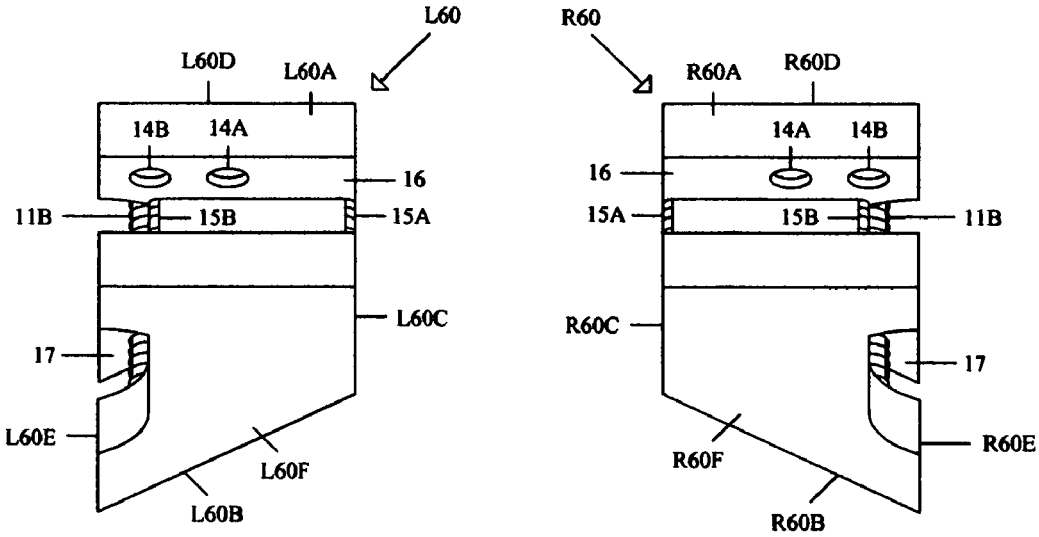
FIG. 60 is a perspective view of the third embodiment L60 and R60 with two screws (not fully seen) each seen slightly from the bottom for use with grids at forty-five degree angles in relation to the walls.

FIG. 60 is a perspective view of the third embodiment L60 and R60 with two screws 11A (not seen) and 11B (not fully seen) each seen slightly from the bottom for use with grids at forty-five degree angles in relation to the walls, control line holder L60 comprises a squared side L60A, a groove 16 formed within the squared side L60A, an angled side L60B, an angled groove 17 (not fully seen) formed within angled side L60B, a group of three rounded inside corners 15A, 15B, and 15C formed by grooves 16 and 17 (rounded corner 15C not seen), a right side L60C, a top L60D, an aligning side L60E, a bottom side L60F, and four threaded holes 14A, 14B, 14C (not seen), and 14D (not seen), the thumb screws 11A (not seen) and 11B (not fully seen) are screwed into threaded holes 14C (not seen) and 14D (not seen), control line holder R60 comprises a squared side R60A, a groove 16 formed within the squared side R60A, an angled side R60B, an angled groove 17 formed within angled side R60B (not fully seen), a group of three rounded inside corners 15A,15B, and 15C formed by grooves 16 and 17 (rounded corner 15C is not seen), a left side R60C, a top R60D, an aligning side R60E, a bottom side R60F, four threaded holes 14A,14B, 14C (not seen), and 14D (not seen), the thumb screws 11A (not seen) and 11B (not fully seen) are screwed into threaded holes 14C (not seen) and 14D (not seen).

Figure 61:
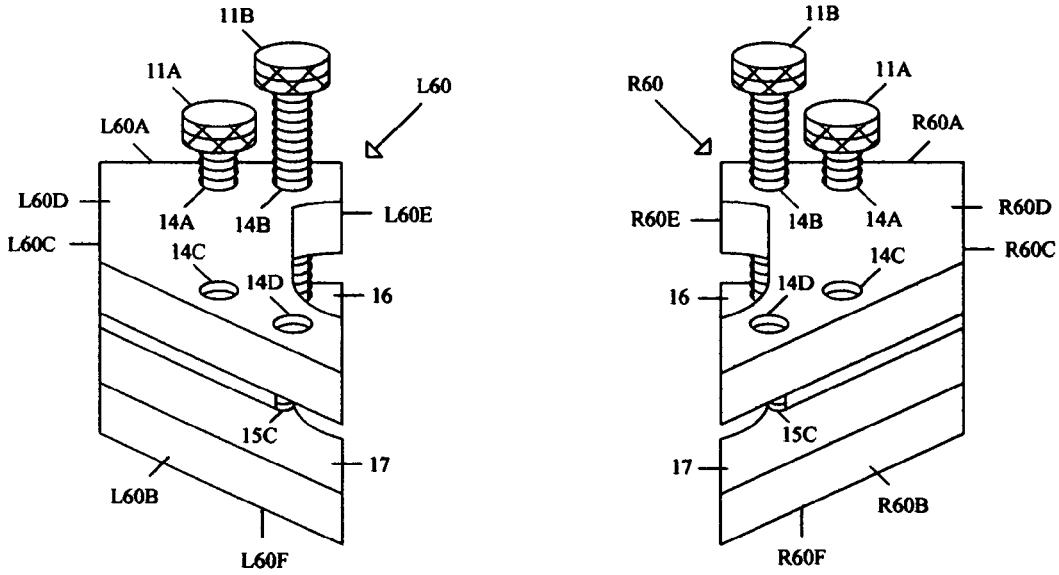
FIG. 61 is a perspective view of the third embodiment L60 and R60 with two screws each seen slightly from the top for use with grids at ninety degree angles in relation to the walls.

FIG. 61 is a perspective view of the third embodiment L60 and R60 with two thumb screws 11A and 11B each seen slightly from the top for use with grids at ninety degree angles in relation to the walls, control line holder L60 comprises a squared side L60A (not fully seen), a groove 16 formed within the squared side L60A (not fully seen), an angled side L60B, an angled groove 17 formed within angled side L60B, a group of three rounded inside corners 15A (not seen), 15B (not seen) and 15C formed by grooves 16 and 17, a right side L60C, a top L60D, an aligning side L60E, a bottom side L60F (not seen), four threaded holes 14A, 14B, 14C and 14D formed through top L60D to grooves 16 and 17, and the thumb screws 11A and 11B are screwed into threaded holes 14A and 14B, control line holder R60 comprises a squared side R60A (not fully seen), a groove 16 formed within the squared side R60A (not fully seen), an angled side R60B, an angled groove 17 formed within angled side R60B, a group of three rounded inside corners 15A (not seen), 15B (not seen) and 15C formed by grooves 16 and 17, a left side R60C, a top R60D, an aligning side R60E, a bottom side R60F (not seen), four threaded holes 14A, 14B, 14C and 14D formed through top R60D to grooves 16 and 17, and the thumb screws 11A and 11B are screwed into threaded holes 14A and 14B.

Figure 62:
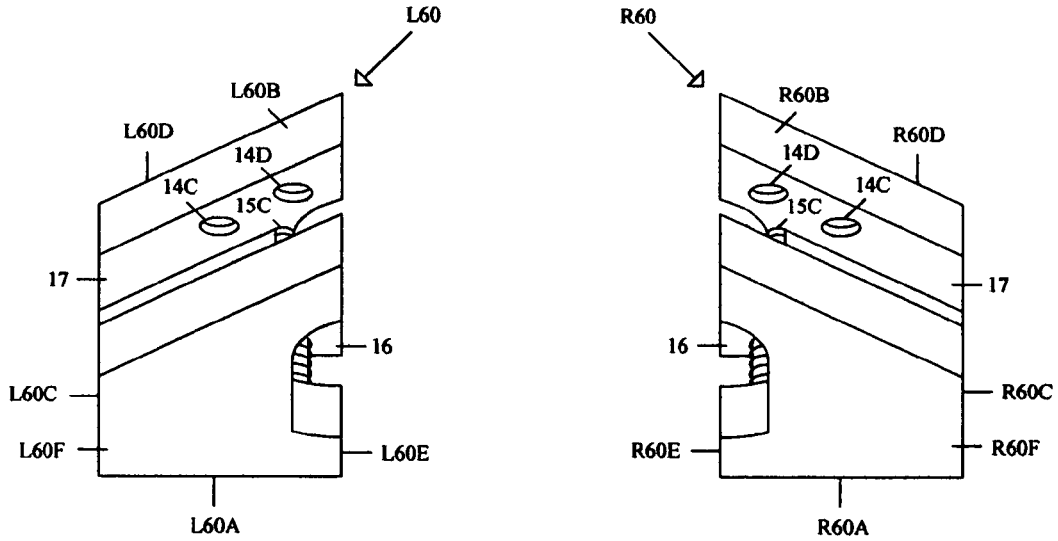
FIG. 62 is a perspective view of the third embodiment L60 and R60 with two screws (not fully seen) each seen slightly from the bottom for use with grids at ninety degree angles in relation to the walls.

FIG. 62 is a perspective view of the third embodiment L60 and R60 with two thumb screws 11A (not seen) and 11B (not fully seen) each seen slightly from the bottom for use with grids at ninety degree angles in relation to the walls, control line holder L60 comprises a squared side L60A (not fully seen), a groove 16 formed within the squared side L60A (not fully seen), an angled side L60B, an angled groove 17 formed within angled side L60B, a group of three rounded inside corners 15A (not seen), 15B (not seen) and 15C formed by grooves 16 and 17, a right side L60C, a top L60D, an aligning side L60E, a bottom side L60F, four threaded holes 14A (not seen), 14B (not seen), 14C and 14D, and the thumb screws 11A (not seen) and 11B (not fully seen) are screwed into threaded holes 14A (not seen) and 14B (not seen), control line holder R60 comprises a squared side R60A (not fully seen), a groove 16 formed within the squared side R60A (not fully seen), an angled side R60B, an angled groove 17 formed within angled side R60B, a group of three rounded inside corners 15A (not seen), 15B (not seen) and 15C formed by grooves 16 and 17, a left side R60C, a top R60D, an aligning side R60E, a bottom side R60F, four threaded holes 14A (not seen), 14B (not seen) 14C and 14D, and the thumb screws 11A (not seen) and 11B (not fully seen) are screwed into threaded holes 14A (not seen) and 14B (not seen).

Figure 63:
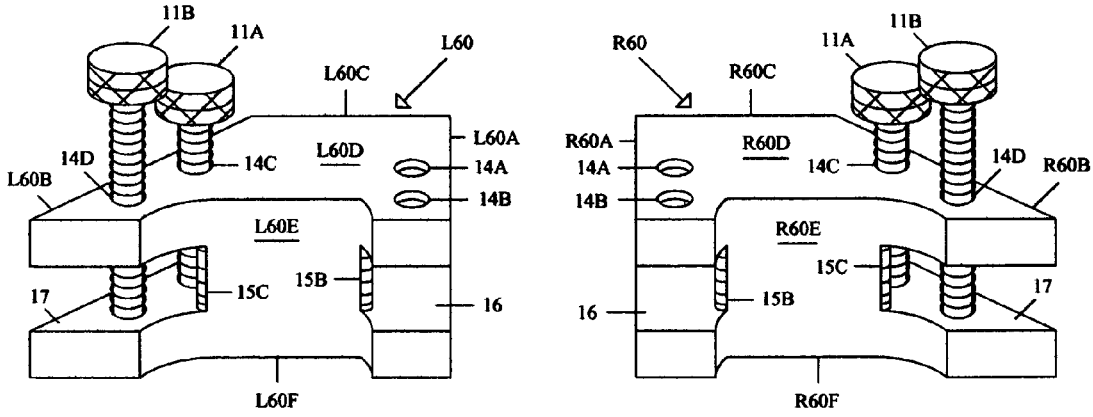
FIG. 63 is a perspective side view of the third embodiment L60 and R60 with two screws each seen slightly from the top for use with grids at forty-five degree angles in relation to the walls.

FIG. 63 is a perspective side view of the third embodiment L60 and R60 with two thumb screws 11A and 11B each seen slightly from the top for use with grids at forty-five degree angles in relation to the walls, control line holder L60 comprises a squared side L60A, a groove 16 formed within the squared side L60A, an angled side L60B, an angled groove 17 formed within angled side L60B, a group of three rounded inside corners 15A (not seen), 15B and 15C formed by grooves 16 and 17, a right side L60C, a top L60D, an aligning side L60E, a bottom side L60F (not seen), and four threaded holes 14A, 14B, 14C and 14D formed through top L60D to grooves 16 and 17, and the thumb screws 11A and 11B are screwed into threaded holes 14C and 14D, control line holder R60 comprises a squared side R60A, a groove 16 formed within the squared side R60A, an angled side R60B, an angled groove 17 formed within angled side R60B, a group of three rounded inside corners 15A (not seen), 15B and 15C formed by grooves 16 and 17, a left side R60C, a top R60D, an aligning side R60E, a bottom side R40F (not seen), four threaded holes 14A, 14B, 14C and 14D formed through top R60D to grooves 16 and 17, and the thumb screws 11A and 11B are screwed into threaded holes 14C and 14D.

Figure 64:
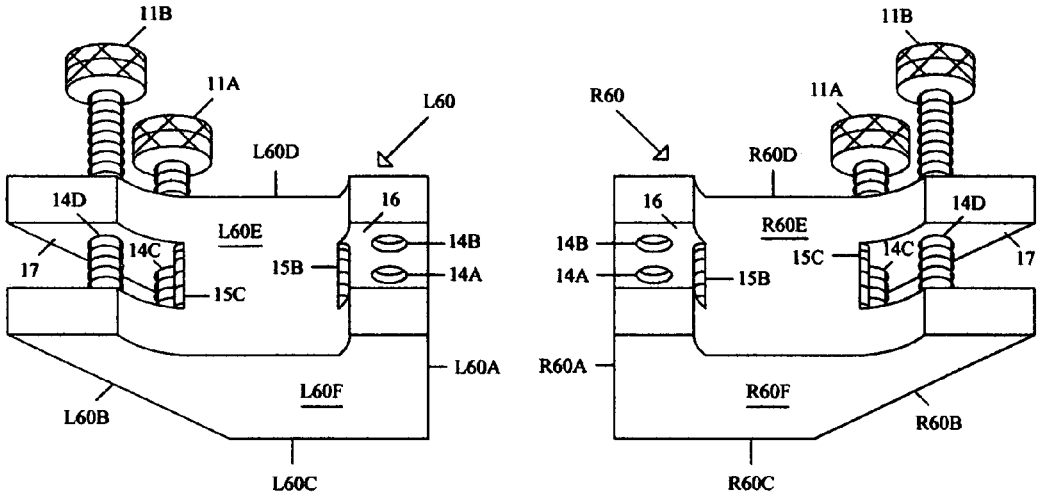
FIG. 64 is a perspective side view of the third embodiment L60 and R60 with two screws each seen slightly from the bottom for use with grids at forty-five degree angles in relation to the walls.

FIG. 64 is a perspective side view of the third embodiment L60 and R60 with two thumb screws 11A and 11B each seen slightly from the bottom for use with grids at forty-five degree angles in relation to the walls, control line holder L60 comprises a squared side L60A, a groove 16 formed within the squared side L60A, an angled side L60B, an angled groove 17 formed within angled side L60B, a group of three rounded inside corners 15A (not seen), 15B and 15C formed by grooves 16 and 17, a right side L60C, a top L60D, an aligning side L60E, a bottom side L60F, and four threaded holes 14A, 14B, 14C and 14D formed through top L60D to grooves 16 and 17, and the thumb screws 11A and 11B are screwed into threaded holes 14C and 14D, control line holder R60 comprises a squared side R60A, a groove 16 formed within the squared side R60A, an angled side R60B, an angled groove 17 formed within angled side R60B, a group of three rounded inside corners 15A (not seen), 15B and 15C formed by grooves 16 and 17, a left side R60C, a top R60D, an aligning side R60E, a bottom side R60F, four threaded holes 14A, 14B, 14C and 14D formed through top R60D to grooves 16 and 17, and the thumb screws 11A and 11B are screwed into threaded holes 14C and 14D.

Figure 65:
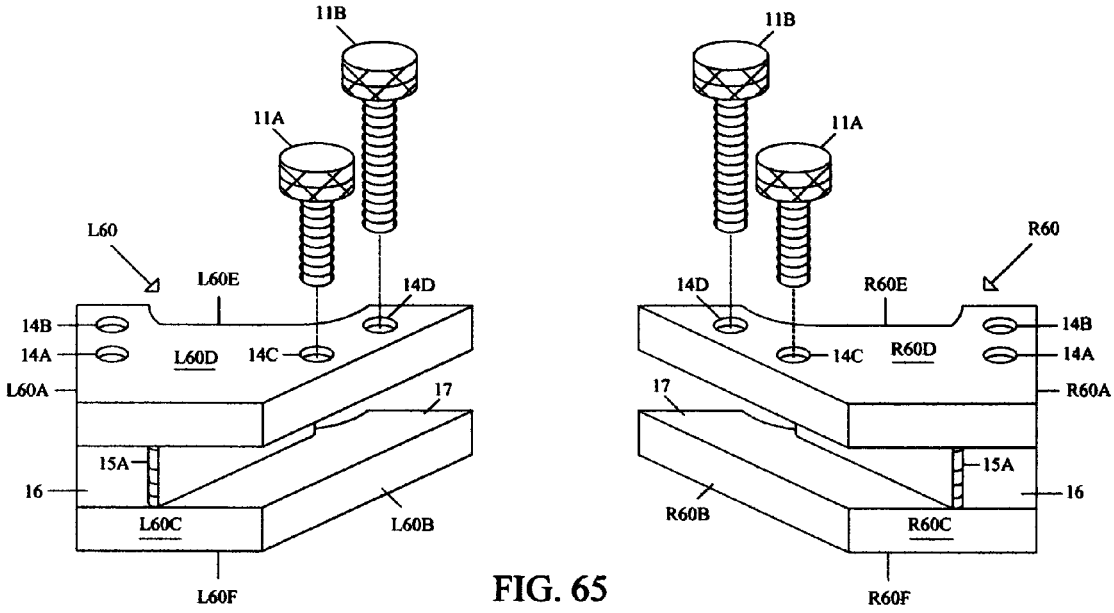
FIG. 65 is an exploded perspective side view of the third embodiment L60 and R60 with two screws each seen slightly from the top for use with grids at forty-five degree angles in relation to the walls.

FIG. 65 is an exploded perspective side view of the third embodiment L60 and R60 with two thumb screws 11A and 11B each seen slightly from the top for use with grids at forty-five degree angles in relation to the walls, control line holder L60 comprises a squared side L60A, a groove 16 formed within the squared side L60A, an angled side L60B, an angled groove 17 formed within angled side L60B, a group of three rounded inside corners 15A, 15B (not seen) and 15C (not seen) formed by grooves 16 and 17, a right side L60C, a top L60D, an aligning side L60E (not fully seen), a bottom side L60F (not seen), and four threaded holes 14A, 14B, 14C and 14D formed through top L60D to grooves 16 and 17, and the thumb screws 11A and 11B aligned to threaded holes 14C and 14D, control line holder R60 comprises a squared side R60A, a groove 16 formed within the squared side R60A, an angled side R60B, an angled groove 17 formed within angled side R60B, a group of three rounded inside corners 15A, 15B (not seen) and 15C (not seen) formed by grooves 16 and 17, a left side R60C, a top R60D, an aligning side R60E (not fully seen), a bottom side R60F (not seen), four threaded holes 14A, 14B, 14C and 14D formed through top R60D to grooves 16 and 17, and the thumb screws 11A and 11B aligned to threaded holes 14C and 14D.

Figure 66:
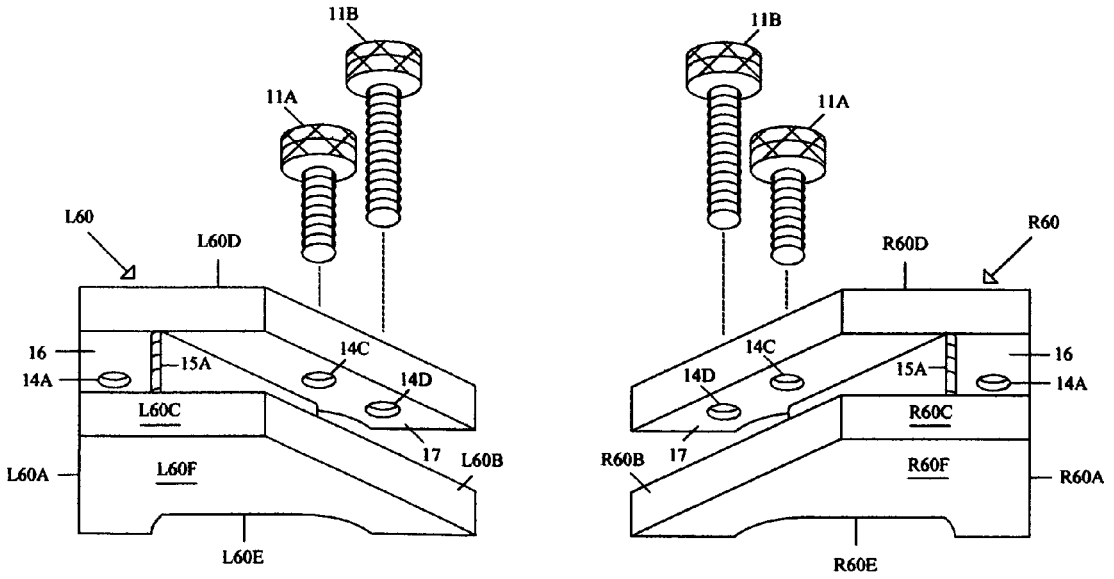
FIG. 66 is an exploded perspective side view of the third embodiment L60 and R60 with two screws each seen slightly from the bottom for use with grids at forty-five degree angles in relation to the walls.

FIG. 66 is an exploded perspective side view of the third embodiment L60 and R60 with two thumb screws 11A and 11B each seen slightly from the bottom for use with grids at forty-five degree angles in relation to the walls, control line holder L60 comprises a squared side L60A, a groove 16 formed within the squared side L60A, an angled side L60B, an angled groove 17 formed within angled side L60B, a group of three rounded inside corners 15A, 15B (not seen), and 15C (not seen) formed by grooves 16 and 17, a right side L60C, a top L60D, an aligning side L60E (not fully seen), a bottom side L60F, and four threaded holes 14A, 14B (not seen), 14C and 14D, the thumb screws 11A and 11B aligned to threaded holes 14C and 14D, control line holder R60 comprises a squared side R60A, a groove 16 formed within the squared side R60A, an angled side R60B, an angled groove 17 formed within angled side R60B, a group of three rounded inside corners 15A, 15B (not seen) and 15C (not seen) formed by grooves 16 and 17, a left side R60C, a top R60D, an aligning side R60E (not fully seen), a bottom side R60F, four threaded holes 14A, 14B (not seen), 14C and 14D, the thumb screws 11A and 11B aligned to threaded holes 14C and 14D.

Figure 67:
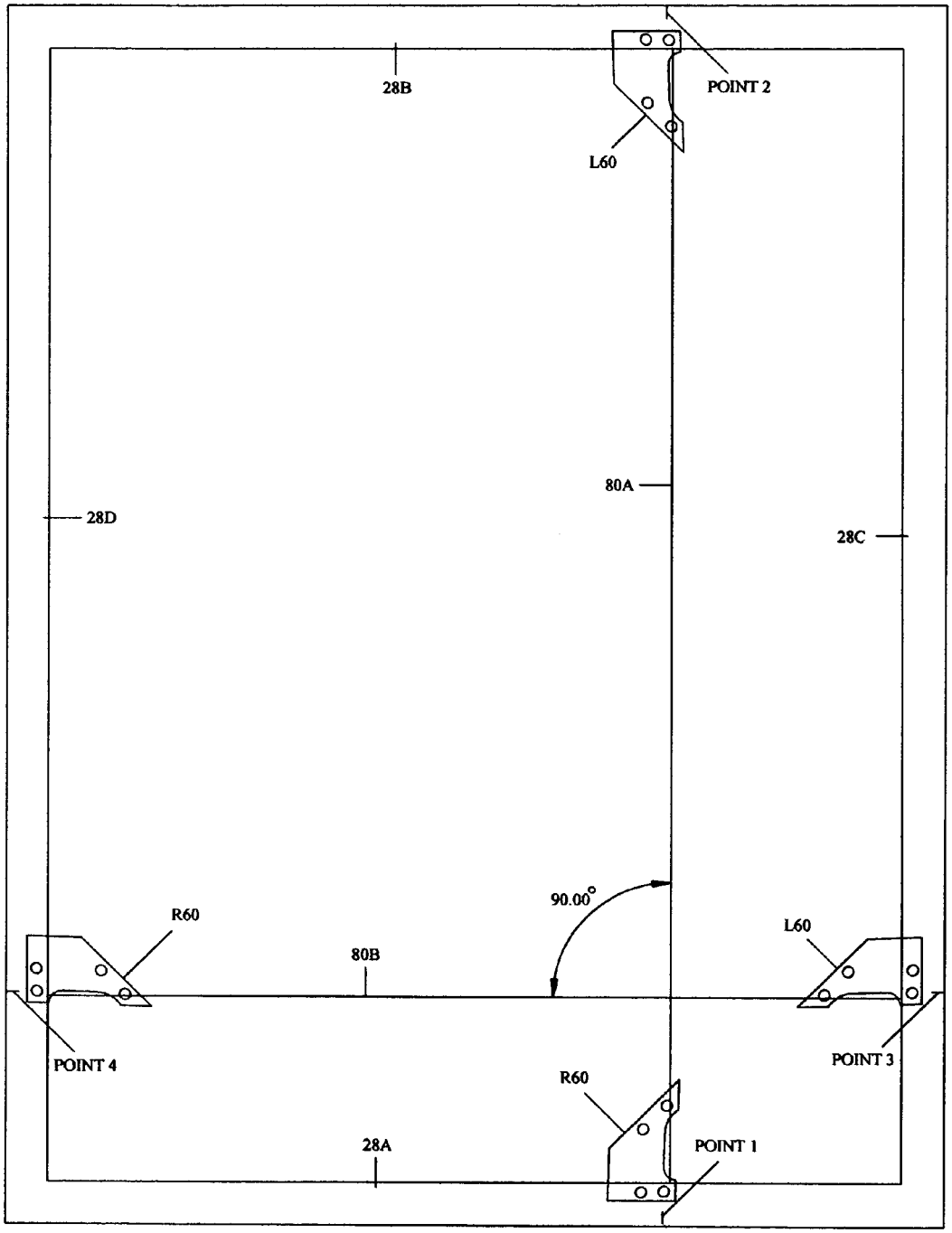
FIG. 67 is a perspective top view of the third embodiment R60, L60, additional L60, and additional R60 in use for grids at ninety degree angles in relation to the walls.

FIG. 67 is a perspective top view of the third embodiment R60, L60, additional L60, and additional R60 in use for grids at ninety degree angles in relation to the walls and comprises control line holder R60 attached to the right and next to a main tee 82A (not shown in this view) laid out mark or point one inscribed onto wall angle molding 28A, control line 80A pulled and held taut by control line holder L60 attached to the left and next to a main tee 82A (not shown in this view) laid out mark or point two inscribed onto wall angle molding 28B, additional control line holder L60 attached to the left and next to a cross tee 82B (not shown in this view) laid out mark or point three inscribed onto wall angle molding 28C, control line 80B pulled and held taut by additional control line holder R60 attached to the right and next to a cross tee 82B (not shown in this view) laid out mark or point four inscribed onto wall angle molding 28D.

Figure 68:
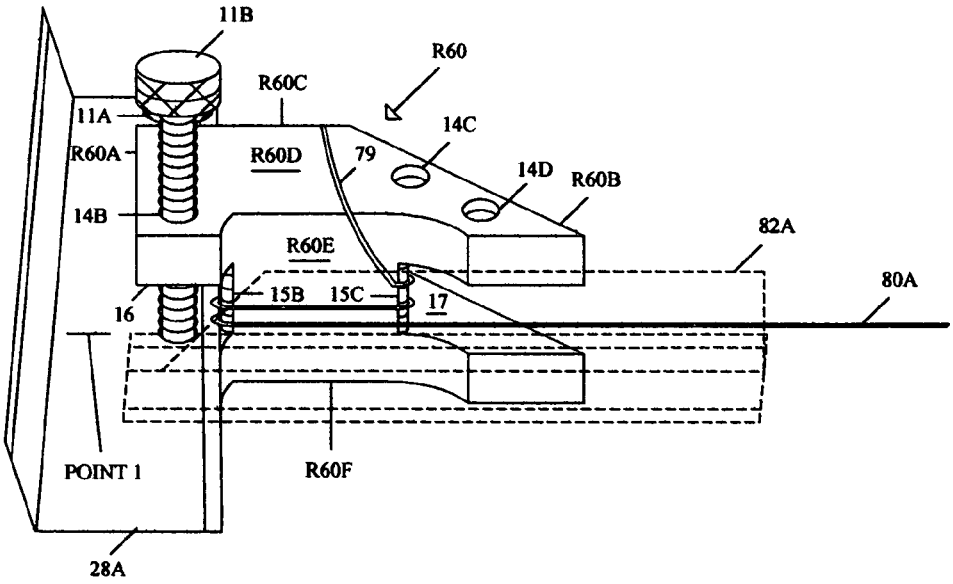
FIG. 68 is a perspective side view of the third embodiment R60 in use with two screws (one screw is not fully seen) seen slightly from the top for use with grids at ninety degree angles in relation to the walls.

FIG. 68 is a perspective side view of the third embodiment R60 in use with two thumb screws 11A (not fully seen) and 11B seen slightly from the top for use with grids at ninety degree angles in relation to the walls and comprises a squared side R60A, a groove 16 formed within the squared side R60A, an angled side R60B, a groove 17 formed within the angled side R60B, a group of three rounded corners 15A (not seen), 15B, and 15C formed by grooves 16 and 17, a left side R60C, a top R60D, an aligning side R60E aligned to the right of point 1 which is inscribed onto wall angle molding 28A, a bottom side R60F (not seen), four threaded holes 14A (not seen), 14B, 14C and 14D formed through top R60D to grooves 16 and 17, thumb screw 11A (not fully seen) screwed into threaded hole 14A (not seen) that is applying a clamping force onto a piece of wall angle molding 28A against the bottom of groove 16, thumb screw 11B screwed into threaded hole 14B that is applying a clamping force onto a piece of main tee 82A (shown sketched with dash lines) and wall angle molding 28A against the bottom of groove 16, a loop 79 about 31.75 mm. in diameter tied from a roll of control line 80A which is hooked from groove 17 and the top R60D, control line 80A which is wrapped around counter clock wise left side R60C (not fully seen in this view), rounded corner 15A (not seen in this view), groove 16, rounded corner 15B, aligning side R60E, rounded corner 15C, groove 17, left side R60C (not fully seen), rounded corner 15A (not seen in this view), groove 16, rounded corner 15B, and ending running along aligning side R60E.

Figure 69:
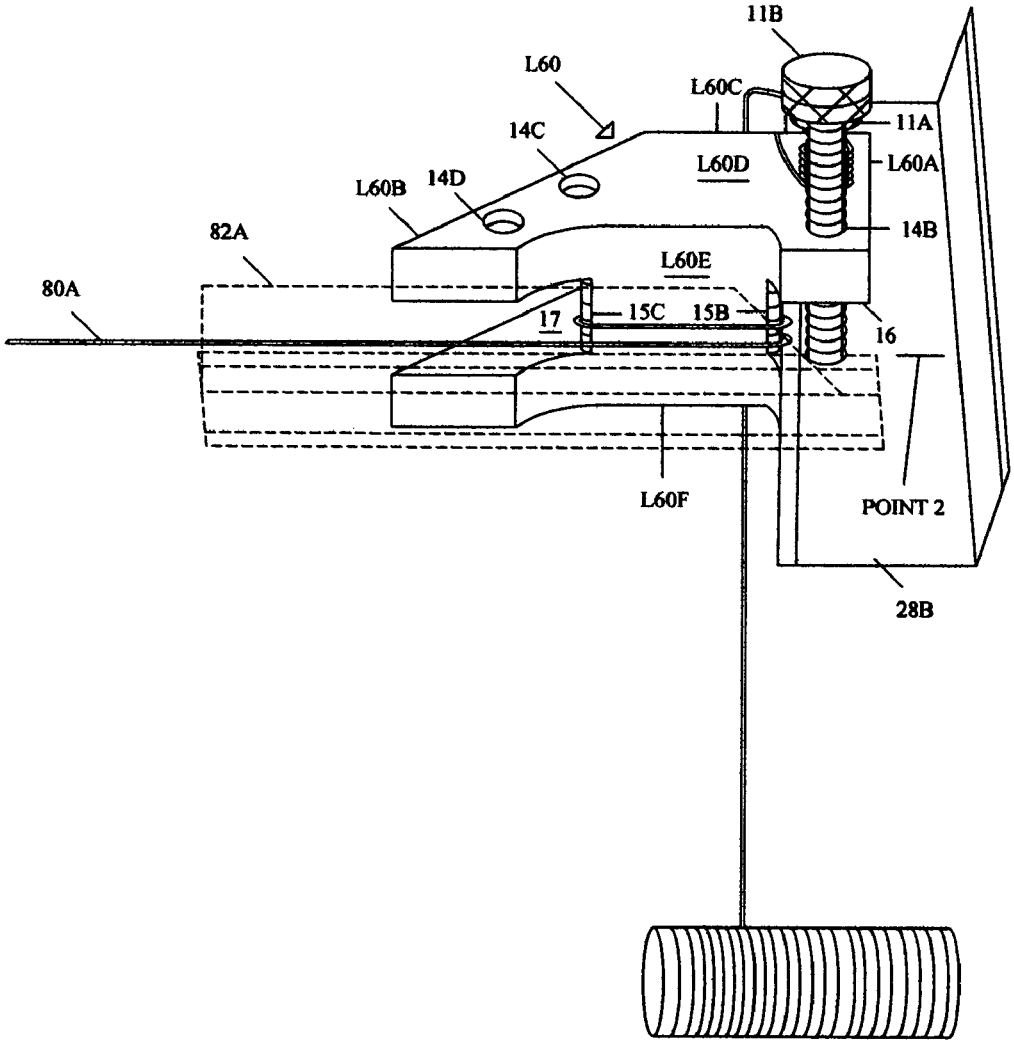
FIG. 69 is a perspective side view of the third embodiment L60 in use with two screws (one screw is not fully seen) seen slightly from the top for use with grids at ninety degree angles in relation to the walls.

FIG. 69 is a perspective side view of the third embodiment L60 in use with two screws 11A (not fully seen) and 11B seen slightly from the top for use with grids at ninety degree angles in relation to the walls and comprises a squared side L60A, a groove 16 formed within the squared side L60A, an angled side L60B, a groove 17 formed within the angled side L60B, a group of three rounded corners 15A (not seen in this view), 15B, and 15C formed by grooves 16 and 17, a right side L60C (not fully seen in this view), a top L60D, an aligning side L60E aligned to the left of point 2 which is inscribed onto wall angle molding 28B, a bottom side L60F (not seen), four threaded holes 14A (not seen), 14B, 14C and 14D formed through top L60D to grooves 16 and 17, thumb screw 11A (not fully seen) screwed into threaded hole 14A (not seen) that is applying a clamping force onto a piece of wall angle molding 28A against the bottom of groove 16, thumb screw 11B screwed into threaded hole 14B that is applying a clamping force onto a piece of main tee 82A (shown sketched with dash lines) and wall angle molding 28B against the bottom of groove 16, control line 80A which is wrapped around counter clock wise aligning side L60E, rounded corner 15B, groove 16 formed within the squared side L60A, rounded corner 15A (not seen in this view), right side L60C (not fully seen in this view), groove 17 formed within the angled side L60B, rounded corner 15C, aligning side L60E, rounded corner 15B, groove 16 formed within the squared side L60A, right side L60C (not fully seen in this view), pulled taut and wrapped around counter clock wise five times the remainder top section of the thumb screw 11A (not fully seen in this view), returned and let hung next to right side L60C (not fully seen in this view).

Figure 70:
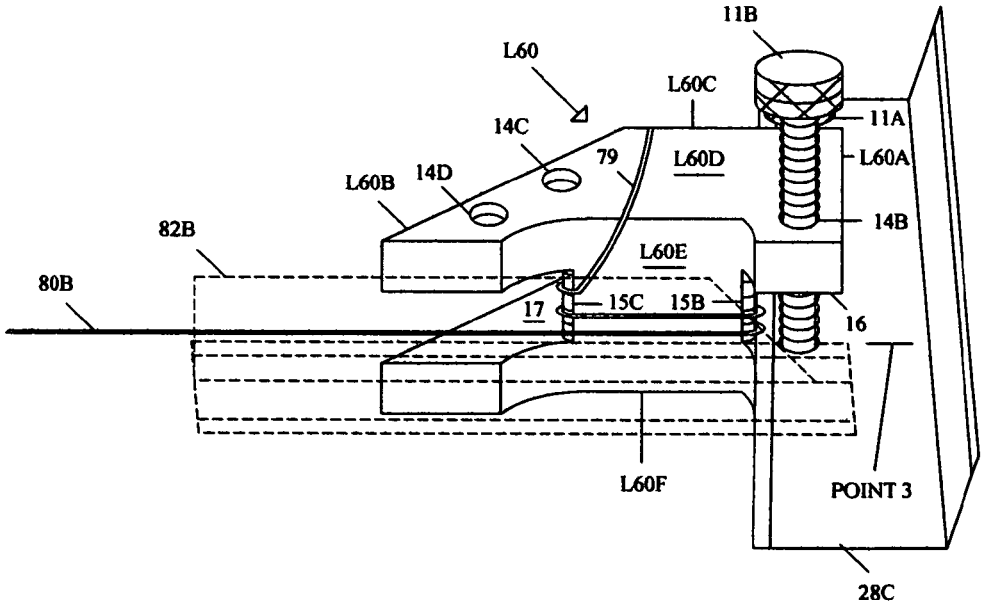
FIG. 70 is a perspective side view of additional third embodiment L60 in use with two screws (one screw is not fully seen) seen slightly from the top for use with grids at ninety degree angles in relation to the walls.

FIG. 70 is a perspective side view of additional third embodiment L60 in use with two screws 11A (not fully seen) and 11B seen slightly from the top for use with grids at ninety degree angles in relation to the walls and comprises a squared side L60A, a groove 16 formed within the squared side L60A, an angled side L60B, a groove 17 formed within the angled side L60B, a group of three rounded corners 15A (not seen in this view), 15B, and 15C formed by grooves 16 and 17, a right side L60C (not fully seen in this view), a top L60D, an aligning side L60E aligned to the left of point 3 which is inscribed onto wall angle molding 28C, a bottom side L60F (not seen), four threaded holes 14A (not seen), 14B, 14C and 14D formed through top L60D to grooves 16 and 17, thumb screw 11A (not fully seen) screwed into threaded hole 14A (not seen) that is applying a clamping force onto a piece of wall angle molding 28C against the bottom of groove 16, thumb screw 11B screwed into threaded hole 14B that is applying a clamping force onto a piece of cross tee 82B (shown sketched with dashed lines) and wall angle molding 28C against the bottom of groove 16, a loop 79 about 31.75 mm. in diameter tied from control line 80B which is hooked from groove 17 and the top L60D, control line 80B which is wrapped around clock wise right side L60C (not fully seen in this view), rounded corner 15A (not seen in this view), groove 16 formed within the squared side L60A, rounded corner 15B, aligning side L60E, rounded corner 15C, groove 17 formed within the angled side L60B, right side L60C (not fully seen in this view), rounded corner 15A (not seen in this view), groove 16 formed within the squared side L60A, rounded corner 15B, and ending running along aligning side L60E.

Figure 71:
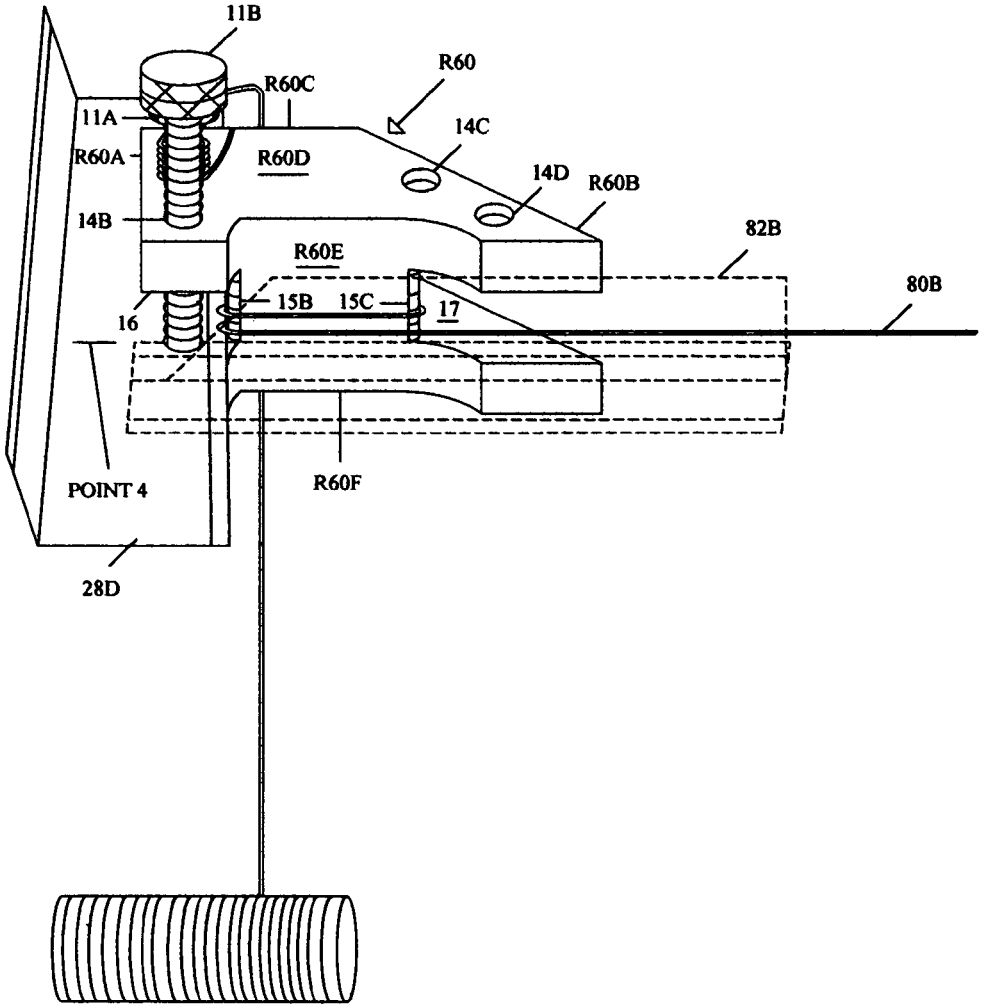
FIG. 71 is a perspective side view of additional third embodiment R60 in use with two screws (one screw is not fully seen) seen slightly from the top for use with grids at ninety degree angles in relation to the walls.

FIG. 71 is a perspective side view of additional third embodiment R60 in use with two screws 11A (not fully seen) and 11B seen slightly from the top for use with grids at ninety degree angles in relation to the walls and comprises a squared side R60A, a groove 16 formed within the squared side R60A, an angled side R60B, a groove 17 formed within the angled side R60B, a group of three rounded corners 15A (not seen in this view), 15B, and 15C formed by grooves 16 and 17, a left side R60C (not fully seen in this view), a top R60D, an aligning side R60E aligned to the right of point 4 which is inscribed onto wall angle molding 28D, a bottom side L60F (not seen), four threaded holes 14A (not seen), 14B, 14C and 14D formed through top R60D to grooves 16 and 17, thumb screw 11A (not fully seen) screwed into threaded hole 14A (not seen) that is applying a clamping force onto a piece of wall angle molding 28D against the bottom of groove 16, thumb screw 11B screwed into threaded hole 14B that is applying a clamping force onto a piece of cross tee 82B (shown sketched with dashed lines) and wall angle molding 28D against the bottom of groove 16, control line 80B which is wrapped around clock wise aligning side R60E, rounded corner 15B, groove 16 formed within the squared side R60A, rounded corner 15A (not seen in this view), left side R60C (not fully seen in this view), groove 17 formed within the angled side R60B, rounded corner 15C, aligning side R60E, rounded corner 15B, groove 16 formed within the squared side R60A, left side R60C (not fully seen in this view), pulled taut and wrapped around counter clock wise five times the remainder top section of the thumb screw 11A, returned and let hung next to left side R60C (not fully seen in this view).

Figure 72:
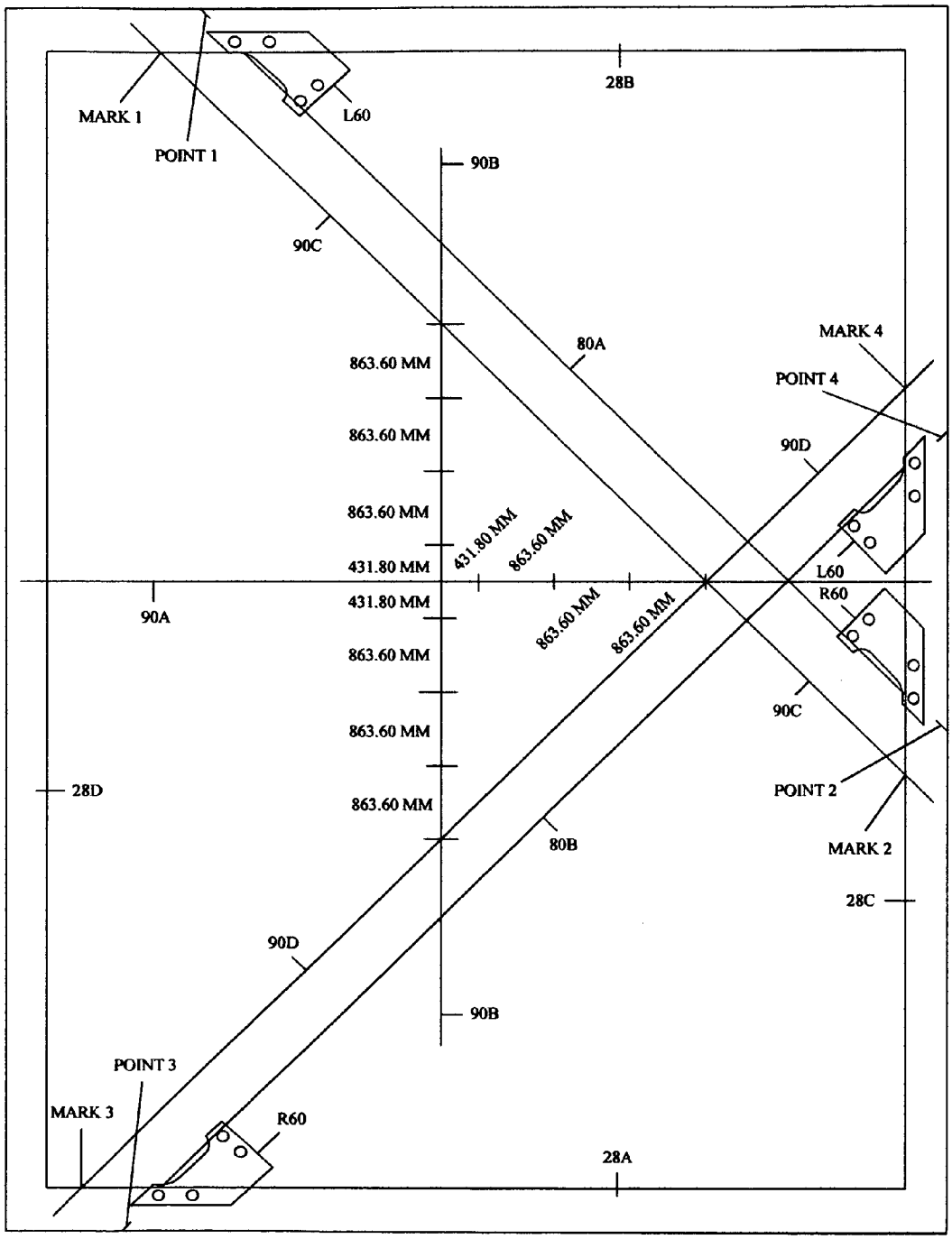
FIG. 72 is a perspective top view of the third embodiment L60, R60, additional R60 and additional L60 in use with grids at forty-five degree angles in relation to the walls.

FIG. 72 is a perspective top view of the third embodiment L60, R60, additional R60 and additional L60 in use with grids at forty-five degree angles in relation to the walls (not shown) and comprises a chalk line 90A snapped on the floor in the middle of the room, a chalk line 90B snapped on the floor in the center of and perpendicular to chalk line 90A, graduations marked in one direction on chalk line 90A starting from where chalk line 90A and chalk line 90B intersect are 431.80 mm. followed by three times graduations of 863.60 mm., graduations marked in opposite directions on chalk line 90B starting from where chalk line 90B and 90A intersect are 431.80 mm. followed by three times graduations of 863.60 mm., chalk line 90C snapped on the floor and joining the last marked graduation of 863.60 mm. on chalk line 90A and one last marked graduation of 863.60 mm. on chalk line 90B and extending to wall angle moldings 28B and 28C thus creating mark 1 transferred from the floor onto wall angle molding 28B and mark 2 transferred from the floor onto wall angle molding 28C, chalk line 90D snapped on the floor and joining the last marked graduation of 863.60 mm. on chalk line 90A and one opposite last marked graduation of 863.60 mm. on chalk line 90B and extending to wall angle moldings 28A and 28C thus creating mark 3 transferred from the floor onto wall angle molding 28A and mark 4 transferred from the floor onto wall angle molding 28C, control line holder L60 attached to the right and next to a main tee 82A (not shown in this view) point one inscribed onto wall angle molding 28B, control line 80A pulled and held taut by control line holder R60 attached to the left and next to a main tee 82A (not shown in this view) point two inscribed onto wall angle molding 28C, additional control line holder R60 attached to the left and next to a cross tee 82B (not shown in this view) point three inscribed onto wall angle molding 28A, control line 80B pulled and held taut by control line holder L60 attached to the right and next to a cross tee 82B (not shown in this view) point four inscribed onto wall angle molding 28C.

Figure 73:
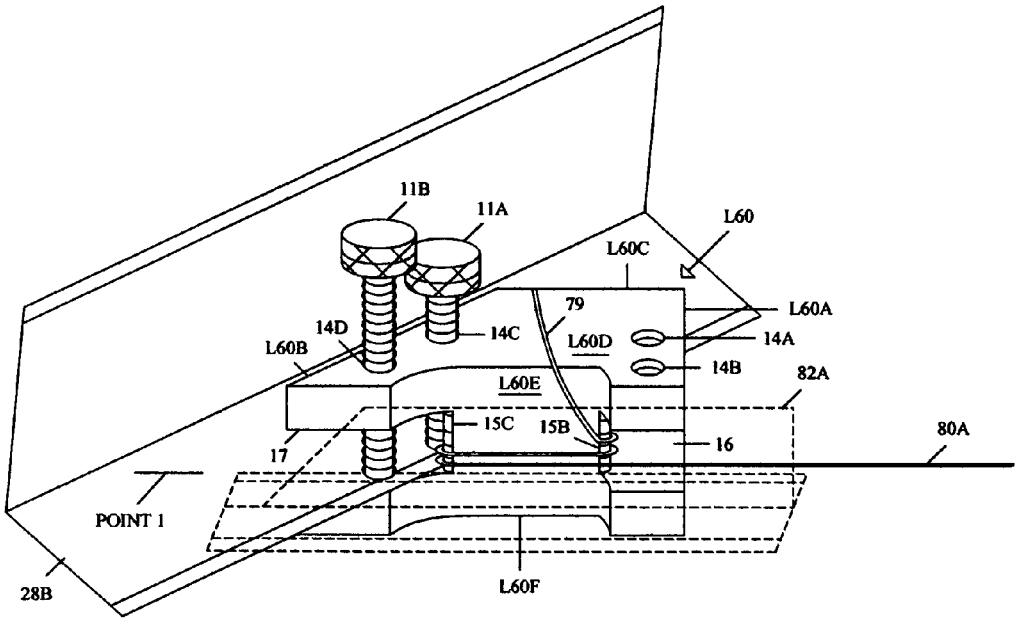
FIG. 73 is a perspective side view of the third embodiment L60 in use with two screws seen slightly from the top for use with grids at forty-five degree angles in relation to the walls.

FIG. 73 is a perspective side view of the third embodiment L60 in use with two screws 11A and 11B seen slightly from the top for use with grids at forty-five degree angles in relation to the walls and comprises a squared side L60A, a groove 16 formed within the squared side L60A, an angled side L60B, a groove 17 formed within the angled side L60B, a group of three rounded corners 15A (not seen in this view), 15B, and 15C formed by grooves 16 and 17, a right side L60C, a top L60D, an aligning side L60E aligned to the right of point 1 which is inscribed onto wall angle molding 28B, a bottom side L60F (not fully seen in this view), four threaded holes 14A, 14B, 14C and 14D formed through top L60D to grooves 16 and 17, thumb screw 11A screwed into threaded hole 14C that is applying a clamping force onto a piece of wall angle molding 28B against the bottom of groove 17, thumb screw 11B screwed into threaded hole 14D that is applying a clamping force onto a piece of main tee 82A (shown sketched with dashed lines) and wall angle molding 28B against the bottom of groove 17, a loop 79 about 31.75 mm. in diameter tied from control line 80A which is hooked from groove 16 and the top L60D, control line 80A which is wrapped around counter clock wise right side L60C (not fully seen in this view), rounded corner 15A (not seen in this view), groove 17, rounded corner 15C, aligning side L60E, rounded corner 15B, groove 16, rounded corner 15A (not seen in this view), right side L60C, groove 17, rounded corner 15C, and ending running along aligning side L60E.

Figure 74:
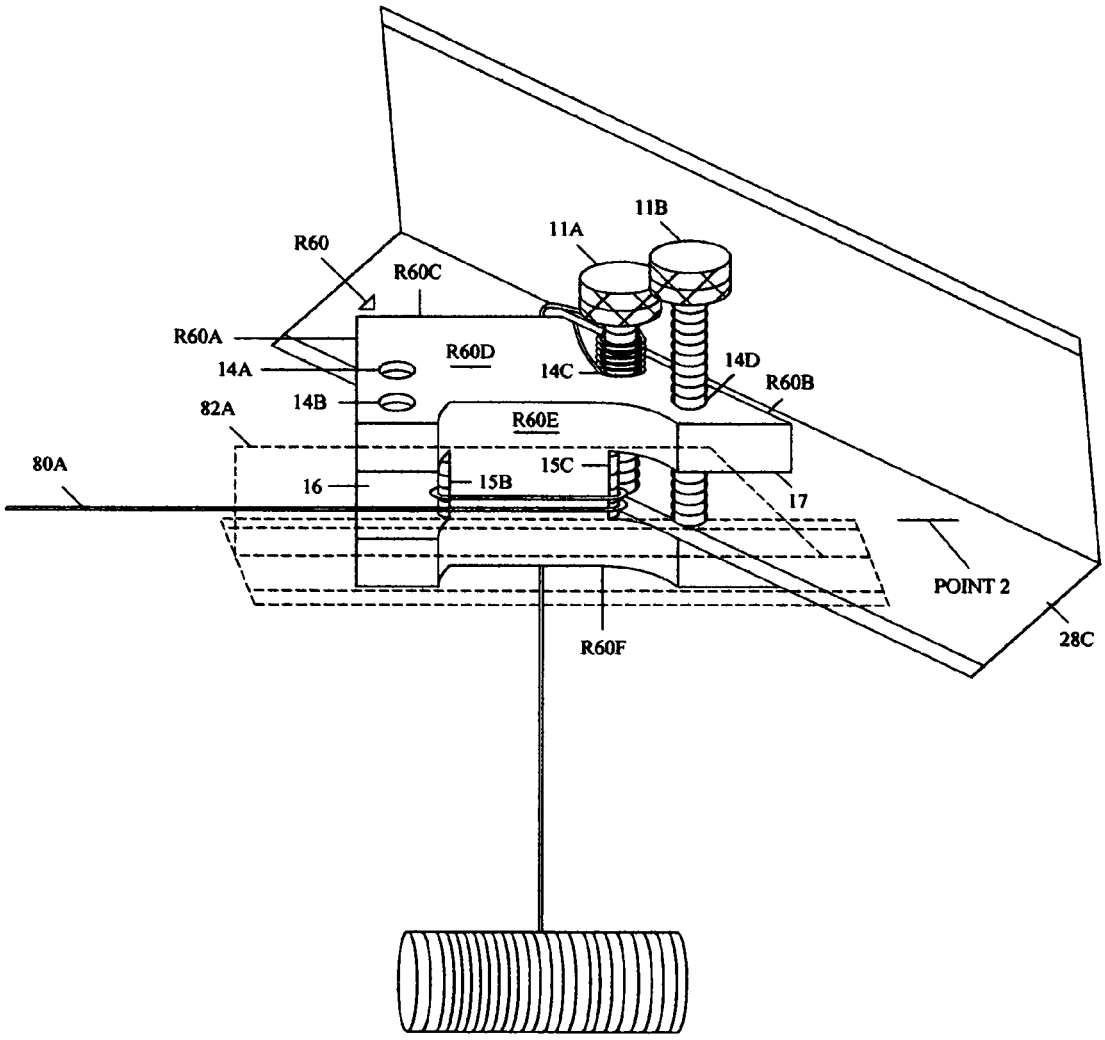
FIG. 74 is a perspective side view of the third embodiment R60 in use with two screws seen slightly from the top for use with grids at forty-five degree angles in relation to the walls.

FIG. 74 is a perspective side view of the third embodiment R60 in use with two screws 11A and 11B seen slightly from the top for use with grids at forty-five degree angles in relation to the walls and comprises a squared side R60A, a groove 16 formed within the squared side R60A, an angled side R60B, a groove 17 formed within the angled side R60B, a group of three rounded corners 15A (not seen in this view), 15B, and 15C formed by grooves 16 and 17, a left side R60C (not fully seen in this view), a top R60D, an aligning side R60E aligned to the left of point 2 which is inscribed onto a piece of wall angle molding 28C, a bottom side R60F (not fully seen in this view), four threaded holes 14A, 14B, 14C and 14D formed through top R60D to grooves 16 and 17, thumb screw 11A screwed into threaded hole 14C that is applying a clamping force onto a piece of wall angle molding 28C against the bottom of groove 17, thumb screw 11B screwed into threaded hole 14D that is applying a clamping force onto a piece of main tee 82A (shown sketched with dashed lines) and wall angle molding 28C against the bottom of groove 17, control line 80A which is wrapped around counter clock wise aligning side R60E, rounded corner 15C, groove 17 formed within the angled side R60B, rounded corner 15A (not seen in this view), left side R60C (not fully seen in this view), groove 16 formed within the squared side R60A, rounded corner 15B, aligning side R60E, rounded corner 15C, groove 17 formed within the angled side R60B, left side R60C (not fully seen in this view), pulled taut and wrapped around counter clock wise five times the remainder top section of the thumb screw 11A, returned and let hung next to left side R60C (not fully seen in this view).

Figure 75:
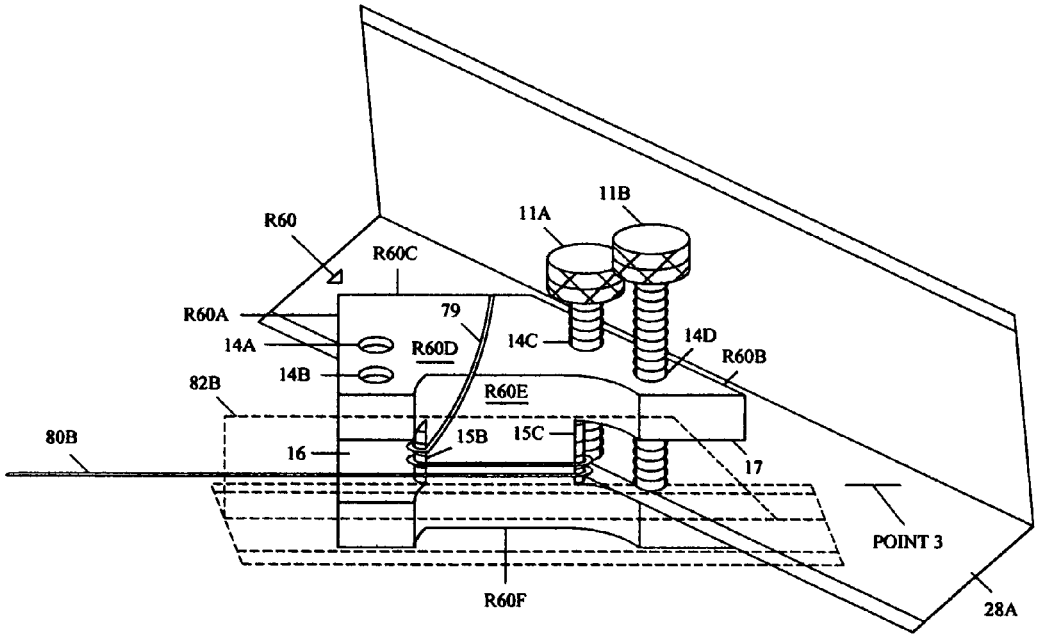
FIG. 75 is a perspective side view of additional third embodiment R60 in use with two screws seen slightly from the top for use with grids at forty-five degree angles in relation to the walls.

FIG. 75 is a perspective side view of additional third embodiment R60 in use with two screws 11A and 11B seen slightly from the top for use with grids at forty-five degree angles in relation to the walls and comprises a squared side R60A, a groove 16 formed within the squared side R60A, an angled side R60B, a groove 17 formed within the angled side R60B, a group of three rounded corners 15A (not seen in this view), 15B, and 15C formed by grooves 16 and 17, a left side R60C (not fully seen in this view), a top R60D, an aligning side R60E aligned to the left of point 3 which is inscribed onto a piece of wall angle molding 28A, a bottom side R60F (not seen), four threaded holes 14A, 14B, 14C and 14D formed through top R60D to grooves 16 and 17, thumb screw 11A screwed into threaded hole 14C that is applying a clamping force onto the piece of wall angle molding 28A against the bottom of groove 17, thumb screw 11B screwed into threaded hole 14D that is applying a clamping force onto a piece of cross tee 82B (shown sketched with dashed lines) and wall angle molding 28A against the bottom of groove 17, a loop 79 about 31.75 mm. in diameter tied from control line 80B which is hooked from groove 16 and the top R60D, control line 80B which is wrapped around clock wise left side R60C (not fully seen in this view), rounded corner 15A (not seen in this view), groove 17 formed within the angled side L60B, rounded corner 15C, aligning side R60E, rounded corner 15B, groove 16 formed within the squared side R60A, rounded corner 15A (not seen in this view), left side R60C (not fully seen in this view), groove 17 formed within the angled side R60B, rounded corner 15C, and ending running along aligning side R60E.

Figure 76:
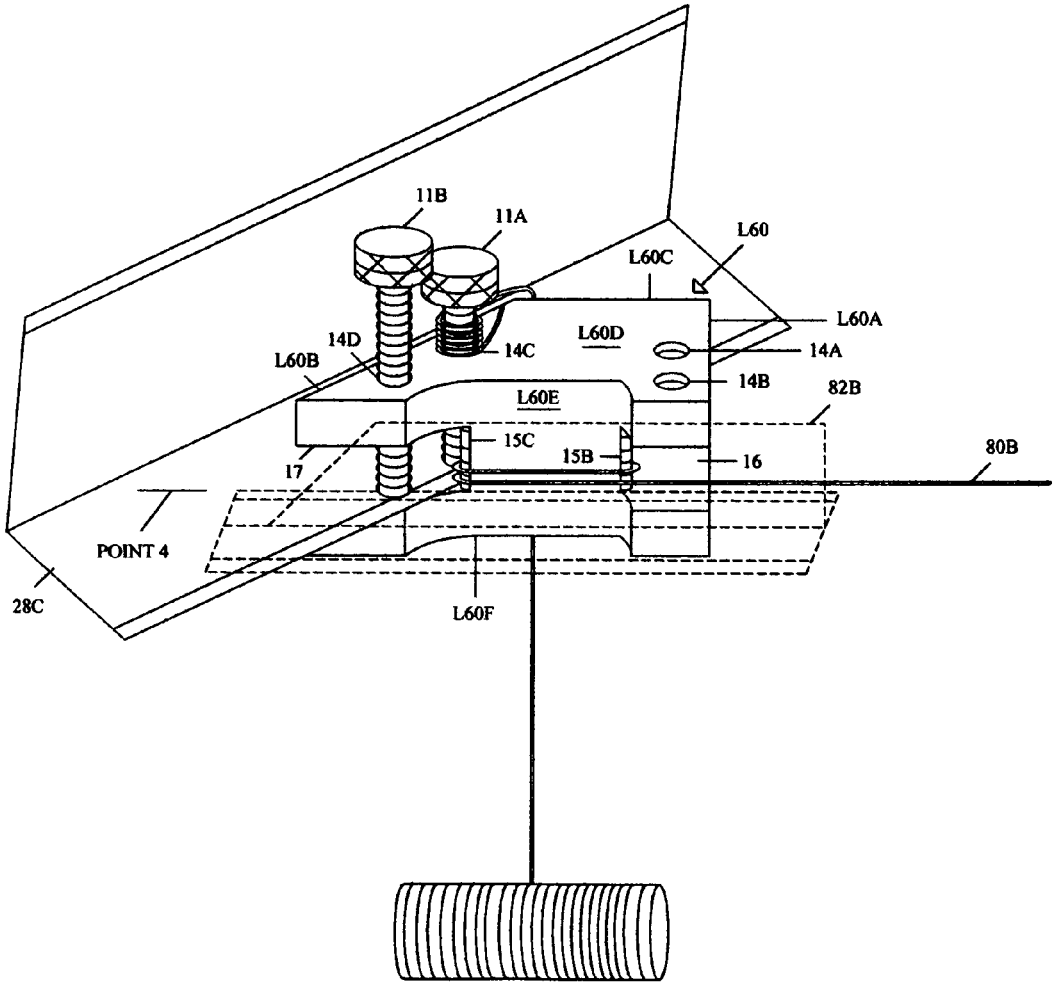
FIG. 76 is a perspective side view of additional third embodiment L60 in use with two screws seen slightly from the top for use with grids at forty-five degree angles in relation to the walls.

FIG. 76 is a perspective side view of additional third embodiment L60 in use with two screws 11A and 11B seen slightly from the top for use with grids at forty-five degree angles in relation to the walls and comprises a squared side L60A, a groove 16 formed within the squared side L60A, an angled side L60B, a groove 17 formed within the angled side L60B, a group of three rounded corners 15A (not seen in this view), 15B, and 15C formed by grooves 16 and 17, a right side L60C (not fully seen in this view), a top L60D, an aligning side L60E aligned to the right of point 4 which is inscribed onto a piece of wall angle molding 28C, a bottom side L60F (not fully seen in this view), four threaded holes 14A, 14B, 14C and 14D formed through top L60D to grooves 16 and 17, thumb screw 11A screwed into threaded hole 14C that is applying a clamping force onto the piece of wall angle molding 28C against the bottom of groove 17, thumb screw 11B screwed into threaded hole 14D that is applying a clamping force onto a piece of cross tee 82B (shown sketched with dashed lines) and wall angle molding 28C against the bottom of groove 17, control line 80B which is wrapped around clock wise aligning side L60E, rounded corner 15C, groove 17 formed within the angled side L60B, rounded corner 15A (not seen in this view), right side L60C (not fully seen in this view), groove 16 formed within the squared side L60A, rounded corner 15B, aligning side L60E, rounded corner 15C, groove 17 formed within the angled side L60B, right side L60C (not fully seen in this view) pulled taut and wrapped around counter clock wise five times the remainder top section of the thumb screw 11A, returned and let hung next to right side L60C (not fully seen in this view).

To enable those skilled in the art to fully understand and practice my new and improved method of installing or setting the control lines, I will proceed to give an example as to how a suspended grid framer can use the control line holders R60, L60, additional L60, and additional R60 to frame a 609.6 mm.×1219.2 mm. or 2'×4' 90 degree angle suspended grid:

1. Referring to FIGS. 67 through 71 and if you are using either 23.81 mm.×23.81 mm. or 14.29 mm.×23.81 mm. wall angle moldings 28A, 28B, 28C, and 28D snap chalk lines 25.4 mm. above given finished ceiling height; by doing this you will keep all chalk line marks out of the finished ceiling's view.
2. Install wall angle moldings 28A, 28B, 28C, and 28D at prescribed height and label them as such.
3. Layout location of control lines 80A and 80B on wall angle moldings 28A, 28B, 28C, and 28D making sure all the marks are above the finished ceiling so no one will be able to see them.
4. The location of the control line 80A that runs parallel to the main tee is determined by adding the border dimension plus ½ the thickness of the main tee.
5. Make sure the thumb screws 11A and 11B are threaded into holes 14A and 14B but not into groove 16.
6. See FIG. 68, control line for main tee 82A (shown sketched with dash lines): Grab a roll of control line 80A and tie a loop 79 about 31.75 mm. in diameter at the end, with the other hand take control line holder R60 with the thumb screws 11A and 11B facing up, next, hook the loop 79 from groove 17 and the top R60D, wrap control line 80A around counter clock wise left side R60C (not fully seen in this view), rounded corner 15A (not seen in this view), groove 16, rounded corner 15B, aligning side R60E, rounded corner 15C, groove 17, left side R60C (not fully seen), rounded corner 15A, groove 16, rounded corner 15B, and ending running along aligning side R60E.
7. See FIG. 68, go to main tee 82A (shown sketched with dash lines) point 1 and as you face this point 1 attach control line holder R60 to your right of this point 1 by first inserting the wall angle molding 28A into the groove 16 formed within the squared side R60A, aligning side R60E to your right of point 1, followed by firmly tightening the thumb screw 11A.
8. See FIG. 69, roll out control line 80A and go to point 2 for the main tee 82A (shown sketched with dash lines) inscribed onto wall angle molding 28B, take control line holder L60, wrap the control line 80A around counter clock wise aligning side L60E, rounded corner 15B, groove 16 formed within the squared side L60A, rounded corner 15A (not seen in this view), right side L60C (not fully seen), groove 17, rounded corner 15C, aligning side L60E, rounded corner 15B, groove 16 formed within the squared side L60A, right side L60C (not fully seen).
9. See FIG. 69, as you face point 2 for the main tee 82A (shown sketched with dash lines) attach control line holder L60 to your left of point 2 by first inserting the wall angle molding 28B into the groove 16 formed within the squared side L60A, aligning side L60E to your left of point 2, followed by firmly tightening the thumb screw 11A.
10. See FIG. 69, the control line 80A must not be trapped against the groove 16 by the wall angle molding 28B.
11. See FIG. 69, next, with your right hand grab the control line 80A coming from holder R60 and pull on it while at the same time with your left hand you pull at the previously wrapped control line 80A on the holder L60, do this until you are satisfied with the tautness of the line, finally, with the line that is on your left hand wrap it around counter clock wise five times the remainder top section of the thumb screw 11A, return the line and let it hang next to right side L60C, by using the control line's 80A pulling force and wrapping the control line 80A counter clock wise the remainder top section of the thumb screw 11A locks the control line 80A and prevents it from becoming loose.
12. To adjust this control line 80A, first the line must be unwrapped from the screw 11A to relieve the pulling pressure from the taut control line, second, unscrew the thumb screw 11A four turns, then move the control line holder L60 to either side and firmly tighten the screw back, repeat step 11 over again.
13. The location of the control line 80B that runs perpendicular to the cross tee 82B (shown sketched with dash lines) is determined by adding the border dimension plus ½ the thickness of the cross tee.
14. See FIG. 70, control line for cross tee 82B (shown sketched with dash lines): Grab a roll of control line 80B and tie a loop 79 about 31.75 mm. in diameter at the end, with the other hand take additional control line holder L60 with the thumb screws 11A and 11B facing up, next, hook the loop 79 from groove 17 and the top L60D, wrap control line 80B around clock wise right side L60C (not fully seen in this view), rounded corner 15A (not seen in this view), groove 16, rounded corner 15B, aligning side L60E, rounded corner 15C, groove 17, right side L60C (not fully seen), rounded corner 15A (not seen), groove 16, rounded corner 15B, and ending running along aligning side L60E.
15. See FIG. 70, go to cross tee 82B (shown sketched with dash lines) point 3 and as you face point 3 attach additional control line holder L60 to your left of point 3 by first inserting the wall angle molding 28C into the groove 16 formed within the squared side L60A, aligning side L60E to your left of point 3, followed by firmly tightening the thumb screw 11A (not fully seen).
16. See FIG. 71, roll out control line 80B and go to point 4 for the cross tee 82B (shown sketched with dash lines) inscribed onto wall angle molding 28D, take additional control line holder R60, wrap the control line 80B around clock wise aligning side R60E, rounded corner 15B, groove 16 formed within the squared side R60A, rounded corner 15A (not seen in this view), left side R60C, groove 17, rounded corner 15C, aligning side R60E, rounded corner 15B, groove 16, left side R50C.
17. See FIG. 71, as you face point 4 for the cross tee 82B (shown sketched with dash lines) attach control line holder R60 to your right of point 4 by first inserting the wall angle molding 28D into the groove 16 formed within the squared side R60A, aligning side R60E to your right of point 4, followed by firmly tightening the thumb screw 11A.
18. See FIG. 71, the control line 80B must not be trapped against the groove 16 by the wall angle molding 28D.
19. See FIG. 71, next, with your left hand grab the control line 80B coming from additional holder L60 and pull on it while at the same time with your right hand you pull at the previously wrapped control line 80B on the additional holder R60, do this until you are satisfied with the tautness of the line, finally, with the line that is on your right hand wrap it around counter clock wise five times the remainder top section of the thumb screw 11A, return the line and let it hang next to left side R60C, by using the control line's 80B pulling force and wrapping the control line 80B counter clock wise the remainder top section of the thumb screw 11A locks the control line 80B and prevents it from becoming loose.
20. To adjust this control line 80B unwrap the line from the screw 11A to relieve the pulling pressure from the taut control line 80B, unscrew the thumb screw 11A four turns then move the additional control line holder R60 to either side and firmly tightening the screw back, repeat step 19 over again.

21. You have successfully installed, or set the control lines for a 90 degree angle grid.
22. See FIG. 68, as you start framing the 90 degree angle grid and you have the first trimmed to the border dimension main tee 82A (shown sketched with dash lines) position it between groove 17, groove 16, top of wall angle molding 28A and against the aligning side R60E and tighten the thumb screw 11B thus restricting the movement of the main tee 82A (shown sketched with dash lines).
23. See FIG. 70, as you start framing the 90 degree angle grid and you have the first trimmed to the border dimension cross tee 82B (shown sketched with dash lines) position it between groove 17, groove 16, top of wall angle molding 28C and against the aligning side L60E and tighten the thumb screw 11B thus restricting the movement of the cross tee 82B (shown sketched with dash lines).
24. See FIG. 69, as you finish framing the 90 degree angle grid and you have the last trimmed to the border dimension main tee 82A (shown sketched with dash lines) position it between groove 17, groove 16, top of wall angle molding 28B and against the aligning side L60E and tighten the thumb screw 11B thus restricting the movement of the main tee 82A (shown sketched with dash lines).
25. See FIG. 71, as you finish framing the 90 degree angle grid and you have the last trimmed to the border dimension cross tee 82B (shown sketched with dash lines) position it between groove 17, groove 16, top of wall angle molding 28D and against the aligning side R60E and tighten the thumb screw 11B thus restricting the movement of the cross tee 82B (shown sketched with dash lines).

Using control line holders L60, R60, additional R60, and additional L60 for 609.6 mm.×609.6 mm. or 2'×2' suspended-ceiling grids at 45 degree angle:

1. Referring to FIGS. 72 through 76 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed ceiling's height and label them as such.
3. On the floor of the room establish and snap a chalk line 90A in the middle of the room, at the center of this line 90A establish and snap a perpendicular chalk line 90B making sure it is a perfect 90 degree angle.
4. From this center point where chalk lines 90A and chalk line 90B intersect mark graduations of 431.8 mm. in three directions, then, from the marked graduations of 431.8 mm. measure and mark graduations of 863.6 mm. three times.
5. Snap a third chalk line 90C on the floor joining the last marked graduation of 863.60 mm.

on chalk line 90A and one last marked graduation of 863.60 mm. on chalk line 90B extending to wall angle moldings 28B and 28C.

6. Snap a fourth chalk line 90D on the floor joining the last marked graduation of 863.60 mm. on chalk line 90A and the last opposite marked graduation of 863.60 mm. on chalk line 90B extending to wall angle moldings 28A and 28C.
7. You have created 4 new marks, mark 1, mark 2, mark 3, and mark 4, transfer these 4 marks from the floor up to the wall moldings 28B, 28C, 28A, and 28C.
8. Layout location of control lines 80A and 80B on wall moldings 28B, 28C, 28A, and 28C making sure all the marks are above the finished ceiling so no one will be able to see them.
9. The location of the control line 80A that runs parallel to the main tee 82A (shown sketched with dash lines) is determined by inscribing ½ the thickness of the main tee parallel and to the right of mark 1 transferred from the floor onto wall angle molding 28B thus creating point 1, and parallel and to the left of mark 2 transferred from the floor onto wall angle molding 28C thus creating point 2.
10. The location of the control line 80B that runs parallel to the cross tee 82B (shown sketched with dash lines) is determined by inscribing ½ the thickness of the cross tee parallel and to the left of mark 3 transferred from the floor onto wall angle molding 28A thus creating point 3, and parallel and to the right of mark 4 transferred from the floor onto wall angle molding 28C thus creating point 4.
11. See FIG. 73, make sure the thumb screws 11A and 11B are threaded into holes 14C and 14D but not into angled groove 17.
12. See FIG. 73, take a roll of control line 80A and tie a loop 79 at the end, about 31.75 mm. in diameter, take control line holder L60 and hook the loop 79 from groove 16 and the top L60D, wrap control line 80A around counter clock wise right side L60C (not fully seen), rounded corner 15A (not seen), groove 17, rounded corner 15C, aligning side L60E, rounded corner 15B, groove 16, rounded corner 15A (not seen), right side L60C, groove 17, rounded corner 15C and ending running along the aligning side L60E.
13. See FIG. 73, go to point 1 inscribed onto wall angle molding 28B and as you face this main tee 82A (shown sketched with dash lines) point 1 attach control line holder L60 to your right of this point 1 by first inserting the wall angle molding 28B into groove 17 formed within angled side L60B, aligning side L60E to your right of point 1, followed by firmly tightening the thumb screw 11A.
14. See FIG. 74, roll out control line 80A and go to point 2, take control line holder R60, wrap the control line 80A around counter clock wise aligning side R60E, rounded corner 15C, groove 17 formed within the angled side R60B, rounded corner 15A (not seen), left side R60C (not fully seen), groove 16 formed within the squared side R60A, rounded corner 15B, aligning side R60E, rounded corner 15C, groove 17, and left side R60C (not fully seen).
15. See FIG. 74, as you face this main tee 82A (shown sketched with dash lines) point 2 attach control line holder R60 to your left of this point 2 by first inserting the wall angle molding 28C into groove 17, aligning side R60E to your left of point 2, followed by firmly tightening the thumb screw 11A.
16. See FIG. 74, the control line must not be trapped against the groove 17 by the wall angle molding 28C.
17. See FIG. 74, next, with your right hand grab the control line 80A coming from holder L60 and pull on it while at the same time with your left hand you pull at the previously wrapped line on holder R60, do this until you are satisfied with the tautness of the line, finally, with the line that is on your left hand wrap it around counter clock wise five times the remainder top section of the thumb screw 11A, return the line and let it hang next to left side R60C, by using the control line's 80A pulling force and wrapping the control line 80A counter clock wise the remainder top section of the thumb screw 11A locks the control line 80A and prevents it from becoming loose.
18. See FIG. 75, control line for cross tee 82B (shown sketched with dash lines), grab a roll of control line 80B and tie a loop 79 about 31.75 mm. in diameter at the end, with the other hand take additional control line holder R60 with the thumb screws 11A and 11B facing up, next, hook the loop 79 from groove 16 and the top R60D, wrap control line 80B around clock wise left side R60C (not fully seen), rounded corner 15A (not seen), groove 17, rounded corner 15C, aligning side R60E, rounded corner 15B, groove 16, rounded corner 15A (not seen), left side R60C (not fully seen), groove 17, rounded corner 15C, and ending running along aligning side R60E.

19. See FIG. 75, take additional holder R60 and go to point 3, and as you face point 3, attach additional control line holder R60 to your left of this point 3 by first inserting the wall angle molding 28A into groove 17, aligning side R60E to your left of point 3, followed by firmly tightening the thumb screw 11A.
20. See FIG. 76, roll out control line 80B and go to point 4, take additional control line holder L60 and wrap control line 80B clock wise aligning side L60E, rounded corner 15C, groove 17 formed within the angled side L60B, rounded corner 15A (not seen), right side L60C (not fully seen), groove 16, rounded corner 15B, aligning side L60E, rounded corner 15C, groove 17 formed within the angled side L60B, right side L60C (not fully seen).
21. See FIG. 76, as you face this cross tee 82B (shown sketched with dash lines) point 4 attach additional control line holder L60 to your right of this point 4 by first inserting the wall angle molding 28C into the groove 17, aligning side L60E to your right of point 4, followed by firmly tightening the thumb screw 11A.
22. See FIG. 76, the control line 80B must not be trapped against the groove 17 by the wall angle molding 28C.
23. See FIG. 76, next, with your left hand grab the control line 80B coming from holder R60 and pull on it while at the same time with your right hand you pull at the previously wrapped line on holder L60, do this until you are satisfied with the tautness of the line, finally, with the line that is on your right hand wrap it around counter clock wise five times the remainder top section of the thumb screw 11A, return the line and let it hang next to right side L60C, by using the control line's 80B pulling force and wrapping the control line 80B counter clock wise the remainder top section of the thumb screw 11A locks the control line 80B and prevents it from becoming loose.
24. You have set, or installed the control lines for a 45 degree angle grid.
25. See FIG. 74, as you start framing the 45 degree angle grid and you have the first trimmed to the border dimension main tee 82A (shown sketched with dash lines) position it between groove 16, groove 17, top of wall angle molding 28C and against the aligning side R60E and tighten the thumb screw 11B thus restricting the movement of the main tee 82A (shown sketched with dash lines).
26. See FIG. 76, as you start framing the 45 degree angle grid and you have the first trimmed to the border dimension cross tee 82B (shown sketched with dash lines) position it between groove 16, groove 17, top of wall angle molding 28C and against the aligning side L60E and tighten the thumb screw 11B thus restricting the movement of the cross tee 82B (shown sketched with dash lines).
27. See FIG. 73, as you finish framing the 45 degree angle grid and you have the last trimmed to the border dimension main tee 82A (shown sketched with dash lines) position it between groove 16, groove 17, top of wall angle molding 28B and against the aligning side L60E and tighten the thumb screw 11B thus restricting the movement of the main tee 82A (shown sketched with dash lines).
28. See FIG. 75, as you finish framing the 45 degree angle grid and you have the last trimmed to the border dimension cross tee 82B (shown sketched with dash lines) position it between groove 16, groove 17, top of wall angle molding 28A and against the aligning side R60E and tighten the thumb screw 11B thus restricting the movement of the cross tee 82B (shown sketched with dash lines).

DETAILED DESCRIPTION

FIGS. 77 Through 110—Fourth Embodiment

Figure 77:
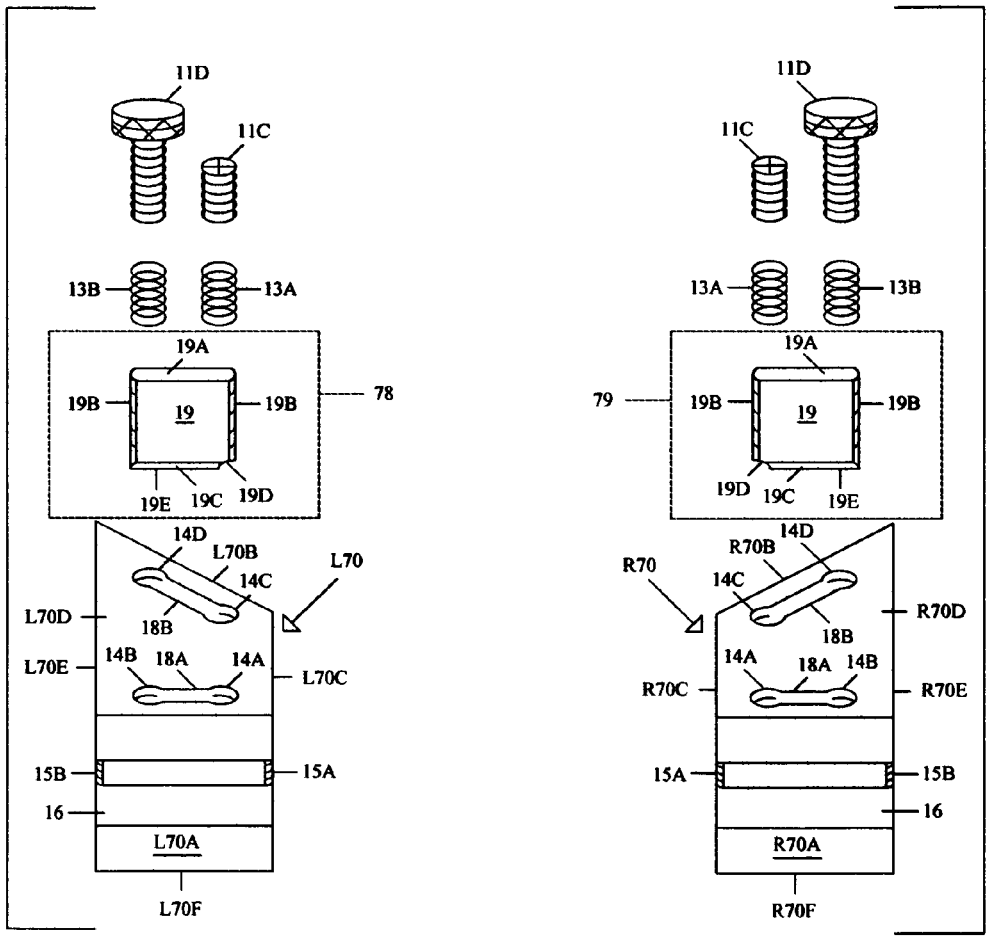
FIG. 77 is an exploded perspective view of a fourth embodiment L70 and R70 for use with grids at ninety degree angles in relation to the walls seen slightly from the top.

FIG. 77 is an exploded perspective view of a fourth embodiment L70 and R70 for use with grids at ninety degree angles in relation to the walls seen slightly from the top, control line holder L70 comprises a squared side L70A, a horizontal groove 16 formed within the squared side L70A, an angled side L70B, a horizontal angled groove 17 (not seen) formed within angled side L70B, a group of three rounded inside corners 15A, 15B and 15C formed by horizontal grooves 16 and 17 (rounded corner 15C not seen), a right side L70C, a top L70D, an aligning side L70E, a bottom side L70F (not seen), four threaded holes 14A, 14B, 14C and 14D formed through top L70D to horizontal grooves 16 and 17, a vertical groove 18A formed through top L70D to horizontal groove 16 and joining threaded holes 14A and 14B, a vertical groove 18B formed through top L70D to horizontal groove 17 and joining threaded holes 14C and 14D, an attaching-detaching locking bar 19 configured to fit within vertical groove 18A and threaded holes 14A and 14B comprising a top 19A, two rounded sides 19B, a rounded wall angle molding depressed locking actuator side 19C, an unlocking notch 19D, a flat bottom 19E (not fully seen), two compression springs 13A and 13B configured to fit within threaded holes 14A and 14B, a set screw 11C configured to be screwed into threaded hole 14A, a thumb screw 11D configured to be screwed into threaded hole 14B, control line holder R70 comprises a squared side R70A, a horizontal groove 16 formed within the squared side R70A, an angled side R70B, a horizontal angled groove 17 formed within angled side R70B (not seen), a group of three rounded inside corners 15A, 15B and 15C formed by grooves 16 and 17 (rounded corner 15C not seen), a left side R70C, a top R70D, an aligning side R70E, a bottom side R70F (not seen), four threaded holes 14A, 14B, 14C and 14D formed through top R70D to horizontal grooves 16 and 17, a vertical groove 18A formed through top R70D to horizontal groove 16 and joining threaded holes 14A and 14B, a vertical groove 18B formed through top R70D to horizontal groove 17 and joining threaded holes 14C and 14D, an attaching-detaching locking bar 19 configured to fit within vertical groove 18A and threaded holes 14A and 14B comprising a top 19A, two rounded sides 19B, a rounded wall angle molding depressed locking actuator side 19C, an unlocking notch 19D, a flat bottom 19E (not fully seen), two compression springs 13A and 13B configured to fit within threaded holes 14A and 14B, a set screw 11C configured to be screwed into threaded hole 14A, a thumb screw 11D configured to be screwed into threaded hole 14B.

Figure 78:
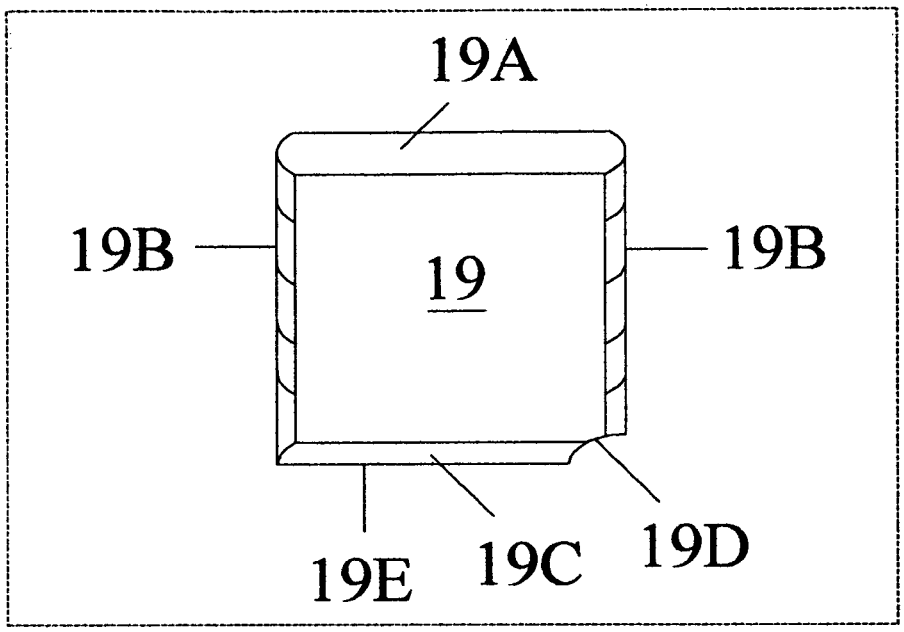
FIG. 78 is a perspective view of a three times enlarged attaching-detaching locking bar seen slightly from the top.

FIG. 78 is a perspective view of a three times enlarged attaching-detaching locking bar 19 seen slightly from the top and comprises a top 19A, two rounded sides 19B, a rounded wall angle molding depressed locking actuator side 19C, an unlocking notch 19D, and a flat bottom 19E (not fully seen).

Figure 79:
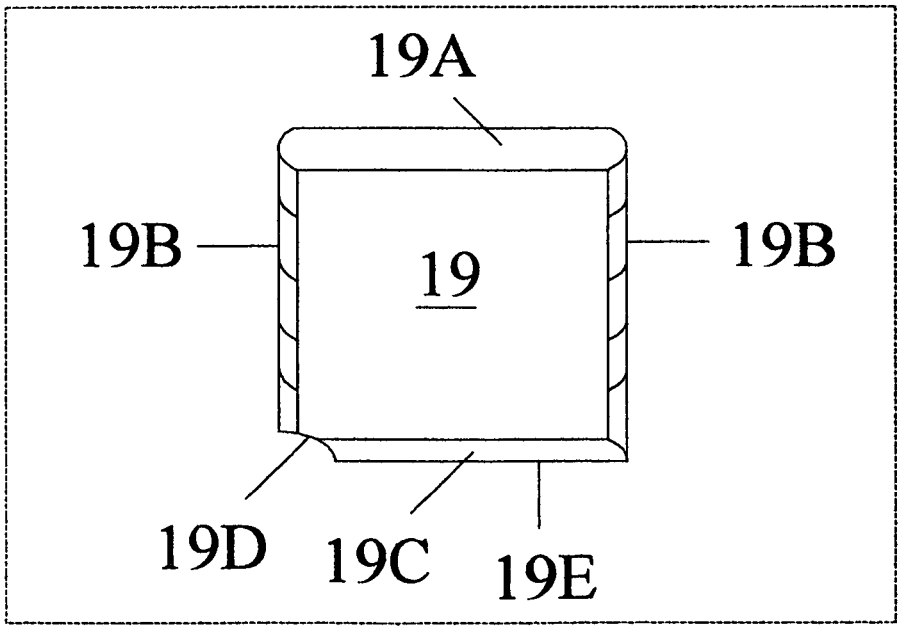
FIG. 79 is a perspective view of a three times enlarged attaching-detaching locking bar seen slightly from the top.

FIG. 79 is a perspective view of a three times enlarged attaching-detaching locking bar 19 seen slightly from the top and comprises a top 19A, two rounded sides 19B, a rounded wall angle molding depressed locking actuator side 19C, an unlocking notch 190, and a flat bottom 19E (not fully seen).

Figure 80:
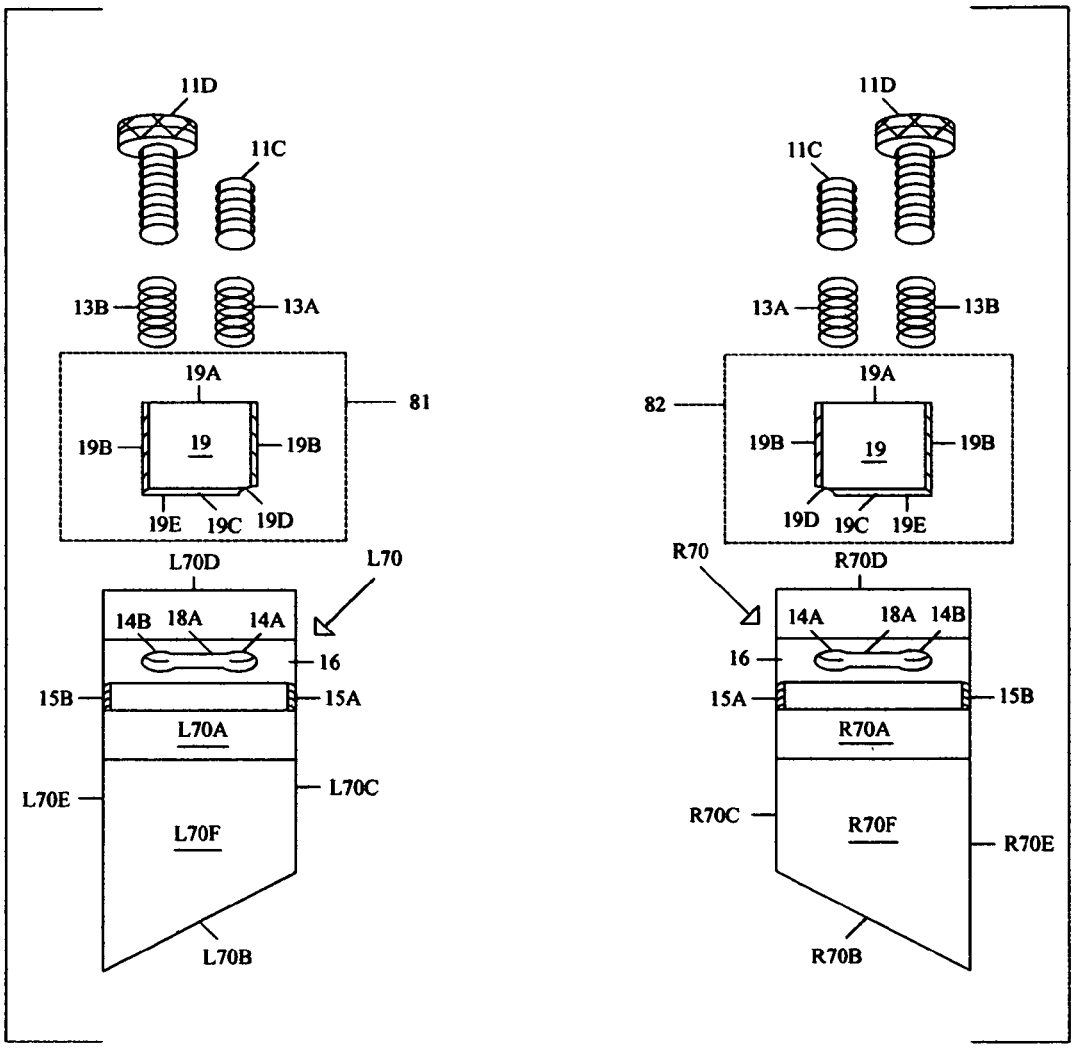
FIG. 80 is an exploded perspective view of the fourth embodiment L70 and R70 for use with grids at ninety degree angles in relation to the walls seen slightly from the bottom.

FIG. 80 is an exploded perspective view of the fourth embodiment L70 and R70 for use with grids at ninety degree angles in relation to the walls seen slightly from the bottom, control line holder L70 comprises a squared side L70A, a horizontal groove 16 formed within the squared side L70A, an angled side L70B, a horizontal angled groove 17 (not seen) formed within angled side L70B, a group of three rounded inside corners 15A, 15B and 15C formed by horizontal grooves 16 and 17 (rounded corner 15C not seen), a right side L70C, a top L70D, an aligning side L70E, a bottom side L70F, four threaded holes 14A, 14B, 14C (not seen), and 14D (not seen) formed through top L70D to horizontal grooves 16 and 17, a vertical groove 18A formed through top L70D to horizontal groove 16 and joining threaded holes 14A and 14B, a vertical groove 18B (not seen) formed through top L70D to groove 17 (not seen) and joining threaded holes 14C (not seen) and 14D (not seen), an attaching-detaching locking bar 19 configured to fit within vertical groove 18A and threaded holes 14A and 14B comprising a top 19A, two rounded sides 19B, a rounded wall angle molding depressed locking actuator side 19C, an unlocking notch 190, a flat bottom 19E (not fully seen), two compression springs 13A and 13B configured to fit within threaded holes 14A and 14B, a set screw 11C configured to be screwed into threaded hole 14A, a thumb screw 11D configured to be screwed into threaded hole 14B, control line holder R70 comprises a squared side R70A, a horizontal groove 16 formed within the squared side R70A, an angled side R70B, a horizontal angled groove 17 (not seen) formed within angled side R70B, a group of three rounded inside corners 15A, 15B and 15C formed by horizontal grooves 16 and 17 (rounded corner 15C not seen), a left side R70C, a top R70D (not seen), an aligning side R70E, a bottom side R70F, four threaded holes 14A, 14B, 14C (not seen), and 14D (not seen) formed through top R70D to horizontal grooves 16 and 17 (not seen), a vertical groove 18A formed through top R70D to horizontal groove 16 and joining threaded holes 14A and 14B, a vertical groove 18B (not seen) formed through top R70D to horizontal groove 17 (not seen) and joining threaded holes 14C (not seen), and 14D (not seen), an attaching-detaching locking bar 19 configured to fit within vertical groove 18A and threaded holes 14A and 14B comprising a top 19A, two rounded sides 19B, a rounded wall angle molding depressed locking actuator side 19C, an unlocking notch 19D, a flat bottom 19E (not fully seen), two compression springs 13A and 13B configured to fit within threaded holes 14A and 14B, a set screw 11C configured to be screwed into threaded hole 14A, a thumb screw 11D configured to be screwed into threaded hole 14B.

Figure 81:
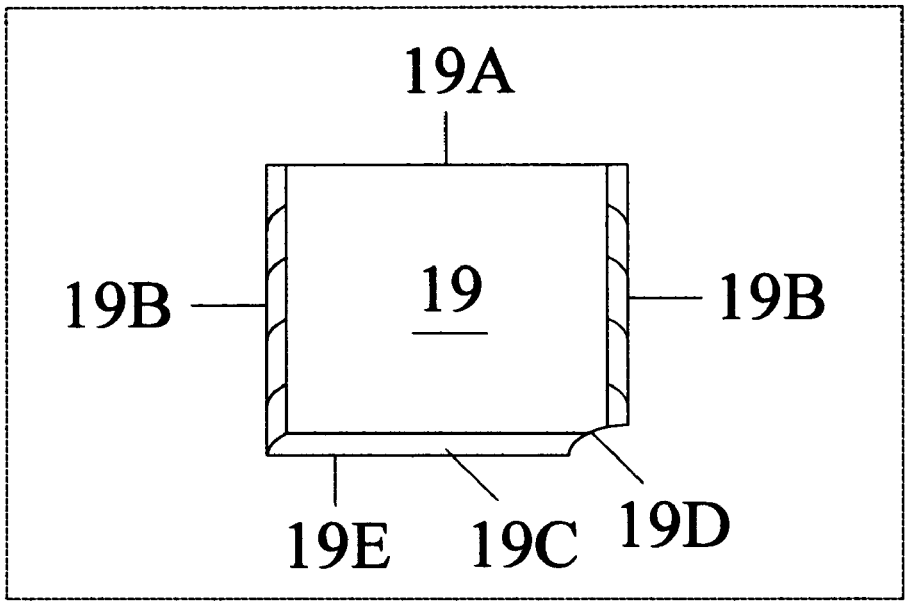
FIG. 81 is a perspective view of a three times enlarged attaching-detaching locking bar seen slightly from the bottom.

FIG. 81 is a perspective view of a three times enlarged attaching-detaching locking bar 19 seen slightly from the bottom and comprises a top 19A (not fully seen), two rounded sides 19B, a rounded wall angle molding depressed locking actuator side 19C, an unlocking notch 19D, and a flat bottom 19E (not fully seen).

Figure 82:
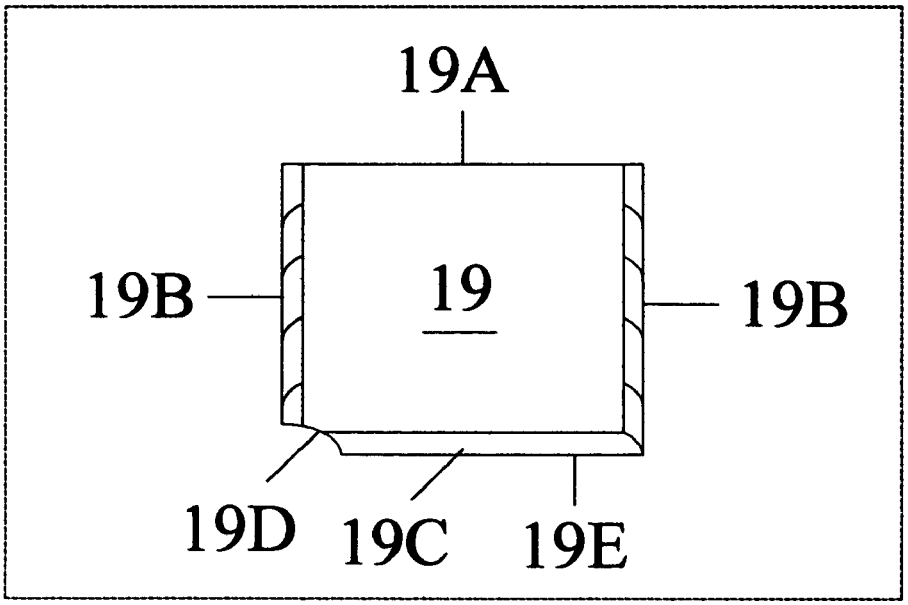
FIG. 82 is a perspective view of a three times enlarged attaching-detaching locking bar seen slightly from the bottom.

FIG. 82 is a perspective view of a three times enlarged attaching-detaching locking bar 19 seen slightly from the bottom and comprises a top 19A (not fully seen), two rounded sides 19B, a rounded wall angle molding depressed locking actuator side 19C, an unlocking notch 19D, and a flat bottom 19E (not fully seen).

Figure 83:
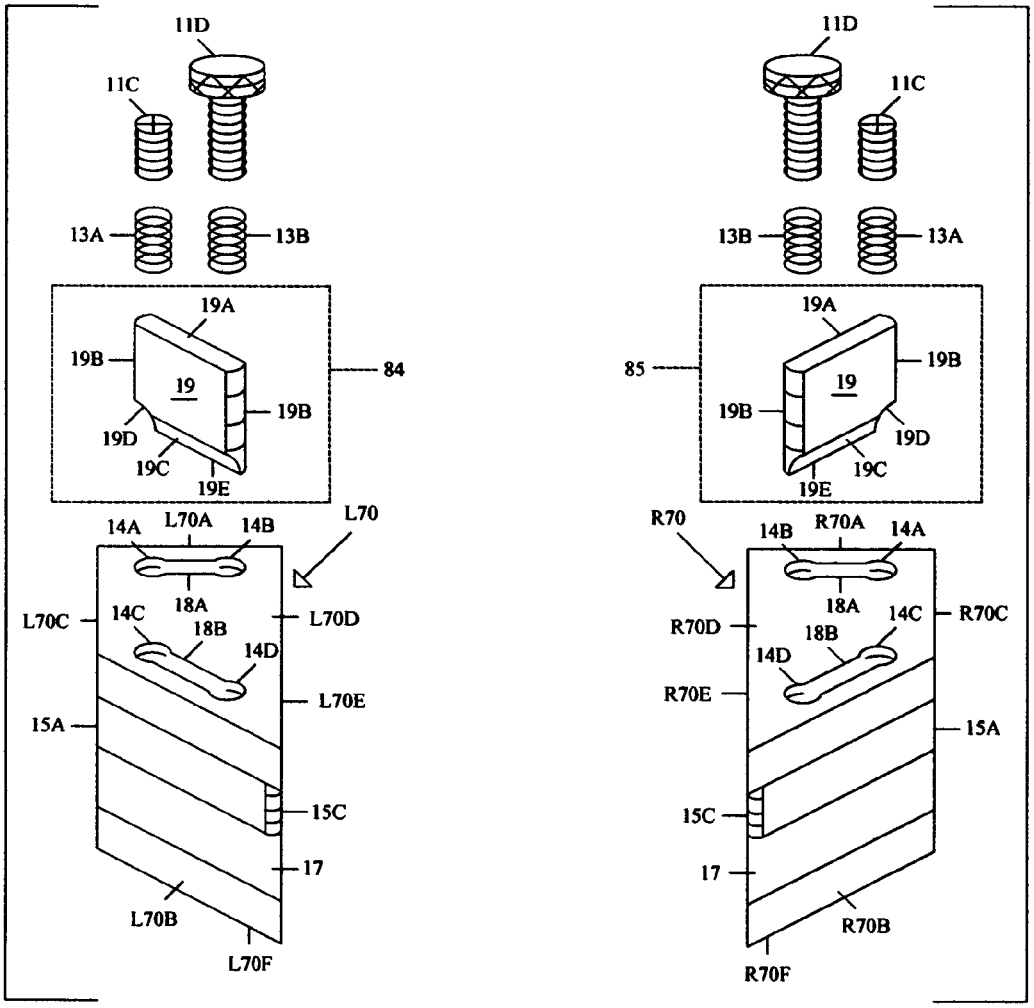
FIG. 83 is an exploded perspective view of the fourth embodiment L70 and R70 for use with grids at forty-five degree angles in relation to the walls seen slightly from the top.

FIG. 83 is an exploded perspective view of the fourth embodiment L70 and R70 for use with grids at forty-five degree angles in relation to the walls seen slightly from the top, control line holder L70 comprises a squared side L70A (not fully seen), a horizontal groove 16 formed within the squared side L70A (not seen), an angled side L70B, a horizontal angled groove 17 formed within angled side L70B, a group of three rounded inside corners 15A (not seen), 15B (not seen) and 15C formed by horizontal grooves 16 (not seen) and 17, a right side L70C, a top L70D, an aligning side L70E, a bottom side L70F (not seen), four threaded holes 14A, 14B, 14C and 14D formed through top L70D to horizontal grooves 16 and 17, a vertical groove 18A formed through top L70D to horizontal groove 16 and joining threaded holes 14A and 14B, a vertical groove 18B formed through top L70D to horizontal groove 17 and joining threaded holes 14C and 14D, an attaching-detaching locking bar 19 configured to fit within vertical groove 18B and threaded holes 14C and 14D comprising a top 19A, two rounded sides 19B (one side 19B is not fully seen), a rounded wall angle molding depressed locking actuator side 19C, an unlocking notch 190, a flat bottom 19E (not fully seen), two compression springs 13A and 13B configured to fit within threaded holes 14C and 14D, a set screw 11C configured to be screwed into threaded hole 14C, a thumb screw 11D configured to be screwed into threaded hole L40, control line holder R70 comprises a squared side R70A (not fully seen), a horizontal groove 16 formed within the squared side R70A (not seen), an angled side R70B, a horizontal angled groove 17 formed within angled side R70B, a group of three rounded inside corners 15A (not seen), 15B (not seen) and 15C formed by horizontal grooves 16 and 17, a left side R70C, a top R70D, an aligning side R70E, a bottom side R70F (not seen), four threaded holes 14A, 14B, 14C and 14D formed through top R70D to horizontal grooves 16 and 17, a vertical groove 18A formed through top R70D to horizontal groove 16 and joining threaded holes 14A and 14B, a vertical groove 18B formed through top R70D to horizontal groove 17 and joining threaded holes 14C and 14D, an attaching-detaching locking bar 19 configured to fit within vertical groove 18B and threaded holes 14C and 14D comprising a top 19A, two rounded sides 19B (one rounded side 198 is not fully seen), a rounded wall angle molding depressed locking actuator side 19C, an unlocking notch 190, a flat bottom 19E (not fully seen), two compression springs 13A and 13B configured to fit within threaded holes 14C and 14D, a set screw 11C configured to be screwed into threaded hole 14C, a thumb screw 11D configured to be screwed into threaded hole 14D.

Figure 84:
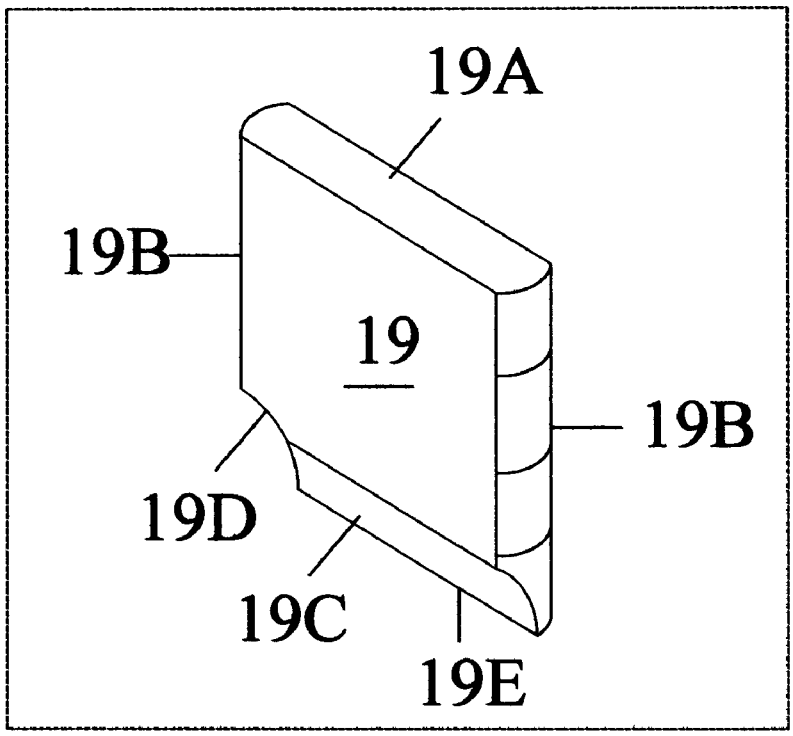
FIG. 84 is a perspective view of a three times enlarged attaching-detaching locking bar seen slightly from the top.

FIG. 84 is a perspective view of a three times enlarged attaching-detaching locking bar 19 seen slightly from the top and comprises a top 19A, two rounded sides 19B (one rounded side 19B is not fully seen), a rounded wall angle molding depressed locking actuator side 19C, an unlocking notch 19D, and a flat bottom 19E (not fully seen).

Figure 85:
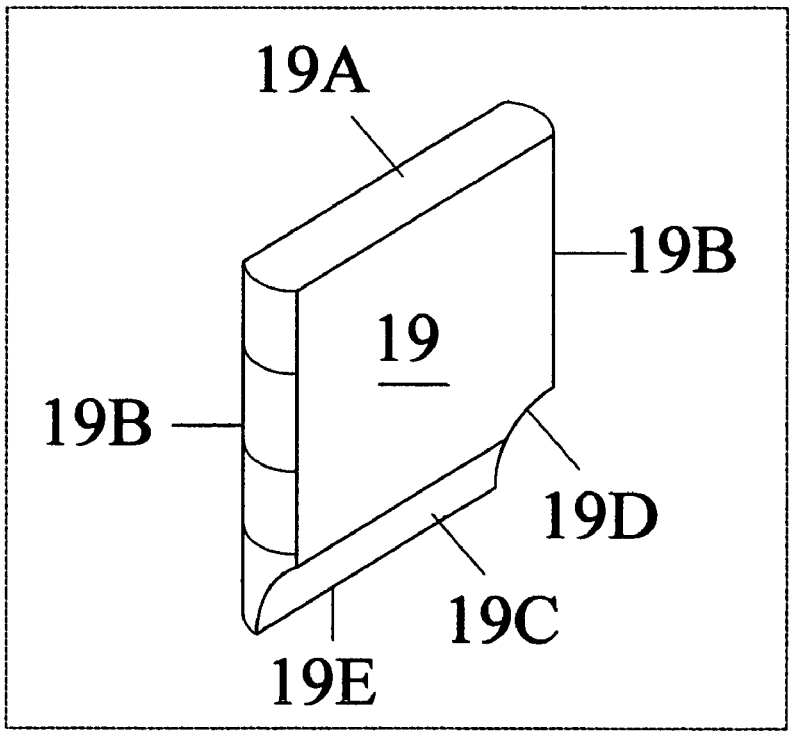
FIG. 85 is a perspective view of a three times enlarged attaching-detaching locking bar seen slightly from the top.

FIG. 85 is a perspective view of a three times enlarged attaching-detaching locking bar 19 seen slightly from the top and comprises a top 19A, two rounded sides 19B (one rounded side 19B is not fully seen), a rounded wall angle molding depressed locking actuator side 19C, an unlocking notch 19D, and a flat bottom 19E (not fully seen).

Figure 86:
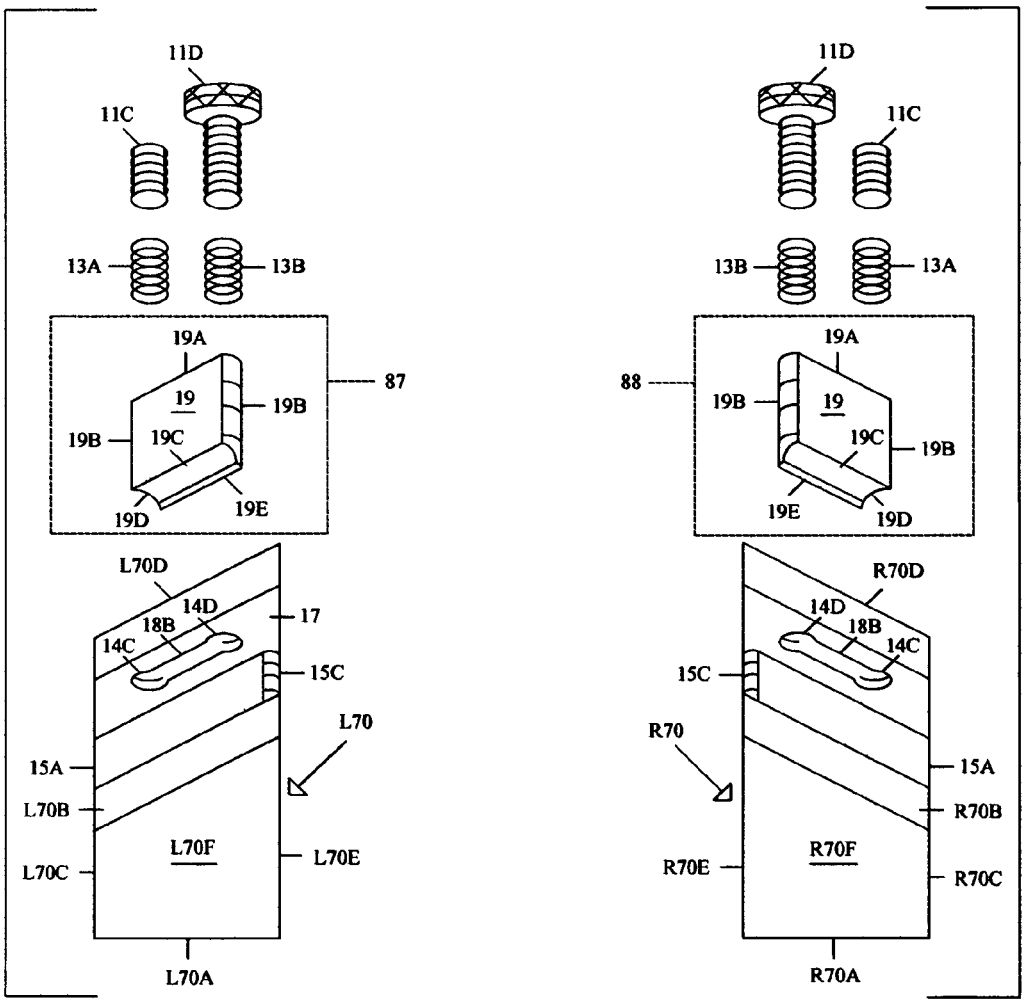
FIG. 86 is an exploded perspective view of the fourth embodiment L70 and R70 for use with grids at forty-five degree angles in relation to the walls seen slightly from the bottom.

FIG. 86 is an exploded perspective view of the fourth embodiment L70 and R70 for use with grids at forty-five degree angles in relation to the walls seen slightly from the bottom, control line holder L70 comprises a squared side L70A (not fully seen), a horizontal groove 16 formed within the squared side L70A (not seen), an angled side L70B, a horizontal angled groove 17 formed within angled side L70B, a group of three rounded inside corners 15A (not seen), 15B (not seen) and 15C formed by horizontal grooves 16 and 17, a right side L70C, a top L70D (not seen), an aligning side L70E, a bottom side L70F, four threaded holes 14A (not seen), 14B (not seen), 14C and 14D formed through top L70D (not seen) to horizontal grooves 16 and 17, a vertical groove 18A (not seen) formed through top L70D to horizontal groove 16 and joining threaded holes 14A and 14B (not seen), a vertical groove 18B formed through top L70D to groove 17 and joining threaded holes 14C and 14D, an attaching-detaching locking bar 19 configured to fit within groove 18B and threaded holes 14C and 14D comprising a top 19A (not fully seen), two rounded sides 19B (one rounded side 19B is not fully seen), a rounded wall angle molding depressed locking actuator side 19C, an unlocking notch 19D, a flat bottom 19E, two compression springs 13A and 13B configured to fit within threaded holes 14C and 14D, a set screw 11C configured to be screwed into threaded hole 14C, a thumb screw 11D configured to be screwed into threaded hole 14D, control line holder R70 comprises a squared side R70A (not fully seen), a horizontal groove 16 formed within the squared side R70A (not seen), an angled side R70B, a horizontal angled groove 17 formed within angled side R70B, a group of three rounded inside corners 15A (not seen), 15B (not seen) and 15C formed by horizontal grooves 16 and 17, a left side R70C, a top R70D (not seen), an aligning side R70E, a bottom side R70F, four threaded holes 14A (not seen), 14B (not seen), 14C and 14D formed through top R70D to horizontal grooves 16 and 17, a vertical groove 18A (not seen) formed through top R70D to horizontal groove 16 and joining threaded holes 14A and 14B (not seen), a vertical groove 18B formed through top R70D to horizontal groove 17 and joining threaded holes 14C and 14D, an attaching-detaching locking bar 19 configured to fit within groove 18B and threaded holes 14C and 14D comprising a top 19A, two rounded sides 19B (one rounded side 19B is not fully seen), a rounded wall angle molding depressed locking actuator side 19C, an unlocking notch 19D, a flat bottom 19E, two compression springs 13A and 13B configured to fit within threaded holes 14C and 14D, a set screw 11C configured to be screwed into threaded hole 14C, a thumb screw 11D configured to be screwed into threaded hole 14D.

Figure 87:
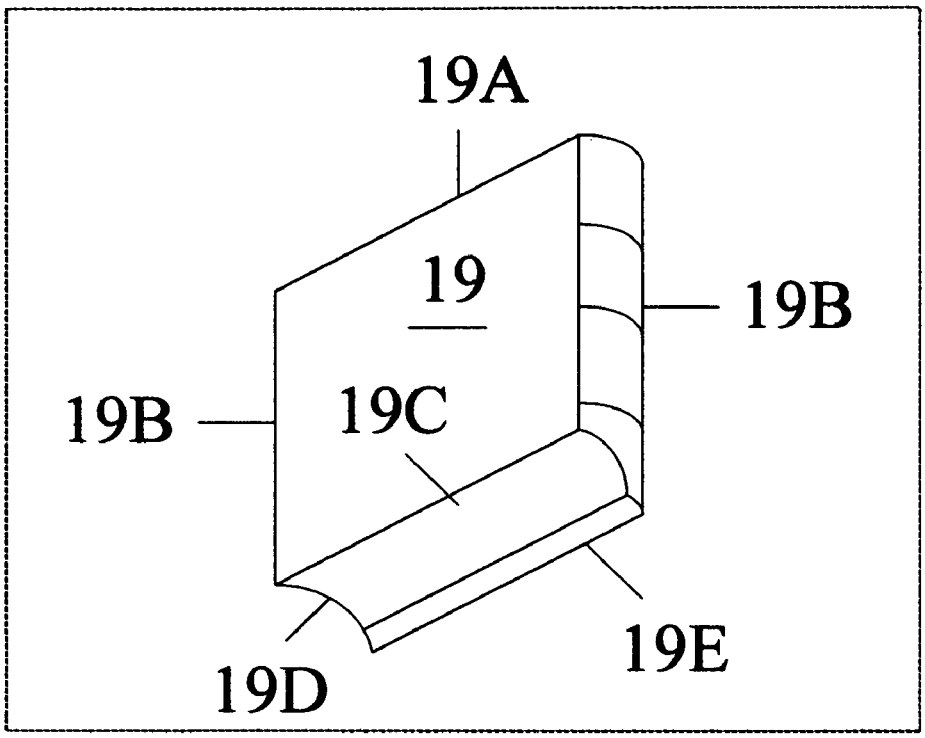
FIG. 87 is a perspective view of a three times enlarged attaching-detaching locking bar seen slightly from the bottom.

FIG. 87 is a perspective view of a three times enlarged attaching-detaching locking bar 19 seen slightly from the bottom and comprises a top 19A (not fully seen), two rounded sides 19B (one rounded side 19B is not fully seen), a rounded wall angle molding depressed locking actuator side 19C, an unlocking notch 19D, and a flat bottom 19E.

Figure 88:
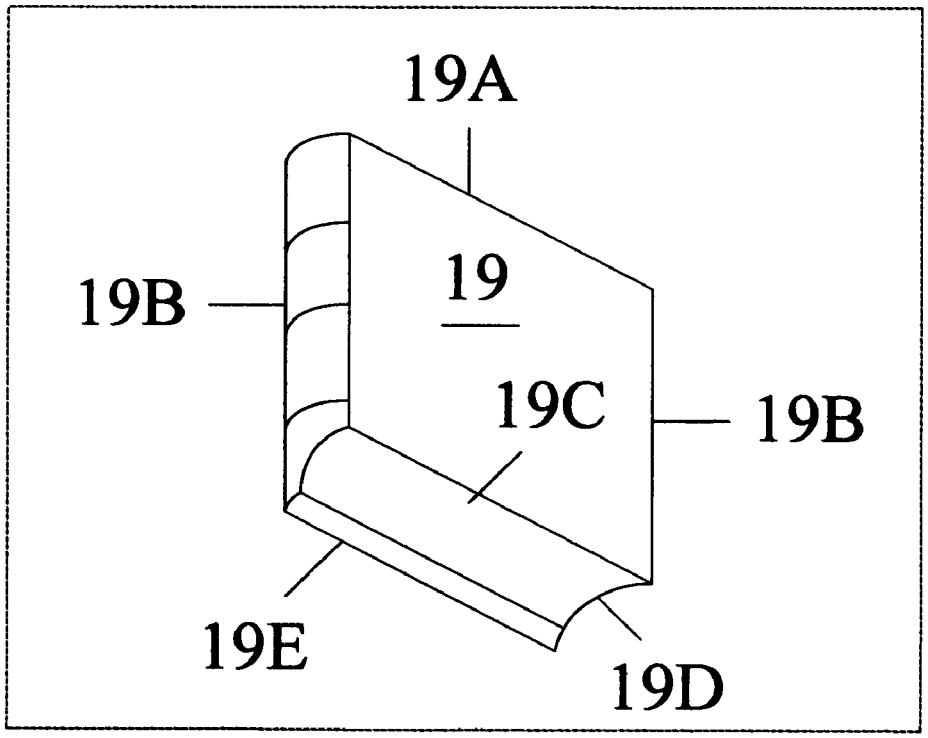
FIG. 88 is a perspective view of a three times enlarged attaching-detaching locking bar seen slightly from the bottom.

FIG. 88 is a perspective view of a three times enlarged attaching-detaching locking bar 19 seen slightly from the bottom and comprises a top 19A (not fully seen), two rounded sides 19B (one rounded side 19B is not fully seen), a rounded wall angle molding depressed locking actuator side 19C, an unlocking notch 19D, and a flat bottom 19E.

Figure 89:
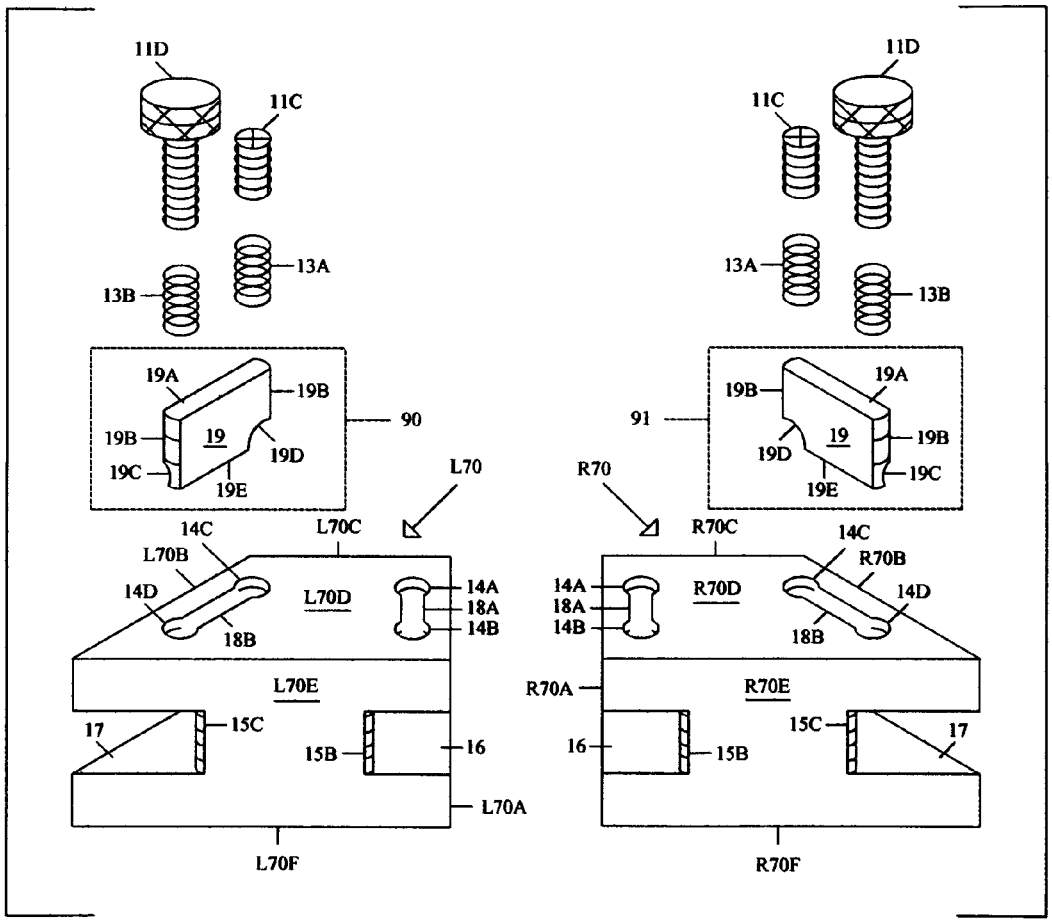
FIG. 89 is an exploded perspective side view of the fourth embodiment L70 and R70 for use with grids at forty-five degree angles in relation to the walls seen slightly from the top.

FIG. 89 is an exploded perspective side view of the fourth embodiment L70 and R70 for use with grids at forty-five degree angles in relation to the walls seen slightly from the top, control line holder L70 comprises a squared side L70A, a horizontal groove 16 formed within the squared side L70A, an angled side L70B, a horizontal angled groove 17 formed within angled side L70B, a group of three rounded inside corners 15A (not seen), 15B and 15C formed by horizontal grooves 16 and 17, a right side L70C, a top L70D, an aligning side L70E, a bottom side L70F (not seen), four threaded holes 14A, 14B, 14C and 14D formed through top L70D to horizontal grooves 16 and 17, a vertical groove 18A formed through top L70D to horizontal groove 16 and joining threaded holes 14A and 14B, a vertical groove 18B formed through top L70D to horizontal groove 17 and joining threaded holes 14C and 14D, an attaching-detaching locking bar 19 configured to fit within vertical groove 18B and threaded holes 14C and 14D comprising a top 19A, two rounded sides 19B (one rounded side 19B is not fully seen), a rounded wall angle molding depressed locking actuator side 19C, an unlocking notch 19D, a flat bottom 19E (not fully seen), two compression springs 13A and 13B configured to fit within threaded holes 14C and 14D, a set screw 11C configured to be screwed into threaded hole 14C, a thumb screw 11D configured to be screwed into threaded hole 14D, control line holder R70 comprises a squared side R70A, a horizontal groove 16 formed within the squared side R70A, an angled side R70B, a horizontal angled groove 17 formed within angled side R70B, a group of three rounded inside corners 15A (not seen), 15B and 15C formed by horizontal grooves 16 and 17, a left side R70C, a top R70D, an aligning side R70E, a bottom side R70F (not seen), four threaded holes 14A, 14B, 14C and 14D formed through top R70D to horizontal grooves 16 and 17, a vertical groove 18A formed through top R70D to horizontal groove 16 and joining threaded holes 14A and 14B, a vertical groove 18B formed through top R70D to horizontal groove 17 and joining threaded holes 14C and 14D, an attaching-detaching locking bar 19 configured to fit within groove 18B and threaded holes 14C and 14D comprising a top 19A, two rounded sides 19B (one rounded side 19B is not fully seen), a rounded wall angle molding depressed locking actuator side 19C, an unlocking notch 19D, a flat bottom 19E (not fully seen), two compression springs 13A and 13B configured to fit within threaded holes 14C and 14D, a set screw 11C configured to be screwed into threaded hole 14C, a thumb screw 11D configured to be screwed into threaded hole 14D.

Figure 90:
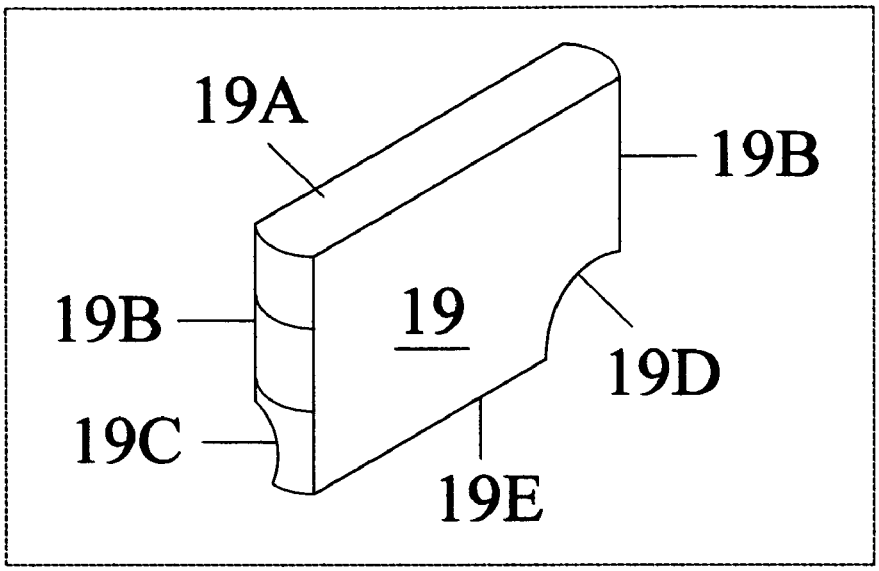
FIG. 90 is a perspective view of a three times enlarged attaching-detaching locking bar seen slightly from the top.

FIG. 90 is a perspective view of a three times enlarged attaching-detaching locking bar 19 seen slightly from the top and comprises a top 19A, two rounded sides 19B (one rounded side 19B is not fully seen), a rounded wall angle molding depressed locking actuator side 19C (not fully seen), an unlocking notch 19D, and a flat bottom 19E (not fully seen).

Figure 91:
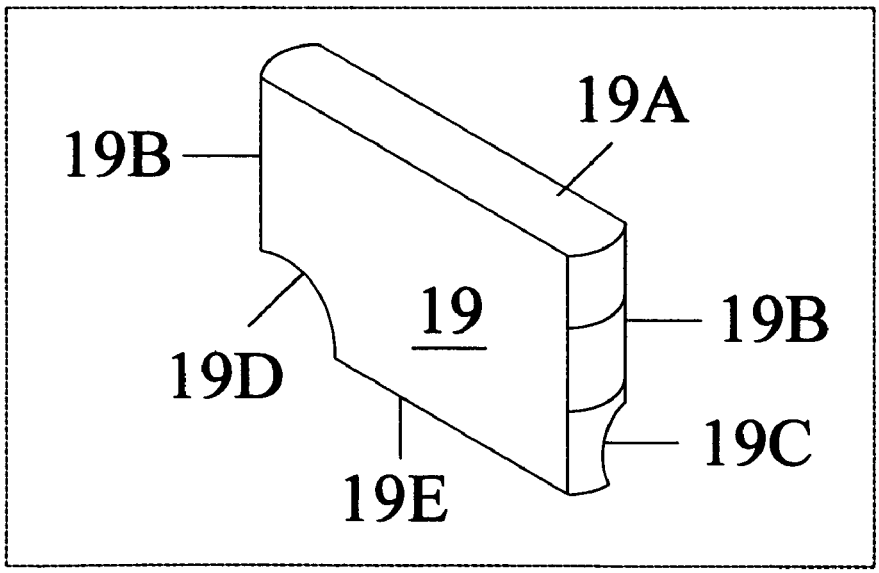
FIG. 91 is a perspective view of a three times enlarged attaching-detaching locking bar seen slightly from the top.

FIG. 91 is a perspective view of a three times enlarged attaching-detaching locking bar 19 seen slightly from the top and comprises a top 19A, two rounded sides 19B (one rounded side 19B is not fully seen), a rounded wall angle molding depressed locking actuator side 19C (not fully seen), an unlocking notch 19D, and a flat bottom 19E (not fully seen).

Figure 92:
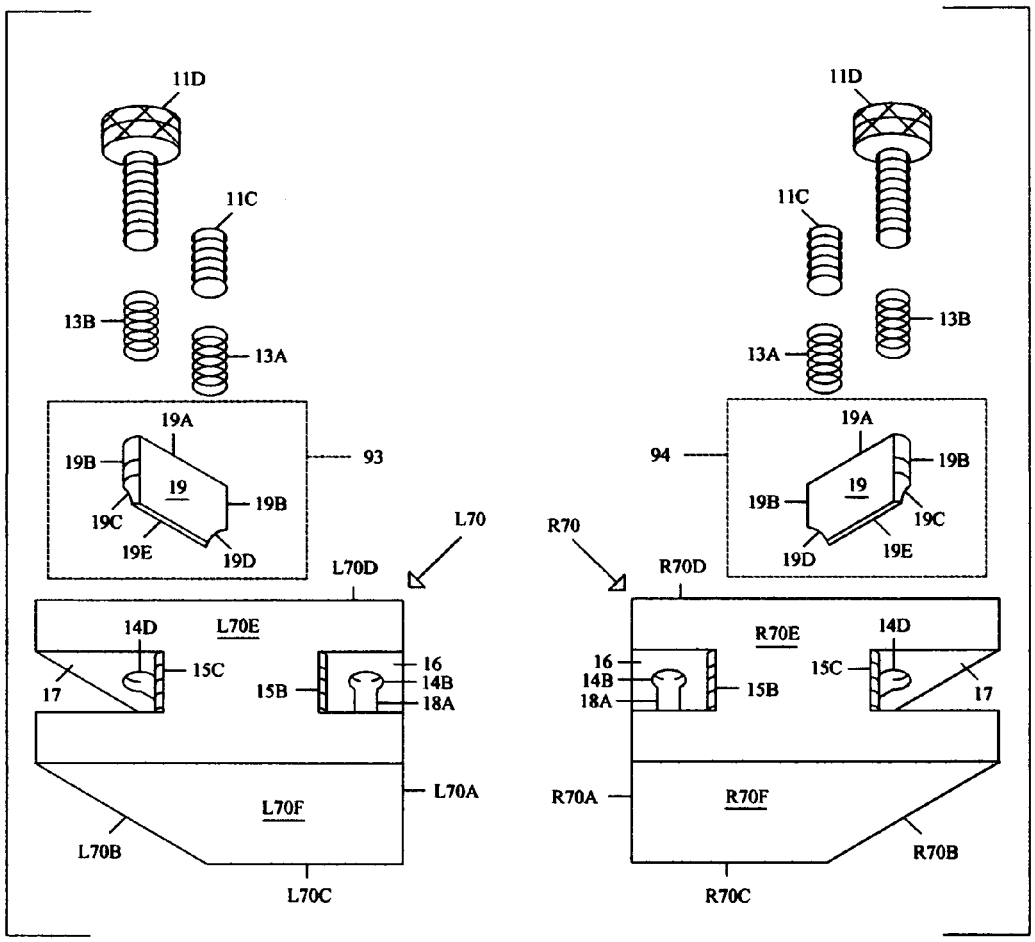
FIG. 92 is an exploded perspective side view of the fourth embodiment L70 and R70 for use with grids at forty-five degree angles in relation to the walls seen slightly from the bottom.

FIG. 92 is an exploded perspective side view of the fourth embodiment L70 and R70 for use with grids at forty-five degree angles in relation to the walls seen slightly from the bottom, control line holder L70 comprises a squared side L70A, a horizontal groove 16 formed within the squared side L70A, an angled side L70B, a horizontal angled groove 17 formed within angled side L70B, a group of three rounded inside corners 15A (not seen), 15B and 15C formed by horizontal grooves 16 and 17, a right side L70C, a top L70D (not seen), an aligning side L70E, a bottom side L70F, four threaded holes 14A (not seen), 14B, 14C (not seen), and 14D formed through top L70D to horizontal grooves 16 and 17, a vertical groove 18A (not fully seen) formed through top L70D to horizontal groove 16 and joining threaded holes 14A (not seen) and 14B, a vertical groove 18B (not seen) formed through top L70D to horizontal groove 17 and joining threaded holes 14C (not seen) and 14D, an attaching-detaching locking bar 19 configured to fit within groove 18B and threaded holes 14C and 14D comprising a top 19A (not fully seen), two rounded sides 19B (one rounded side 19B is not fully seen), a rounded wall angle molding depressed locking actuator side 19C (not fully seen), an unlocking notch 19D, a flat bottom 19E, two compression springs 13A and 13B configured to fit within threaded holes 14C (not seen) and 14D, a set screw 11C configured to be screwed into threaded hole 14C, a thumb screw 11D configured to be screwed into threaded hole 14D, control line holder R70 comprises a squared side R70A, a horizontal groove 16 formed within the squared side R70A, an angled side R70B, a horizontal angled groove 17 formed within angled side R70B, a group of three rounded inside corners 15A (not seen), 15B and 15C formed by horizontal grooves 16 and 17, a left side R70C, a top R70D (not seen), an aligning side R70E, a bottom side R70F, four threaded holes 14A (not seen), 14B, 14C (not seen) and 14D formed through top R70D to horizontal grooves 16 and 17, a vertical groove 18A (not fully seen) formed through top R70D to horizontal groove 16 and joining threaded holes 14A and 14B, a vertical groove 18B (not seen) formed through top R70D to horizontal groove 17 and joining threaded holes 14C and 14D, an attaching-detaching locking bar 19 configured to fit within vertical groove 18B and threaded holes 14C and 14D comprising a top 19A (not fully seen), two rounded sides 19B (one rounded side 19B is not fully seen), a rounded wall angle molding depressed locking actuator side 19C, an unlocking notch 190, a flat bottom 19E, two compression springs 13A and 13B configured to fit within threaded holes 14C and 14D, a set screw 11C configured to be screwed into threaded hole 14C, a thumb screw 11D configured to be screwed into threaded hole 14D.

Figure 93:
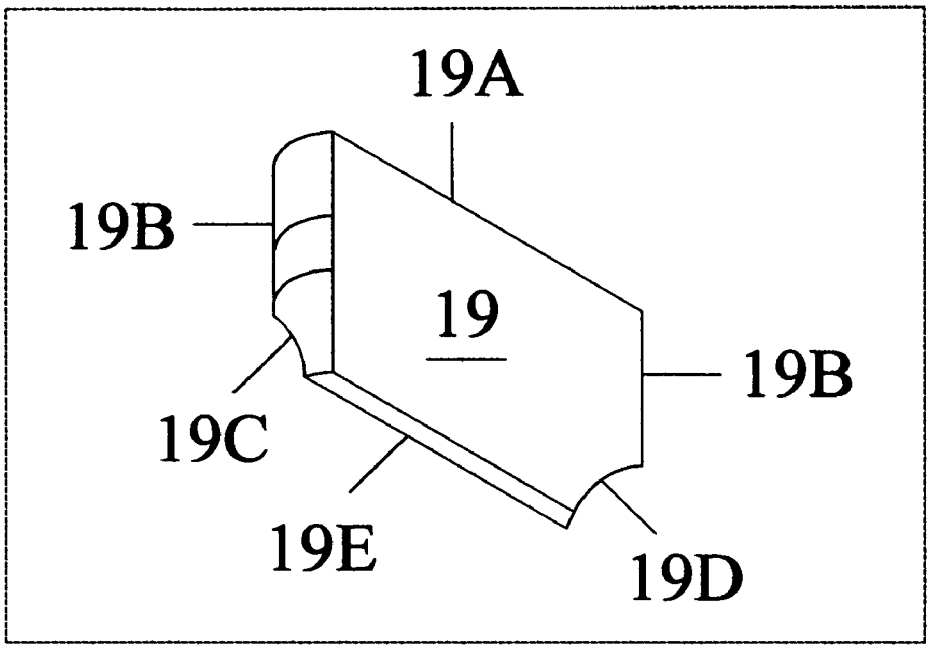
FIG. 93 is a perspective view of a three times enlarged attaching-detaching locking bar seen slightly from the bottom.

FIG. 93 is a perspective view of a three times enlarged attaching-detaching locking bar 19 seen slightly from the bottom and comprises a top 19A (not fully seen), two rounded sides 19B (one rounded side 19B is not fully seen), a rounded wall angle molding depressed locking actuator side 19C (not fully seen), an unlocking notch 19D, and a flat bottom 19E.

Figure 94:
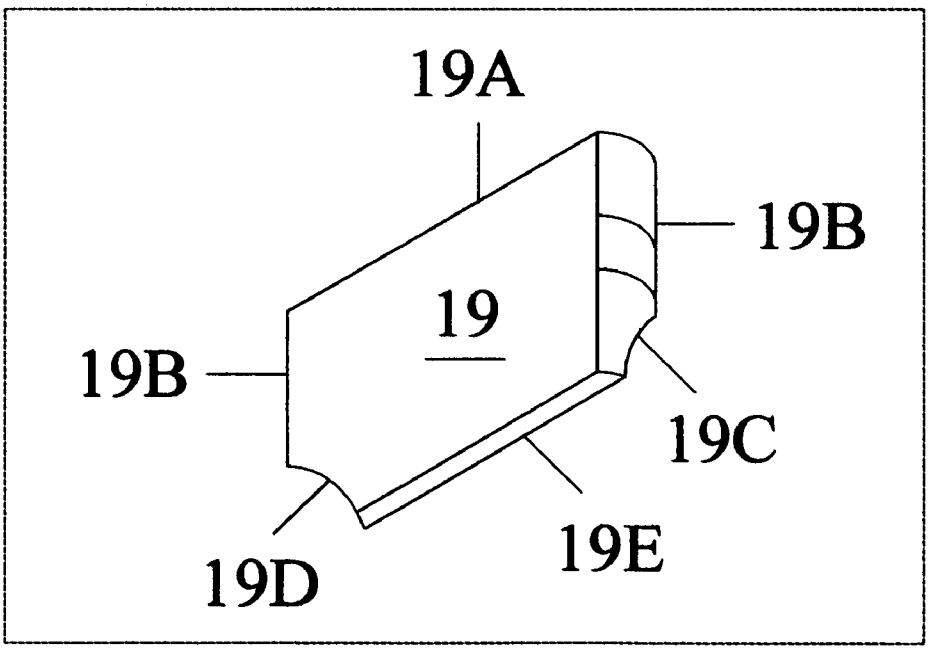
FIG. 94 is a perspective view of a three times enlarged attaching-detaching locking bar seen slightly from the bottom.

FIG. 94 is a perspective view of a three times enlarged attaching-detaching locking bar 19 seen slightly from the bottom and comprises a top 19A (not fully seen), two rounded sides 19B (one rounded side 19B is not fully seen), a rounded wall angle molding depressed locking actuator side 19C (not fully seen), an unlocking notch 19D, and a flat bottom 19E.

Figure 95:
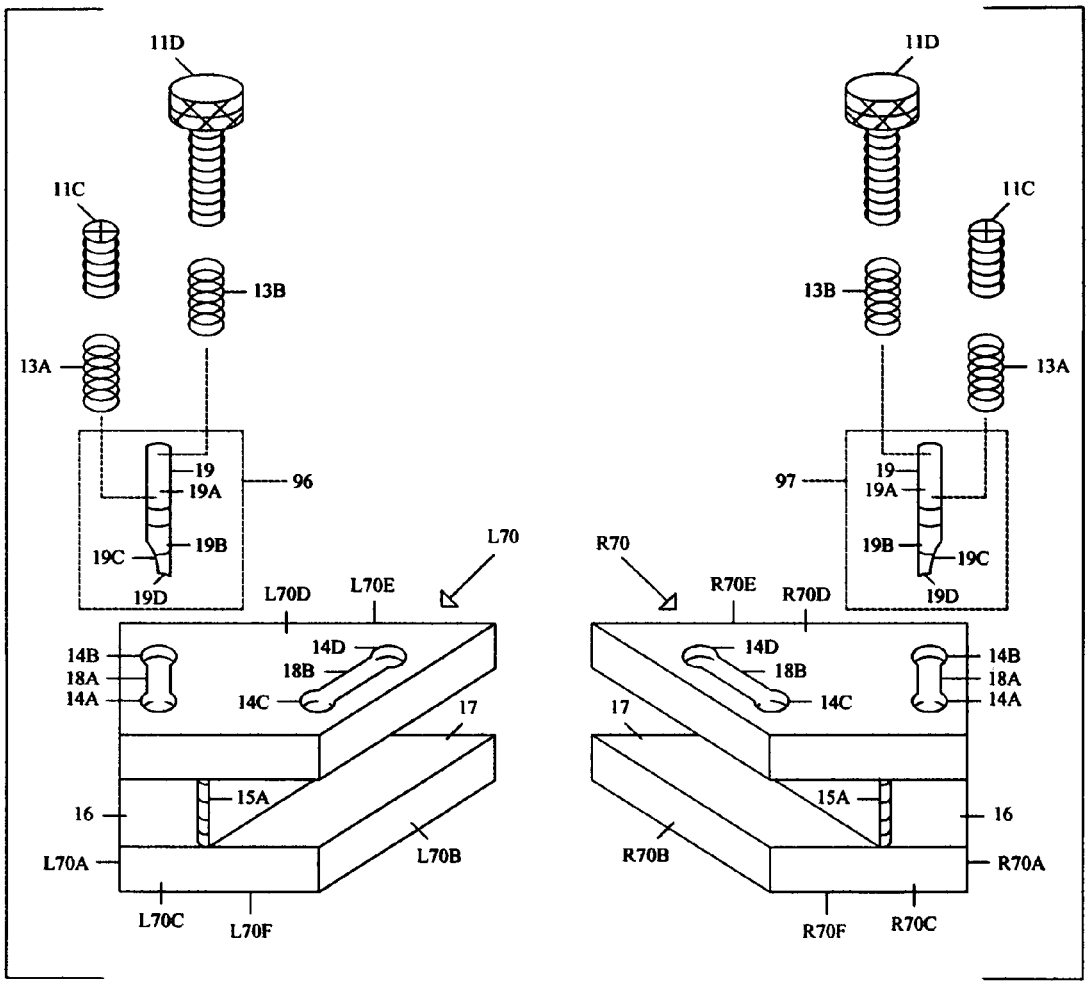
FIG. 95 is an exploded perspective side view of the fourth embodiment L70 and R70 for use with grids at ninety degree angles in relation to the walls seen slightly from the top.

FIG. 95 is an exploded perspective side view of the fourth embodiment L70 and R70 for use with grids at ninety degree angles in relation to the walls seen slightly from the top, control line holder L70 comprises a squared side L70A, a horizontal groove 16 formed within the squared side L70A, an angled side L70B, a horizontal angled groove 17 formed within angled side L70B, a group of three rounded inside corners 15A, 15B (not seen) and 15C (not seen), formed by horizontal grooves 16 and 17, a right side L70C, a top L70D, an aligning side L70E, a bottom side L70F (not seen), four threaded holes 14A, 14B, 14C, and 14D formed through top L70D to horizontal grooves 16 and 17, a vertical groove 18A formed through top L70D to horizontal groove 16 and joining threaded holes 14A and 14B, a vertical groove 18B formed through top L70D to horizontal groove 17 and joining threaded holes 14C and 14D, an attaching-detaching locking bar 19 configured to fit within vertical groove 18A and threaded holes 14A and 14B comprising a top 19A, two rounded sides 19B (one rounded side 19B is not seen), a rounded wall angle molding depressed locking actuator side 19C (not fully seen), an unlocking notch 19D (not fully seen), a flat bottom 19E (not seen), two compression springs 13A and 13B configured to fit within threaded holes 14A and 14B, a set screw 11C configured to be screwed into threaded hole 14A, a thumb screw 11D configured to be screwed into threaded hole 14B, control line holder R70 comprises a squared side R70A, a horizontal groove 16 formed within the squared side R70A, an angled side R70B, a horizontal angled groove 17 formed within angled side R70B, a group of three rounded inside corners 15A, 15B (not seen) and 15C (not seen), formed by horizontal grooves 16 and 17, a left side R70C, a top R70D, an aligning side R70E, a bottom side R70F (not seen), four threaded holes 14A, 14B, 14C, and 14D formed through top R70D to horizontal grooves 16 and 17, a vertical groove 18A formed through top R70D to horizontal groove 16 and joining threaded holes 14A and 14B, a vertical groove 18B formed through top R70D to horizontal groove 17 and joining threaded holes 14C and 14D, an attaching-detaching locking bar 19 configured to fit within vertical groove 18A and threaded holes 14A and 14B comprising a top 19A, two rounded sides 19B (one rounded side 19B is not seen), a rounded wall angle molding depressed locking actuator side 19C (not fully seen), an unlocking notch 19D (not fully seen), a flat bottom 19E (not seen), two compression springs 13A and 13B configured to fit within threaded holes 14A and 14B, a set screw 11C configured to be screwed into threaded hole 14A, a thumb screw 11D configured to be screwed into threaded hole 14B.

Figure 96:
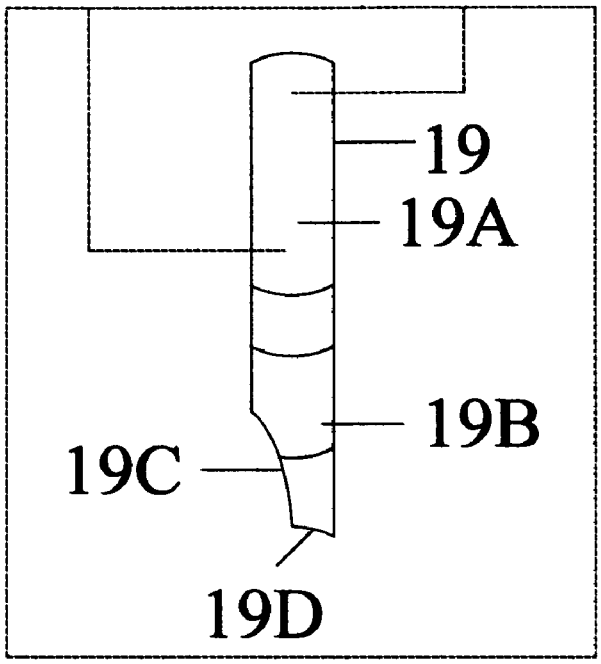
FIG. 96 is a perspective view of a three times enlarged attaching-detaching locking bar seen slightly from the top.

FIG. 96 is a perspective view of a three times enlarged attaching-detaching locking bar 19 seen slightly from the top and comprises a top 19A, two rounded sides 19B (one rounded side 19B is not seen), a rounded wall angle molding depressed locking actuator side 19C (not fully seen), an unlocking notch 19D (not fully seen), and a flat bottom 19E (not seen).

Figure 97:
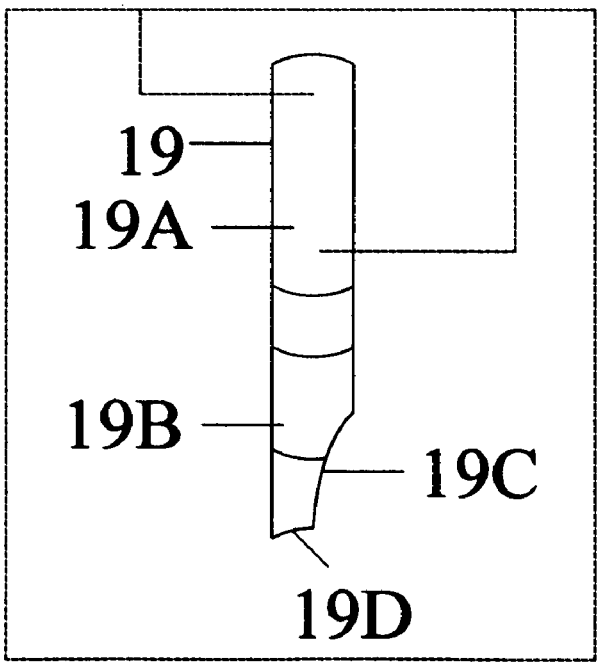
FIG. 97 is a perspective view of a three times enlarged attaching-detaching locking bar seen slightly from the top.

FIG. 97 is a perspective view of a three times enlarged attaching-detaching locking bar 19 seen slightly from the top and comprises a top 19A, two rounded sides 19B (one rounded side 19B is not seen), a rounded wall angle molding depressed locking actuator side 19C (not fully seen), an unlocking notch 19D (not fully seen), and a flat bottom 19E (not seen).

Figure 98:
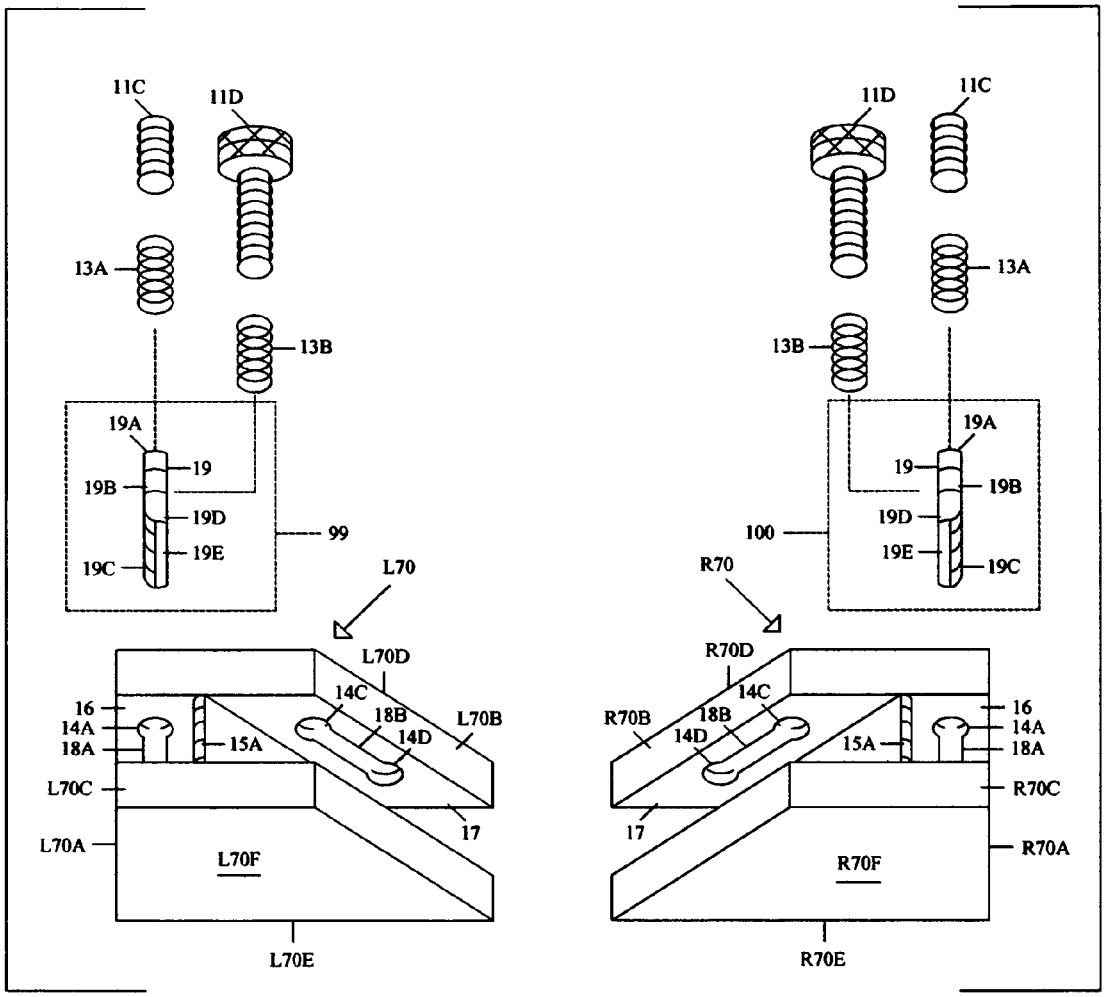
FIG. 98 is an exploded perspective side view of the fourth embodiment L70 and R70 for use with grids at ninety degree angles in relation to the walls seen slightly from the bottom.

FIG. 98 is an exploded perspective side view of the fourth embodiment L70 and R70 for use with grids at ninety degree angles in relation to the walls seen slightly from the bottom, control line holder L70 comprises a squared side L70A, a horizontal groove 16 formed within the squared side L70A, an angled side L70B, a horizontal angled groove 17 formed within angled side L70B, a group of three rounded inside corners 15A, 15B (not seen), and 15C (not seen), formed by horizontal grooves 16 and 17, a right side L70C, a top L70D (not seen), an aligning side L70E, a bottom side L70F, four threaded holes 14A, 14B (not seen), 14C, and 14D formed through top L70D to horizontal grooves 16 and 17, a vertical groove 18A (not fully seen) formed through top L70D to horizontal groove 16 and joining threaded holes 14A and 14B (not seen), a vertical groove 18B formed through top L70D to horizontal groove 17 and joining threaded holes 14C and 14D, an attaching-detaching locking bar 19 configured to fit within vertical groove 18A and threaded holes 14A and 14B comprising a top 19A (not seen), two rounded sides 19B (one rounded side 19B is not seen), a rounded wall angle molding depressed locking actuator side 19C, an unlocking notch 19D (not fully seen), a flat bottom 19E, two compression springs 13A and 13B configured to fit within threaded holes 14A and 14B, a set screw 11C configured to be screwed into threaded hole 14A, a thumb screw 11D configured to be screwed into threaded hole 14B, control line holder R70 comprises a squared side R70A, a horizontal groove 16 formed within the squared side R70A, an angled side R70B, a horizontal angled groove 17 formed within angled side R70B, a group of three rounded inside corners 15A, 15B (not seen), and 15C (not seen) formed by horizontal grooves 16 and 17, a left side R70C, a top R70D (not seen), an aligning side R70E, a bottom side R70F, four threaded holes 14A, 14B (not seen), 14C, and 14D formed through top R70D to horizontal grooves 16 and 17, a vertical groove 18A (not fully seen) formed through top R70D to horizontal groove 16 and joining threaded holes 14A and 14B, a vertical groove 18B formed through top R70D to horizontal groove 17 and joining threaded holes 14C and 14D, an attaching-detaching locking bar 19 configured to fit within vertical groove 18A and threaded holes 14A and 14B comprising a top 19A (not seen), two rounded sides 19B (one rounded side 19B is not seen), a rounded wall angle molding depressed locking actuator side 19C, an unlocking notch 19D (not fully seen), a flat bottom 19E, two compression springs 13A and 13B configured to fit within threaded holes 14A and 14B, a set screw 11C configured to be screwed into threaded hole 14A, a thumb screw 11D configured to be screwed into threaded hole 14B.

Figure 99:
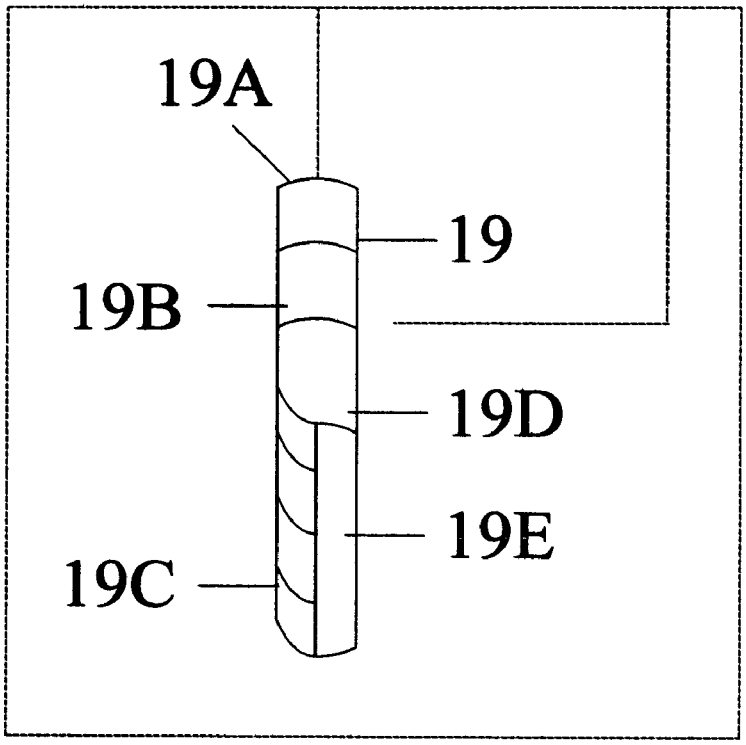
FIG. 99 is a perspective view of a three times enlarged attaching-detaching locking bar seen slightly from the bottom.

FIG. 99 is a perspective view of a three times enlarged attaching-detaching locking bar 19 seen slightly from the bottom and comprises a top 19A (not fully seen), two rounded sides 19B (one rounded side 19B is not seen), a rounded wall angle molding depressed locking actuator side 19C, an unlocking notch 19D (not fully seen), and a flat bottom 19E.

Figure 100:
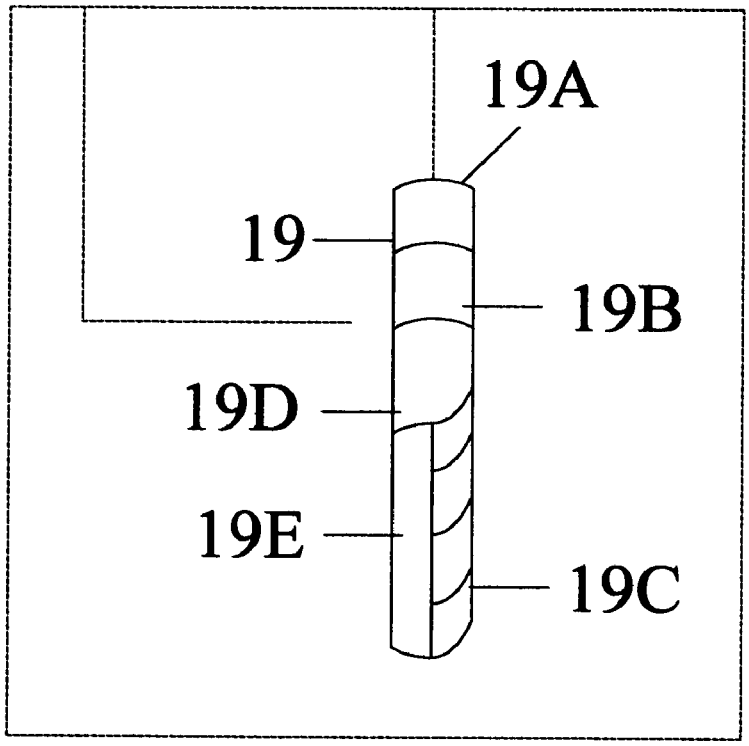
FIG. 100 is a perspective view of a three times enlarged attaching-detaching locking bar seen slightly from the bottom.

FIG. 100 is a perspective view of a three times enlarged attaching-detaching locking bar 19 seen slightly from the bottom and comprises a top 19A (not fully seen), two rounded sides 19B (one rounded side 19B is not seen), a rounded wall angle molding depressed locking actuator side 19C, an unlocking notch 19D (not fully seen), and a flat bottom 19E.

Figure 101:
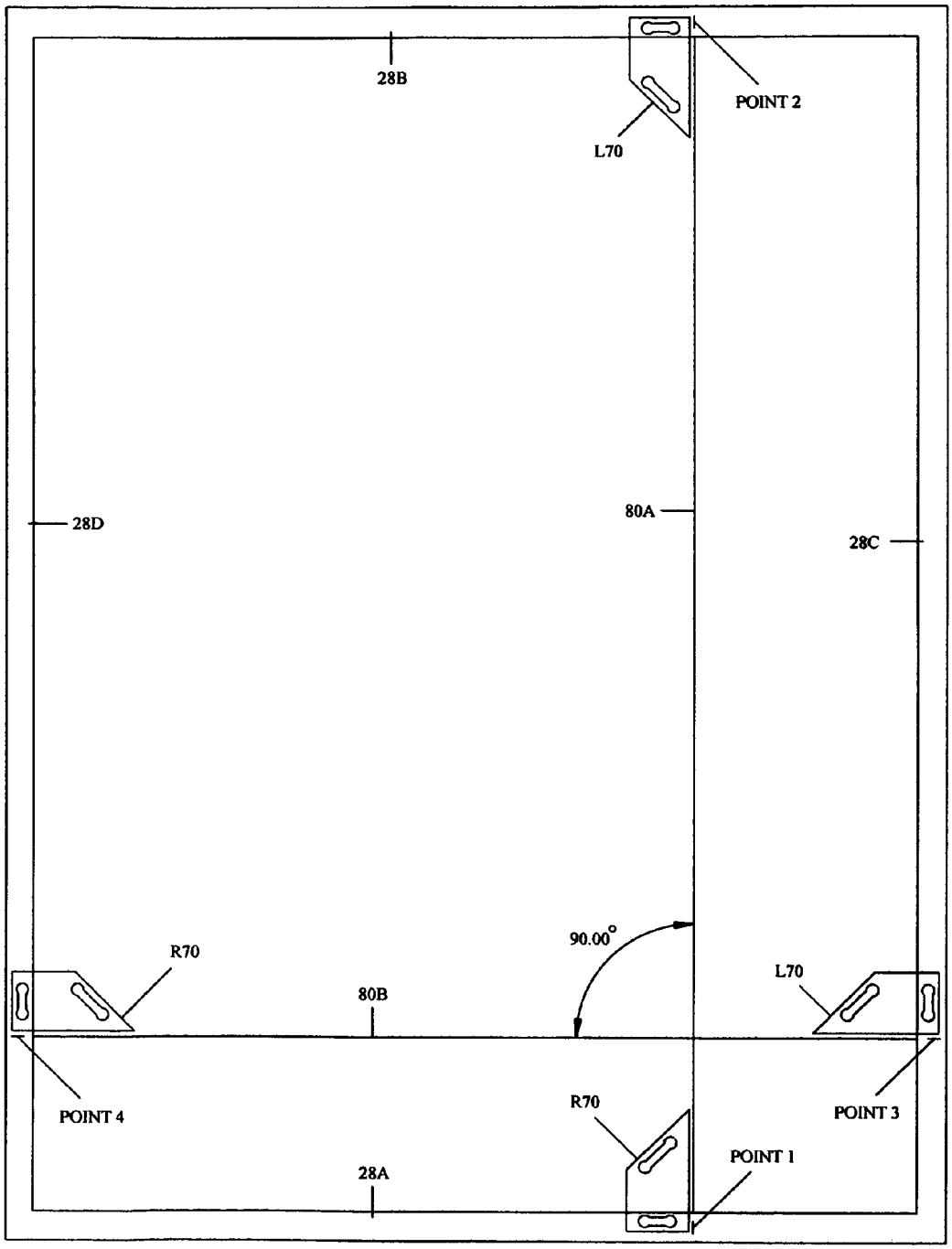
FIG. 101 is a perspective top view of embodiment R70, L70, additional L70, and additional R70 in use for grids at ninety degree angles in relation to the walls.

FIG. 101 is a perspective top view of embodiment R70, L70, additional L70, and additional R70 in use for grids at ninety degree angles in relation to the walls and comprises control line holder R70 attached to the right and next to a main tee 82A (not shown in this view) laid out mark or point one inscribed onto wall angle molding 28A, control line 80A pulled and held taut by control line holder L70 attached to the left and next to a main tee 82A (not shown in this view) laid out mark or point two inscribed onto wall angle molding 28B, additional control line holder L70 attached to the left and next to a cross tee 82B (not shown in this view) laid out mark or point three inscribed onto wall angle molding 28C, control line 80B pulled and held taut by additional control line holder R70 attached to the right and next to a cross tee 82B (not shown in this view) laid out mark or point four inscribed onto wall angle molding 28D.

Figure 102:
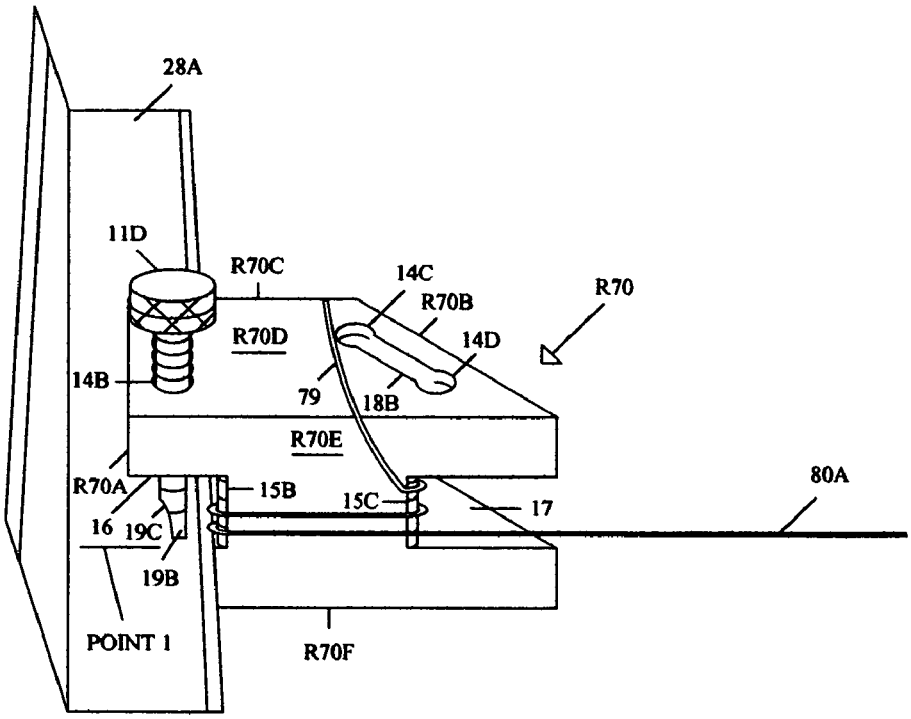
FIG. 102 is a perspective side view of the fourth embodiment R70 in use for grids at ninety degree angles in relation to the walls seen slightly from the top.

FIG. 102 is an assembled perspective side view of the fourth embodiment R70 in use for grids at ninety degree angles in relation to the walls seen slightly from the top, and comprises a squared side R70A, a horizontal groove 16 formed within the squared side R70A, an angled side R70B, a horizontal angled groove 17 formed within the angled side R70B, a group of three rounded corners 15A (not seen in this view), 15B, and 15C formed by horizontal grooves 16 and 17, a left side R70C, a top R70D, an aligning side R70E aligned to the right of point 1 which is inscribed onto wall angle molding 28A, a bottom side R70F (not seen), four threaded holes 14A (not seen), 14B, 14C, and 14D formed through top R70D to horizontal grooves 16 and 17, a vertical groove 18A (not seen) formed through top R70D to horizontal groove 16 and joining threaded holes 14A (not seen) and 14B, a vertical groove 18B formed through top R70D to horizontal groove 17 and joining threaded holes 14C and 14D, an attaching-detaching locking bar 19 (reference number not seen), rounded side 19B, and rounded wall angle molding depressed locking actuator side 19C (not fully seen) inserted into vertical groove 18A, threaded hole 14A and threaded hole 14B and applying a clamping force onto wall angle molding 28A against the bottom of horizontal groove 16, a compression spring 13A (not seen) inserted into threaded hole 14A (not seen) and compressed by set screw 11C screwed into threaded hole 14A, a compression spring 13B (not seen) inserted into threaded hole 14B and compressed by thumb screw 11D screwed into threaded hole 14B, a loop 79 about 31.75 mm. in diameter tied from a roll of control line 80A which is hooked from horizontal groove 17 and the top R700, control line 80A which is wrapped around counter clock wise left side R70C (not fully seen in this view), rounded corner 15A (not seen in this view), horizontal groove 16, rounded corner 15B, aligning side R70E, rounded corner 15C, horizontal groove 17, rounded corner 15A (not seen in this view), horizontal groove 16, rounded corner 15B, and ending running along aligning side R70E.

Figure 103:
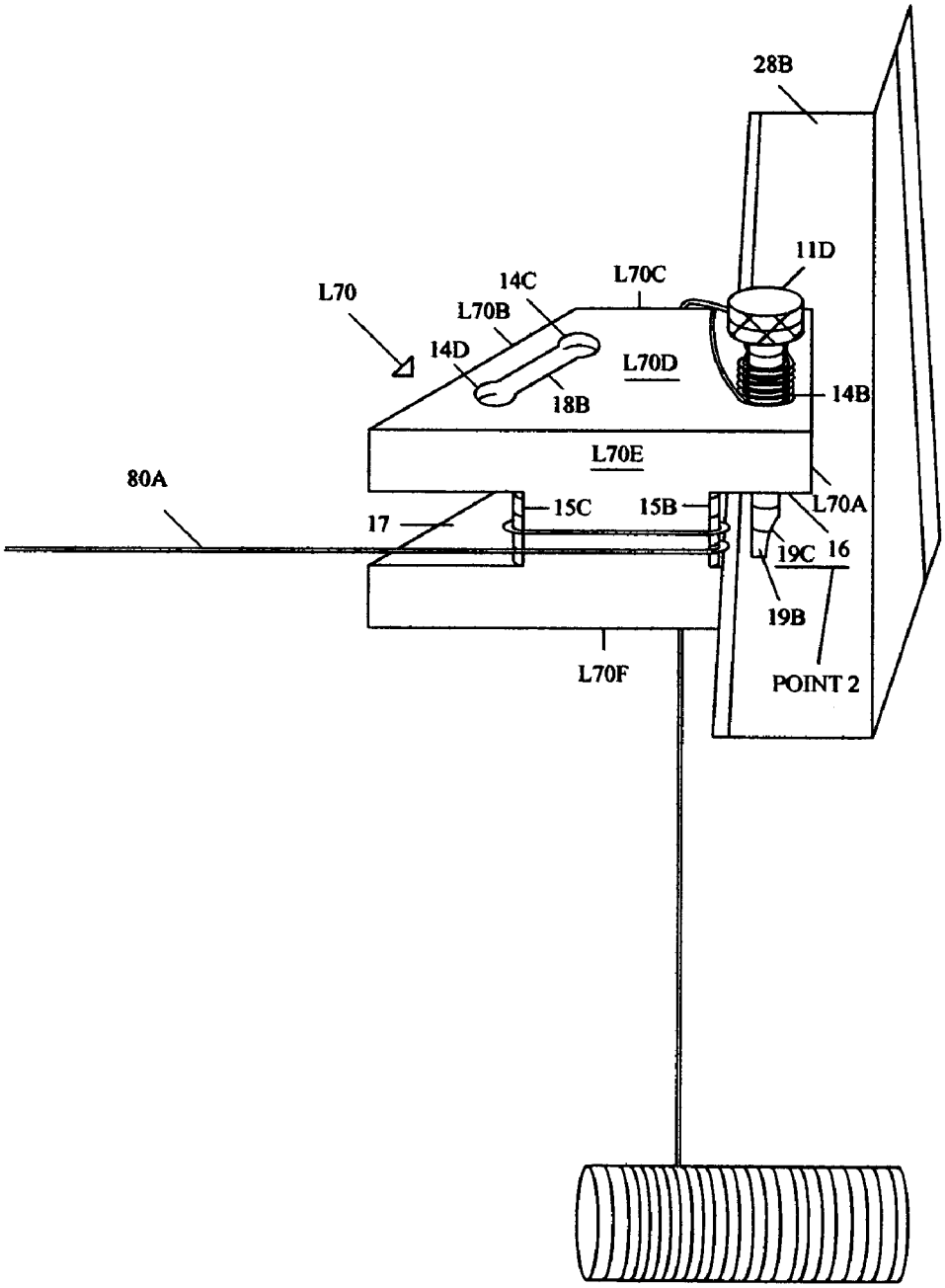
FIG. 103 is a perspective side view of the fourth embodiment L70 in use for grids at ninety degree angles in relation to the walls seen slightly from the top.

FIG. 103 is an assembled perspective side view of the fourth embodiment L70 in use for grids at ninety degree angles in relation to the walls seen slightly from the top and comprises a squared side L70A, a horizontal groove 16 formed within the squared side L70A, an angled side L70B, a horizontal groove 17 formed within the angled side L70B, a group of three rounded corners 15A (not seen in this view), 15B, and 15C formed by horizontal grooves 16 and 17, a right side L70C (not fully seen in this view), a top L70D, an aligning side L70E aligned to the left of point 2 which is inscribed onto wall angle molding 28B, a bottom side L70F (not seen), four threaded holes 14A (not seen), 14B, 14C, and 14D formed through top L70D to horizontal grooves 16 and 17, a vertical groove 18A (not seen) formed through top L70D to horizontal groove 16 and joining threaded holes 14A (not seen) and 14B, a vertical groove 18B formed through top L70D to horizontal groove 17 and joining threaded holes 14C and 14D, an attaching-detaching locking bar 19 (reference number not seen), rounded side 19B, and rounded wall angle molding depressed locking actuator side 19C (not fully seen) inserted into vertical groove 18A, threaded hole 14A and threaded hole 14B and applying a clamping force onto wall angle molding 28B against the bottom of groove 16, a compression spring 13A (not seen) inserted into threaded hole 14A (not seen) and compressed by set screw 11C screwed into threaded hole 14A, a compression spring 13B (not seen) inserted into threaded hole 14B and compressed by thumb screw 11D screwed into threaded hole 14B, control line 80A which is wrapped around counter clock wise aligning side L70E, rounded corner 15B, horizontal groove 16 formed within the squared side L70A, rounded corner 15A (not seen in this view), right side L70C (not fully seen in this view), horizontal angled groove 17 formed within the angled side L70B, rounded corner 15C, aligning side L70E, rounded corner 15B, horizontal groove 16 formed within the squared side L70A, right side L70C (not fully seen in this view), pulled taut and wrapped around counter clock wise five times the remainder top section of the thumb screw 11D, returned and let hung next to right side L70C (not fully seen in this view).

Figure 104:
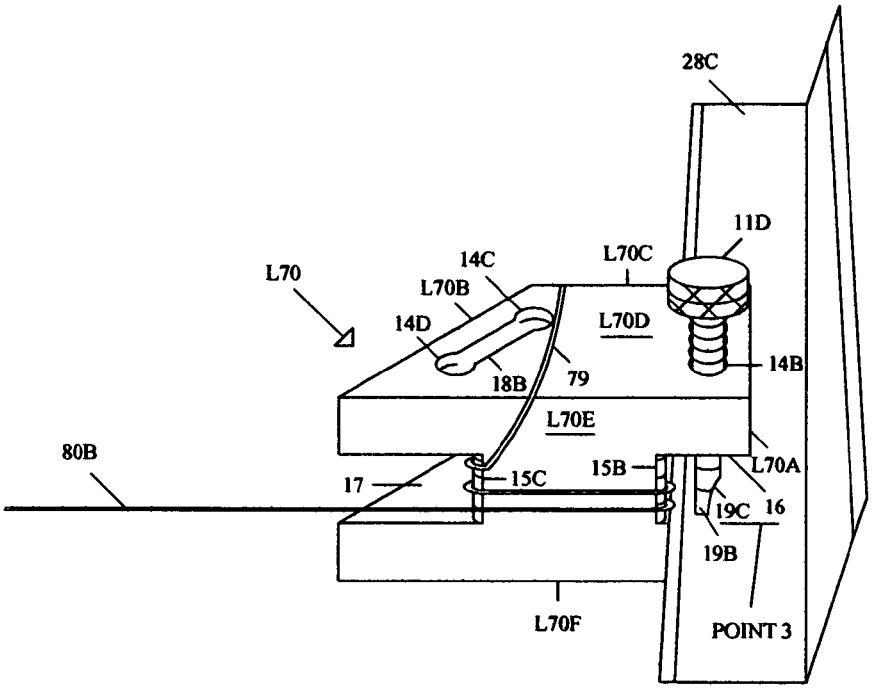
FIG. 104 is a perspective side view of additional embodiment L70 in use seen slightly from the top for use with grids at ninety degree angles in relation to the walls.

FIG. 104 is an assembled perspective side view of additional embodiment L70 in use seen slightly from the top for use with grids at ninety degree angles in relation to the walls and comprises a squared side L70A, a horizontal groove 16 formed within the squared side L70A, an angled side L70B, a horizontal angled groove 17 formed within the angled side L70B, a group of three rounded inside corners 15A (not seen in this view), 15B, and 15C formed by horizontal grooves 16 and 17, a right side L70C (not fully seen in this view), a top L70D, an aligning side L70E aligned to the left of point 3 which is inscribed onto wall angle molding 28C, a bottom side L70F (not seen), four threaded holes 14A (not seen), 14B, 14C, and 14D formed through top L70D to horizontal grooves 16 and 17, a vertical groove 18A (not seen) formed through top L70D to horizontal groove 16 and joining threaded holes 14A (not seen) and 14B, a vertical groove 18B formed through top L70D to horizontal angled groove 17 and joining threaded holes 14C and 14D, an attaching-detaching locking bar 19 (reference number not seen), rounded side 19B, and rounded wall angle molding depressed locking actuator side 19C (not fully seen) inserted into groove 18A, threaded hole 14A and threaded hole 14B and applying a clamping force onto wall angle molding 28C against the bottom of horizontal groove 16, a compression spring 13A (not seen) inserted into threaded hole 14A (not seen) and compressed by set screw 11C screwed into threaded hole 14A, a compression spring 13B (not seen) inserted into threaded hole 14B and compressed by thumb screw 11D screwed into threaded hole 14B, a loop 79 about 31.75 mm. in diameter tied from control line 80B which is hooked from horizontal groove 17 and the top L70D, control line 80B which is wrapped around clock wise right side L70C (not fully seen in this view), rounded corner 15A (not seen in this view), horizontal groove 16 formed within the squared side L70A, rounded corner 15B, aligning side L70E, rounded corner 15C, horizontal angled groove 17 formed within the angled side L70B, right side L70C (not fully seen in this view), rounded corner 15A (not seen in this view), horizontal groove 16 formed within the squared side L70A, rounded corner 15B, and ending running along aligning side L70E.

Figure 105:
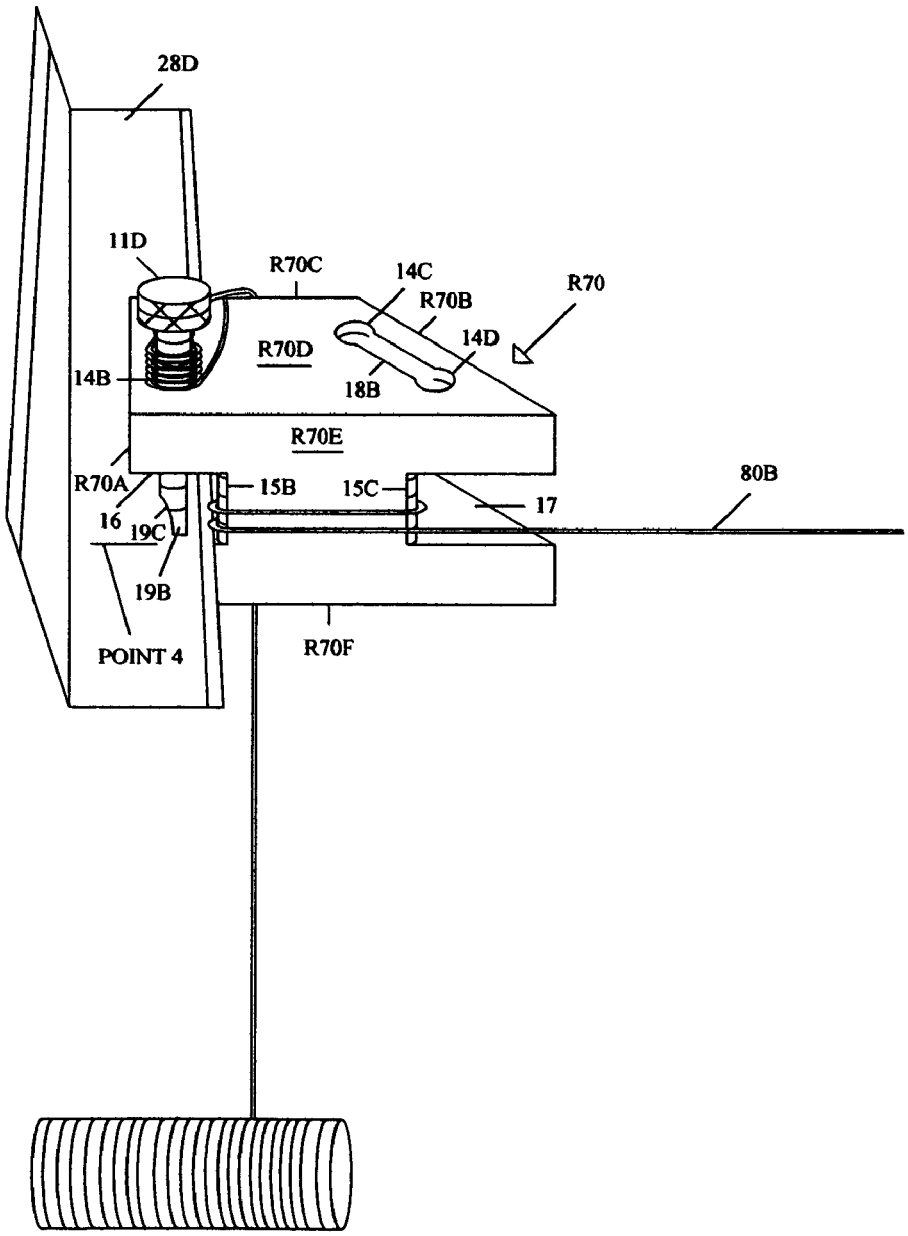
FIG. 105 is a perspective side view of additional embodiment R70 in use seen slightly from the top for use with grids at ninety degree angles in relation to the walls.

FIG. 105 is an assembled perspective side view of additional embodiment R70 in use seen slightly from the top for use with grids at ninety degree angles in relation to the walls and comprises a squared side R70A, a horizontal groove 16 formed within the squared side R70A, an angled side R70B, a horizontal angled groove 17 formed within the angled side R70B, a group of three rounded inside corners 15A (not seen in this view), 15B, and 15C formed by horizontal grooves 16 and 17, a left side R70C (not fully seen in this view), a top R70D, an aligning side R70E aligned to the right of point 4 which is inscribed onto wall angle molding 28D, a bottom side R70F (not seen), four threaded holes 14A (not seen), 14B, 14C, and 14D formed through top R70D to horizontal grooves 16 and 17, a vertical groove 18A (not seen) formed through top R70D to horizontal groove 16 and joining threaded holes 14A (not seen) and 14B, a vertical groove 18B formed through top R70D to horizontal angled groove 17 and joining threaded holes 14C and 14D, an attaching-detaching locking bar 19 (reference number not seen), rounded side 19B, and rounded wall angle molding depressed locking actuator side 19C (not fully seen) inserted into groove 18A, threaded hole 14A and threaded hole 14B and applying a clamping force onto wall angle molding 28D against the bottom of horizontal groove 16, a compression spring 13A (not seen) inserted into threaded hole 14A (not seen) and compressed by set screw 11C (not seen) screwed into threaded hole 14A, a compression spring 13B (not seen) inserted into threaded hole 14B and compressed by thumb screw 11D screwed into threaded hole 14B, control line 80B which is wrapped around clock wise aligning side R70E, rounded corner 15B, horizontal groove 16 formed within the squared side R70A, rounded corner 15A (not seen in this view), left side R70C (not fully seen in this view), horizontal angled groove 17 formed within the angled side R70B, rounded corner 15C, aligning side R70E, rounded corner 15B, horizontal groove 16 formed within the squared side R70A, left side R70C (not fully seen in this view), pulled taut and wrapped around counter clock wise five times the remainder top section of the thumb screw 11D, returned and let hung next to left side R70C (not fully seen in this view).

Figure 106:
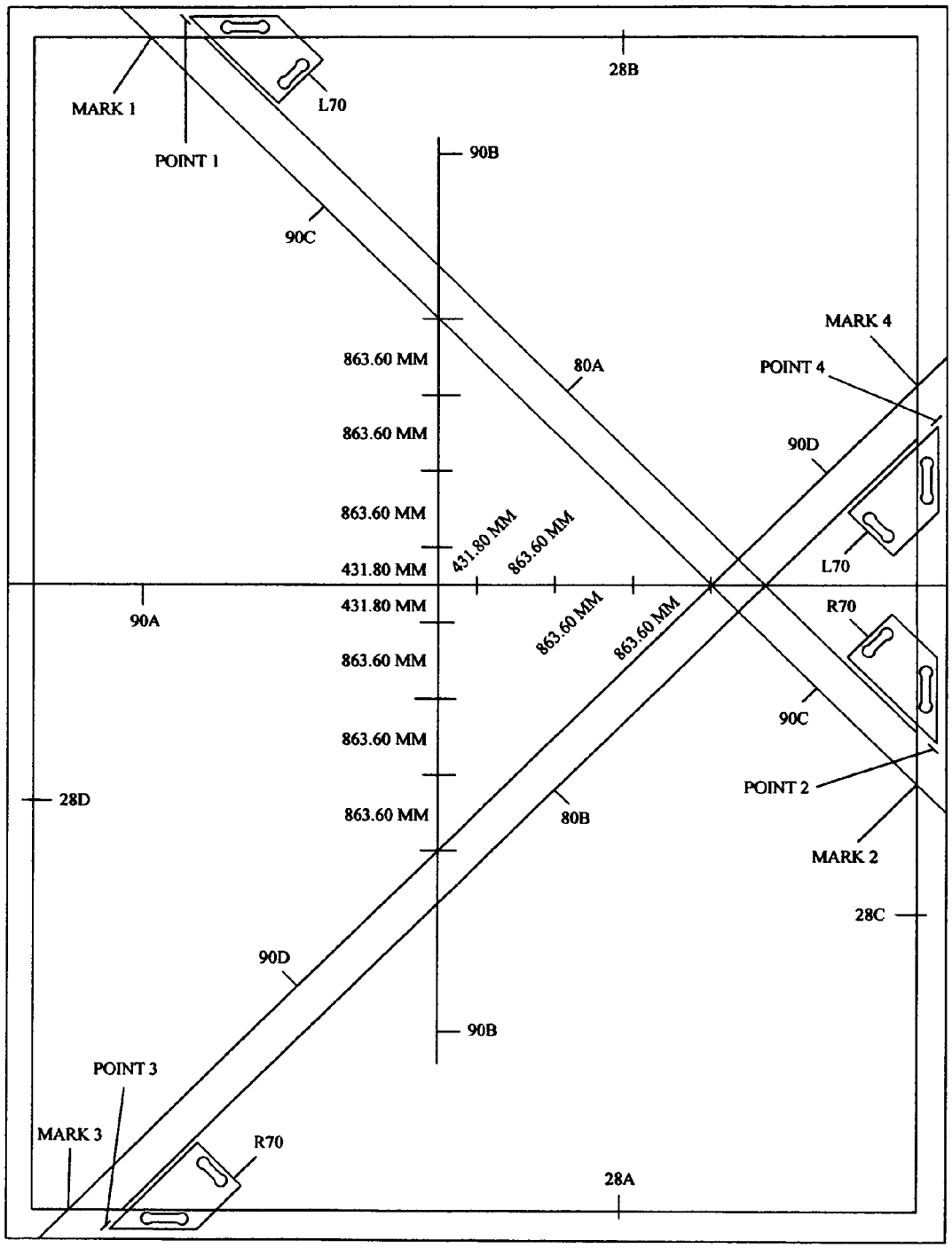
FIG. 106 is a perspective top view of embodiment L70, R70, additional R70, and additional L70 in use for grids at forty-five degree angles in relation to the walls.

FIG. 106 is a perspective top view of embodiment L70, R70, additional R70, and additional L70 in use for grids at forty-five degree angles in relation to the walls (not shown) and comprises a chalk line 90A snapped on the floor in the middle of the room, a chalk line 90B snapped on the floor in the center of and perpendicular to chalk line 90A, graduations marked in one direction on chalk line 90A starting from where chalk line 90A and chalk line 90B intersect are 431.80 mm. followed by three times graduations of 863.60 mm., graduations marked in opposite directions on chalk line 90B starting from where chalk line 90B and 90A intersect are 431.80 mm. followed by three times graduations of 863.60 mm., a chalk line 90C snapped on the floor and joining the last marked graduation of 863.60 mm. on chalk line 90A and one last marked graduation of 863.60 mm. on chalk line 90B and extending to wall angle moldings 28B and 28C thus creating mark 1 transferred from the floor onto wall angle molding 28B and mark 2 transferred from the floor onto wall angle molding 28C, a chalk line 90D snapped on the floor and joining the last marked graduation of 863.60 mm. on chalk line 90A and one opposite last marked graduation of 863.60 mm. on chalk line 90B and extending to wall angle moldings 28A and 28C thus creating mark 3 transferred from the floor onto wall angle molding 28A and mark 4 transferred from the floor onto wall angle molding 28C, control line holder L70 attached to the right and next to a main tee 82A (not shown in this view) point one inscribed onto wall angle molding 28B, control line 80A pulled and held taut by control line holder R70 attached to the left and next to a main tee 82A (not shown in this view) point two inscribed onto wall angle molding 28C, additional control line holder R70 attached to the left and next to a cross tee 82B (not shown in this view) point three inscribed onto wall angle molding 28A, control line 80B pulled and held taut by additional control line holder L70 attached to the right and next to a cross tee 82B (not shown in this view) point four inscribed onto wall angle molding 28C.

Figure 107:
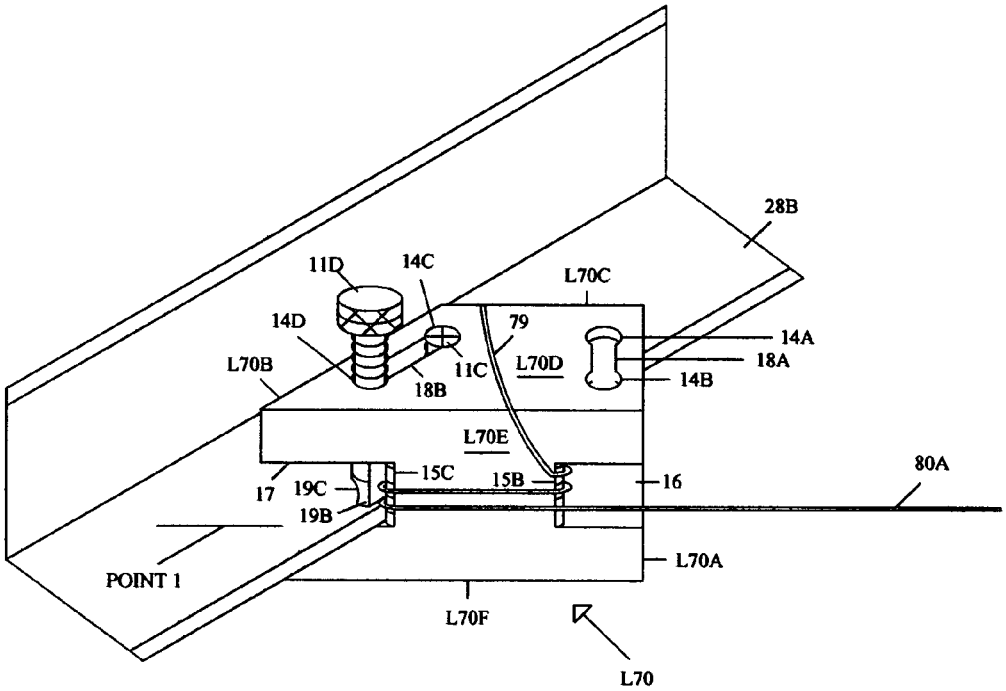
FIG. 107 is a perspective side view of the fourth embodiment L70 in use for grids at forty-five degree angles in relation to the walls seen slightly from the top.

FIG. 107 is an assembled perspective side view of the fourth embodiment L70 in use for grids at forty-five degree angles in relation to the walls seen slightly from the top and comprises a squared side L70A, a horizontal groove 16 formed within the squared side L70A, an angled side L70B, a horizontal angled groove 17 formed within the angled side L70B, a group of three rounded corners 15A (not seen in this view), 15B, and 15C formed by horizontal grooves 16 and 17, a right side L70C, a top L70D, an aligning side L70E aligned to the right of point 1 which is inscribed onto wall angle molding 28B, a bottom side L70F (not fully seen in this view), four threaded holes 14A, 14B, 14C, and 14D formed through top L70D to horizontal grooves 16 and 17, a vertical groove 18A formed through top L70D to horizontal groove 16 and joining threaded holes 14A and 14B, a vertical groove 18B formed through top L70D to horizontal angled groove 17 and joining threaded holes 14C and 14D, an attaching-detaching locking bar 19 (reference number not seen), rounded side 19B, and rounded wall angle molding depressed locking actuator side 19C (not fully seen) inserted into groove 18B, threaded hole 14C and threaded hole 14D and applying a clamping force onto wall angle molding 28B against the bottom of horizontal angled groove 17, a compression spring 13A (not seen) inserted into threaded hole 14C and compressed by set screw 11C screwed into threaded hole 14C, a compression spring 13B (not seen) inserted into threaded hole 14D and compressed by thumb screw 11D screwed into threaded hole 14D, a loop 79 about 31.75 mm. in diameter tied from control line 80A which is hooked from horizontal groove 16 and the top L70D, control line 80A which is wrapped around counter clock wise right side L70C (not fully seen in this view), rounded corner 15A (not seen in this view), horizontal angled groove 17, rounded corner 15C, aligning side L70E, rounded corner 15B, horizontal groove 16, rounded corner 15A (not seen in this view), horizontal angled groove 17, rounded corner 15C, and ending running along aligning side L70E.

Figure 108:
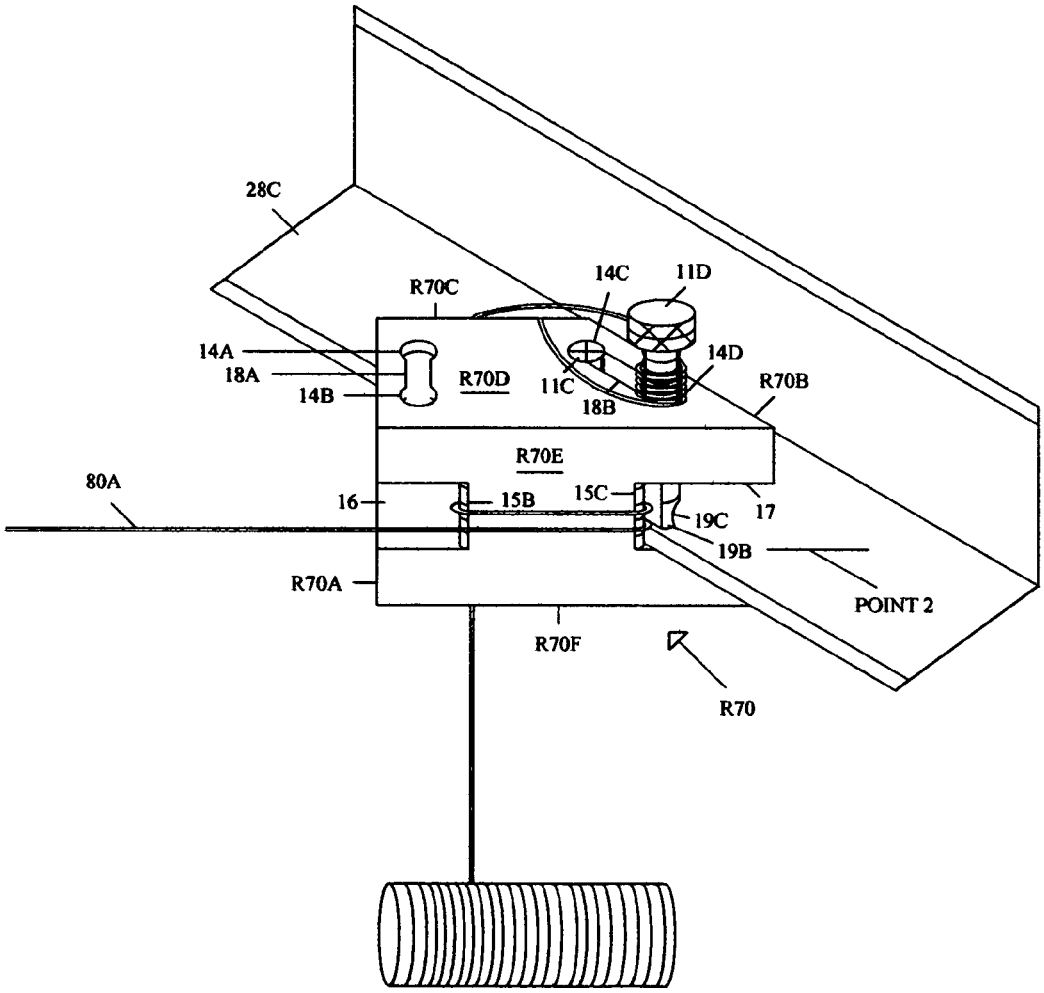
FIG. 108 is a perspective side view of the fourth embodiment R70 in use for grids at forty-five degree angles in relation to the walls seen slightly from the top.

FIG. 108 is an assembled perspective side view of the fourth embodiment R70 in use for grids at forty-five degree angles in relation to the walls seen slightly from the top and comprises a squared side R70A, a horizontal groove 16 formed within the squared side R70A, an angled side R70B, a horizontal angled groove 17 formed within the angled side R70B, a group of three rounded inside corners 15A (not seen in this view), 15B, and 15C formed by horizontal grooves 16 and 17, a left side R70C (not fully seen in this view), a top R70D, an aligning side R70E aligned to the left of point 2 which is inscribed onto a piece of wall angle molding 28C, a bottom side R70F (not fully seen in this view), four threaded holes 14A, 14B, 14C, and 14D formed through top R70D to horizontal grooves 16 and 17, a vertical groove 18A formed through top R70D to horizontal groove 16 and joining threaded holes 14A and 14B, a vertical groove 18B formed through top R70D to horizontal groove 17 and joining threaded holes 14C and 14D, an attaching-detaching locking bar 19 (reference number not seen), rounded side 19B, and rounded wall angle molding depressed locking actuator side 19C (not fully seen) inserted into vertical groove 18B, threaded hole 14C and threaded hole 14D and applying a clamping force onto wall angle molding 28C against the bottom of groove 17, a compression spring 13A (not seen) inserted into threaded hole 14C (not seen) and compressed by set screw 11C screwed into threaded hole 14C, a compression spring 13B (not seen) inserted into threaded hole 14D and compressed by thumb screw 11D screwed into threaded hole 14D, control line 80A which is wrapped around counter clock wise aligning side R70E, rounded corner 15C, horizontal angled groove 17 formed within the angled side R70B, rounded corner 15A (not seen in this view), left side R70C (not fully seen in this view), horizontal groove 16 formed within the squared side R70A, rounded corner 15B, aligning side R70E, rounded corner 15C, horizontal angled groove 17 formed within the angled side R70B, left side R70C (not fully seen in this view), pulled taut and wrapped around counter clock wise five times the remainder top section of the thumb screw 11D, returned and let hung next to left side R70C (not fully seen in this view).

Figure 109:
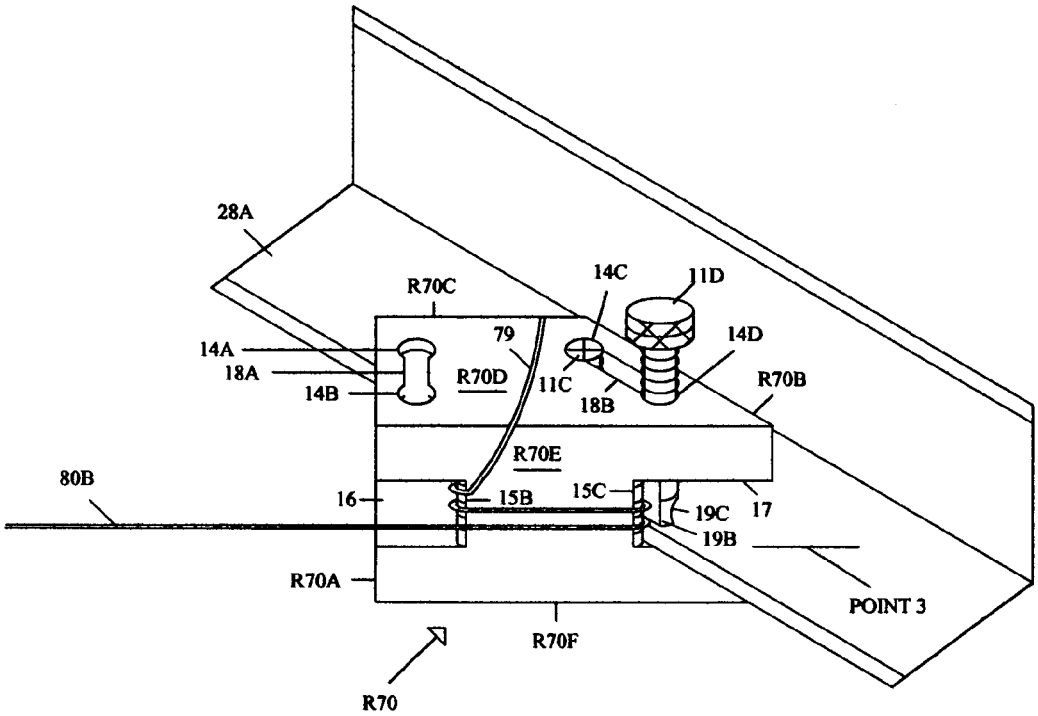
FIG. 109 is a perspective side view of additional embodiment R70 in use seen slightly from the top for use with grids at forty-five degree angles in relation to the walls.

FIG. 109 is an assembled perspective side view of additional embodiment R70 in use seen slightly from the top for use with grids at forty-five degree angles in relation to the walls and comprises a squared side R70A, a horizontal groove 16 formed within the squared side R70A, an angled side R70B, a horizontal angled groove 17 formed within the angled side R70B, a group of three rounded inside corners 15A (not seen in this view), 15B, and 15C formed by horizontal grooves 16 and 17, a left side R70C (not fully seen in this view), a top R70D, an aligning side R70E aligned to the left of point 3 which is inscribed onto a piece of wall angle molding 28A, a bottom side R70F (not seen), four threaded holes 14A, 14B, 14C, and 14D formed through top R70D to horizontal grooves 16 and 17, a vertical groove 18A formed through top R70D to horizontal groove 16 and joining threaded holes 14A and 14B, a vertical groove 18B formed through top R70D to horizontal angled groove 17 and joining threaded holes 14C and 14D, an attaching-detaching locking bar 19 (reference number not seen), rounded side 19B, and rounded wall angle molding depressed locking actuator side 19C (not fully seen) inserted into groove 18B, threaded hole 14C and threaded hole 14D and applying a clamping force onto wall angle molding 28A against the bottom of horizontal angled groove 17, a compression spring 13A (not seen) inserted into threaded hole 14C (not seen) and compressed by set screw 11C screwed into threaded hole 14C, a compression spring 13B (not seen) inserted into threaded hole 14D and compressed by thumb screw 11D screwed into threaded hole 14D, a loop 79 about 31.75 mm. in diameter tied from control line 80B which is hooked from horizontal groove 16 and the top R70D, control line 80B which is wrapped around clock wise left side R70C (not fully seen in this view), rounded corner 15A (not seen in this view), horizontal angled groove 17 formed within the angled side R70B, rounded corner 15C, aligning side R70E, rounded corner 15B, horizontal groove 16 formed within the squared side R70A, rounded corner 15A (not seen in this view), left side R70C (not fully seen in this view), horizontal angled groove 17 formed within the angled side R70B, rounded corner 15C, and ending running along aligning side R70E.

Figure 110:
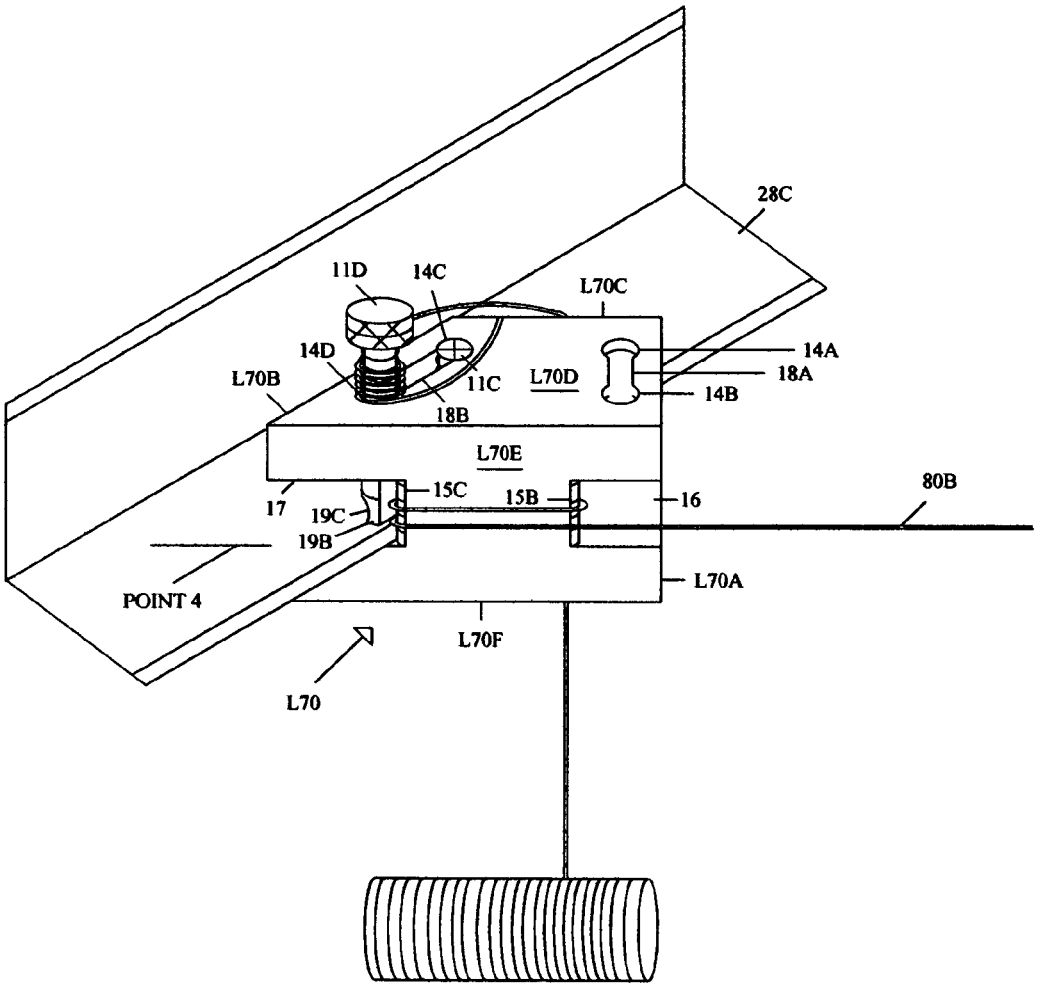
FIG. 110 is a perspective side view of additional embodiment L70 in use seen slightly from the top for use with grids at forty-five degree angles in relation to the walls.

FIG. 110 is an assembled perspective side view of additional embodiment L70 in use seen slightly from the top for use with grids at forty-five degree angles in relation to the walls and comprises a squared side L70A, a horizontal groove 16 formed within the squared side L70A, an angled side L70B, a horizontal angled groove 17 formed within the angled side L70B, a group of three rounded inside corners 15A (not seen in this view), 15B, and 15C formed by horizontal grooves 16 and 17, a right side L70C (not fully seen in this view), a top L70D, an aligning side L70E aligned to the right of point 4 which is inscribed onto a piece of wall angle molding 28C, a bottom side L70F (not fully seen in this view), four threaded holes 14A, 14B, 14C, and 14D formed through top L70D to horizontal grooves 16 and 17, a vertical groove 18A formed through top L70D to horizontal groove 16 and joining threaded holes 14A and 14B, a vertical groove 18B formed through top L70D to horizontal angled groove 17 and joining threaded holes 14C and 14D, an attaching-detaching locking bar 19 (reference number not seen), rounded side 19B, and rounded wall angle molding depressed locking actuator side 19C (not fully seen) inserted into groove 18B, threaded hole 14C and threaded hole 14D and applying a clamping force onto wall angle molding 28C against the bottom of horizontal angled groove 17, a compression spring 13A (not seen) inserted into threaded hole 14C and compressed by set screw 11C screwed into threaded hole 14C, a compression spring 13B (not seen) inserted into threaded hole 14D and compressed by thumb screw 11D screwed into threaded hole 14D, control line 80B which is wrapped around clock wise aligning side L70E, rounded corner 15C, horizontal angled groove 17 formed within the angled side L70B, rounded corner 15A (not seen in this view), right side L70C (not fully seen in this view), horizontal groove 16 formed within the squared side L70A, rounded corner 15B, aligning side L70E, rounded corner 15C, horizontal angled groove 17 formed within the angled side L70B, right side L70C (not fully seen in this view) pulled taut and wrapped around counter clock wise five times the remainder top section of the thumb screw 11D, returned and let hung next to right side L70C (not fully seen in this view).

To enable those skilled in the art to fully understand and practice my new and improved method of installing or setting the control lines, I will proceed to give an example as to how a suspended grid framer can use the control line holders R70, L70, additional L70, and additional R70 to frame a 609.6 mm.×1219.2 mm. or 2'×4' 90 degree angle suspended grid:

1. Referring to FIGS. 101 through 105 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed height and label them as such.

3. Layout location of control lines 80A and 80B on wall angle moldings 28A, 28B, 28C, and 28D making sure all the marks are above the finished ceiling so no one will be able to see them.
4. The location of the control line 80A that runs parallel to the main tee is determined by adding the border dimension plus' the thickness of the main tee.
5. See FIG. 102, control line for main tee 82A (not shown): Grab a roll of control line 80A and tie a loop 79 about 31.75 mm. in diameter at the end, with the other hand take control line holder R70 with the set screw 11C, and thumb screw 11D facing up, next, hook the loop 79 from horizontal groove 17 and the top R70D wrap control line 80A around counter clock wise left side R70C (not fully seen), rounded corner 15A (not seen), horizontal groove 16, rounded corner 15B, aligning side R70E, rounded corner 15C, horizontal groove 17, rounded corner 15A (not seen), horizontal groove 16, rounded corner 15B, and ending running along aligning side R70E.
6. See FIG. 102, go to main tee 82A (not shown) laid out mark or point 1 inscribed onto wall angle molding 28A and as you face this laid out mark attach control line holder R70 to your right of this laid out mark or point 1 by first aligning side R70E to your right of point 1, inserting the wall angle molding 28A into horizontal groove 16 formed within the squared side R70A accomplish this by applying pushing force to the rounded wall angle molding locking actuator side 19C (not fully seen) with the wall angle molding 28A.
7. As you face control line holder R70 and if you need to detach it you need to first relieve the pulling force from the taut control line, then you have to pull it and turn it to your left at the same time thus actuating unlocking notch 190 and detaching control line holder R70 off the wall angle molding 28A.
8. See FIG. 103, roll out control line 80A and go to the other laid out mark or point 2 for the main tee 82A (not shown) inscribed onto wall angle molding 28B, take control line holder L70, wrap the control line 80A around counter clock wise aligning side L70E, rounded corner 15B, horizontal groove 16 formed within the squared side L70A, rounded corner 15A (not seen), right side L70C (not fully seen in this view), horizontal groove 17 formed within the angled side L70B, rounded corner 15C, aligning side L70E, rounded corner 15B, horizontal groove 16 formed within the squared side L70A, and right side L70C (not fully seen in this view).
9. See FIG. 103, as you face the laid out mark or point 2 for the main tee 82A (not shown), attach control line holder L70 to your left of this laid out mark or point 2 by first aligning side L70E to your left of point 2, inserting the wall angle molding 28B into horizontal groove 16 formed within the squared side L70A accomplish this by applying pushing force to the rounded wall angle molding locking actuator side 19C (not fully seen) with the wall angle molding 28B.
10. See FIG. 103, the control line 80A must not be trapped against the groove 16 by the wall angle molding 28B.
11. See FIG. 103, next, with your right hand grab the control line 80A coming from holder R70 and pull on it while at the same time with your left hand you pull at the previously wrapped control line 80A on the holder L70, do this until you are satisfied with the tautness of the line, finally with the line that is on your left hand wrap it around counter clock wise five times the remainder top section of the thumb screw 11D, return the line and let it hang next to right side L70C (not fully seen), by using the control line's 80A pulling force and wrapping the control line 80A counter clock wise the remainder top section of the thumb screw 11D locks the control line 80A and prevents it from becoming loose.
12. To adjust this control line 80A, first unwrap the line from the screw 11D to relieve the pulling pressure from the taut control line, second, move the control line holder L70 to either side and repeat step 11 over again.
13. As you face control line holder L70 and if you need to detach it you need to first relieve the pulling force from the taut control line, then you have to pull it and turn it to your right at the same time thus actuating unlocking notch 19D and detaching control line holder L70 off the wall angle molding 28B.
14. The location of the control line 80B that runs perpendicular to the main tee is determined by adding the border dimension plus ½ the thickness of the cross tee.
15. See FIG. 104, control line for cross tee 82B (not shown): Grab a roll of control line 80B and tie a loop 79 about 31.75 mm. in diameter at the end, with the other hand take additional control line holder L70 with the set screw 11C and the thumb screw 11D facing up, next, hook the loop 79 from horizontal groove 17 and the top L70D, wrap control line 80B around clock wise right side L70C (not fully seen), rounded corner 15A (not seen), horizontal groove 16, rounded corner 15B, aligning side L70E, rounded corner 15C, horizontal groove 17, right side L70C (not fully seen), rounded corner 15A (not seen), horizontal groove 16, rounded corner 15B, and ending running along aligning side L70E.
16. See FIG. 104, go to cross tee 82B (not shown) laid out mark or point 3 and as you face this laid out mark attach additional control line holder L70 to your left of this laid out mark or point 3 by first aligning side L70E to your left of point 3, inserting the wall angle molding 28C into horizontal groove 16 formed within the squared side L70A, accomplish this by applying pushing force to the rounded wall angle molding locking actuator side 19C (not fully seen) with the wall angle molding 28C.
17. As you face additional control line holder L70 and if you need to detach it you need to first relieve the pulling force from the taut control line, then you have to pull it and turn it to your right at the same time thus actuating unlocking notch 19D and detaching control line holder L70 off the wall angle molding 28C.
18. See FIG. 105, roll out control line 80B and go to the other laid out mark or point 4 for the cross tee 82B (not shown) inscribed onto wall angle molding 28D, take additional control line holder R70, wrap the control line 80B around clock wise aligning side R70E, rounded corner 15B, horizontal groove 16 formed within the squared side R70A, rounded corner 15A (not seen), left side R70C (not fully seen in this view), horizontal groove 17 formed within the angled side R70B, rounded corner 15C, aligning side R70E, rounded corner 15B, horizontal groove 16 formed within the squared side R70A, and left side R70C (not fully seen in this view).
19. See FIG. 105, as you face the laid out mark or point 4 for the cross tee 82B (not shown), attach control line holder R70 to your right of this laid out mark or point 4 by first aligning side R70E to your right of point 4, inserting the wall angle molding 28D into horizontal groove 16 formed within the squared side R70A, accomplish this by applying pushing force to the rounded wall angle molding locking actuator side 19C (not fully seen) with the wall angle molding 28D.
20. See FIG. 105, the control line 80B must not be trapped against the groove 16 by the wall angle molding 28D.

21. See FIG. 105, next, with your left hand grab the control line 80B coming from additional holder L70 and pull on it while at the same time with your right hand you pull at the previously wrapped control line 80B on the additional holder R70, do this until you are satisfied with the tautness of the line, finally, with the line that is on your right hand wrap it around counter clock wise five times the remainder top section of the thumb screw 11D, return the line and let it hang next to left side R70C (not fully seen), by using the control line's 80B pulling force and wrapping the control line 80B counter clock wise the remainder top section of the thumb screw 11D locks the control line 80B and prevents it from becoming loose.
22. To adjust this control line 80B unwrap the line from the screw 11D to relieve the pulling pressure from the taut control line 80B, move the additional control line holder R70 to either side and repeat step 21 over again.
23. As you face additional control line holder R70 and if you need to detach it you need to first relieve the pulling force from the taut control line, then you have to pull it and turn it to your left at the same time thus actuating unlocking notch 19D and detaching control line holder R70 off the wall angle molding 28D.
24. You have successfully installed, or set the control lines for a 90 degree angle grid.

Using control line holders L70, R70, additional R70, and additional L70 for 609.6 mm.×609.6 mm. or 2'×2' suspended-ceiling grids at 45 degree angle:

1. Referring to FIGS. 106 through 110 and if you are using either 23.81 mm.×23.81 mm. or 14.29 mm.×23.81 mm. wall angle moldings 28A, 28B, 28C, and 28D snap chalk lines 25.4 mm. above given finished ceiling height, by doing this you will keep all chalk line marks out of the finished ceiling's view.
2. Install wall angle moldings 28A, 28B, 28C, and 28D at prescribed ceiling's height and label them as such.
3. On the floor of the room establish and snap a chalk line 90A in the middle, at the center of this line 90A establish and snap a perpendicular chalk line 90B making sure it is a perfect 90 degree angle.
4. From this center point where chalk lines 90A and chalk line 90B intersect mark graduations of 431.8 mm. in three directions, then, from the marked graduations of 431.8 mm. measure and mark graduations of 863.6 mm. three times.
5. Snap a third chalk line 90C on the floor joining the last marked graduation of 863.60 mm. on chalk line 90A and one last marked graduation of 863.60 mm. on chalk line 90B extending to wall angle moldings 28B and 28C.
6. Snap a fourth chalk line 90D on the floor joining the last marked graduation of 863.60 mm. on chalk line 90A and one opposite last marked graduation of 863.60 mm. on chalk line 90B extending to wall angle moldings 28A and 28C.
7. You have created 4 new marks, mark 1, mark 2, mark 3, and mark 4, transfer these 4 marks from the floor up to the wall moldings 28B, 28C, 28A, and 28C.
8. Layout location of control lines 80A and 80B on wall moldings 28B, 28C, 28A, and 28C making sure all the marks are above the finished ceiling so no one will be able to see them.
9. The location of the control line 80A that runs parallel to the main tee 82A (not shown) is determined by inscribing ½ the thickness of the main tee parallel and to the right of mark 1 transferred from the floor onto wall angle molding 28B thus creating point 1, and parallel and to the left of mark 2 transferred from the floor onto wall angle molding 28C thus creating point 2.
10. The location of the control line 80B that runs parallel to the cross tee 82B (not shown) is determined by inscribing ½ the thickness of the cross tee parallel and to the left of mark 3 transferred from the floor onto wall angle molding 28A thus creating point 3, and parallel and to the right of mark 4 transferred from the floor onto wall angle molding 28C thus creating point 4.
11. See FIG. 107, take a roll of control line 80A and tie a loop 79 at the end, about 31.75 mm. in diameter, take control line holder L70 and hook the loop 79 from horizontal groove 16 and the top L70D, wrap control line 80A around counter clock wise right side L70C (not fully seen in this view), rounded corner 15A (not seen in this view), horizontal groove 17, rounded corner 15C, aligning side L70E, rounded corner 15B, horizontal groove 16, rounded corner 15A (not seen in this view), horizontal groove 17, rounded corner 15C, and ending running along aligning side L70E.
12. See FIG. 107, go to point 1 inscribed onto wall angle molding 28B and as you face this main tee 82A (not shown) point 1 attach control line holder L70 to your right of this point 1 by first aligning side L70E to your right of point 1, inserting the wall angle molding 28B into horizontal groove 17 formed within angled side L70B, accomplish this by applying pushing force to the rounded wall angle molding locking actuator side 19C (not fully seen) with the wall angle molding 28B.
13. As you face control line holder L70 and if you need to detach it you need to first relieve the pulling force from the taut control line, then you have to pull it and turn it to your left at the same time thus actuating unlocking notch 19D and detaching control line holder L70 off the wall angle molding 28B.
14. See FIG. 108, roll out control line 80A and go to point 2, take control line holder R70, wrap the control line 80A around counter clock wise aligning side R70E, rounded corner 15C, horizontal groove 17 formed within the angled side R70B, rounded corner 15A (not seen), left side R70C (not fully seen in this view), horizontal groove 16 formed within the squared side R70A, rounded corner 15B, aligning side R70E, rounded corner 15C, horizontal groove 17 formed within the angled side R70B, left side R70C (not fully seen in this view).
15. See FIG. 108, as you face this main tee 82A (not shown) point 2 attach control line holder R70 to your left of this point 2 by first aligning side R70E to your left of point 2, inserting the wall angle molding 28C into horizontal groove 17 formed within angled side L70B, accomplish this by applying pushing force to the rounded wall angle molding locking actuator side 19C (not fully seen) with the wall angle molding 28C.
16. See FIG. 108, the control line 80A must not be trapped against the groove 17 by the wall angle molding 28C.
17. See FIG. 108, next, with your right hand grab the control line 80A coming from holder L70 and pull on it while at the same time with your left hand you pull at the previously wrapped line on holder R70, do this until you are satisfied with the tautness of the line, finally, with the line that is on your left hand wrap it around counter clock wise five times the remainder top section of the thumb screw 11D, return the line and let it hang next to left side R70C (not fully seen), by using the control line's 80A pulling force and wrapping the control line 80A counter clock wise the remainder top section of the thumb screw 11D locks the control line 80A and prevents it from becoming loose.

18. As you face control line holder R70 and if you need to detach it you need to first relieve the pulling force from the taut control line, then you have to pull it and turn it to your right at the same time thus actuating unlocking notch 19D and detaching control line holder R70 off the wall angle molding 28C.

19. See FIG. 109, control line for cross tee 82B (not shown): Grab a roll of control line 80B and tie a loop 79 about 31.75 mm. in diameter at the end, with the other hand take additional control line holder R70 with the set screw 11C and thumb screw 11D facing up, next, hook the loop 79 from horizontal groove 16 and the top R70D, wrap control line 80B around clock wise left side R70C (not fully seen), rounded corner 15A (not seen), horizontal groove 17, rounded corner 15C, aligning side R70E, rounded corner 15B, horizontal groove 16, rounded corner 15A (not seen), left side R70C (not fully seen), horizontal groove 17, rounded corner 15C, and ending running along aligning side R70E.

20. See FIG. 109, take additional holder R70 and go to point 3 inscribed onto wall angle molding 28A, and as you face point 3, attach control line holder R70 to your left of this point 3 by first aligning side R70E to your left of point 3, inserting the wall angle molding 28A into horizontal groove 17 formed within angled side R70B, accomplish this by applying pushing force to the rounded wall angle molding locking actuator side 19C (not fully seen) with the wall angle molding 28A.

21. As you face additional control line holder R70 and if you need to detach it you need to first relieve the pulling force from the taut control line, then you have to pull it and turn it to your right at the same time thus actuating unlocking notch 19D and detaching control line holder R70 off the wall angle molding 28A.

22. See FIG. 110, roll out control line 80B and go to point 4 inscribed onto wall angle molding 28C, take control line holder L70 and wrap control line 80B clock wise aligning side L70E, rounded corner 15C, horizontal groove 17 formed within the angled side L70B, rounded corner 15A (not seen), right side L70C (not fully seen in this view), horizontal groove 16 formed within the squared side L70A, rounded corner 15B, aligning side L70E, rounded corner 15C, horizontal groove 17 formed within the angled side L70B, right side L70C (not fully seen in this view).

23. See FIG. 110, as you face this cross tee 82B (not shown) point 4 attach control line holder L70 to your right of this point 4 by first aligning side L70E to your right of point 4, inserting the wall angle molding 28C into the groove 17 formed within angled side R70B accomplish this by applying pushing force to the rounded wall angle molding locking actuator side 19C (not fully seen) with the wall angle molding 28C.

24. See FIG. 110, the control line 80B must not be trapped against the groove 17 by the wall angle molding 28C.

25. See FIG. 110, next, with your left hand grab the control line 80B coming from holder R70 and pull on it while at the same time with your right hand you pull at the previously wrapped line on holder L70, do this until you are satisfied with the tautness of the line, finally, with the line that is on your right hand wrap it around counter clock wise five times the remainder top section of the thumb screw 11D, return the line and let it hang next to right side L70C (not fully seen), by using the control line's 80B pulling force and wrapping the control line 80B counter clock wise the remainder top section of the thumb screw 11D locks the control line 80B and prevents it from becoming loose.

26. As you face additional control line holder L70 and if you need to detach it you need to first relieve the pulling force from the taut control line, then you have to pull it and turn it to your left at the same time thus actuating unlocking notch 19D and detaching control line holder L70 off the wall angle molding 28C.

27. You have set, or installed the control lines for a 45 degree angle grid.

All embodiments thus provide novel devices and a method for installing control lines, guide lines or reference strings to control the straightness and squareness of main tees and cross tees when framing a suspended ceiling grid. The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

The invention claimed is:

1. Devices including a body portion for aiding installation of control lines in suspended ceiling systems and each body of said devices comprises:

a. a longitudinal flat base portion, and b. a longitudinal aligning side adjacent to and perpendicular to said longitudinal flat base portion, and c. a longitudinal side adjacent to and perpendicular to said longitudinal flat base portion, and d. a squared side adjacent to and perpendicular to said longitudinal flat base portion, said longitudinal aligning side, said longitudinal side, and e. a horizontal groove formed within said squared side and adapted to receive a portion of a wall angle molding, and f. an angled side oppositely disposed said squared side adjacent to and perpendicular to said longitudinal flat base portion, adjacent to said longitudinal aligning side, adjacent to said longitudinal side, and g. a horizontal groove oppositely disposed said horizontal groove formed within said angled side and adapted to receive a portion of a wall angle molding, and h. a plurality of rounded corners substantially adjacent to said horizontal grooves formed within said squared side and said angled side, and i. a top portion adjacent to and perpendicular to said longitudinal aligning side, said longitudinal side, said squared side, said angled side, and j. a plurality of threaded holes piercing said top portion and adapted to receive first means for temporarily attaching to and detaching said devices from portions of wall angle moldings.

2. Devices of claim 1 wherein said horizontal grooves formed within said squared sides and said angled sides are formed at a predetermined depth.

3. Devices of claim 1 wherein said horizontal grooves formed within said squared sides and said angled sides are formed to frontally and horizontally engage portions of wall angle moldings.

4. Devices of claim 1 wherein said plurality or threaded holes are formed at a predetermined location from said longitudinal aligning side and said squared sides.

5. Devices of claim 1 wherein first means for temporarily attaching to and detaching said devices from portions of wall angle moldings are screws of a predetermined size.

6. Devices including a body portion for aiding installation of control lines in suspended ceiling systems and each body of said devices comprises:

a. a longitudinal flat base portion, and
b. a longitudinal angled aligning side adjacent to and perpendicular to said longitudinal flat base portion, and
c. a longitudinal squared aligning side adjacent to and perpendicular to said longitudinal flat base portion, and
d. a squared side adjacent to and perpendicular to said longitudinal flat base portion, said longitudinal angled aligning side, said longitudinal squared aligning side, and
e. a horizontal groove formed within said squared side and adapted to receive a portion of a wall angle molding, and
f. a longitudinal angled side adjacent to and perpendicular to said flat base portion, said angled aligning side, said squared aligning side, and
g. a plurality of rounded corners adjacent to said horizontal groove formed within said squared side, said longitudinal angled aligning side, said angled side, said squared aligning side, and
h. a top portion adjacent to and perpendicular to said longitudinal angled aligning side, said longitudinal squared aligning side, said squared side, said angled side, and
i. a plurality of threaded holes piercing said top portion and adapted to receive first means for temporarily attaching to and detaching said devices from wall angle moldings.

7. Devices of claim 6 wherein said horizontal grooves formed within said squared sides are formed at a predetermined depth.

8. Devices of claim 6 wherein said horizontal grooves formed within said squared sides are formed to frontally and horizontally engage portions of wall angle moldings.

9. Devices of claim 6 wherein said plurality of threaded holes are formed at a predetermined location from said longitudinal angled aligning sides, said squared aligning sides and said horizontal grooves.

10. Devices of claim 6 wherein first means for temporarily attaching to and detaching said devices from wall angle moldings are screws of a predetermined size.

11. Devices including a body portion for aiding installation of control lines in suspended ceiling systems and each body of said devices comprises:

a. a longitudinal flat base portion, and
b. a longitudinal aligning side adjacent to and perpendicular to said longitudinal flat base portion, and
c. a longitudinal side adjacent to and perpendicular to said longitudinal flat base portion, and
d. a squared side adjacent to and perpendicular to said longitudinal flat base portion, said longitudinal aligning side, said longitudinal side, and
e. a horizontal groove formed within said squared side and adapted to receive a portion of a wall angle molding, and
f. an angled side oppositely disposed said squared side adjacent to and perpendicular to said longitudinal flat base portion, adjacent to said longitudinal aligning side, adjacent to said longitudinal side, and
g. a horizontal groove formed within said angled side adapted to receive a portion of wall angle molding, and
h. a plurality of rounded corners substantially adjacent to said horizontal grooves formed within said squared side and said angled side, and
i. a top portion adjacent to and perpendicular to said longitudinal aligning side, said longitudinal side, said squared side, said angled side, and
j. a plurality of threaded holes piercing said top portion and adapted to receive first means for temporarily attaching to and detaching said devices from portions of wall angle moldings, and
k. a plurality of threaded holes piercing said top portion and adapted to receive means to temporarily restrict movement of main tees and cross tees.

12. Devices of claim 11 wherein said horizontal grooves formed within said squared sides and said angled sides are formed at a predetermined depth.

13. Devices of claim 11 wherein said horizontal grooves formed within said squared sides and said angled sides are formed to frontally and horizontally engage portions of wall angle moldings.

14. Devices of claim 11 wherein said plurality or threaded holes are formed at a predetermined location from said longitudinal aligning side and said horizontal grooves.

15. Devices of claim 11 wherein first means for temporarily attaching to and detaching said devices from wall angle moldings are screws of a predetermined size.

16. Devices of claim 11 wherein said means to temporarily restrict movement of main tees and cross tees are screws of a predetermined size.

17. Devices of claim 11 wherein said longitudinal aligning sides have a depression of a predetermined depth.

18. Devices including a body portion for aiding installation of control lines in suspended ceiling systems and each body of said devices comprises:

a. a longitudinal flat base portion, and
b. a longitudinal aligning side adjacent to and perpendicular to said longitudinal flat base portion, and
c. a longitudinal side adjacent to and perpendicular to said longitudinal flat base portion, and
d. a squared side adjacent to and perpendicular to said longitudinal flat base portion, said longitudinal aligning side, said longitudinal side, and
e. a horizontal groove formed within said squared side and adapted to receive a portion of wall angle molding, and
f. an angled side oppositely disposed said squared side adjacent to and perpendicular to said longitudinal flat base portion, adjacent to said longitudinal aligning side, adjacent to said longitudinal side, and
g. a horizontal groove formed within said angled side adapted to receive a portion of wall angle molding, and
h. a plurality of rounded corners substantially adjacent to said horizontal grooves formed within said squared side and said angled side, and
i. a top portion adjacent to and perpendicular to said longitudinal aligning side, said longitudinal side, said squared side, said angled side, and
j. a plurality of vertical grooves piercing said top portion and adapted to receive an elongated clamping element for temporarily attaching to and detaching said devices from wall angle moldings, and
k. a plurality of threaded holes piercing said top portion and adapted to receive second urging means for temporarily attaching to and detaching said devices from wall angle moldings, and
i. a plurality of threaded holes piercing said top portion and adapted to receive second means for temporarily attaching to and detaching said devices from wall angle moldings and to compress said urging means.

19. Devices of claim 18 wherein said horizontal grooves formed within said squared sides and said angled sides are formed at a predetermined depth.

20. Devices of claim 18 wherein said horizontal grooves formed within said squared sides and said angled sides are formed to frontally and horizontally engage portions of wall angle moldings.

21. Devices of claim 18 wherein said plurality or threaded holes are formed at a predetermined location from said longitudinal aligning side and said horizontal grooves.

22. Devices of claim 18 wherein said plurality of vertical grooves are formed at a predetermined location from said longitudinal aligning side and said horizontal grooves.

23. Devices of claim 18 wherein said plurality or threaded holes and said plurality of vertical grooves are substantially adjacent to each other.

24. Devices of claim 18 wherein said second means for temporarily attaching to and detaching said devices from wall angle moldings comprises:

a. said elongated clamping element, which comprises:

1. a substantially flat top adjacent to and perpendicular to two oppositely disposed rounded edges, and
2. a first rounded depression adjacent to and perpendicular to said rounded edges, and
3. a second rounded depression adjacent to and perpendicular to one of said rounded edges and adjacent to said first rounded depression, and
4. a substantially flat bottom adjacent to and perpendicular to said rounded edges, said first rounded depression and said second rounded depression, and b. said urging means which are coil springs, and c. said second means which are screws of a predetermined size for temporarily attaching to and detaching said devices from wall angle moldings and to compress said urging means.

* * * * *